US006823535B2

(12) United States Patent
Tomita et al.

(10) Patent No.: US 6,823,535 B2
(45) Date of Patent: Nov. 30, 2004

(54) TANKLESS WESTERN-STYLE FLUSH TOILET INCLUDING CONTROL PORTION

(75) Inventors: Katsunori Tomita, Aichi (JP); Kenichi Ito, Aichi (JP); Koji Miwa, Aichi (JP); Shingo Morikawa, Aichi (JP); Yasuhiro Shirai, Aichi (JP); Masataka Mizutani, Aichi (JP); Shoichi Nakamura, Aichi (JP); Hideya Koike, Aichi (JP); Hidefumi Toyoshi, Aichi (JP); Atsushi Itoh, Aichi (JP)

(73) Assignee: INAX Corporation, Tokoname (JP)

( * ) Notice: Subject to any disclaimer, the term of this patent is extended or adjusted under 35 U.S.C. 154(b) by 0 days.

(21) Appl. No.: 10/311,899

(22) PCT Filed: Feb. 8, 2001

(86) PCT No.: PCT/JP01/00900

§ 371 (c)(1),
(2), (4) Date: Dec. 23, 2002

(87) PCT Pub. No.: WO01/98593

PCT Pub. Date: Dec. 27, 2001

(65) Prior Publication Data

US 2003/0106145 A1 Jun. 12, 2003

(30) Foreign Application Priority Data

| | | |
|---|---|---|
| Jun. 23, 2000 | (JP) | 2000-190024 |
| Jun. 30, 2000 | (JP) | 2000-198235 |
| Jul. 11, 2000 | (JP) | 2000-209677 |
| Jul. 19, 2000 | (JP) | 2000-218499 |
| Aug. 4, 2000 | (JP) | 2000-237381 |

(51) Int. Cl.[7] ..... E03D 11/02; E03D 11/18
(52) U.S. Cl. ..... 4/425; 4/421; 4/422
(58) Field of Search ..... 4/421, 422, 423, 4/420, 425

(56) References Cited

U.S. PATENT DOCUMENTS

| | | | | |
|---|---|---|---|---|
| 6,584,623 | B2 * | 7/2003 | Grech et al. | 4/434 |
| 2003/0088910 | A1 * | 5/2003 | Hidetaka et al. | 4/425 |
| 2003/0101509 | A1 * | 6/2003 | Noboru et al. | 4/425 |

FOREIGN PATENT DOCUMENTS

| | | |
|---|---|---|
| JP | 1-299930 | 12/1989 |
| JP | 3-90723 | 4/1991 |
| JP | 2000-309968 | 11/2000 |
| JP | 2000-309969 | 11/2000 |
| JP | 2000-309974 | 11/2000 |
| JP | 2001-73434 | 3/2001 |
| JP | 2001-81827 | 3/2001 |

* cited by examiner

*Primary Examiner*—Henry Bennett
*Assistant Examiner*—Amanda Flynn
(74) *Attorney, Agent, or Firm*—Oblon, Spivak, McClelland, Maier & Neustadt, P.C.

(57) ABSTRACT

A tankless western-style flush toilet having a western-style toilet body and a toilet washing device configured to wash the western-style toilet body with water, the toilet washing device including an open/close valve configured to be directly connected to a city water service pipe to supply water from outside and configured to spout water by being opened and closed electrically. The toilet washing device includes a control portion configured to ensure at least two periods of releasing times of the open/close valve, and a mechanism for switching the control portion in accordance with a pressure of city water in the city water service pipe.

1 Claim, 96 Drawing Sheets

(A)

(B)

(A)

(B)

(A)

(B)

(A)

(B)

(A)

(B)

(A)

(B)

(A)

(B)

TANKLESS WESTERN-STYLE FLUSH TOILET INCLUDING CONTROL PORTION

TECHNICAL FIELD

First, seventh and eighth inventions relate to an open/close valve which works as a valve means for carrying out water supply and for stopping water supply. The open/close valve is suitable for, for example, a flush toilet, especially, a tankless western-style flush toilet as a western-style flush toilet which has no toilet washing tank. Second invention relates to a toilet washing water supply device for supplying water to such a western-style flush toilet. Third invention relates to a tankless western-style flush toilet. Fourth invention relates to a water supply method to a western-style flush toilet. This water supply method is suitable for, especially, a tankless western-style flush toilet. Fifth invention relates to a flow passage switching device which has the following constitution. When an open/close valve in which the open/close operation of a valve plug is mechanically carried out is mounted in each of plural flow passages respectively, the open/close operation of a valve plug of each open/close valve can be carried out by a single operation means. Sixth invention relates to a tankless western-style flush toilet, especially, a tankless western-style flush toilet having an open/close valve which is able to supply water and to stop supplying water to a rim channel or a jet hole selectively. Ninth invention relates to an open/close valve for a flush toilet. Tenth invention relates to a western-style flush toilet having a manual handle which is able to wash a toilet body due to fluctuation. Eleventh invention relates to a tankless western-style flush toilet. Twelfth and Thirteenth inventions relate to a flush toilet.

BACKGROUND ART

In a common western-style flush toilet, water which is supplied from a water supply source such as a city water service pipe and so on is temporarily reserved in a toilet washing tank such as a low tank and so on, and a western-style toilet body is washed by the water which is reserved in the toilet washing tank. The toilet washing tank is mounted at a rear portion of the western-style toilet body or on a side wall of a toilet room in such a manner that the toilet washing tank is positioned outside the western-style toilet body. Furthermore, the toilet washing tank has a large volume in order to spout a large amount of water into the western-style toilet body at one time for ensuring the discharge of filth from the western-style toilet body. However, in such a common western-style flush toilet, a space is required for mounting the toilet washing tank. Accordingly, recently, from the viewpoint of effectively making use of the space, a tankless western-style flush toilet in which an open/close vale (valve for adjusting a flow amount) is mounted between a water supply source and a western-style flush toilet, and which is capable of directly supplying water that is supplied from the water supply source by opening the open/close valve to the western-style flush toilet has been developed (Japanese Patent Laid-open No. 90723/1991, Japanese Patent Registration No. 2841537).

In this tankless western-style flush toilet, a toilet washing water supply device which washes a western-style toilet body with water that is directly supplied from a water supply source is mounted in the western-style toilet body, and the water is directly supplied to the western-style toilet body by opening an open/close valve which is contained in the toilet washing water supply device. In the toilet washing water supply device, the open/close valve has a water-in port as an inlet port and a water-out port as an outlet port at a housing, and at the same time, a valve mechanism which is able to adjust the divergence between the water-in port and the water-out port. The water-in port is connected to the water supply source to be capable of taking water into the housing, and the water-out port is connected to the western-style toilet body to be capable of spouting water from the housing to the western-style toilet body. Furthermore, the open/close valve has a diaphragm as a valve mechanism between the water-in port and the water-out port, and the diaphragm can be bent flexibly by the operation of an electromagnetic valve which is driven by the on-off operation. Accordingly, in this toilet washing water supply device, the diaphragm is bent flexibly by the operation of the electromagnetic valve, and hence, the divergence of the communication between the water-in port and the water-out port can be adjusted.

Moreover, in the open/close valve of the tankless western-style flush toilet, a rim flow passage such as a rim conduit and the like for supplying water to a rim channel which is mounted at an upper portion of a toilet bowl of the western-style toilet body, and a jet flow passage such as a jet conduit and the like for supplying water to a jet hole which generates a forced siphon effect and which is mounted at a bottom portion of the toilet bowl are formed. Then, the open/close valve carries out the rim water-through operation in which water is supplied to the rim flow passage to wash an inner wall surface of the toilet bowl with water which flows down from the rim channel, and the open/close valve carries out the jet water-through operation in which water is supplied to the jet flow passage to spout the water from the jet hole in the inside of the toilet bowl at high speed, and as a result, a forced siphon effect is generated to discharge filth which is excreted in the toilet bowl. Such a rim flow passage and such a jet flow passage are separate paths which are independent from each other. In the above-mentioned tankless western-style flush toilet, there exists a possibility that a negative pressure is generated at an upstream side of the rim flow passage and the jet flow passage to generate aback flow of filth water after the open/close valve which is in the open condition for supplying water is closed to stop supplying water to the rim channel or the jet hole. Accordingly, in such a tankless western-style flush toilet, a vacuum breaker which is communicated with an air is formed at the rim flow passage and the jet flow passage respectively in order to prevent a back flow of filth water.

In addition, in a forced siphon toilet as a tankless western-style flush toilet, the time for supplying water to the rim flow passage and the jet flow passage is controlled by a flow passage switching device in such a manner that each time doesn't overlap with each other. FIG. 122 shows one example of a forced siphon toilet 1 having such kind of flow passage switching device. In this flow passage switching device, two branch water supply pipes Q and R are connected by way of a constant flow amount valve L at the middle of a main water supply pipe P which is connected to a water supply source, and an open/close valve M, N is mounted in each branch water supply pipe Q, R. At the same time, one branch water supply pipe Q is connected to a rim channel 2, and the other branch water supply pipe R is connected to a jet hole 5 which is mounted at the bottom portion of a toilet bowl 4. In such a conventional flow passage switching device, in order to carry out the washing of the forced siphon toilet 1, at first, only one open/close valve M is opened to supply water from the branch water supply pipe Q to the side of the rim channel 2, thereby washing the toilet bowl 4. Then, the open/close valve M is closed, and the other open/close valve N is opened to spout water from the jet hole 5 to a discharge pipe 3 by way of the branch water supply pipe R. Due to this, the discharge pipe 3 is rapidly filled with water, so a siphon effect is swiftly generated. When water is discharged and the siphon effect is finished, the open/close valve N is closed to stop supplying water to the branch water supply pipe R on the side of the jet hole 5, and at the same time, the open/close valve M is again opened to supply water from the branch water supply pipe Q on the side of the rim channel 2 to the toilet bowl 4, thereby forming sealing water in the forced siphon toilet 1.

In an open/close valve for a flush toilet having a valve mechanism in a housing, a water-in port, a water-out port and a communication passage are formed in the housing. The communication passage communicates the water-in port with the water-out port, and the communication passage can be opened and closed by the valve mechanism. In the open/close valve for a flush toilet, as above-mentioned, when the valve mechanism opens the communication passage, water which is taken from a water supply source by way of the water-in port is spouted to a western-style toilet body by way of the water-out port, and accordingly, it is possible to wash the western-style toilet body. When the washing of the western-style toilet body is finished, the valve mechanism closes the communication passage, and spouting water to the western-style toilet body is finished.

Moreover, normally, a manual handle is mounted on a toilet washing tank in such a manner that the manual handle can be fluctuated. If the user fluctuates the manual handle by the manual operation, a chain which is dragged by the manual handle lifts up a valve which is mounted at the bottom of the toilet washing tank to be the released condition. Due to this, water in the toilet washing tank is supplied to the western-style toilet body, and the western-style toilet body is washed. Accordingly, when the manual handle is fluctuated by the manual operation, the manual handle should be fluctuated against water pressure which acts on the valve. Such an operation requires some physical strength, so the manual handle doesn't have necessarily an excellent operability for a serious patient or an old man whose physical strength is considerably weak. Accordingly, recently, a western-style flush toilet in which an electric motor for driving a manual handle automatically is mounted on a toilet washing tank, and at the same time, a toilet washing switch is mounted on a toilet wall which is apart from a western-style toilet body in such a manner that the toilet washing switch is independent from the manual handle separately has been developed. In this western-style flush toilet, after relieving oneself, if the user who is a part from the western-style toilet body carries out the push operation of the toilet washing switch at the toilet wall, the electric motor is driven to flactuate the manual handle automatically, and the washing of the western-style toilet body is carried out. In this case, the push operation of the toilet washing switch doesn't require much physical strength, so an excellent operability can be exhibited.

Furthermore, in the above tankless western-style flush toilet, at the time of washing a western-style toilet body, it is possible to select a water supply amount depending on whether or not a drain pipe which is connected to a trap of a western-style toilet body is an underfloor discharging construction or a floor discharging construction. Therefore, the time for releasing an open/close valve is maintained in accordance with the discharging construction, and the effective washing of the western-style toilet body can be carried out by an appropriate amount of water supply.

DISCLOSURE OF THE INVENTION

First Invention

However, in the above-mentioned conventional open/close valve, a diaphragm having good flexibility is applied as a valve mechanism. The diaphragm is bent flexibly, and the operation responsibility is not stable. For example, if this open/close valve is used for a western-style flush toilet, there is a fear that the washability is not reliable.

Especially, in this open/close valve, one face of the diaphragm always receives the pressure of water in a water-in port. So, in the open/close valve, when the pressure of water in the water-in port is excessively high, the divergence of the communication between the water-in port and a water-out port is likely to be large contrary to the operation of an electromagnetic valve for making the divergence small. On the contrary, when the pressure of water in the water-in port is excessively low, the divergence of the communication between the water-in port and a water-out port is likely to be small contrary to the operation of the electromagnetic valve for making the divergence large. Such a variation of the pressure of water in the water-in port is generated by circumstances under which the open/close valve is used, such as an upper layer floor of a building or underground. Accordingly, it is considered that the operation responsibility of this open/close valve is especially hard to be stable.

The first invention has been made in view of the above circumstances and it is the first task to be solved to provide an open/close valve which can contribute to stabilization of the operation responsibility.

With respect to the open/close valve of the first invention, in an open/close valve including a valve mechanism which has an inlet port and an outlet port at a housing, and which is capable of adjusting the divergence between the inlet port and the outlet port, the improvement is characterized in that the valve mechanism has a piston which is slidably mounted on the housing in the axial direction by the external operation of an external operation means, and which is attached to a seat face of the housing by being slided on one side in the axial direction to close the communication between the inlet port and the outlet port, and which is detached from the seat face by being slided on the other side in the axial direction to open the communication between the inlet port and the outlet port, and a pressure offset room for offsetting the pressure which the piston receives from a fluid in the inlet port or the outlet port to the other side.

In the open/close valve of the first invention, when the piston is slided to one side in the axial direction by the external operation of the external operation means, the piston is attached to the seat face of the housing to close the communication between the inlet port and the outlet port. In this condition, the flow of the fluid from the inlet port is stopped. Furthermore, when the piston is slided to the other side in the axial direction by the external operation of the external operation means, the piston is detached from the seat face of the housing to open the communication between the inlet port and the outlet port. In this condition, in accordance with the divergence, the fluid flows in the housing from the inlet port to be spouted from the outlet port. Thus, in the open/close valve of the first invention, it is possible to adjust the divergence of the communication between the water-in port and the water-out port.

Accordingly, the piston opens and closes the communication between the inlet port and the outlet port, so the piston receives the pressure on the other side due to the fluid in the inlet port or the outlet port. At this time, the piston is not bent flexibly to the side of the open valve by the pressure on the other side because the piston has no flexibility. However, if only a space for the sliding of the piston is mounted, the slidability of the piston in the axial direction is hindered by the pressure on the other side. So, in the open/close valve of the first invention, the pressure on the other side is offset by a pressure offset means, and due to this, the slidability of the piston in the axial direction is ensured. Accordingly, in the open/close valve of the first invention, the operation responsibility becomes stable, and it is possible to improve the reliability of the washability and the like when the open/close valve is used for, for example, a tankless western-style flush toilet.

Furthermore, in the open/close valve of the first invention, the speed for opening and closing valve can be set voluntarily by the operation of the piston, so a rapid opening and closing of the valve, which is caused by the diaphragm of the conventional open/close valve, is not occurred. So, in the open/close valve of the first invention, even if a large amount of fluid flows, a rapid closing of the valve can be prevented. As a result, the generation of water hammer is prevented, and a noise and the like can be suppressed.

Moreover, since the conventional open/close valve adopts the diaphragm, the valve is hardly opened satisfactorily when the pressure of the fluid is low, and the pressure loss is likely to be generated. In connection with this, if it is attempted to open the valve satisfactorily even when the pressure of the fluid is low, and due to this, to make the pressure loss small, the open/close valve necessarily becomes large because the diaphragm is required to be large. As a result, the mountability of the open/close valve on a tankless western-style flush toilet and the like is damaged. On the contrary, in the open/close valve of the first invention, the valve is opened satisfactorily by the operation of merely a small piston when the pressure of the fluid is low, so the pressure loss is hardly generated, and the open/close valve doesn't necessarily become large. As a result, an excellent mountability of the open/close valve on a tankless western-style flush toilet and the like is exhibited.

As a pressure offset means, the one comprising a pressure offset room which is formed on the other side of the piston and a passage for communicating one side of the piston with the pressure offset means can be adopted. With such a constitution, a fluid which exists at one side of the piston is moved from the inlet port or the outlet port to the pressure offset room via the passage, and the balance between the pressure of the fluid in the pressure offset room and the pressure of the fluid atone side of the piston is kept, thereby canceling or decreasing the differential pressure between them.

The passage is formed in the housing, but it is preferable that the passage is formed in the piston. If the passage is formed in the housing, the piston is slided in the axial direction, so the passage becomes complicated, for example, the passage is bent and the like. If the passage is formed in the piston, a simple passage is adopted, for example, the passage is mounted through the axial direction. Furthermore, if the passage is mounted through the piston in the axial direction, a fluid which is moved in the passage doesn't receive the resistance when the piston is slided, and the slidability of the piston is improved.

It is preferable that the inlet port of the housing opens at a peripheral surface side of the piston, and that the outlet port of the housing opens at an end surface side of one side of the piston in the axial direction. With such a constitution, the piston doesn't receive the pressure on the other side due to the fluid in the inlet port. If the pressure of the fluid in the inlet port is excessively high or low due to circumstances under which the open/close valve is used and the like, the slidability of the piston is not changed by this matter.

As an external operation means, the one having the constitution in which a piston can be externally operated by magnetic force and the like can be adopted. However, it is preferable to adopt a shaft which is fixed to the piston and which is protruded from the housing, and furthermore, by which the piston is slided in the axial direction while being against a force act means. With such a constitution, it is unnecessary to adopt an electromagnetic valve such as a conventional open/close valve, so the production cost of the open/close valve can be reduced. Especially, when plural open/close valves are used, individual electromagnetic valves should be opened and closed in the conventional open/close valve, but however, if such a shaft is used, individual shafts can be opened and closed by individual cams, and the effect of the reduction of the production cost is large.

In the open/close valve of the first invention, it is possible to adopt the relationship between a force act means and a shaft which is shown in FIGS. 9(A) to (D). Here, as a force act means, in addition to a push means such as a push spring and the like, it is possible to adopt a tensile means such as a tension spring which pulls a piston.

In the relationship as shown in FIG. 9(A), a force act means S pushes a piston P forcibly to one side in the axial direction, and a shaft D is protruded to one side. In this relationship, if the shaft D is pushed to the other side against act force of the force act means S, the piston P opens the communication between an inlet port I and an outlet port O. On the other hand, if the shaft D is pulled to one side according to act force of the force act means S, the piston P closes the communication between the inlet port I and the outlet port O.

Furthermore, in the relationship as shown in FIG. 9(B), a force act means S pushes a piston P forcibly to one side, and a shaft D is protruded to the other side. In this relationship, if the shaft D is pulled to the other side against act force of the force act means S, the piston P opens the communication between an inlet port I and an outlet port O. On the other hand, if the shaft D is pushed to one side according to act force of the force act means S, the piston P closes the communication between the inlet port I and the outlet port O.

Besides, in the relationship as shown in FIG. 9(C), a force act means S pushes a piston P forcibly to the other side, and a shaft D is protruded to one side. In this relationship, if the shaft D is pulled to one side against act force of the force act means S, the piston P closes the communication between an inlet port I and an outlet port O. On the other hand, if the shaft D is pushed to the other side according to act force of the force act means S, the piston P opens the communication between the inlet port I and the outlet port O.

Moreover, in the relationship as shown in FIG. 9(D), a force act means S pushes a piston P forcibly to the other side, and a shaft D is protruded to the other side. In this relationship, if the shaft D is pushed to one side against act force of the force act means S, the piston P closes the communication between an inlet port I and an outlet port O. On the other hand, if the shaft D is pulled to the other side according to act force of the force act means S, the piston P opens the communication between the inlet port I and the outlet port O.

Among these relationships, the one as shown in FIG. 9(A) is preferable. With such a constitution, a general push spring is adopted as the force act means S, and the piston P can close the communication between the inlet port I and the outlet port O by means of act force of the push spring while it is possible to adopt a cam which pushes the shaft D to the other side against act force of the force act means S in order to open the communication between the inlet port I and the outlet port O. Such a cam has the constitution that pushes the shaft D to the other side in order to open the communication between the inlet port I and the outlet port O, so the constitution becomes relatively simple, and the production cost of the open/close valve can be reduced.

According to the preferred embodiment of the open/close valve of the first invention, it is possible to adopt the constitution in which a fluid is water, and an outlet port is connected to a tankless western-style flush toilet having no toilet washing tank. With such a constitution, even at an upper layer floor of a building or underground and the like, it is possible to supply water and to stop supplying water surely to the tankless western-style flush toilet having no toilet washing tank by means of the open/close valve.

Second Invention

Furthermore, in the above conventional toilet washing water supply device, an electromagnetic valve is adopted to operate a diaphragm as a valve mechanism which has an excellent flexibility, and the diaphragm can be bent flexibly by the operation of the electromagnetic valve. So, there arise the following disadvantages.

Namely, in the electromagnetic valve, magnetic attraction force is generated by magnetization due to feeding to a solenoid, and a movable body formed of a permeable material which is contained in the electromagnetic valve is magnetically attracted to open the electromagnetic valve. Accordingly, in such an electromagnetic valve, even if the solenoid is demagnetized, there is a disadvantage that remarkably large residual magnetism remains in the movable body. So, if no measure is taken on the electromagnetic valve of the toilet washing water supply device in order to avoid the influence of the residual magnetism, there exists a possibility that the operation of the valve mechanism is not stable depending on the primary water pressure which acts on a water-in port.

Furthermore, it is the assumption that the open valve degree of the electromagnetic valve is fully-opened or fully-closed, so the open valve degree cannot be maintained at an intermediate stage. Accordingly, in such a toilet washing water supply device, even if a small amount of water is tried to flow continuously in order to prevent the freezing of water in a water supply system during the cold season and the like, the electromagnetic valve cannot achieve such a use form.

Moreover, the electromagnetic valve is expensive as compared with a general motor and the like, so this pushes up the cost of the toilet washing water supply device.

The second invention has been made in view of the above circumstances and it is the second task to be solved to provide a toilet washing water supply device which can contribute to stabilization of the operation of a valve mechanism, and which is able to prevent the freezing of water during the cold season and the like, and which is relatively low cost.

The toilet washing water supply device of the second invention is characterized in that it includes an open/close valve having a valve housing in which a water-in port that is communicated with a water supply source in order that water is supplied and a water-out port that is capable of supplying the water to a flow passage of a flush toilet are formed, and a valve mechanism which is protruded from the valve housing to be movably mounted on the valve housing and which opens and closes the water-in port and the water-out port, and a cam device having a cam which mechanically opens and closes the valve mechanism.

The cam device is a mechanism having a rotation body which can be mechanically engaged with the portion on the side of the valve mechanism that works as a follower, and in this mechanism, the follower is moved reciprocatingly in accordance with the rotation of the rotation body. Here, the rotation body can be a rotation axis or a gear, in short, the one which can be rotated. The cam device can be a plane cam in which a locus of a connecting point between the cam and the follower is a plane curve, or a three-dimensional cam in which a locus of the connecting point is a three-dimensional curve.

The gravity can be utilized in order that the follower is brought into contact with the cam, or a force act means such as a spring and the like can be adopted in order to ensure the connecting point between the cam and the follower. The rotation direction of the rotation body can be selected in consideration of circumstances such as a mounting space and the like, so it doesn't matter that the rotation direction is the back and forward direction of a toilet bowl, the right and left direction of the toilet bowl, or the direction which is slanted with respect to these directions. As the cam device, the well-known cam mechanism can be adopted.

In the toilet washing water supply device of the second invention, when the cam device is operated, the valve mechanism which is mechanically engaged with the cam of the cam device is operated to be opened or closed, thereby adjusting the divergence of the communication between the water-in port and the water-out port.

Furthermore, in the toilet washing water supply device of the second invention, the speed for opening and closing valve of the valve mechanism can be set voluntarily by selecting a profile of the cam of the cam device, so it is possible to suppress a rapid opening or a rapid closing of the valve, and to suppress a noise, a water hammer phenomenon and the like. When the valve is opened or closed, it is possible to stop driving the cam device in the halfway. In this case, an amount for opening and closing valve of the valve mechanism can be continuously maintained at an intermediate stage, in addition to the fully-opened or fully-closed condition. With such a constitution, it is possible to continue to flow a small amount of water to a western-style toilet body, and this is advantageous to prevent the freezing of water during the cold season and the like.

In the toilet washing water supply device of the second invention, it is preferable that the valve mechanism has a shaft which is pushed to the side of the valve housing by the cam of the cam device. With such a constitution, it is possible to adopt the mechanism in which the shaft is pushed to the side of the valve housing to open the valve of the valve mechanism. Such a system in which the valve of the valve mechanism is opened by pushing is advantageous to the simplification of the mechanism, and the manufacturing cost can be reduced.

The cam of the cam device can be driven by the manual operation, but it is preferable that the cam is driven by a motor. With such a constitution, it is possible to wash the toilet body by the simple switch operation. Moreover, a motor is generally low price as compared with an electromagnetic valve and the like, so the reduction of the cost of the toilet washing water supply device can be achieved.

It is preferable that the open/close valve, the motor and the cam device are mounted on a common single base plate.

If the open/close valve, the motor and the cam device are mounted together on the single base plate like this, it is possible to improve the saving of spaces, the reduction of the number of components and the assembly performance. Furthermore, the base plate is preferably mounted on a rear portion of the toilet bowl.

It is preferable that the motor or the cam device has a manual axis which drives the cam of the cam device by the manual operation. With such a constitution, it is unnecessary to use a motor for driving the cam device, so the toilet body can be washed by opening and closing the valve mechanism even at the time of power failure in which the motor is not driven. It is preferable that the manual axis is detachable. With such a constitution, normally, the manual axis is detached in order not to be obstacle, and the manual axis may be attached when the manual operation is required. Moreover, it is possible that the manual axis can be foldable.

According to the second invention, it is possible that the toilet washing water supply device is used for a tankless flush toilet as a flush toilet having no toilet washing tank. With such a constitution, it is possible to surely supply water to the tankless flush toilet even at an upper layer floor of a building or underground and the like.

Third Invention

In addition, in the above-mentioned conventional tankless western-style flush toilet, when the toilet washing device is mounted in the western-style toilet body, a mounting space of the toilet washing device on the western-style toilet body is not satisfactorily examined, for example, to solve the problem that the mounting space hinders the person who uses the western-style toilet body.

For example, in the above tankless western-style flush toilet, the open/close valve is assembled into the toilet washing device, and moreover, each kind of components such as a driving device and the like for driving the valve mechanism of the open/close valve is also assembled into the toilet washing device. So, there is a tendency that the mounting space of the toilet washing device becomes large. Especially, If there are plural flow passages for supplying water to the western-style toilet body in order to discharge filth in the western-style toilet body, it is requested that the open/close valve is assembled into each flow passage. In this respect, there is a tendency that the mounting space becomes large. Furthermore, in a tankless western-style flush toilet having a part washing mechanism or a tankless western-style flush toilet having a heating toilet seat mechanism, components which is required for the part washing or the heating toilet seat are also assembled into the toilet washing device together with the above open/close valve and the like. In this respect, there is a tendency that the mounting space of the toilet washing device becomes large.

The third invention has been made in view of the above circumstances and it is the third task to be solved to provide a tankless western-style flush toilet which is able to save a mounting space of a toilet washing device.

With respect to the tankless western-style flush toilet of the third invention, in a tankless western-style flush toilet including a toilet washing device which has no toilet washing tank, and which carries out the washing of a western-style toilet body with water which is supplied from a water supply source, the improvement is characterized in that the toilet washing device includes an open/close valve having a valve housing in which a water-in port that is communicated with the water supply source in order that water is supplied and a water-out port that is capable of supplying the water to a flow passage of the western-style toilet body are formed, and a shaft which is protruded from the valve housing to be mounted on the valve housing movably in the axial direction and which opens and closes the water-in port and the water-out port, and a cam device having a cam which moves the shaft in the axial direction, and that the open/close valve is mounted in such a manner that the shaft is extended in the vertical direction of the western-style toilet body in the toilet washing device.

In the tankless western-style flush toilet of the third invention, when the cam of the cam device is driven, the shaft which is protruded from the valve housing of the open/close valve moves in the axial direction to open and close the water-in port and the water-out port of the valve housing of the open/close valve. Accordingly, water which is supplied from the water supply source is supplied or stopped being supplied to the flow passage of the western-style toilet body. Due to this, the washing of the western-style toilet body is carried out.

In the tankless western-style flush toilet of the third invention, the shaft which is protruded from the valve housing of the open/close valve is extended in the vertical direction of the western-style toilet body. Due to this, a top end of the shaft is not protruded toward the side or the rear of the western-style toilet body, and it is possible to save the mounting space of the toilet washing device.

The cam device is a mechanism having a rotation body which is engaged with the shaft that works as a follower, and in this mechanism, the shaft is moved reciprocatingly in accordance with the rotation of the rotation body. The gravity can be utilized in order that the shaft as the follower is brought into contact with the cam, or a force act means such as a spring and the like can be adopted in order to ensure the connecting point between the cam and the shaft. The rotation direction of the rotation body can be selected in consideration of circumstances such as a mounting space and the like, so it doesn't matter that the rotation direction is the back and forward direction of a toilet bowl, the right and left direction of the western-style toilet body, or the direction which is slanted with respect to these directions. As the cam device, the well-known cam mechanism can be adopted.

In the tankless western-style flush toilet of the third invention, the speed for opening and closing valve of the valve mechanism can be set voluntarily by selecting a profile of the cam of the cam device, so it is possible to suppress a rapid opening or a rapid closing of the valve, and to suppress a noise, a water hammer phenomenon and the like. When the valve is opened or closed, it is possible to stop driving the cam device in the halfway. In this case, an amount for opening and closing valve of the valve mechanism can be continuously maintained at an intermediate stage, in addition to the fully-opened or fully-closed condition. Due to this, it is possible to continue to flow a small amount of water to a western-style toilet body, and this is advantageous to prevent the freezing of water during the cold season and the like.

It is possible to adopt the constitution in which the cam device is mounted on an upper end of the open/close valve in the axial direction, and in which a motor for driving the cam is mounted in adjacent to the cam device. Furthermore, it is also possible to adopt the constitution in which the cam device is mounted on a lower end of the open/close valve in the axial direction, and in which a motor for driving the cam is mounted in adjacent to the cam device.

If there are plural flow passages for washing the western-style toilet body, plural open/close valves can be mounted in accordance with the number of the flow passages. With such a constitution, it is possible to open and close the valve in each flow passage respectively. In this case, the effect of the third invention is large. It is preferable that plural open/close valves are mounted in such a manner that they are adjacent to each other.

It is preferable to adopt the system in which the shaft of the open/close valve is pushed by the cam of the cam device to open the communication between the water-in port and the water-out port of the open/close valve. With such a constitution, it is advantageous to the simplification of the mechanism, and the reduction of the manufacturing cost can be achieved.

Fourth Invention

Furthermore, in the above-mentioned general western-style flush toilet and tankless western-style flush toilets, there is no consideration on the freezing of a water supply system during the cold season. Accordingly, in such western-style flush toilets, when water is freezed at an upstream side of the western-style toilet body, it is impossible that filth which is excreted in the western-style toilet body is flown to be removed. Due to this, such western-style flush toilets are restricted not to be used until the freezing condition is canceled. So, this becomes hindrance in a daily life, and also, such western-style flush toilets are unsanitary.

Especially, if the western-style flush toilet is a tankless western-style flush toilet having no toilet washing tank, in the conventional tankless western-style flush toilet, a flow amount of water which flows in a water supply system of a toilet washing device cannot be switched stepwise. So, the person who uses the toilet and the like cannot avoid the above disadvantage, and such an advantage becomes remarkable.

The fourth invention has been made in view of the above circumstances and it is the fourth task to be solved to provide a water supply method to a western-style flush toilet which is able to prevent the freezing of water at an upstream side of a western-style toilet body.

With respect to the water supply method to the western-style flush toilet of the fourth invention, in a water supply method to a western-style flush toilet for supplying water which is supplied from a water supply source to a western-style toilet body of the western-style flush toilet by way of a water supply passage, the improvement is characterized in that the water supply passage has a flow amount switching means which is able to switch a flow amount of water stepwise, and the flow amount switching means carries out a flow mode for flowing water in the flow amount which is able to prevent the freezing of water at an upstream side of the western-style toilet body.

According to the water supply method of the fourth invention, the flow amount switching means is mounted in the water supply passage for supplying water which is supplied from the water supply source to the western-style toilet body, and the flow mode is carried out by the switching of the flow amount switching means. Accordingly, it is possible to flow water from the water supply source to the water supply passage little by little, so the freezing of water is suppressed at the upstream side of the western-style toilet body. Due to this, in a western-style flush toilet which adopts such a water supply method, water is hardly freezed at an upstream side of a western-style toilet body, and it is possible to avoid an impossibility of washing filth. So, in this western-style flush toilet, there is no restriction for use, which becomes hindrance in a daily life, and also, such a western-style flush toilet is sanitary.

An amount of water per unit time in the flow mode can be selected properly depending on the degree of coldness. For example, if a normal amount of water which is flown from the flow amount switching means is made to be 100%, it is possible that the amount of water per unit time is made to be 0.5–15%, especially, 1–10%, moreover 2–5%.

According to the water supply method of the fourth invention, it is possible to adopt a form in which the flow amount switching means comprises a stop cock that is able to adjust a flow amount of water flown in the water supply passage not stepwise and an open/close valve for opening and closing the water supply passage at a downstream side of the stop cock, and in which 100% of flow amount of water is flown at the stop cock and the flow mode is carried out by the divergence of the open/close valve. In this case, the open/close valve has a divergence adjusting mechanism in order to achieve the flow mode.

According to the water supply method of the fourth invention, it is possible to adopt a form in which the flow amount switching means comprises a step stop cock that is able to adjust a flow amount of water flown in the water supply passage stepwise and an open/close valve for opening and closing the water supply passage at a downstream side of the step stop cock, and in which the flow mode is carried out by the step stop cock and water is flown at 100% of the divergence of the open/close valve. In this case, the step stop cock has a flow adjusting mechanism in order to achieve the flow mode.

The open/close valve can adopt a form which has a valve housing in which a water-in port that is communicated with a water supply source in order that water is supplied and a water-out port that is capable of supplying the water to a flow passage of a western-style toilet body are formed, and a shaft which is protruded from the valve housing to be movably mounted on the valve housing and which opens and closes the water-in port and the water-out port, and in which the shaft is moved by a cam.

Such a cam is a mechanism in which a shaft that works as a follower is moved reciprocatingly in accordance with the rotation of a rotation body. The cam is different from an electromagnetic valve which has an assumption that it is fully-opened or fully-closed, and it is possible to stop an amount for opening and closing valve at an intermediate stage, so the cam is suitable for the flow mode in which water is flown little by little. Furthermore, when the cam is adopted, the speed for opening and closing valve of the open/close valve can be set voluntarily by selecting a profile of a cam face, so it is possible to suppress a rapid opening or a rapid closing of the valve, and to decrease a noise, a water hammer phenomenon and the like.

It is preferable that the cam is driven by a motor. With such a constitution, when the user operates the motor, the cam is driven and the shaft of the open/close valve is automatically moved. As a result, it is possible to open and close the communication between the water-in port and the water-out port automatically. As a motor, a motor which carries out a normal rotation, a motor which is able to carry out a normal rotation and a reverse rotation, a stepping motor whose rotation amount is regulated by the frequency of an inlet pulse and the like are adopted.

The cam can adopt a form in which it can be driven by the manual operation. With such a constitution, even at the time of power failure or breakdown of the motor, not only the washing of the western-style toilet body but also the flow mode is carried out by driving the cam.

Moreover, according to the water supply method of the fourth invention, it is possible to adopt a form in which water is flown to a water supply passage intermittently at every predetermined time (generally, a short time) in the flow mode, in consideration of the degree of coldness, the request for saving water and the like. Namely, it is possible to adopt a form in which supplying a small amount of water and stopping water supply are alternately repeated. With such a constitution, it is possible to save water while suppressing the freezing. Such a form can be easily carried out by a program if a control device which uses a microcomputer in order to control the flow switching means such as the stop cock, the step stop cock, the open/close valve and the like.

Fifth Invention

Furthermore, in the conventional flow passage switching means as shown in FIG. 122, in order to automatically control the opening and closing of an open/close valve M, N which is mounted in the above branch water supply pipe Q, R, the open/close valve M, N is respectively needed to be a motor-operated valve which is driven by a motor. In this case, in the flow passage switching means which requires two open/close valves, two motors are required, and this pushes up the cost.

The fifth invention has been made in view of the above circumstances and it is the fifth task to be solved to provide a flow passage switching means which is able to automatically control the opening and closing of an open/close valve without pushing up the cost.

The flow passage switching means of the fifth invention is characterized in that an open/close valve whose valve body is mechanically operated to be opened and closed is mounted in each of plural flow passages, a transmission means which transmits mechanical operation force in order to operate the opening and closing of each valve body is mounted on each open/close valve, an operation means which applies the mechanical operation force to each open/close valve by means of each transmission means is mounted, and the timing for outputting the mechanical operation force from the operation means to each transmission means has the predetermined time lag with respect to each transmission means.

With such a constitution, the opening and closing of respective open/close valve which is mounted in plural flow passages can be operated by single operation means in such a manner that it has the predetermined time lag. Accordingly, the opening and closing of the open/close valve can be automatically operated without pushing up the cost.

In the flow passage switching means of the fifth invention, it is possible to adopt the constitution in which the operation means is a motor, and the transmission means comprises plural cams having each different phase which are mounted on a rotation axis driven directly or indirectly by the motor, and an acceptance tool of operation force which is mounted on a valve axis connected to each valve body of each open/close valve and which can be brought into contact with each cam. When the operation means is the motor, it is preferable to mount a backup electric power supply for rotating each cam to the predetermined position at the time of power failure.

In the flow passage switching means of the fifth invention, it is possible to mount a manual operation means which is able to manually rotate the rotation axis to which the cam is attached, either. With such a constitution, it is possible to operate the opening and closing of the open/close valve by the manual operation.

Furthermore, in the flow passage switching means of the fifth invention, it is preferable that a clutch mechanism is disposed between an output axis of the motor and the rotation axis to which each cam is attached, and that the operation force of the manual operation means is transmitted to an output portion of the clutch mechanism. With such a constitution, an operation force transmission path from the motor can be used as an operation force transmission path from the manual operation means. So, this makes the constitution simple.

In the flow passage switching means of the fifth invention, a worm gear and a worm wheel can be used as the transmission mechanism of rotation operation force from the output portion of the clutch mechanism to the rotation axis to which each cam is attached. Accordingly, it is possible to suppress a rapid rotation of the cam.

In the conventional flow passage switching means, in order to supply water by the manual operation, other supply pipe system is needed to be mounted, and there arises a problem that the constitution becomes complicated. In this respect, in the flow passage switching means of the fifth invention, it is preferable that the operation means comprises a manual member. In this case, the transmission means comprises plural cams having each different phase which are mounted on a rotation axis driven directly or indirectly by the manual operation and an acceptance tool of operation force which is mounted on a valve axis connected to each valve body of each open/close valve and which can be brought into contact with each cam, and an adjusting means in which the time of period for transmitting the rotation operation force inputted from the manual member to the rotation axis to which each cam is attached is adjusted to the predetermined time is mounted. With such a constitution, it is possible to adjust the transmission time period of the operation force inputted from the manual member, and to adjust the rotation speed of the cam to the predetermined speed.

Sixth Invention

Furthermore, in the above tankless western-style flush toilet, a vacuum breaker which is used as a rim flow passage exclusively is mounted, and at the same time, a vacuum breaker which is used as a jet flow passage exclusively is also used. So, the number of components increases, and there is a disadvantage in the reduction of the cost.

The sixth invention has been made in view of the above circumstances and it is the sixth task to be solved to provide a tankless western-style flush toilet which aims to reduce the number of components, and which has an advantage in the reduction of the cost.

With respect to the tankless western-style flush toilet of the sixth invention, in a tankless western-style flush toilet including a western-style toilet body which has a rim channel and a jet hole, and a valve means which is connected to a water supply source that is able to supply water, and in which a rim conduit for supplying the water to the rim channel is connected to a jet conduit for supplying the water to the jet hole, and which is able to supply the water and to stop supplying the water to the rim channel and/or the jet hole selectively, the improvement is characterized in that the valve means has a communication passage for communicating a rim flow passage which is connected to the rim conduit with a jet flow passage which is connected to the jet conduit, and a vacuum breaker having an intake port which is communicated with an air upward from the uppermost surface of the rim channel at either one of the rim flow passage, the jet flow passage and the communication passage.

According to the tankless western-style flush toilet of the sixth invention, when the valve of the valve means is opened, water is selectively supplied to the rim channel or the jet hole, and the western-style toilet body is washed. When the valve of the valve means is closed, water is stopped being supplied to the rim channel or the jet hole.

When a negative pressure is generated at an upstream side of the rim flow passage and the jet flow passage while closing the valve of the vale means which is in the open condition for supplying water, the rim flow passage and the jet flow passage are communicated with each other by means of the communication passage, and the vacuum breaker which is mounted at either one of the rim flow passage, the jet flow passage and the communication passage has the intake port which is communicated with an air upward from the uppermost surface of the rim channel. As a result, the rim flow passage, the jet flow passage and the communication passage are communicated with an air, and a back flow of filth water which flows by way of the rim flow passage and the jet flow passage is prevented. Namely, in the tankless western-style flush toilet of the sixth invention, although the rim flow passage and the jet flow passage are separate paths which are independent from each other, both of them are communicated with each other by means of the communication passage. So, the vacuum breaker is able to cancel the negative pressure on the upstream side of the rim flow passage, and at the same time, to cancel the negative pressure on the upstream side of the jet flow passage. In other words, the vacuum breaker is common between the rim flow passage and the jet flow passage, so it is unnecessary to mount the vacuum breaker which is used as the rim flow passage exclusively and the vacuum breaker which is used as the jet flow passage exclusively. Furthermore, the number of components can be decreased, and there is an advantage in the reduction of the cost.

It is preferable that the vacuum breaker is mounted in the communication passage. When the rim flow passage and the jet flow passage are communicated with each other by means of the communication passage, and the vacuum breaker is mounted in either one of the rim flow passage and the jet flow passage, if the communication passage is a small path, water is likely to be filled in the communication passage. So, there is a fear that the negative pressure at the passage to which the vacuum breaker is not mounted is not canceled. In this respect, if the vacuum breaker is mounted in the communication passage, water is not filled in the communication passage, so it is possible to surely obtain the cancellation of the negative pressure on the upstream side of the rim flow passage, and at the same time, to obtain the cancellation of the negative pressure on the upstream side of the jet flow passage.

According to the preferred form of the tankless western-style flush toilet of the sixth invention, it is possible to adopt a constitution in which a throttle passage for contracting a flow passage area is mounted as a suction means at a part of the rim flow passage which is communicated with the communication passage. In this case, when water flows in the throttle passage of the rim flow passage, the reduction of the pressure is generated in the throttle passage according to Bernoulli's theorem. Due to this, an air which is remained in the jet conduit can be sucked to the rim flow passage by way of the communication passage. Accordingly, it is possible to suppress a noise which is caused by the air remained in the jet conduit.

Seventh Invention

Furthermore, in the conventional open/close valve, it is only possible that a large amount of water flows at the time of releasing a main water passage due to a main valve body. So, a small amount of water cannot flow in order to achieve the prevention of the freezing of a water supply system or the freezing of a trap of a western-style toilet body, for example, during the cold season, and to achieve an inexpensive maintenance fee. In this respect, even if such an open/close valve is used, and at the same time, a sub open/close valve having a sub water passage in which a small amount of water is able to flow and a sub valve body for opening and closing the sub water passage is separately mounted, dead water is easily generated near the main valve body, and there is a fear that the contamination and the freezing of dead water is generated under the condition that the main open/close valve and the sub open/close valve is merely connected to each other.

The seventh invention has been made in view of the above circumstances and it is the seventh task to be solved to provide an open/close valve by which a large amount of water and a small amount of water is able to flow, and by which dead water is not generated.

The open/close valve of the seventh invention is characterized in that it includes a main water passage which is connected to a water supply source and in which a large amount of water is able to flow, a sub water passage which is connected to the water supply source and in which a small amount of water is able to flow, a main valve body which is able to open and close the main water passage, and a sub valve body which is able to open and close the sub water passage, and that the sub water passage passes through the main valve body.

In the open/close valve of the seventh invention, a large amount of water is able to flow at the time of releasing the main water passage due to the main valve body, and simultaneously, a small amount of water is able to flow at the time of closing the main water passage due to the main valve body and of releasing the sub water passage due to the sub valve body. Accordingly, it is possible to prevent the freezing of a water supply system such as a city water service pipe and the like, the freezing of a water supply source reaching a western-style toilet body or the freezing of a trap of the western-style toilet body, for example, during the cold season, and to achieve an inexpensive maintenance fee.

Furthermore, in the open/close valve of the seventh invention, since the sub water passage passes through the main valve body, as far as a small amount of water flows, dead water is hardly generated near the main valve body, and there is no possibility that the contamination and the freezing of dead water is generated.

When the main water passage is connected to the water supply source and also the sub water passage is connected to the water supply source, it is possible to adopt a means for diverging the sub water passage from the main water passage. Furthermore, when the sub water passage passes through the main valve body, if a water inlet of the sub water passage is not a terminal end portion of the main water passage at the primary side, dead water is generated between near the water inlet of the sub water passage and the terminal end portion of the main water passage at the primary side at the time of closing the main water passage due to the main valve body and of releasing the sub water passage due to the sub valve body. Due to this, it is preferable that the water inlet of the sub water passage is connected to the terminal end portion of the main water passage at the primary side. With such a constitution, even at the time of closing the main water passage due to the main valve body and of releasing the sub water passage due to the sub valve body, dead water is not generated between near the water inlet of the sub water passage and the terminal end portion of the main water passage at the primary side. As a result, the effect of the seventh invention is further exhibited.

It is possible that the primary side of the main water passage is connected to the water supply source, and that the secondary side of the main water passage and the secondary side of the sub water passage is connected to a western-style toile body. Accordingly, it is possible to achieve a tankless western-style flush toilet as a western-style flush toilet having no toilet washing tank.

Moreover, it is possible to spout water from the sub water passage in a flow amount which is able to prevent the freezing of water at an upstream side of the western-style toilet body and the freezing of the trap of the western-style toilet body. Accordingly, in the western-style flush toilet including the tankless western-style flush toilet, it is possible to prevent the freezing of water at an upstream side of the western-style toilet body and the freezing of the trap of the western-style toilet body.

The open/close valve of the seventh invention can adopt a housing in which a water-in port connected to a water supply source, a main water passage and a sub water passage connected to the water-in port and a water-out port connected to the main water passage by way of a main valve body and connected to the sub water passage by way of a sub valve body are formed. In the open/close valve having such a housing, a main valve mechanism comprising the main water passage and the main valve body, and a sub valve mechanism comprising the sub water passage and the sub valve body becomes one body. As a result, the mountability to a western-style toilet body and the like is excellent, and the reduction of the cost can be achieved because no pipe is required.

As the main valve body, it is possible to adopt the one comprising a piston which is slidably mounted on the housing in the axial direction, and which is attached to a seat face of the housing by being slided on one side in the axial direction to close the communication of the main water passage, and which is detached from the seat face by being slided on the other side in the axial direction to open the communication of the main water passage. In this piston, it is possible to mount a shaft which is protruded from the housing, and furthermore, by which the piston is slided in the axial direction while being against a force act means. With such a constitution, the speed for opening and closing valve can be set voluntarily by the operation of the piston. So, even if a large amount of water flows, a rapid closing of the valve can be prevented. As a result, the generation of water hammer is prevented, and a noise and the like can be suppressed. Moreover, even by the operation of a small piston, it is possible to open the valve satisfactorily at the time of low pressure of water. So, pressure loss is hardly generated, and the piston doesn't necessarily become large, and it is possible to exhibit an excellent mountability to a western-style flush toilet and the like.

The shaft may be driven by the manual operation, but it is preferable that the shaft is driven based on an electric signal. If a shaft which is driven based on an electric signal is adopted, the opening and closing of the open/close valve is automatically performed, and this is convenient.

It is possible that the housing has a pressure offset room which is mounted on the other side of the piston, and a passage which is mounted through the piston in the axial direction, which communicates one side of the piston with the pressure offset room and which offsets the pressure that the piston receives from water in the main water passage to the other side. With such a constitution, the slidability of the piston in the axial direction is ensured, and the operation responsibility is stable. For example, if this housing is used for a western-style flush toilet, it is possible to improve the reliability about the washability and the like. Moreover, water which exists at one side of the piston is moved from the water-in port or the water-out port to the pressure offset room by way of the passage, and then, the balance between the pressure of water in the pressure offset room and the pressure of water in one side of the piston is kept, and the difference of the pressure between them is canceled or decreased. Then, it is possible that the sub water passage includes the passage.

It is possible that the main water passage and the main valve body for the rim, and the main water passage and the main valve body for the jet are assembled in such a manner that the main water passage and the main valve body for the rim share the same water-in port with the main water passage and the main valve body for the jet. With such a constitution, the open/close valve for the rim, and the open/close valve for the jet become one body, so the mountability to a western-style flush toilet and the like is excellent, and the reduction of the cost can be achieved because no pipe is required. In this case, it is possible that a single water inlet of the sub water passage is connected to the main water passage, and that two water outlets of the sub water passage are connected to the water-out port for the rim and the water-out port for the jet.

The sub valve body may be the one which is driven based on an electric signal, but it is preferable that the sub valve body can be driven by the manual operation. If the sub valve body can be driven by the manual operation, it is inexpensive.

It is difficult to achieve that a constant small amount of water is flown only by the diameter of the sub water passage because the pressure of water in the water supply source is likely to be changed. Accordingly, it is preferable that the sub water passage has a constant flow amount valve mechanism which is able to flow a constant small amount of water in spite of the pressure of water inside the water supply source. As such a constant flow amount valve mechanism, it is possible to adopt the one which is well known, and which uses an elastic rubber and the like whose divergence is changed by the pressure.

Eighth Invention

Furthermore, for example, in a western-style flush toilet, a toilet washing device is mounted in a western-style toilet body, and at the same time, an attached equipment which uses water of a part washing device and the like having a function for washing a part of a human body may be also mounted. In this respect, in the above conventional tankless western-style flush toilet, the open/close valve which is mounted on the toilet washing device has only one single water-in port and water-out port respectively. So, it is necessary that water is supplied to the open/close valve of the toilet washing device, and at the same time, that water is supplied to the attached equipment to be able to wash the western-style toilet body due to the toilet washing device, and simultaneously, that other functions can be achieved by the attached equipment without being relevant to the washing of the western-style toilet body. Then, in this case, it is necessary that the open/close valve and a water supply source which is mounted on a wall of a toilet are connected by a connecting pipe, and at the same time, that a branch cock is attached to the middle portion of the connecting pipe, and that the attached equipment and the branch cock are connected by way of the second connecting pipe. With such a constitution, plural connecting pipes are mounted in parallel between the water supply source and the western-style toilet body. As a result, an arrangement space for the connecting pipe is required, and an appearance is deteriorated.

The eighth invention has been made in view of the above circumstances and it is the eighth task to be solved to provide an open/close valve which has an advantage in the reduction of an arrangement space of pipes and the security of an appearance.

With respect to the open/close valve of the eighth invention, in an open/close valve which includes a housing having a first port and a second port, both of which are at the position being apart from each other, and also having a water-out port which is communicated with a water-through passage, and a valve mechanism which is mounted on the housing, and which carries out supplying water and stopping water supply to the water-through passage by way of the water-out port, the improvement is characterized in that the second port is communicated with the first port without being relevant to the operation of the valve mechanism.

In the open/close valve of the eighth invention, the housing has the water-out port which is communicated with the water-through passage, and at the same time, the first port and the second port, both of which are at the position being apart from each other. Then, the second port is communicated with the first port without being relevant to the operation of the valve mechanism. Due to this, when one of the first port and the second port is connected to the water supply source, it is possible that the other of the first port and the second port can be communicated with the water supply source. Accordingly, while supplying water from the water supply source to one of the first port and the second port, it is possible to supply water from the water supply source to the other of the first port and the second port without being relevant to supplying water and stopping water supply to the water-through passage.

Accordingly, for example, in the western-style flush toilet, when the toilet washing device having the open/close valve is mounted on the western-style toilet body, and at the same time, the attached equipment such as the part washing device is mounted, if the water supply source which is mounted on the wall of the toilet is connected to the open/close valve of the toilet washing device by means of a single connecting pipe and if the open/close valve and the attached equipment are connected by way of the second connecting pipe, water can be supplied to the open/close valve of the toilet washing device, and at the same time, water can be supplied to the attached equipment too. Due to this, it is possible to wash the western-style toilet body due to the toilet washing device, and simultaneously, other functions can be achieved by the attached equipment without being relevant to the washing of the western-style toilet body. In this case, only one connecting pipe is mounted between the water supply source and the western-style toilet body, so an arrangement space of pipes can be omitted, and an appearance is improved.

When the attached equipment is not mounted, the other of the first port and the second port may be merely sealed. For example, when the first port is connected to the water supply source as a water-in port, the second port as a water supply port is made to be able to be sealed. For such a sealing, it is possible to adopt a system in which a lid portion member is detachably attached to the other of the first port and the second port. The constitution for attaching the lid portion member is not specified, and the lid portion may be attached by a screw stop or an irregularity engagement.

Ninth Invention

Furthermore, in the conventional open/close valve for the flush toilet, the bottom surface of the communication passage is formed as a plane surface. So, when the condition that the flush toilet is not used under the low temperature condition such as a cold area and the like is continued, even if water in the communication passage and the downstream side therefrom is drained away by opening the valve mechanism, water is likely to be remained in the communication passage. Due to this, in this case, water is frozen in the communication passage, and the damage is generated or it is impossible to use the flush toilet immediately at the next time. Thus, there arises a disadvantage in the preferable use at the next time.

The ninth invention has been made in view of the above circumstances and it is the ninth task to be solved to provide an open/close valve for a flush toilet which doesn't generate a disadvantage after water is drained away.

With respect to the open/close valve of the ninth invention, in an open/close valve having a housing in which a water-in port that is connected to a water supply source to take in water, a water-out port that is connected to a toilet body to spout the water to the toilet body and a communication passage that communicates the water-in port with the water-out port, and a valve mechanism which is mounted on the housing, and which is able to open and close the communication passage, the improvement is characterized in that the bottom surface of the communication passage is formed downward to the water-in port or the water-out port.

In the open/close valve for the flush toilet of the ninth invention, the bottom surface of the communication passage is formed downward to the water-in port and the water-out port. So, when the condition in which the flush toilet is not used under the low temperature condition such as a cold area and the like is continued, if water in the communication passage and the downstream side therefrom is drained away by opening the valve mechanism, water in the communication passage flows toward the water-in port or the water-out port, and water is not remained in the communication passage. Due to this, in this case, the freezing of water in the communication passage is prevented.

Tenth Invention

However, in the above western-style flush toilet, a toilet washing switch is mounted on the toilet wall which is apart from the western-style toilet body in such a manner that the toilet washing switch is separated from the manual handle. So, if the user is not accustomed to such a western-style flush toilet, there is the case that he doesn't notice the existence of the toilet washing switch. In this case, although the toilet washing switch and the like are existed, the user carries out the manual operation on the manual handle, and as a result, an advantage in the operability is not satisfactorily exhibited.

Especially, the present inventors consider advantages such as an arrangement space and the like recently, and they are now developing a tankless western-style flush toilet having no toilet washing tank. The tankless western-style flush toilet has a toilet washing device which is able to wash a western-style toilet body with water that is directly supplied from a water supply source. So, the manual handle is not required in the sense of supplying water in the conventional toilet washing tank, it is considered that the user who is not accustomed to such a tankless western-style flush toilet is further puzzled.

Furthermore, as the toilet washing device in such a tankless western-style flush toilet, the one having an open/close valve for supplying water and stopping water supply between the water supply source and the western-style toilet body, a cam device for opening and closing the open/close valve and an electric motor which is able to operate the cam device by means of the operation of the toilet washing switch by the user is adopted. In this case, it is effective that the manual handle for rotating the cam device manually is also mounted preliminarily for an emergency such as power failure and the like. If it is not in case of power failure, there is high possibility that the user who is not accustomed to such a tankless western-style flush toilet misunderstands that the manual handle is served for washing the western-style toilet body. In this case, much physical strength is required for operating the cam device manually by the manual handle, and there is a fear that the user has a heavy operation feeling in his mind.

The tenth invention has been made in view of the above circumstances and it is the tenth task to be solved to provide a western-style flush toilet which is able to wash a western-style toilet body with an excellent operability by the user who is not accustomed to the western-style flush toilet.

With respect to the western-style flush toilet of the tenth invention, in a western-style flush toilet which has a western-style toilet body, an open/close valve and a manual handle, and which releases the open/close valve by fluctuation of the manual handle, the improvement is characterized in that a detection means for detecting the contact or a very small angle deviation is mounted on the manual handle, and that at least the release of the open/close valve is assisted by a detection signal of the detection means.

In the western-style flush toilet of the tenth invention, even if the user is not accustomed to the western-style flush toilet, and when the user doesn't notice the existence of the toilet washing switch, only if the user operates the manual handle lightly, the detection means detects that the user touches the manual handle lightly or that the manual handle makes a very small angle deviation. Due to this, the release of the open/close valve is assisted, and the washing of the western-style toilet body is carried out.

In the western-style flush toilet of the tenth invention, it is preferable that the manual handle is assisted to be fluctuated by the detection signal of the detection means. With such a constitution, even if the user is not accustomed to the western-style flush toilet, he notices the fluctuated manual handle visually and acoustically, so he doesn't rotate the manual handle by not more physical strength than that is needed. Therefore, it is possible to prevent malfunction and failure which are caused by the fact that the user rotates the manual handle by force.

In the western-style flush toilet of the tenth invention, it is preferable that the user is able to know the time when the manual handle is assisted. With such a constitution, it is possible to prevent the user from rotating the manual handle by not more physical strength than that is needed. Furthermore, as the means that the user is able to know the time when the manual handle is assisted, it is possible to adopt the one in which a noise such as an intermittent electronic noise is generated, a light is flashed and the like.

In the western-style flush toilet of the tenth invention, when it has a toilet washing device which has no toilet washing tank, and in which water is directly supplied from a water supply source and the water is supplied from a released open/close valve to be able to wash a western-style toilet body, it is preferable that a manual handle is mounted on the toilet washing device. With such a constitution, the user who is not accustomed to the western-style flush toilet is not puzzled.

Moreover, as the toilet washing device of such a tankless western-style flush toilet, when the one having an open/close valve for supplying water and stopping water supply between the water supply source and the western-style toilet body, a cam device for opening and closing the open/close valve and an electric motor which is able to operate the cam device by means of the operation of a toilet washing switch by the user is adopted, if a manual handle for rotating the cam device manually is also mounted preliminarily for an emergency such as power failure and the like, it is preferable that a detection means is mounted on the manual handle, and that at least the release of the open/close valve is assisted by a detection signal of the detection means. With such a constitution, although some physical strength is required at the time of an emergency such as power failure and the like, it is possible to wash the western-style toilet body by the manual handle. Furthermore, in case of not power failure, it is possible to prevent the user who is not accustomed to the western-style flush toilet from having a heavy operation feeling in his mind.

Furthermore, the western-style flush toilet of the tenth invention can be adopted to a tank-type western-style flush toilet having a toilet washing tank in which water that is supplied from a water supply source such as a city water service pipe and the like is temporarily stored before the water is flown into a western-style toilet body. In this case, it may have a constitution in which a detection means is mounted on a manual handle which is mounted on an outer surface of the toilet washing tank, and in which at least the release of an open/close valve is assisted by a detection signal of the detection means.

It is possible that the detection means is constituted by a sensor for detecting that the user touches the manual handle or that the manual handle makes a physical deviation. As such a sensor, it is possible to adopt a pressure sensitive sensor for detecting that the user touches the manual handle, a torque sensor for detecting a torque at the time of the initial operation of the manual handle by the user and a light sensor in which the initial operation of the manual handle by the user is detected by a light. As the light sensor, for example, it is possible to adopt a photo interrupter which includes a luminous element and a light-receiving element, and which detects the existence of an obstruction (manual handle) between the luminous element and the light-receiving element.

In order to assist fluctuation of the manual handle based on the detection signal of the detection means, it is possible to adopt a driving device and a controller. The driving device is served to release the open/close valve, and it is able to have an electric motor for releasing the open/close valve. For example, the driving device can adopt the one having a cam device for opening and closing the open/close valve in order to supply water and stop supplying water to the western-style toilet body, and an electric motor for operating the cam device. Furthermore, the controller is served to operate the driving device based on the detection signal of the detection means, and it can be constituted by a circuit having CPU.

Eleventh Invention

However, in the above conventional tankless western-style flush toilet, since the difference of the pressure of city water in a city water service pipe is not considered, there is a fear that a water supply amount is not satisfactory or excessive.

Especially, when the pressure of the city water is low, a water supply amount is insufficient, and there is a fear that filth is remained in the western-style toilet body. This causes an unpleasant smell and the like, and the western-style toilet body is unsanitary. Such a disadvantage can be solved by unifying a water supply amount to the case in which the pressure of the city water is low. However, in this case, when the pressure of the city water is not low, a water supply amount becomes excessive, and waste consumption of water is generated.

The eleventh invention has been made in view of the above circumstances and it is the eleventh task to be solved to provide a tankless western-style flush toilet which is able to surely prevent both of the unsanitary condition and waste consumption of water.

With respect to the western-style flush toilet of the eleventh invention, in a western-style flush toilet having a western-style toilet body and a toilet washing device which is able to wash the western-style toilet body with water, and which has an open/close valve that is directly connected to a city water service pipe for supplying water from the outside, and that is able to spout the water by being opened and closed electrically, the improvement is characterized in that the toilet washing device has a control portion for ensuring at least two kinds of releasing times of the open/close valve, and a switching means which is able to switch the control portion in accordance with the pressure of city water in the city water service pipe by an installation person.

In the tankless western-style flush toilet of the eleventh invention, the control portion ensures at least two kinds of releasing times of the open/close valve, and the installation person switches the switching means in accordance with the pressure of the city water in the city water service pipe, thereby selecting the releasing time of the open/close valve.

Accordingly, the open/close valve is released at an appropriate releasing time which is in accordance with the pressure of the city water in the city water service pipe. Namely, even when the pressure of the city water is low and the water is spouted not powerfully, it is possible to perfectly discharge filth that is remained in a trap of the western-style toilet body by prolonging the releasing time of the open/close valve. Due to this, there is no cause of an unpleasant smell and the like, and the western-style toilet body becomes sanitary.

On the other hand, when the pressure of the city water is high and the water is spouted powerfully, water is not consumed in not more amount than that is needed by shortening the releasing time of the open/close valve.

In the tankless western-style flush toilet of the eleventh invention, when the open/close valve comprises a rim open/close valve which is able to spout water to a rim of the western-style toilet body and a jet open/close valve which is able to spout water to a trap of the western-style toilet body, it is preferable that the control portion ensures an equal releasing time of the jet open/close valve in spite of the difference between the case of feces and the case of urine.

Filth that is existed in the western-style toilet body, even if it is feces or urine, is collected to the trap by water which is spouted from the rim by releasing the rim open/close valve. At this time, a relatively large water supply amount is required for collecting the feces to the trap, and on the contrary, a relatively small water supply amount is required for collecting urine to the trap. After that, when the jet open/close valve is released to generate a siphon effect forcibly, in both of the case of feces and the case of urine, the same volume is already ensured together with filth in the trap, so the same level of the siphon effect is generated by the same water supply amount. Due to this, the control portion is satisfactory if the releasing time of the jet open/close valve is set to be equal in spite of the difference between the case of feces and the case of urine. Accordingly, it is unnecessary to change the releasing time of the jet open/close valve between the case of feces and the case of urine. So, the constitution of the control portion becomes simple, and the reduction of the cost is achieved.

In the tankless western-style flush toilet described in Japanese Patent Publication No. 2706131, the user is able to select either of washing switches for feces and urine, and the releasing time of the jet open/close valve is set to be different between the case of feces and the case of urine. In fact, when filth which is collected to the trap is discharged, there may be a difference in the siphon effect depending on whether the filth is feces or urine. However, such a difference is very slight, so it seems unnecessary that the constitution of the control portion becomes complicated, and that the increase of the manufacturing cost is generated for such a slight difference.

Twelfth Invention

Furthermore, in the conventional flush toilet, the open/close valve becomes the abnormal condition due to mischief or failure of the toilet washing device. If such an abnormal condition is left alone, water is left to flow, and water is wastefully consumed.

The twelfth invention has been made in view of the above circumstances and it is the twelfth task to be solved to provide a flush toilet in which water is not wastefully consumed.

With respect to the flush toilet of the twelfth invention, in a flush toilet having a toilet body and a toilet washing device which is able to wash the toilet body with water, and which has an open/close valve that is able to spout the water by being opened and closed electrically, the improvement is characterized in that the toilet washing device has a detection means for detecting the abnormal condition of the open/close valve, and a return means for making the open/close valve in the closed condition based on an abnormal signal of the detection means.

In the flush toilet of the twelfth invention, even if the open/close valve becomes the abnormal condition, the abnormal signal is generated by the detection means, and the open/close valve is in the closed condition by the return means automatically.

In the flush toilet of the twelfth invention, it is preferable that the toilet washing device has a notice means for notifying the abnormal condition based on the abnormal signal of the detection means. With such a constitution, the user is able to know that there is something abnormal in the toilet washing device, and it is possible to take measures to meet this rapidly.

As the detection means, it is possible to adopt a position sensor, a flow amount sensor, a water pressure sensor and the like. Furthermore, as the notice means, it is possible to adopt an apparatus for generating, for example, an electric noise, and an apparatus for flashing a luminous diode and the like.

Furthermore, in the flush toilet of the twelfth invention, it is preferable that the return means makes the open/close valve in the closed condition after carrying out at least a water sealing treatment on the toilet body. With such a constitution, even if the open/close valve is in the abnormal condition, a water sealing treatment is carried out in the trap, and it is possible to prevent a nasty smell from going up through a drain pipe.

In this case, the return means is able to make the open/close valve in the closed condition after carrying out the normal washing treatment on the toilet body. With such a constitution, even if the open/close valve is in the abnormal condition, the normal washing treatment is carried out at least once on the toilet body, and the washing of the toilet body is surely carried out. Accordingly, filth is not remained, and the generation of an unpleasant smell is prevented, and the flush toilet becomes sanitary.

Moreover, in the flush toilet of the twelfth invention, it is preferable that the return means makes the open/close valve in the closed condition at the time of exceeding a constant frequency of retry. With such a constitution, even if it is impossible to carry out the normal washing treatment on the toilet body due to the abnormal condition of the open/close valve, the retry is not repeated endlessly, and finally, water is not left to flow. Accordingly, waste consumption of energy is prevented, and waste consumption of water is also prevented.

As the open/close valve, it is possible to adopt the one which is driven by a stepping motor. With such a constitution, the detection means is able to detect the condition of the open/close valve by means of the frequency of pulse which corresponds to a rotation angle of the stepping motor. Due to this, it is possible to control the open/close valve based on a pulse signal easily, and at the same time, it is possible to detect the present condition of the open/close valve easily.

Thirteenth Invention

Furthermore, in the conventional flush toilet, during the winter season, an intention of a control person who tries to prevent the damage which is caused by freezing water that is reserved in the open/close valve is incompatible with the use of the conventional flush toilet under the control of the control person.

Namely, during the winter season, if the open/close valve is maintained in the fully-closed condition, the reserved water that is reserved in the open/close valve is frozen, and there is a fear that the open/close valve is damaged. In order to prevent this, the control person may close a city water service pipe for supplying water to the open/close valve by a stop cock under the ground, and at the same time, he may discharge the reserved water in the open/close valve to an upstream side or a downstream side by making the open/close valve the semi-opened condition, namely, water is drained away.

However, although the control person drains water away, there is a case that the user opens the stop cock again and that he operates a washing switch of the toilet washing device. In this case, if the open/close valve is maintained and stopped in the closed condition after carrying out a series of open/close operations of the open/close valve for washing the western-style toilet body, it is canceled that the control person drains water away after the user uses the flush toilet. As a result, the effect for preventing the freezing of the open/close valve is not exhibited.

The thirteenth invention has been made in view of the above circumstances and it is the thirteenth task to be solved to provide a flush toilet in which the intention of the control person can be compatible with the use of the user during the winter season.

With respect to the flush toilet of the thirteenth invention, in a flush toilet having a toilet body and a toilet washing device which is able to wash the toilet body with water, and which has an open/close valve that is able to spout the water by being opened and closed, the improvement is characterized in that the toilet washing device has an electric driving means for driving the open/close valve electrically, a manual handle which is able to release the open/close valve manually, a detection means for detecting the condition of the open/close valve and a control means for controlling the electric driving means based on a detection signal of the detection means in the desired mode, and that the control means makes the open/close valve restore to the initial condition in which the open/close valve is released by the manual handle after carrying out the desired mode in the initial condition.

In the flush toilet of the thirteenth invention, it is possible that the electric driving means of the toilet washing device drives the open/close valve electrically, and that the manual handle of the toilet washing device drives the open/close valve manually. During this, the detection means of the toilet washing device detects the condition of the open/close valve, and the control means of the toilet washing device controls the electric driving means based on the detection signal of the detection means in the desired mode.

Accordingly, in the flush toilet of the thirteenth invention, when the control person makes the open/close valve in the semi-closed condition by operating the manual handle in order to prevent the freezing during the winter season, and at the same time, he closes the stop cock under the ground, and when the user opens the stop cock to operate the washing switch under such a condition, the control means makes the open/close valve restore to the initial condition after carrying out the mode in the initial condition in which the open/close valve is released by the manual handle. Accordingly, only if the stop cock is closed after the use of the user, it is maintained that the reserved water in the open/close valve is discharged to the western-style toilet body, namely, that water is drained away. As a result, the effect for preventing the freezing of the open/close valve can be exhibited.

Furthermore, if the flush toilet of the thirteenth invention may be the one which detects whether or not the user uses the flush toilet by means of an optical detector such as a light sensor and the like, and which is able to wash the toilet automatically, the optical detector detects the control person after he sets the open/close valve at the position for draining water away by means of the manual handle, and the automatic washing operation is started. However, after carrying out the automatic washing operation, the open/close valve is not closed to be the condition in which water is drained away, so this is effective.

In the flush toilet of the thirteenth invention, if a stepping motor is adopted as an electric driving means, as the detection means, it is possible to adopt a count means for counting the frequency of pulse of the stepping motor, and a position sensor for detecting a rotation angle of the stepping motor. With such a constitution, by using a pulse signal and a position signal, it is possible to control the stepping motor in the desired mode easily.

BRIEF DESCRIPTION OF DRAWINGS

FIG. 59(A) is a side cross-sectional view of an essential portion which corresponds to I—I line shown in FIG. 58, and FIG. 59(B) is a side cross-sectional view of an essential portion which corresponds to II—II line shown in FIG. 58.

FIG. 60(A) is a side cross-sectional view of an essential portion which corresponds to I—I line shown in FIG. 58, and FIG. 60(B) is a side cross-sectional view of an essential portion which corresponds to II—II line shown in FIG. 58.

FIG. 61(A) is a side cross-sectional view of an essential portion which corresponds to I—I line shown in FIG. 58, and FIG. 61(B) is a side cross-sectional view of an essential portion which corresponds to II—II line shown in FIG. 58.

FIG. 62(A) is a side cross-sectional view of an essential portion which corresponds to I—I line shown in FIG. 58, and FIG. 62(B) is a side cross-sectional view of an essential portion which corresponds to II—II line shown in FIG. 58.

FIG. 64(A) is a side cross-sectional view of an essential portion which corresponds to I—I line shown in FIG. 58, and FIG. 64(B) is a side cross-sectional view of an essential portion which corresponds to II—II line shown in FIG. 58.

FIG. 65(A) is a side cross-sectional view of an essential portion which corresponds to I—I line shown in FIG. 58, and FIG. 65(B) is a side cross-sectional view of an essential portion which corresponds to II—II line shown in FIG. 58.

FIG. 66(A) is a side cross-sectional view of an essential portion which corresponds to I—I line shown in FIG. 58, and FIG. 66(B) is a side cross-sectional view of an essential portion which corresponds to II—II line shown in FIG. 58.

FIG. 67(A) is a side cross-sectional view of an essential portion which corresponds to I—I line shown in FIG. 58, and FIG. 67(B) is a side cross-sectional view of an essential portion which corresponds to II—II line shown in FIG. 58.

FIG. 68(A) is a side cross-sectional view of an essential portion which corresponds to I—I line shown in FIG. 58, and FIG. 68(B) is a side cross-sectional view of an essential portion which corresponds to II—II line shown in FIG. 58.

FIG. 69(A) is aside cross-sectional view of an essential portion which corresponds to I—I line shown in FIG. 58, and FIG. 69(B) is a side cross-sectional view of an essential portion which corresponds to II—II line shown in FIG. 58.

FIG. 70(A) is a side cross-sectional view of an essential portion which corresponds to I—I line shown in FIG. 58, and FIG. 70(B) is a side cross-sectional view of an essential portion which corresponds to II—II line shown in FIG. 58.

FIG. 120(A) is a side view of a manual handle when it is at "a jet washing position" according to a tankless western-style flush toilet of an embodiment in the thirteenth invention, and FIG. 120(B) is a cross-sectional view of a rim open/close valve and the jet open/close valve and the like according to a tankless western-style flush toilet of an embodiment in the thirteenth invention.

FIG. 121 is a view for showing the relationship between the number of a pulse count and the open and closed conditions of a rim open/close valve and a jet open/close valve.

FIG. 122 is a side cross-sectional view for showing an outline constitution of a conventional forced siphon toilet.

BEST MODE FOR CARRYING OUT THE INVENTION

First Invention

An embodiment which embodies the first invention is explained hereinafter in conjunction with drawings 1 to 8.

Figure 1:
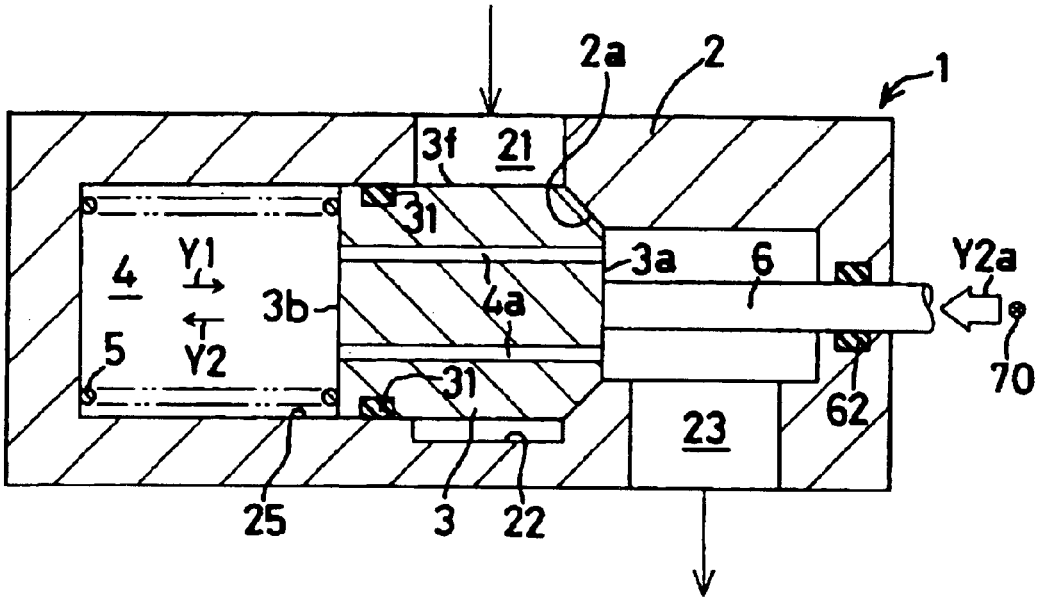
FIG. 1 is a cross-sectional view of an open/close valve which is in the closed condition according to an embodiment in the first invention.
Figure 2:
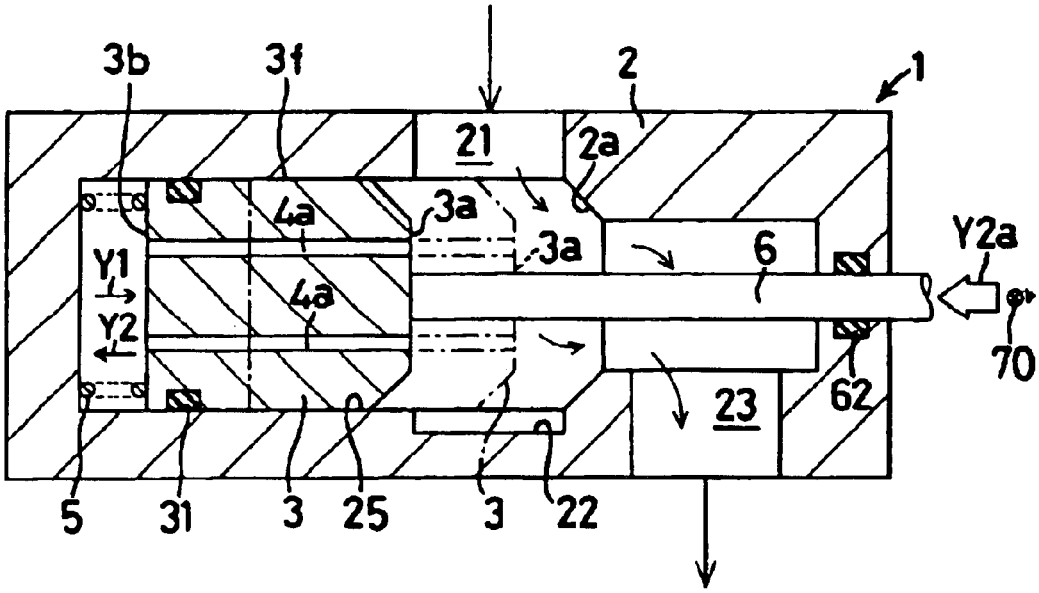
FIG. 2 is a cross-sectional view of an open/close valve which is in the open condition according to an embodiment in the first invention.

As shown in FIGS. 1 and 2, an open/close valve 1 of an embodiment has a water-in port 21 as an inlet port which takes water as a fluid into a housing 2, and a water-out port 23 as an outlet port which spouts water out.

In the housing 2, a piston room 25 which is communicated with the water-in port 21 and the water-out port 23 is formed. In the piston room 25, a piston 3 is contained in such a manner that the piston 3 is capable of sliding in the axial direction. The water-in port 21 opens at a peripheral surface side of the piston 3, and the water-out port 23 opens while bending from an end surface side of one side of the piston 3 in the axial direction to a side surface side of the housing 2. An O ring 31 is held at a ring groove at an outer peripheral portion of the piston 3 to seal a boundary area between the outer peripheral portion of the piston 3 and an inner wall surface of the housing 2.

In the piston room 25, a pressure offset room 4 is formed by the housing 2 and the other end surface 3*b* of the piston 3. The pressure offset room 4 is communicated with the side of the water-out port 23 by way of communication holes 4*a* as plural communication passages which are formed in the piston 3. Each communication hole 4*a* communicates the side of one end surface 3*a* of the piston 3 with the side of the other end surface 3*b* of the piston 3 in the axial direction. The pressure offset room 4 and each communication hole 4*a* like these are a pressure offset means.

In the pressure offset room 4, a push coil spring 5 as a force act means is coaxially arranged. The push coil spring 5 is disposed between the housing 2 and the other end surface 3*b* of the piston 3. The push coil spring 5 always pushes the piston 3 to one side, namely, toward the direction of an arrow Y1, and it has act force toward the direction for closing the communication between the water-in port 21 and the water-out port 23.

At the one end surface 3*a* of the piston 3, a shaft 6 as an outer operation means which is able to move the piston 3 in the axial direction is coaxially fixed, and it is protruded from the housing 2. A top end portion of the shaft 6 is protruded from the housing 2 to one side in the axial direction, namely, toward the direction of an arrow Y1. The top end portion of the shaft 6 can be pushed to the other side in the axial direction, namely, toward the direction of an arrow Y2*a*, by a cam 70 (a first cam 91 or a second cam 92 in FIG. 3 and the like). When the shaft 6 is pushed toward the direction of an arrow Y2*a* by the cam 70, the piston 3 is interlocked with the shaft 6 to be slided in the same direction as that of the shaft 6. A boundary area between the shaft 6 and the housing 2 is sealed by the O ring 62.

Figure 3:
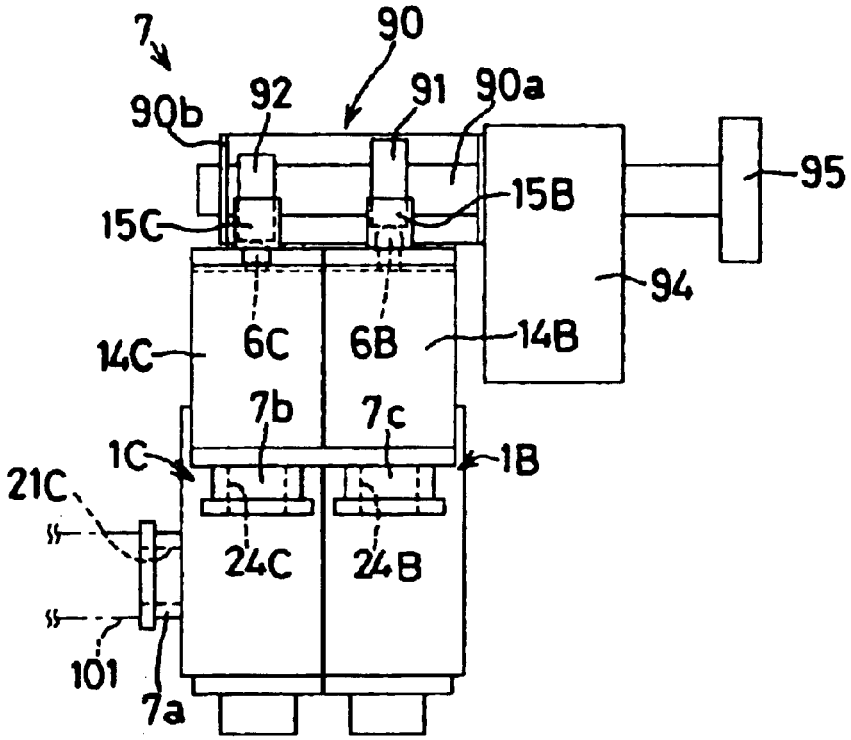
FIG. 3 is a front view of a toilet washing water supply device which uses a jet open/close valve and a rim open/close valve according to an applied embodiment of an embodiment in the first invention.
Figure 4:
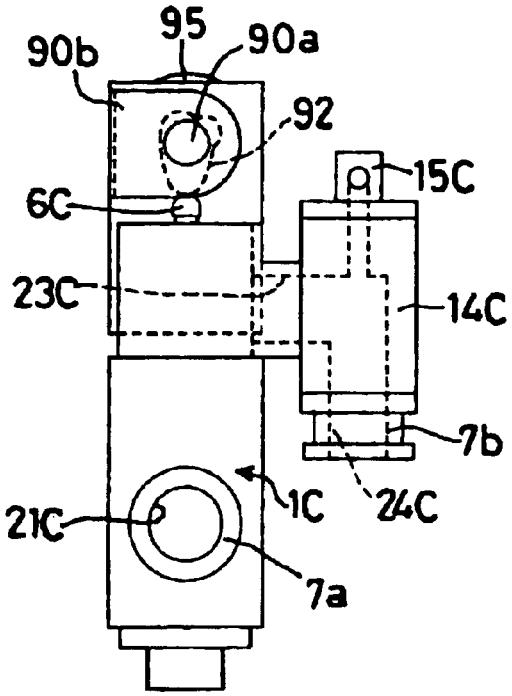
FIG. 4 is a side view of a toilet washing water supply device which uses a jet open/close valve and a rim open/close valve according to an applied embodiment of an embodiment in the first invention.
Figure 5:
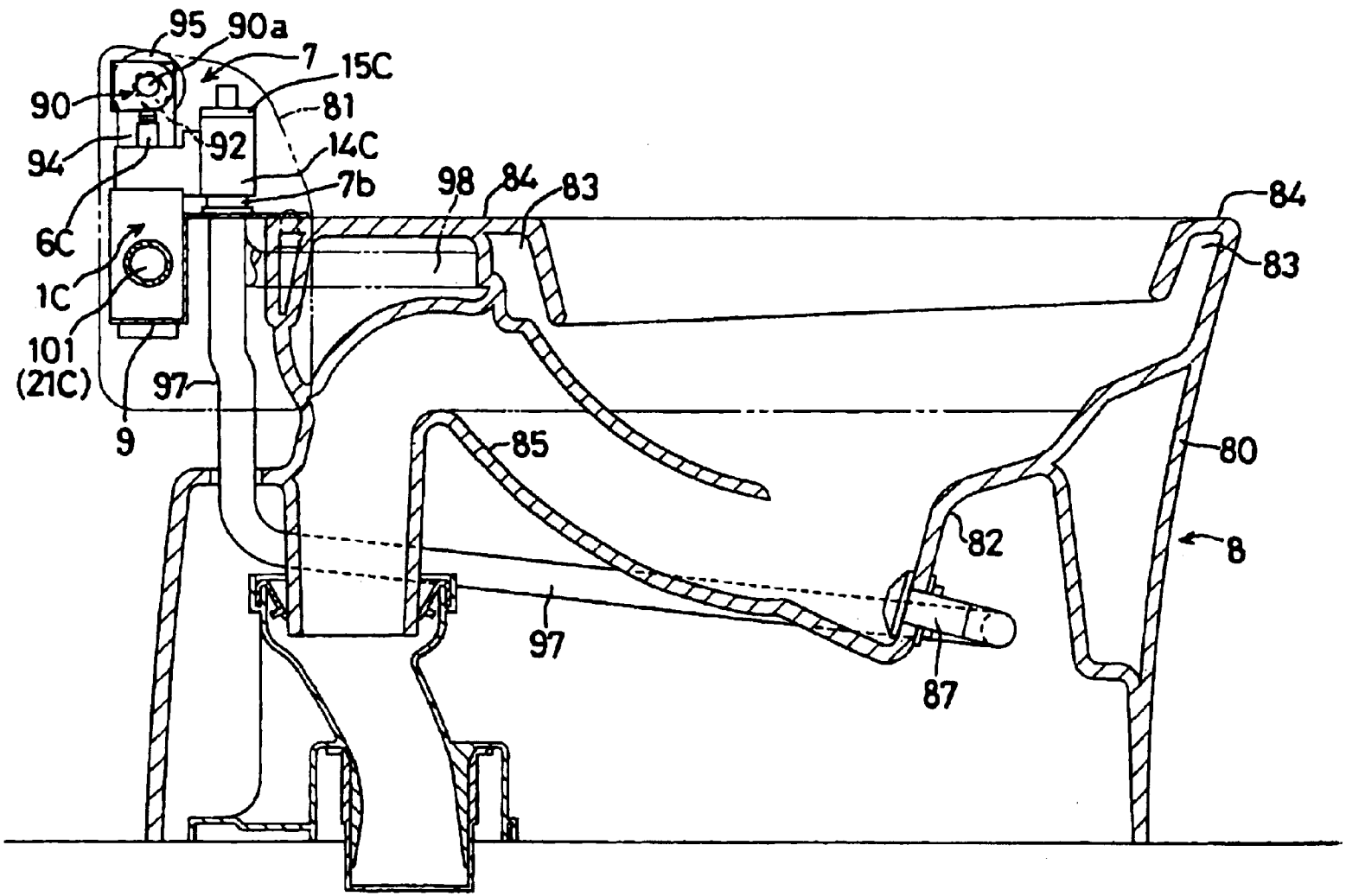
FIG. 5 is a cross-sectional view of an essential portion of a tankless western-style flush toilet according to an applied embodiment of an embodiment in the first invention.

The same open/close valves 1B and 1C as that of the above open/close valve 1 are prepared. As shown in FIGS. 3 and 4, one of these valves is used as a rim open/close valve 1B, and the other of them is used as a jet open/close valve 1B, and a toilet washing water supply device (a flow passage switching device, described as a water supply device hereinafter) 7 is assembled. The water supply device 7 comprises these open/close valves 1B and 1C, connecting members 14B and 14C, a pair of vacuum breakers 15B and 15C, a cam device 90, a driving device 94, a handle 95 for the manual operation and a controller which is not shown in the drawing. As shown in FIGS. 5 to 8, such a water supply device 7 is assembled to a rear end of a western-style toilet body 8 made of porcelain by means of a base plate 9, and it is concealed by a cover 81. Accordingly, a tankless western-style flush toilet which has no toilet washing tank as a sanitary equipment is constituted. A toilet bowl 80 of a western-style toilet body 8 includes a bowl portion 82 which receives filth, a rim 84 having a rim channel 83 which encircles at an upper periphery of the bowl portion 82, a trap portion 85 which is communicated with the bottom of the bowl portion 82 to flow the filth and a jet nozzle 87 which is mounted on an inlet of the trap portion 85. A toilet seat and a toilet lid are not shown in the drawing.

As shown in FIGS. 3 and 4, a flange 7*a* is formed at a water-in port 21C of the open/close valve 1C in such a manner that the flange 7*a* is protruded to a side surface side. As shown in FIGS. 5 to 8, the flange 7*a* is connected to one end of a conduit 101. The other end of the conduit 101 is connected to a branch device 102, and the branch device 102 is connected to a water supply source such as a city water service pipe and the like by means of a flexible hose 103 by way of a stop cock which is not shown in the drawing. Furthermore, the water-in port 21C of the open/close valve 1C which is shown in FIGS. 3 and 4 is connected to a water-in port of the open/close valve 1B by way of a communication passage 22 which is formed between the housing 2 and an outer peripheral surface 3*f* of the piston 3, in the same manner as that of the open/close valve 1 which is shown in FIGS. 1 and 2.

As shown in FIGS. 3 and 4, the open/close valve 1C is connected to the connecting member 14C, and the vacuum breaker 15C is connected to an upper end of the connecting member 14C. A water-out port 23C of the open/close valve 1C is connected to a water-out port 24C of the connecting member 14C and an air hole of the vacuum breaker 15C. At the water-out port 24C of the connecting member 14C, a flange 7*b* is formed in such a manner that the flange 7*b* is protruded downward. As shown in FIGS. 5 to 8, the flange 7*b* is connected to a jet nozzle 87 by means of a jet conduit 97.

Figure 6:
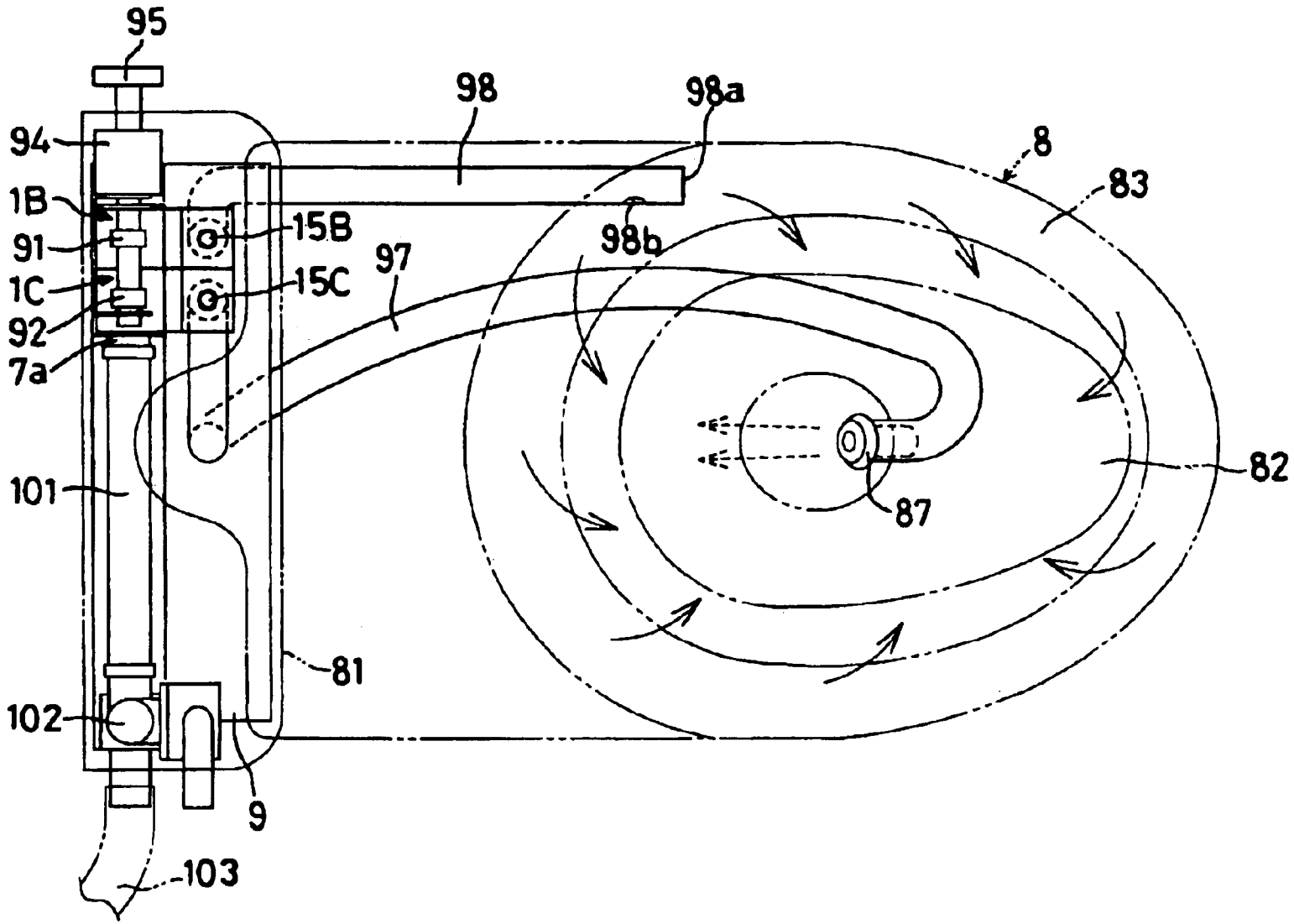
FIG. 6 is a plan view of an essential portion of a tankless western-style flush toilet according to an applied embodiment of an embodiment in the first invention.
Figure 7:
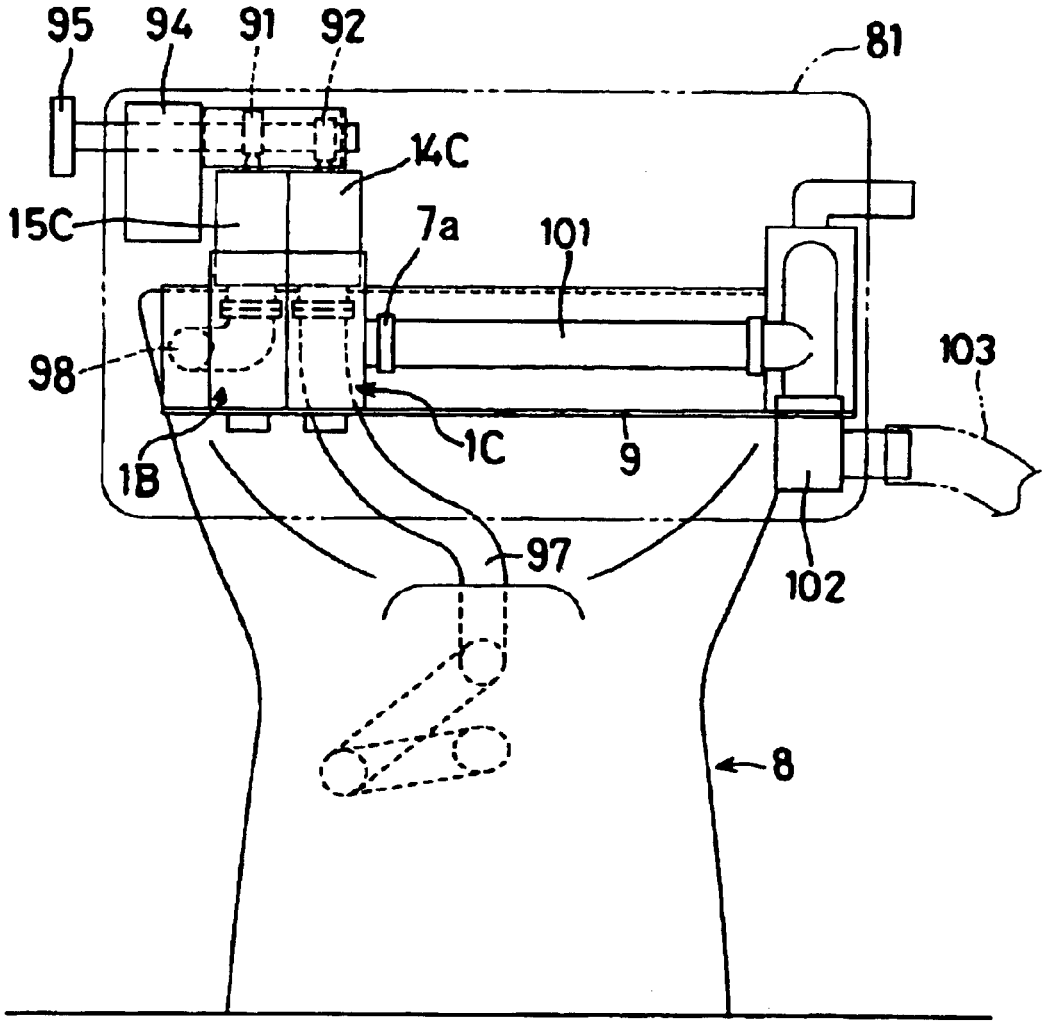
FIG. 7 is a back view of an essential portion of a tankless western-style flush toilet according to an applied embodiment of an embodiment in the first invention.
Figure 8:
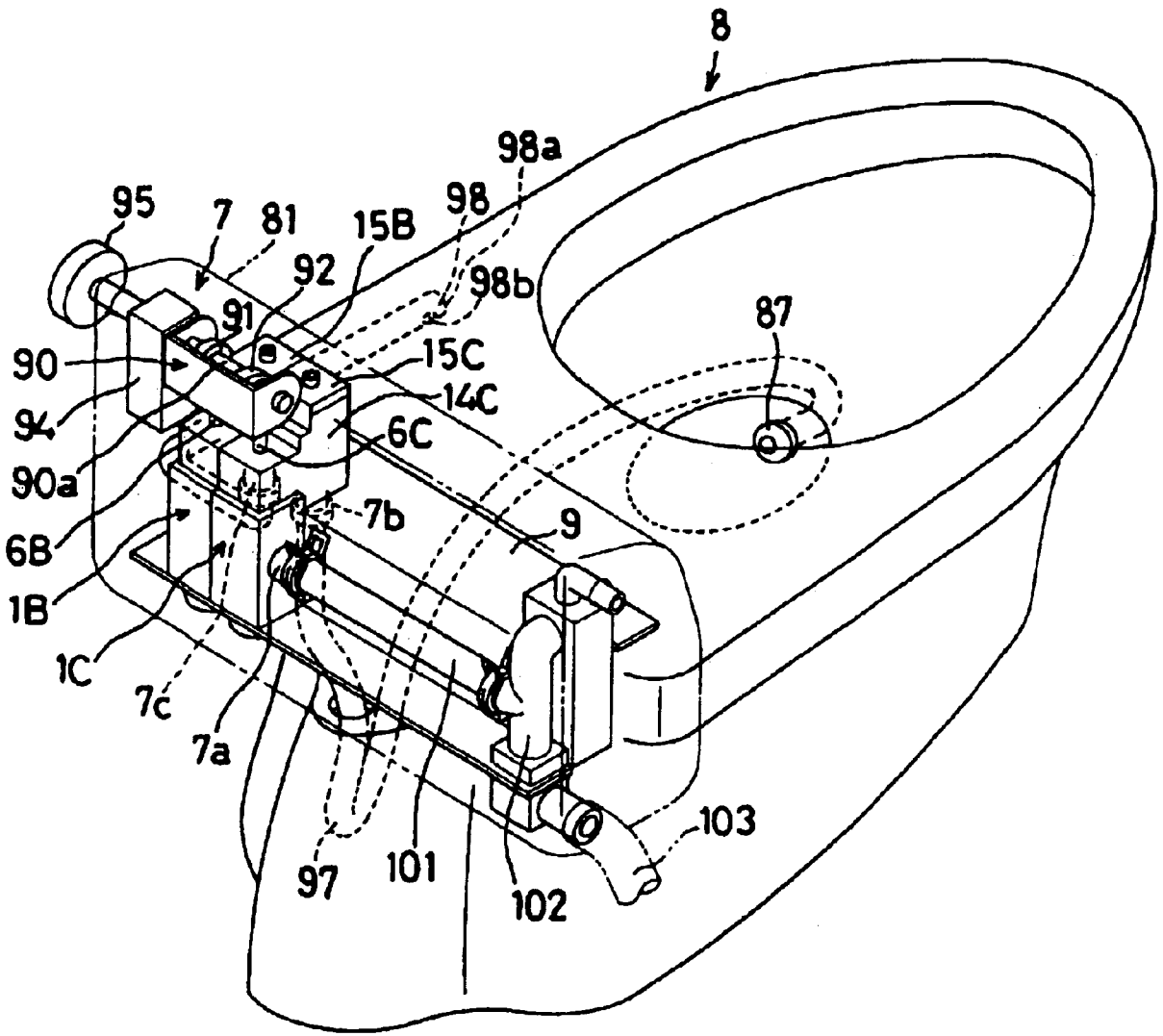
FIG. 8 is a perspective view of an essential portion of a tankless western-style flush toilet according to an applied embodiment of an embodiment in the first invention.
Figure 9:
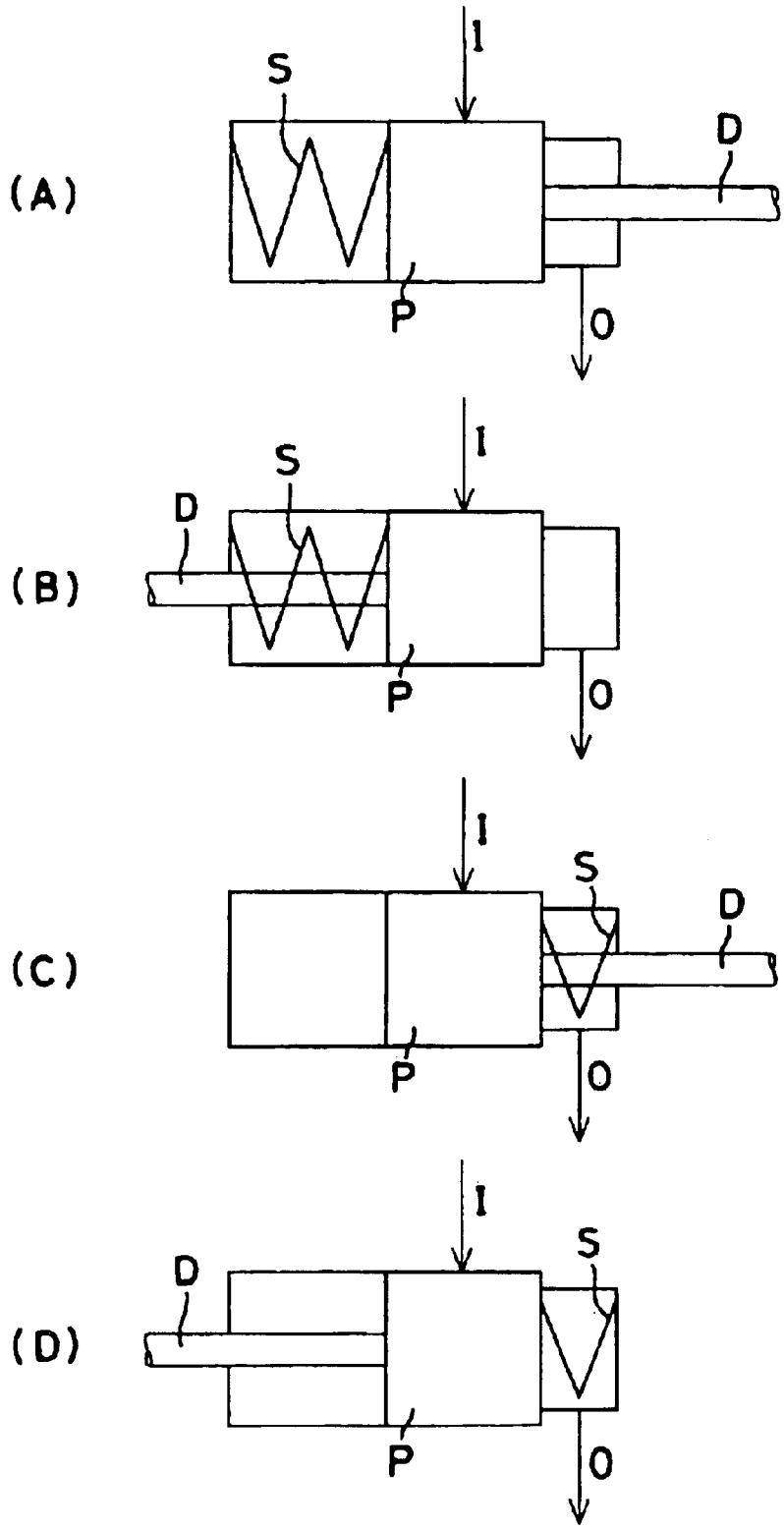
FIG. 9 is a typical view for showing a constitution which is applicable to an open/close valve in the first invention.

On the other hand, as shown in FIGS. 3 and 4, the open/close valve 1B is also connected to the connecting member 14B, and the vacuum breaker 15B is connected to an upper end of the connecting member 14B. In the same manner as that of the open/close valve 1C, a water-out port of the open/close valve 1B is connected to a water-out port 24B of the connecting member 14B and an air hole of the vacuum breaker 15B. At the water-out port 24B of the connecting member 14B, a flange 7*c* is formed in such a manner that the flange 7*c* is protruded downward. As shown in FIGS. 5 to 8, the flange 7*c* is connected to a rim channel 83 by means of a rim conduit 98. As shown in FIGS. 6 and 8, at the rim conduit 98, an opening 98*a* which opens toward a top end side and which is able to spout water clockwise, and an opening 98*b* which opens toward a side surface side and which is able to spout water counter-clockwise are formed.

The cam device 90 which is shown in FIGS. 3 and 4 comprises a bracket 90*b* which is fixed to both of the open/close valves 1B and 1C and both ends of which are protruded forward, a cam shaft 90*a* which is rotatably held in the horizontal condition at the bracket 90*b* and a first cam 91 and a second cam 92 which are fixed to the cam shaft 90*a* and which can be brought into contact with the shafts 6B and 6C of each of open/close valves 1B and 1C by means of an outer periphery of a cam surface.

In the driving device 94, a transmission gear and a motor are contained, and the cam shaft 90*a* of the cam device 90 can be rotatingly driven by the control of the controller.

The handle 95 is attached to the driving device 94, and the cam shaft 90*a* of the cam device 90 can be manually rotated.

In the tankless western-style flush toilet having the above constitution, water is supplied to the water supply device 7 by way of the water supply source, the stop cock, the flexible hose 103, the branch device 12 and the conduit 101. In the water supply device 7, as far as the user doesn't carry out the switch operation for washing the toilet bowl 80, both of the open/close valves 1B and 1C are closed. Namely, if being explained by the open/close valve 1 which is shown in FIGS. 1 and 2, the piston 3 is moved to one side in the axial direction, namely, toward the direction of an arrow Y1, by act force of the push coil spring 5. Due to this, as shown in FIG. 1, the piston 3 is attached to a seat face 2*a* of the housing 2, and the outer peripheral surface 3*f* of the piston 3 closes the water-in port 21, and at the same time, one end surface 3*a* of the piston 3 closes the water-out port 23. Accordingly, the communication between the water-in port 21 and the water-out port 23 is closed, and water cannot be supplied to the western-style toilet body 8.

Furthermore, when the toilet bowl 80 is washed, the motor of the driving device 94 is driven by a signal of the controller in accordance with the switch operation of the user, and the camshaft 90*a* is rotatingly driven. Due to this, the cam surface of the first cam 91 pushes the shaft 6B of the open/close valve 1B downward to open the open/close valve 1B. Namely, if being explained by the open/close valve 1 which is shown in FIGS. 1 and 2, the shaft 6 is pushed to the other side in the axial direction, namely, toward the direction of an arrow Y2*a*, by the first cam 91. Then, the push coil spring 5 is elastically contracted, and the piston 3 is moved to the other direction of the axial direction, namely, toward the direction of an arrow Y2. Due to this, as shown in FIG. 2, the piston 3 is detached from a seat face 2*a* of the housing 2, and the communication between the water-in port 21 and the water-out port 23 is opened. Accordingly, the water supply device 7 supplies water to the rim channel 83 by way of the rim conduit 98, and an inner wall surface of the bowl portion 82 is washed.

The cam surface of the first cam 91 doesn't come to push the shaft 6B of the open/close valve 1B downward, and the open/close valve 1B is closed in the same manner as that of the above open/close valve 1, and after that, the cam surface of the second cam 92 pushes the shaft 6C of the open/close valve 1C downward, and the open/close valve 1C is opened in the same manner as that of above open/close valve 1. Accordingly, the water supply device 7 supplies water to the jet nozzle 87 by way of the jet conduit 97 to generate a siphon effect in the trap portion 85 forcibly.

Next, the cam surface of the second cam 92 doesn't come to push the shaft 6C of the open/close valve 1C downward, and the open/close valve 1C is closed in the same manner as that of the above open/close valve 1, and after that, the cam surface of the first cam 91 again pushes the shaft 6B of the open/close valve 1B downward, and the open/close valve 1B is again opened in the same manner as that of above open/close valve 1. Accordingly, the water supply device 7 supplies water to the rim channel 83 by way of the rim conduit 98, and the bowl portion 82 is sealed with water.

As mentioned above, in both of the open/close valves 1B and 1C in the embodiment, it is possible to adjust the divergence of the communication between the water-in port and the water-out port by means of the outer operation of the shafts 6B and 6C. As follows, if being explained by the open/close valve 1 which is shown in FIGS. 1 and 2, the communication between the water-in port 21 and the water-out port 23 is opened and closed by the piston 3, so the piston 3 receives the pressure on the other side by means of water in the water-out port 23. At this time, the piston having no flexibility is not bent toward the side of the open valve due to the pressure on the other side. However, if a space for the sliding of the piston 3 is merely mounted, the slidability of the piston 3 in the axial direction is hindered by the pressure on the other side like this. In this respect, in the open/close valve 1, the pressure offset room 4 is formed at the other side of the piston 3, and one side of the piston 3 is communicated with the pressure offset room 4 by plural communication holes 4*a*. So, water existed in one side of the piston 3 from the water-out port 23 is moved to the pressure offset room 4 by way of the communication hole 4*a* to attempt to keep the balance between the pressure of water in the pressure offset room 4 and the pressure of water in one side of the piston 3. As a result, the difference of the pressure between them can be canceled or decreased. Due to this, the slidability of the piston 3 in the axial direction can be ensured. Accordingly, in the open/close valve 1, the operation responsibility is stable, and it is possible to improve the reliability of the washability and the like when the open/close valve 1 is used for a tankless western-style flush toilet.

Furthermore, in the open/close valve 1 in the embodiment, the communication hole 4*a* is formed in the piston 3, so each communication hole 4*a* is easily mounted in the axial direction. Since the communication hole 4*a* is mounted in the piston 3 in the axial direction, water which is moved in the communication hole 4*a* doesn't receive the resistance when the piston 3 is slided, and the slidability of the piston 3 is improved.

Moreover, in the open/close valve 1 in the embodiment, the water-in port 21 of the housing 2 opens at a peripheral surface side of the piston 3, and the water-out port 23 of the housing 2 opens at an end surface side of one side of the piston 3 in the axial direction, so the piston 3 doesn't receive the pressure on the other side due to water in the water-in port 21. Even if the pressure of water in the water-in port 21 is excessively high or excessively low due to circumstances or the like under which the open/close valve 1 is used, the slidability of the piston 3 is not changed.

Furthermore, as an outer operation means, a shaft 6 which is fixed to the piston 3 and which is protruded from the housing 2 and by which the piston 3 is slided in the axial direction while being against the push coil spring 5 is adopted. So, it is unnecessary to adopt an electromagnetic valve such as a conventional open/close valve, so the production cost of the open/close valve 1 can be reduced. Especially, in the tankless western-style flush toilet in the embodiment, a pair of open/close valves 1B and 1C are used, so the effect of the reduction of the production cost is large. Furthermore, the open/close valves 1B and 1C can be opened and closed by the first cam 91 and the second cam 92 which are fixed to the cam shaft 90*a*, so the effect of the reduction of the production cost is large.

Moreover, in the open/close valve 1 in the embodiment, the push coil spring 5 pushes the piston 3 to one side in the axial direction, and the shaft 6 is protruded to one side, so a relatively inexpensive push coil spring 5 is adopted. Due to act force of the push coil spring 5, the communication between the water-in port 21 and the water-out port 23 can be closed by the piston 3. On the other hand, in order to open the communication between the water-in port 21 and the water-out port 23, it is possible to adopt the cam 70 for pushing the shaft 6 to the other side while being against act force of the push coil spring 5. The cam 70 like this has the constitution which pushes the shaft 6 to the other side in order to open the communication between the water-in port 21 and the water-out port 23. So, the constitution becomes relatively simple, and the production cost of the open/close valve 1 can be reduced.

In the open/close valve 1 in the embodiment, the speed for opening and closing valve can be set voluntarily by the operation of the piston 3 by way of the cam 70 and the shaft 6. So, even if a large amount of water flows, a rapid closing of the valve can be prevented. As a result, the generation of water hammer is prevented, and a noise and the like can be suppressed.

Furthermore, in the open/close valve 1 in the embodiment, the valve can be opened satisfactorily by the operation of the small piston 3 when the pressure of water is low, so the pressure loss is hardly generated, and the open/close valve 1 doesn't necessarily become large. As a result, an excellent mountability of the open/close valve 1 on the tankless western-style flush toilet is exhibited.

Second Invention

Embodiments 1 to 6 which embody the second invention are explained hereinafter in conjunction with drawings 10 to 25.

Embodiment 1

Figure 10:
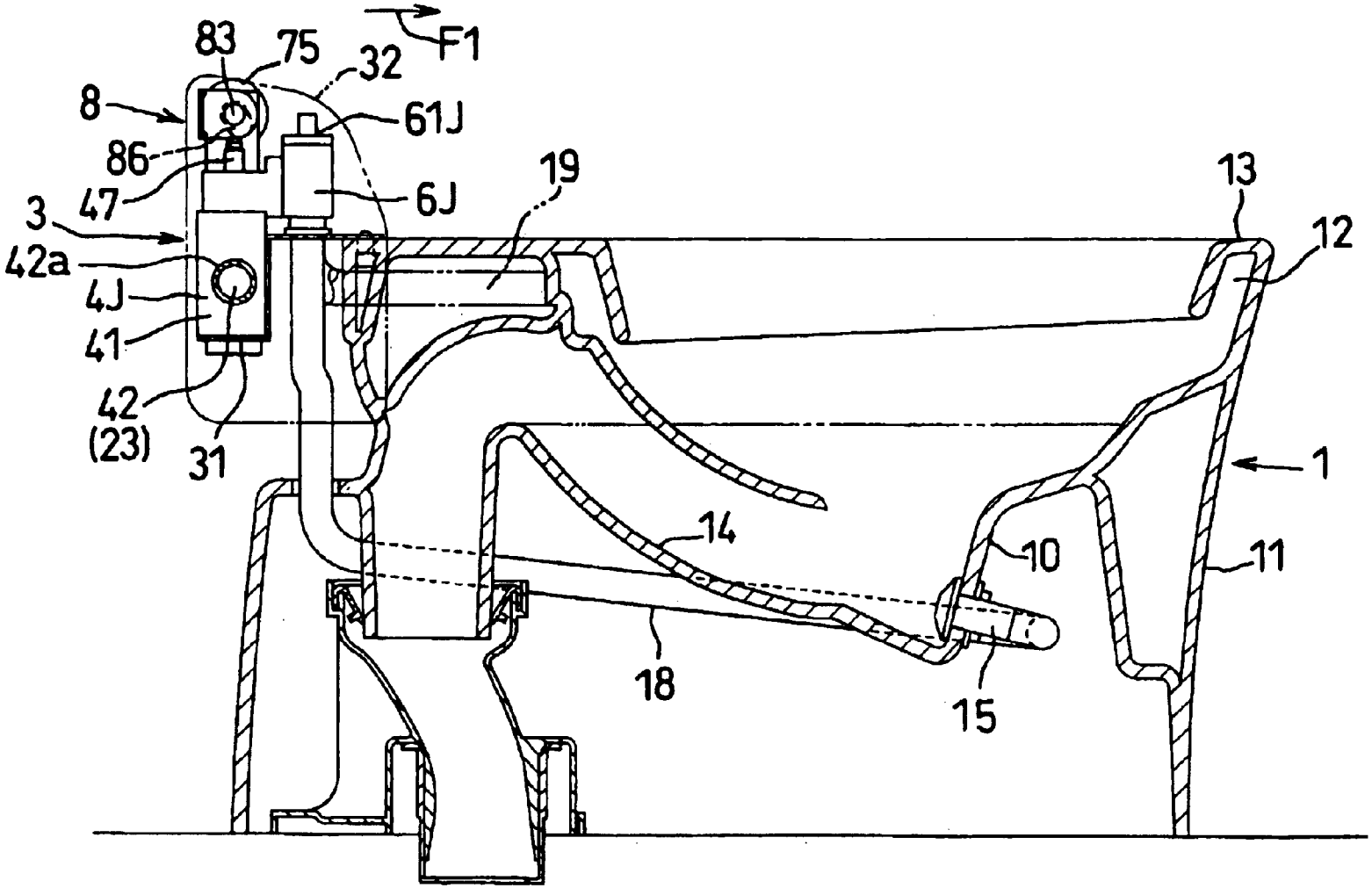
FIG. 10 is a cross-sectional view of an essential portion of a tankless western-style flush toilet according to an embodiment 1 in the second invention.

The embodiment 1 is explained in conjunction with drawings 10 to 17. As shown in FIG. 10, a toilet washing water supply device in the embodiment 1 is mounted in a western-style toilet body 1, and the toilet washing water supply device constitutes a tankless western-style flush toilet as a western-style flush toilet having no toilet washing tank.

Figure 12:
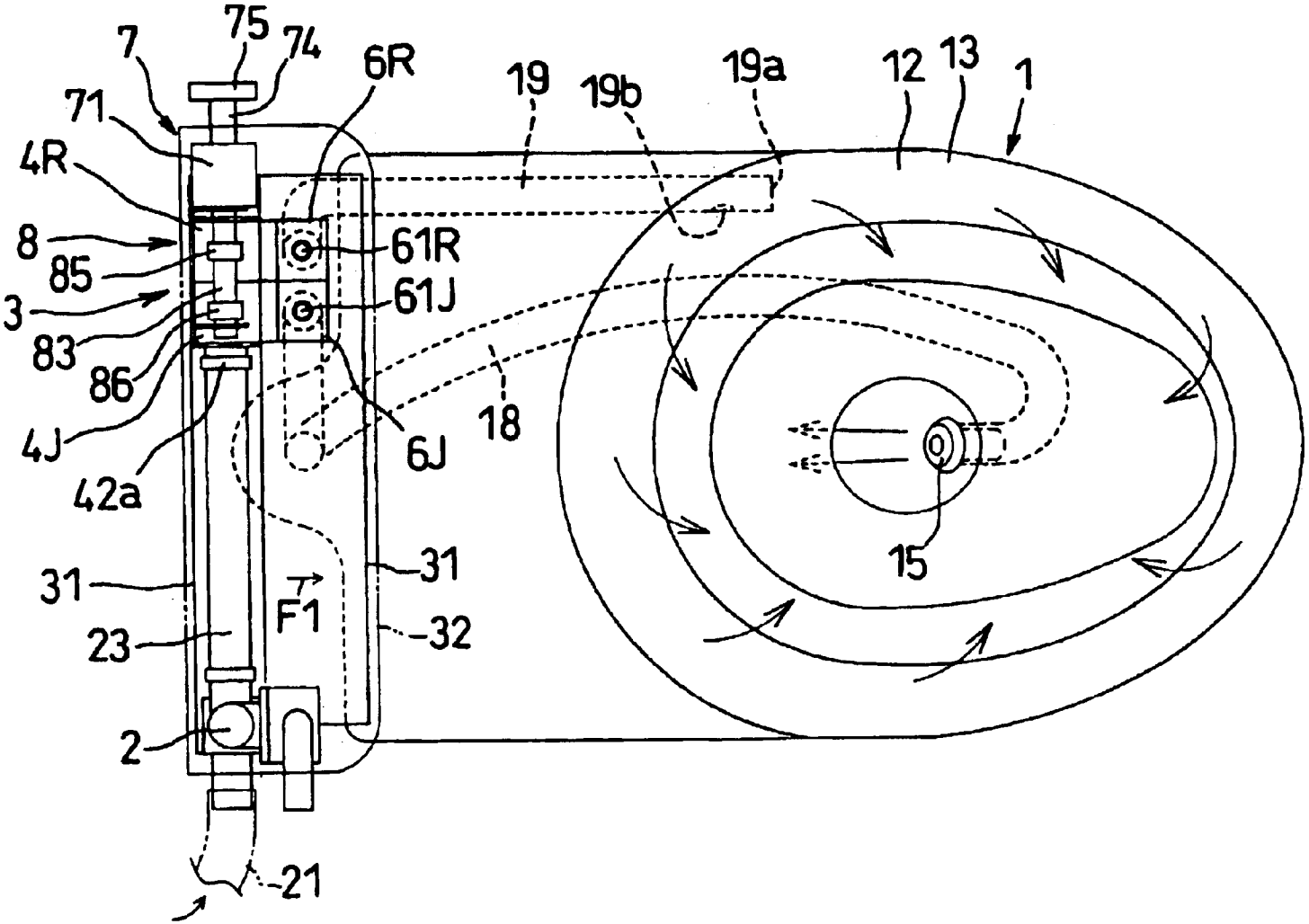
FIG. 12 is a plan view of an essential portion of a tankless western-style flush toilet according to an embodiment 1 in the second invention.

The western-style toilet body 1 includes a toilet bowl 11 having a bowl portion 10 which receives filth, a rim 13 having a rim channel 12 which encircles at an upper periphery of the bowl portion 10 and a trap portion 14 which is communicated with the bottom of the bowl portion 10 and which flows the filth out. At an inlet of the trap portion 14, a jet nozzle 15 is mounted. Furthermore, in the western-style toilet body 1, a jet conduit 18 for supplying water to the jet nozzle 15 and a rim conduit 19 for supplying water to the rim channel 12 are mounted. As shown in FIG. 12, the rim conduit 19 includes an opening 19*a* which opens toward a top end side and which is able to spout water clockwise, and an opening 19*b* which opens toward a side surface side and which is able to spout water counter-clockwise.

Figure 11:
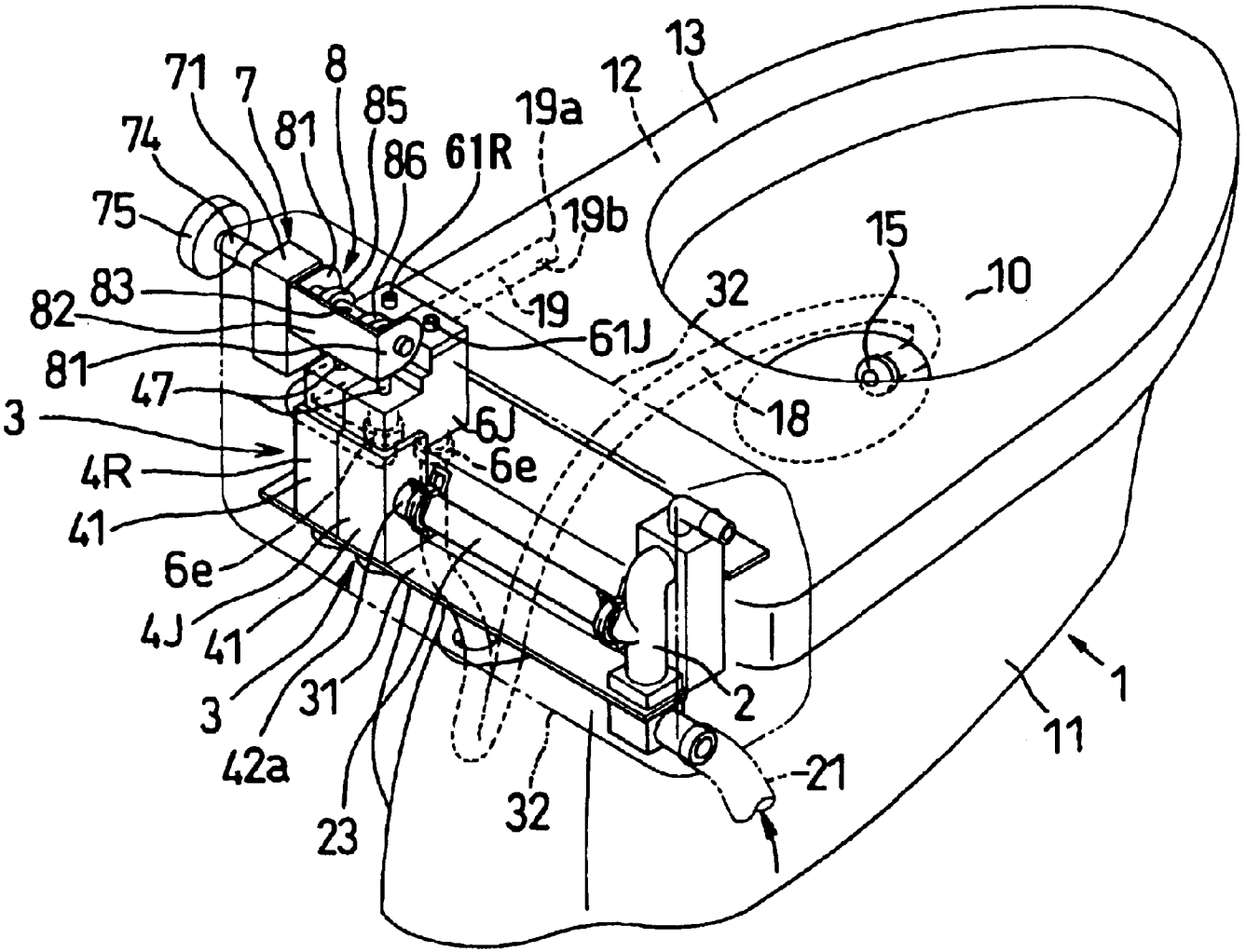
FIG. 11 is a perspective view of an essential portion of a tankless western-style flush toilet according to an embodiment 1 in the second invention.

As shown in FIGS. 11 and 12, a branch device 2 which is able to divide water into water for washing a toilet and water for other use is mounted at one side of a rear portion in the axial direction of the western-style toilet body 1. The branch device 2 is connected to a water supply source such as a city water service pipe and the like by way of a stop cock not shown in the drawing due to a flexible hose 21. The branch device 2 is communicated with a toilet washing water supply device (described as a water supply device hereinafter) 3 of the embodiment 1 by way of a water supply conduit 23, and water which is divided by the branch device 2 is supplied to the water supply device 3 by way of a water supply conduit 23. Furthermore, a toilet lid and a toilet seat are not shown in FIGS. 10 to 13.

Figure 13:
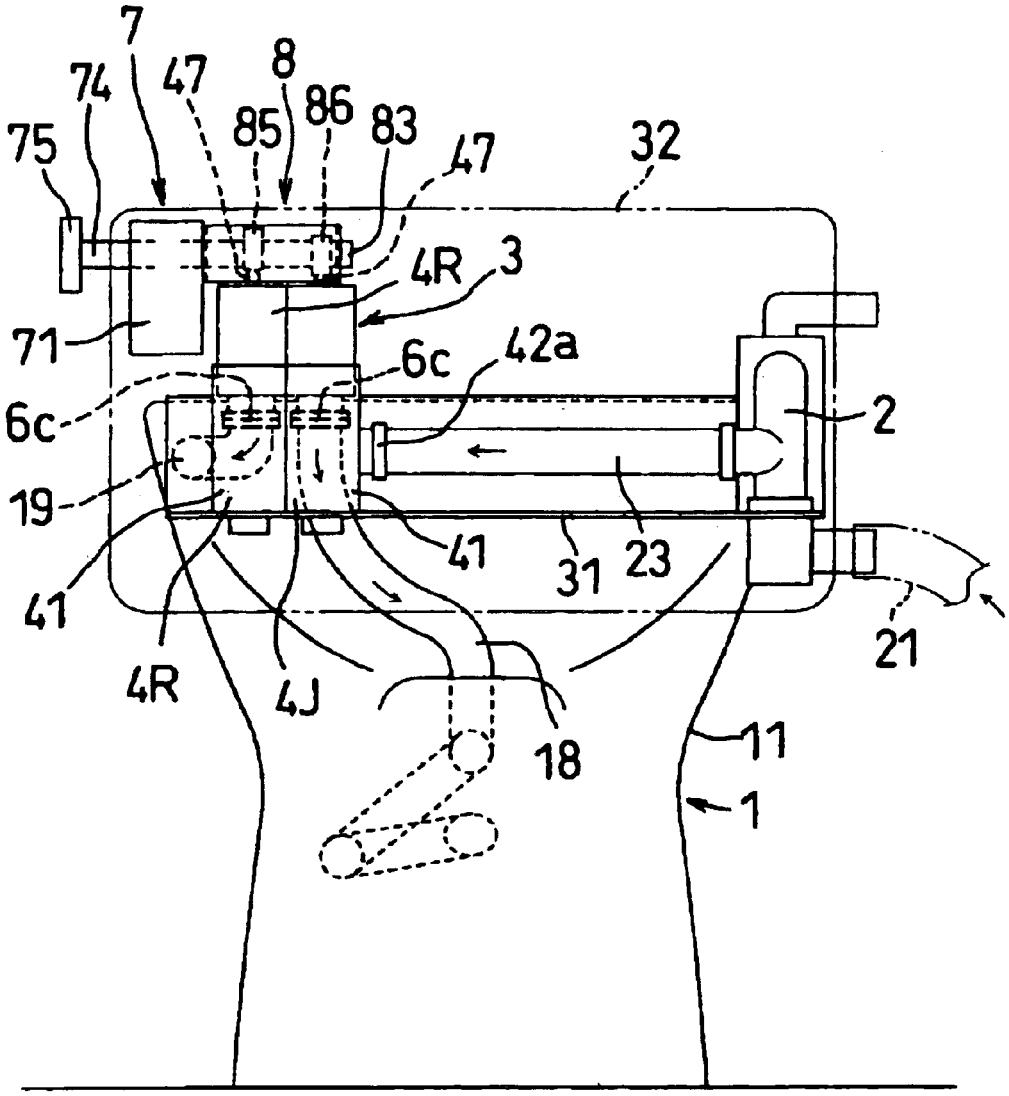
FIG. 13 is a back view of an essential portion of a tankless western-style flush toilet according to an embodiment 1 in the second invention.

Next, the water supply device 3 of the embodiment 1 is further explained. As shown in FIG. 11, the water supply device 3 is assembled to a base plate 31 which is held at the rear portion of the western-style toilet body 1 in such a manner that the water supply device 3 is positioned at the opposite side of the branch device 2, and the water supply device 3 is concealed by a cover 32. The water supply device 3 includes a rim open/close valve 4R for supplying water to the rim channel 12 by means of the rim conduit 19, a jet open/close valve 4J for supplying water to the jet nozzle 15 by means of the jet conduit 18 and a cam device 8 which is functioned as a common driving source for opening and closing the open/close valves 4R and 4J. As shown in FIGS. 11 to 13, two open/close valves 4R and 4J are positioned in such a manner that they are adjacent to each other in a vertical form.

Figure 14:
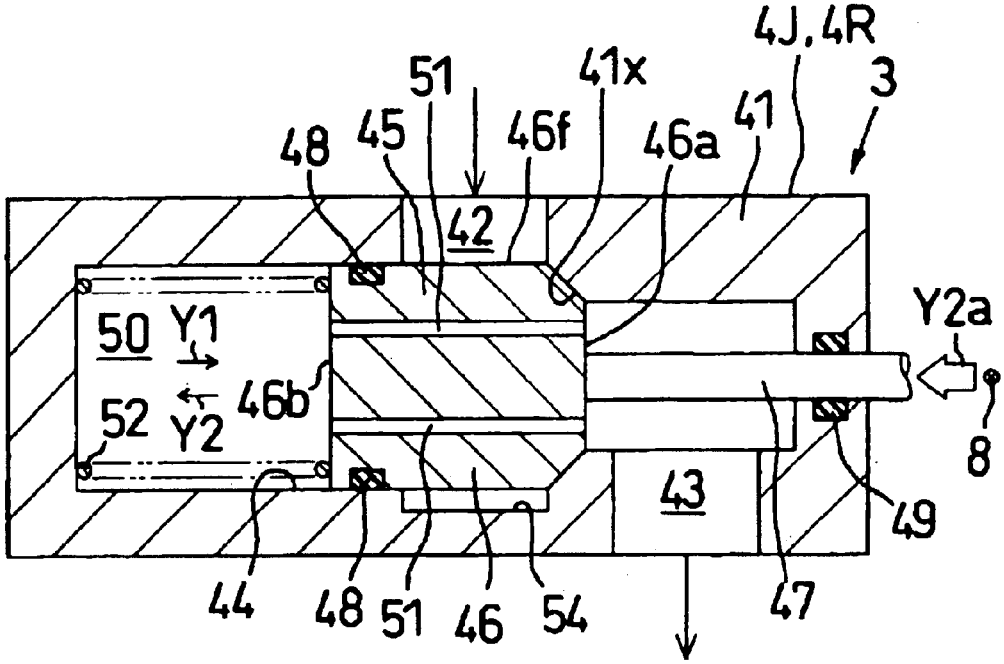
FIG. 14 is a cross-sectional view of an open/close valve which is in the closed condition according to an embodiment 1 in the second invention.
Figure 15:
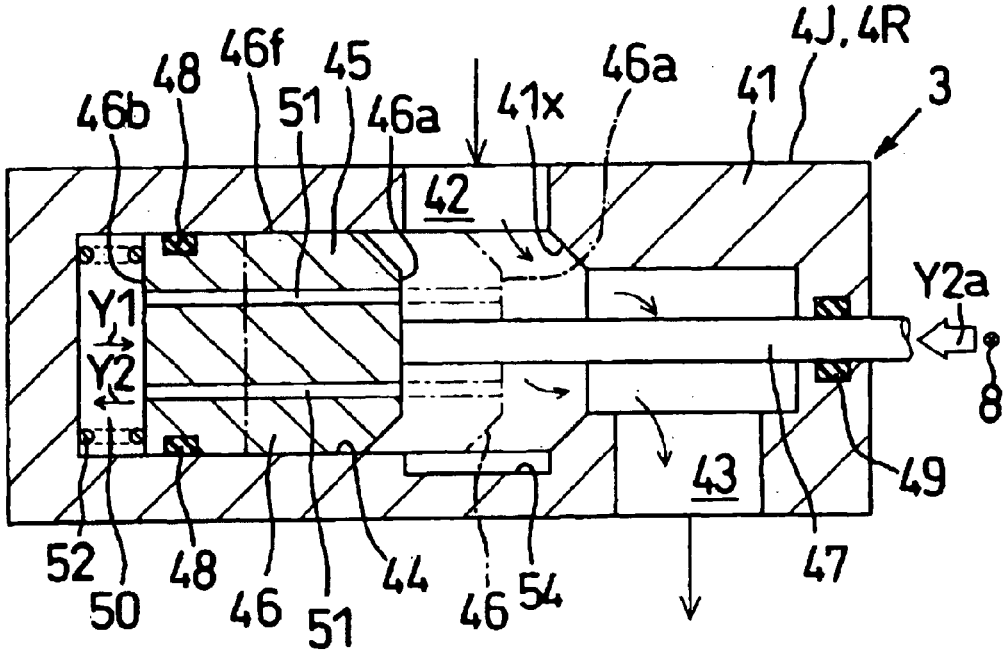
FIG. 15 is a cross-sectional view of an open/close valve which is in the open condition according to an embodiment 1 in the second invention.

An inner constitution of the jet open/close valve 4J is shown in FIGS. 14 and 15. In FIGS. 14 and 15, a left side of the drawing is a lower side, and a right side of the drawing is an upper side. The jet open/close valve 4J has a valve housing 41 which has a water-in port 42 for taking water in and a water-out port 43 for spouting water out, and a valve mechanism 45 which is mounted on the valve housing 41. In the inside of the valve housing 41, a piston room 44 which is communicated with the water-in port 42 and the water-out port 43 is formed. The valve mechanism 45 is constituted by a piston 46 which is slidably mounted on the piston room 44, and a shaft 47 which is coaxially fixed to one end surface (an upper end surface) of the piston 46 in such a manner that the shaft 47 is protruded upward from an upper end of the valve housing 41. In the valve housing 41, the water-in port 42 opens at a peripheral surface side of the piston 46, and the water-out port 43 opens while bending from an end surface side of one side of the piston 46 in the axial direction to a side surface side of the valve housing 41. At a ring groove at an outer peripheral portion of the piston 46, an O ring 48 is held, and a boundary area between the outer peripheral portion of the piston 46 and an inner wall surface of the valve housing 41 is sealed by the O ring 48. A boundary area between the shaft 47 and the valve housing 41 is sealed by an O ring 49.

In the piston room 44, a pressure offset room 50 is formed by the valve housing 41 and the other end surface of the piston 46. The pressure offset room 50 is communicated with the side of the water-out port 43 by way of plural communication holes 51 as communication passages which are formed in the piston 46. Each communication hole 51 communicates the side of one end surface 46*a* of the piston 46 with the side of the other end surface 46*b* of the piston 46 in the axial direction. In the pressure offset room 50, a push coil spring 52 as a force act means is coaxially arranged. The push coil spring 52 is disposed between the valve housing 41 and the other end surface 46*b* of the piston 46. The push coil spring 52 always pushes the piston 46 toward the direction of an arrow Y1, namely, upward to close the communication between the water-in port 42 and the water-out port 43.

As a fore mentioned, a top end portion of the shaft 47 is protruded from the valve housing 41 toward the direction of an arrow Y1, namely, upward. The top end portion of the shaft 47 can be pushed toward the direction of an arrow Y2*a*, namely, downward by the cam device 8. When the shaft 47 is pushed toward the direction of an arrow Y2*a* by the cam device 8, the piston 46 is interlocked with the shaft 47 to be slided in the same direction as that of the shaft 47. As a result, the piston 46 is detached from a seat face 41*x* to communicate the water-in port 42 with the water-out port 43.

An inner constitution of the rim open/close valve 4R is substantially the same as the inner constitution of the jet open/close valve 4J, so an explanation thereof is omitted. The water-in port 42 of the jet open/close valve 4J and the water-in port 42 of the rim open/close valve 4R are communicated with each other by way of a ring-shaped communication passage 54 which is formed between the valve housing 41 and an outer peripheral surface of the piston 46.

Figure 16:
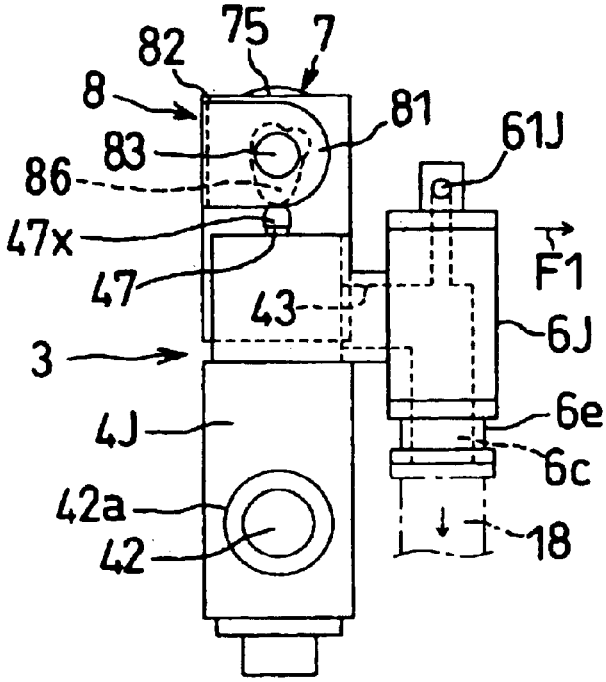
FIG. 16 is a side view of a toilet washing water supply device which uses a jet open/close valve and a cam device according to an embodiment 1 in the second invention.
Figure 17:
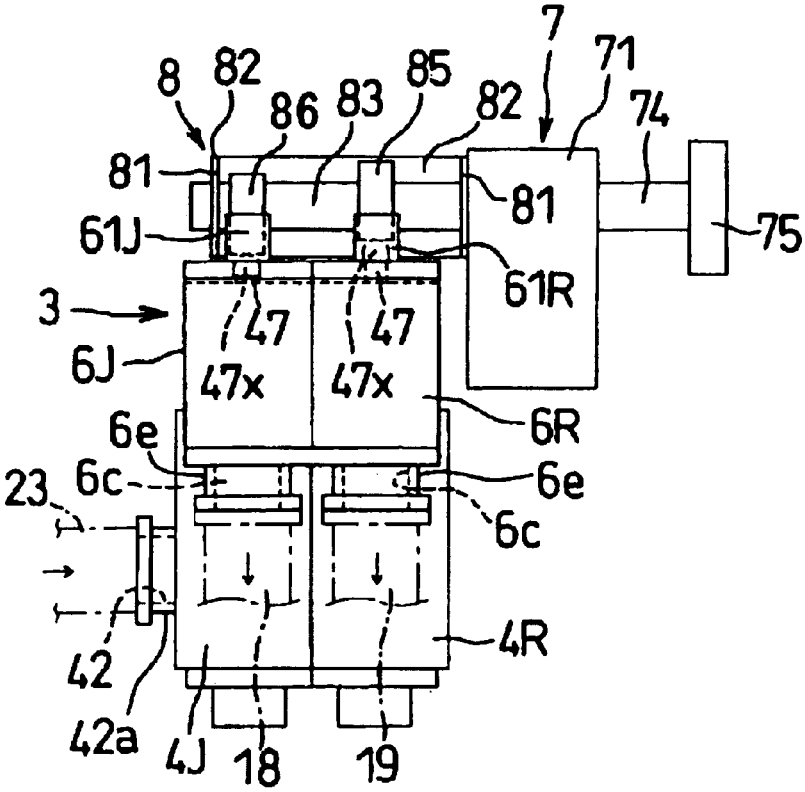
FIG. 17 is a front view of a toilet washing water supply device which uses a jet open/close valve, a rim open/close valve and a cam device according to an embodiment 1 in the second invention.
Figure 18:
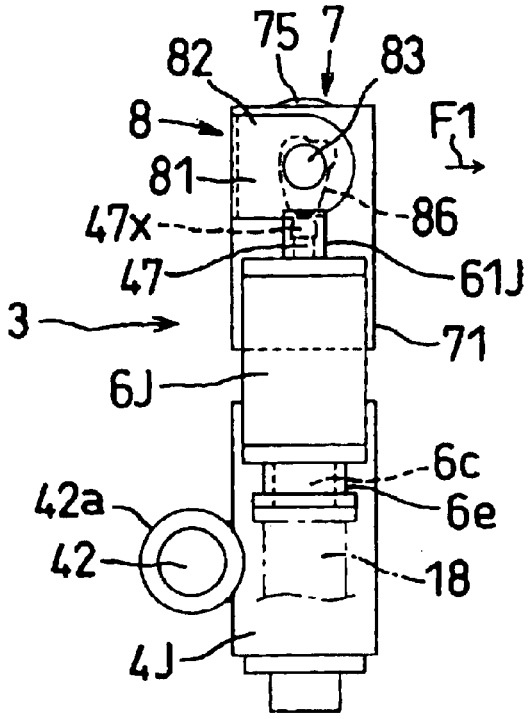
FIG. 18 is a side view of a toilet washing water supply device which uses a jet open/close valve and a cam device according to an embodiment 2 in the second invention.

As shown in FIGS. 16 and 17, at a top end (an upper end) of the shaft 47, a spherical portion 47*x* which ensures the smooth slidability with the cam is mounted. A flange 42*a* is formed at the water-in port 42 of the jet open/close valve 4J in such a manner that the flange 42*a* is protruded to a side surface side, and the flange 42*a* is connected to one end of the water supply conduit 23.

In the water supply device 3, a connecting member 6J is mounted on the jet open/close valve 4J in such a manner that the connecting member 6J is protruded toward the direction of an arrow F1, namely, toward a front portion of the toilet bowl 11. At an upper end portion of the connecting member 6J, a vacuum breaker 61J to be released for an air is integrally mounted. As shown in FIG. 16, the water-out port 43 of the jet open/close valve 4J is communicated with a water-out port 6*c* of the connecting member 6J and an air hole of the vacuum breaker 61J. At the water-out port 6*c* of the connecting member 6J, a flange 6*e* is formed in such a manner that the flange 6*e* is protruded downward, and the flange 6*e* is connected to the jet nozzle 15 by means of the jet conduit 18.

On the other hand, as shown in FIG. 17, a connecting member 6R is integrally mounted also on the rim open/close valve 4R, and a vacuum breaker 61R to be released for an air is integrally mounted at an upper end portion of the connecting member 6R. The water-out port 43 of the rim open/close valve 4R is communicated with a water-out port 6*c* of the connecting member 6R and an air hole of the vacuum breaker 61R. At the water-out port 6*c* of the connecting member 6R or the rim open/close valve 4R, a flange 6*e* is formed in such a manner that the flange 6*e* is protruded downward, and the flange 6*e* is connected to the rim channel 12 by means of the rim conduit 19.

As shown in FIG. 11, the cam device 8, which is a main element of the water supply device 3, is positioned upward from the open/close valves 4R and 4J. The cam device 8 is held at a bracket 82 having two mounting pieces 81 which are protruded forward, in other words, toward a front portion side of the toilet bowl 11. Namely, the cam device 8 includes a rotation axis 83 as a rotation body which is rotatably held at the mounting piece 81 in the horizontal condition, a first cam 85 and a second cam 86 which are mounted on the rotation axis 83 in such a manner that they are protruded in the axially right-angled direction. As shown in FIGS. 11 and 12, the rotation axis 83 is mounted in such a manner that the rotation axis 83 is extended along the width direction of the toilet bowl 11.

When the rotation axis 83 is rotated, the first cam 85 and the second cam 86 are rotated along the height direction of the toilet bowl 11. Due to this, a cam surface at an outer periphery of the first cam 85 is brought into contact with the shaft 47 (which corresponds to a follower) of the rim open/close valve 4R to move the shaft 47 downward. At the same time, a cam surface at an outer periphery of the second cam 86 is brought into contact with the shaft 47 (which corresponds to a follower) of the jet open/close valve 4J to move the shaft 47 downward.

As shown in FIGS. 11 to 13, a driving device 7 by which the cam device 8 is rotatingly driven is mounted on the water supply device 3. The driving device 7 is fixed to one mounting piece 81 of the bracket 82, and a motor 71 and a reduction gear which transmits rotation force of the motor 71 to the rotation axis 83 are contained in the driving device 7. As a result, the rotation axis 83 can be rotatingly driven by controlling a controller which is not shown in the drawing. Furthermore, a manual axis 74 which rotates the rotation axis 83 of the cam device 8 manually is mounted on the driving device 7 in such a manner that the manual axis 74 is positioned at the side of the western-style toilet body 1. The manual axis 74 has an operation handle 75, and they can be detached or folded with respect to the water supply device 3. When the user doesn't use the toilet, only if the manual axis 74 is detached or folded, it is possible to attempt the saving of spaces.

As shown in FIG. 11, the above open/close valves 4R and 4J, the motor 71 and the cam device 8 are mounted at a rear portion of the western-style toilet body 1 by means of a single common base plate 31.

In the tankless western-style flush toilet which is constituted as above, water is supplied to the water supply device 3 by way of a water supply source, the stop cock, the flexible hose 21, the branch device 2 and the water supply conduit 23. In the water supply device 3, as far as the user doesn't carry out the switch operation in order to wash the toilet bowl 11 of the western-style toilet body 1, both of the open/close valves 4J and 4R are closed. Namely, if being explained by FIGS. 14 and 15, the piston 46 is moved to one side in the axial direction, in other words, the direction of an arrow Y1, by act force of the push coil spring 52. Due to this, as shown in FIG. 14, the piston 46 is attached to the seat face 41*x* of the valve housing 41, and as a result, an outer peripheral surface of the piston 46 closes the water-in port 42. At the same time, one end surface 46*a* of the piston 46 closes the water-out port 43. Accordingly, the communication between the water-in port 42 and the water-out port 43 is closed, and water is not supplied to the western-style toilet body 1.

When the toilet bowl 11 is washed, in accordance with the switch operation of the user, the motor 71 of the driving device 7 is driven by a signal of the controller, and the rotation axis 83 is rotatingly driven. Due to this, a cam surface of the first cam 85 pushes the shaft 47 of the rim open/close valve 4R downward to open the rim open/close valve 4R. If being explained by FIGS. 14 and 15, the push coil spring 52 is elastically contracted, and the piston 46 is moved to the other direction of the axial direction, namely, toward the direction of an arrow Y2. Accordingly, as shown in FIG. 15, the piston 46 is detached from the seat face 41*x* of the valve housing 41 to open the communication between the water-in port 42 and the water-out port 43. As a result, the water supply device 3 supplies water to the rim channel 12 by way of the rim conduit 19, and an inner wall surface of the bowl portion 10 is washed.

In accordance with the driving of the cam device 8, the cam surface of the first cam 85 doesn't come to push the shaft 47 of the rim open/close valve 4R downward, and the rim open/close valve 4R is closed. After that, the cam surface of the second cam 86 pushes the shaft 47 of the jet open/close valve 4J downward to open the jet open/close valve 4J. Due to this, the water supply device 3 supplies water to the jet nozzle 15 by way of the jet conduit 18 to generate a siphon effect in the trap portion 14 forcibly.

Next, in accordance with the driving of the cam device 8, the cam surface of the second cam 86 doesn't come to push the shaft 47 of the jet open/close valve 4J downward, and the jet open/close valve 4J is closed. After that, the cam surface of the first cam 85 again pushes the shaft 47 of the rim open/close valve 4R downward to open the rim open/close valve 4R again. Due to this, the water supply device 3 supplies water to the rim channel 12 by way of the rim conduit 19 to seal the bowl portion 10 with water.

Hereinafter, if being explained by FIGS. 14 and 15, the communication between the water-in port 42 and the water-out port 43 is opened and closed by the piston 46, so the piston 46 receives the pressure on the other side by means of water in the water-out port 43. At this time, the piston 46 having no flexibility is not bent toward the side of the open valve due to the pressure on the other side. However, if a space for the sliding of the piston 46 is merely mounted, the slidability of the piston 46 in the axial direction is hindered by the pressure on the other side like this. In this respect, in the open/close valves 4J and 4R, the pressure offset room 50 is formed at the other side of the piston 46, and one side of the piston 46 is communicated with the pressure offset room 50 by plural communication holes 51. So, water existed in one side of the piston 46 from the water-out port 43 is moved to the pressure offset room 50 by way of the communication hole 51 to attempt to keep the balance between the pressure of water in the pressure offset room 50 and the pressure of water in one side of the piston 46. As a result, the difference of the pressure between them can be canceled or decreased. Due to this, the slidability of the piston 46 in the axial direction can be ensured.

Furthermore, the communication hole 51 is formed in the piston 46, so each communication hole 51 is easily mounted in the axial direction. Since the communication hole 51 is mounted in the piston 46 in the axial direction, water which is moved in the communication hole 51 doesn't receive the resistance when the piston 46 is slided, and the slidability of the piston 46 is improved. Moreover, the water-in port 42 of the valve housing 41 opens at a peripheral surface side of the piston 46, and the water-out port 43 of the valve housing 41 opens at an end surface side of one side of the piston 46 in the axial direction, so the piston 46 doesn't receive the pressure on the other side due to water in the water-in port 42. Even if the pressure of water in the water-in port 42 is excessively high or excessively low due to circumstances or the like under which the open/close valve is used, the slidability of the piston 46 is not changed.

In the embodiment 1, in order to open the valve of the piston 46 as the valve mechanism 45, the cam device 8 is used. The first cam 85 of the cam device 8 is mechanically engaged with the shaft 47 of the rim open/close valve 4R, and the second cam 86 is mechanically engaged with the shaft 47 of the jet open/close valve 4J. Due to this, driving force which is caused by the first cam 85 and the second cam 86 is transmitted to the shaft 47 mechanically and directly, and the operation stability is ensured.

Moreover, in the embodiment 1, the cam device 8 for opening and closing the open/close valves 4J and 4R is adopted, so it is unnecessary to adopt an electromagnetic valve which has a conventional solenoid and which is expensive, and the production cost of the water supply device 3 can be reduced.

Especially, in the tankless western-style flush toilet shown in the embodiment, a pair of open/close valves 4J and 4R is used for supplying water to the jet nozzle 15 and the rim channel 12, so the effect of the reduction of the production cost is large. Furthermore, the open/close valves 4J and 4R can be opened and closed by the first cam 85 and the second cam 86 which are fixed to the rotation axis 83, and the effect of the reduction of the production cost is large.

Furthermore, the speed for opening and closing valve of the valve mechanism 45 can be set voluntarily by selecting a profile of the first cam 85 and the second cam 86, so it is possible to suppress a rapid opening or a rapid closing of the valve, and to suppress a noise, a water hammer phenomenon and the like.

In addition, when the valve is opened or closed, it is possible to stop driving the cam device 8 in the halfway by means of the switch operation in case of driving the cam device 8 by the motor 71, and by means of the manual operation in case of driving the cam device 8 by the manual axis 74. In the latter case, an amount for opening and closing valve of the valve mechanism 45 can be continuously maintained at an intermediate stage. Therefore, it is possible to continue to flow a small amount of water to the western-style toilet body 1. With such a constitution, this is advantageous to prevent the freezing of water during the cold season.

Moreover, in the open/close valves 4R and 4J, the push coil spring 52 pushes the piston 46 to one side in the axial direction, and the shaft 47 is protruded to one side, so a relatively inexpensive push coil spring 52 is adopted. Due to act force of the push coil spring 52, the communication between the water-in port 42 and the water-out port 43 can be closed by the piston 46. On the other hand, in order to open the communication between the water-in port 42 and the water-out port 43, it is possible to adopt the cam device 8 for pushing the shaft 47 to the other side while being against act force of the push coil spring 52. The cam device 8 like this has the constitution which pushes the shaft 47 in order to open the communication between the water-in port 42 and the water-out port 43. So, the constitution becomes relatively simple, and the production cost can be reduced.

Therefore, this contributes to the stabilization of the operation of the water supply device 3 and the valve mechanism 45. At the same time, it is possible to prevent the freezing of water during the cold season and the like, and to achieve a relatively low cost.

Embodiment 2

The embodiment 2 is explained in conjunction with drawings 18 to 19. The embodiment 2 has basically the same constitution as that of the embodiment 1, and it exhibits the same operations and effects as those of the embodiment 1. In the embodiment 2, the common portions are labeled as the common symbols. Hereinafter, the portions which are different from the embodiment 1 are mainly explained.

Figure 19:
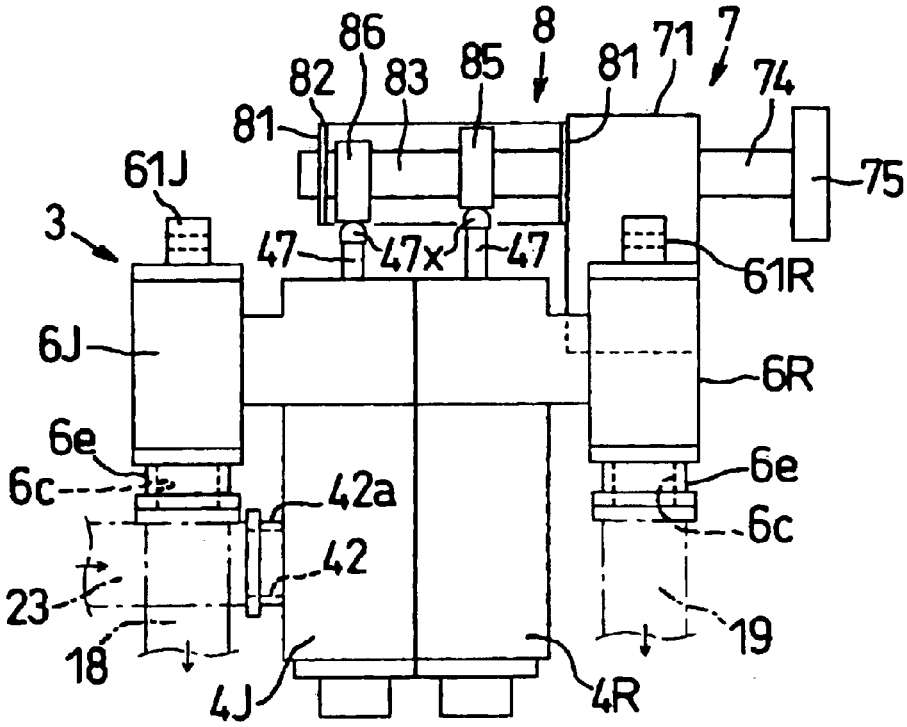
FIG. 19 is a front view of a toilet washing water supply device which uses a jet open/close valve, a rim open/close valve and a cam device according to an embodiment 2 in the second invention.
Figure 20:
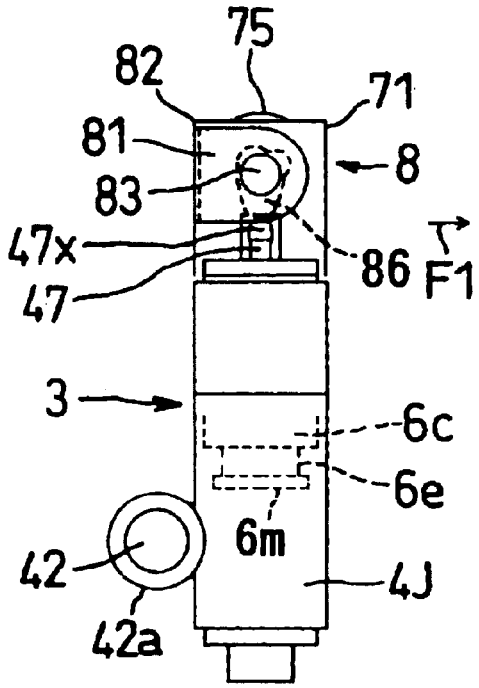
FIG. 20 is a side view of a toilet washing water supply device which uses a jet open/close valve and a cam device according to an embodiment 3 in the second invention.
Figure 21:
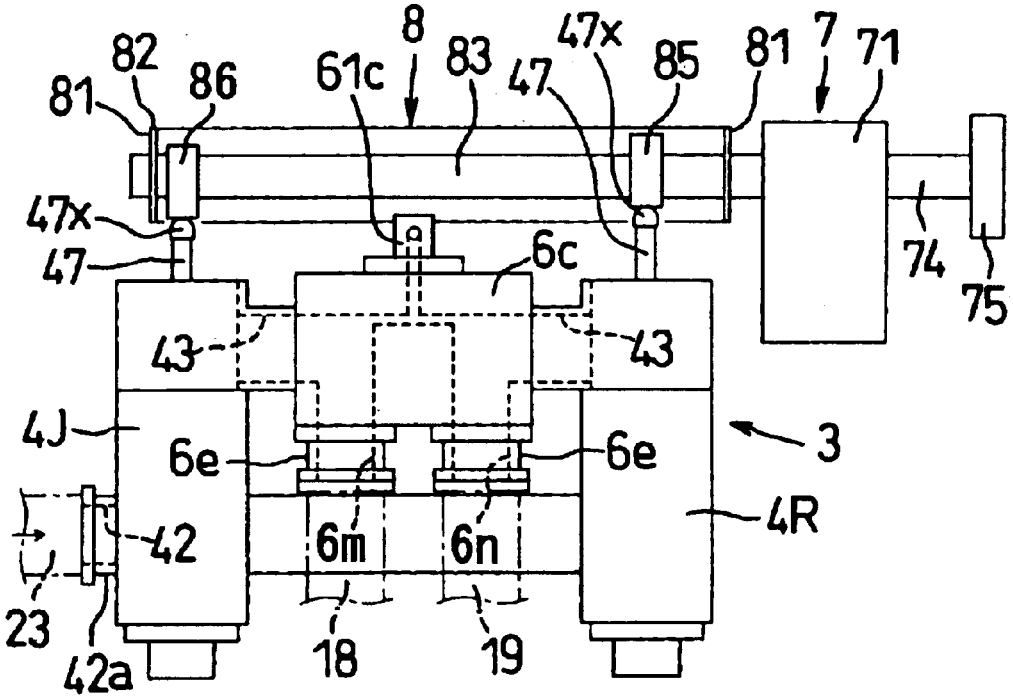
FIG. 21 is a front view of a toilet washing water supply device which uses a jet open/close valve, a rim open/close valve and a cam device according to an embodiment 3 in the second invention.

In the embodiment 2, a connecting member 6J of a jet open/close valve 4J and a connecting member 6R of a rim open/close valve 4R are protruded toward the side of a valve housing 41 of the jet open/close valve 4J and a valve housing 41 of the rim open/close valve 4R, namely, toward the side of a toilet bowl 11 in such a manner that the connecting member 6J and the connecting member 6R are separated from each other by the predetermined distance. In other words, as shown in FIG. 19, a first cam 85, a second cam 86 and the open/close valves 4J and 4R are positioned between the connecting member 6J and the connecting member 6R. This considers a mounting space, piping circumstances and the like.

Embodiment 3

The embodiment 3 is explained in conjunction with drawings 20 to 21. The embodiment 3 has basically the same constitution as that of the embodiment 1, and it exhibits the same operations and effects as those of the embodiment 1. In the embodiment 3, the common portions are labeled as the common symbols. Hereinafter, the portions which are different from the embodiment 1 are mainly explained.

In the embodiment 1, the connecting member 6J of the jet open/close valve 4J and the connecting member 6R of the rim open/close valve 4R are separated from each other. But, in the embodiment 3, a connecting member 6C which is common to a jet open/close valve 4J and a rim open/close valve 4R is mounted therebetween.

The common connecting member 6C has a water-out port 6*m*, 6*n* which is communicated with a common vacuum breaker 61C which is communicated with an air. The water-out port 6*m* is communicated with a water-out port 43 of the jet open/close valve 4J, and at the same time, the water-out port 6*n* is communicated with a water-out port 43 of the rim open/close valve 4R.

In the embodiment 3, the common connecting member 6C is mounted between a first cam 85 and a second cam 86 in the axial length direction of a rotation axis 83. So, the axial length of the rotation axis 83 becomes long, and a clearance between the first cam 85 and the second cam 86 increases.

Embodiment 4

The embodiment 4 is explained in conjunction with drawing 22. The embodiment 4 has basically the same constitution as that of the embodiment 1, and it exhibits the same operations and effects as those of the embodiment 1. In the embodiment 4, the common portions are labeled as the common symbols. Hereinafter, the portions which are different from the embodiment 1 are mainly explained.

A rim open/close valve 4R and a jet open/close valve 4J are mounted on a base plate 31 in such a manner that they are opposed to each other, and also that they are positioned up and down. Furthermore, in the base plate 31, a driving device 7D is attached to the side of the rim open/close valve 4R.

A cam device 8D includes a rotation axis 83D which is held at the base plate 31, a gear 87 as a rotation body which is integrally mounted on the rotation axis 83D and which is rotated in the horizontal direction, a first cam 85D which is projectingly mounted at an upper surface portion of the gear 87 and a second cam 86D which is projectingly mounted at a lower surface portion of the gear 87. The first cam 85D and the second cam 86D have a cam surface which is slanted along the peripheral direction of the gear 87.

The rotation axis 83D is a vertical form, and it is rotatably supported by a bearing 90*a*, 90*b* which is fixed to the base plate 31. The first cam 85D is engaged with a sliding cap 47*s* which covers a shaft 47 of the rim open/close valve 4R. The second cam 86D is engaged with a sliding cap 47*s* which covers a shaft 47 of the jet open/close valve 4J. The sliding cap 47*s* is formed of an excellent wear-resistant material, and it has an outer surface in the spherical surface condition in order to decrease the frictional resistance.

The driving device 7D includes a motor 71 which is attached to the base plate 31 and which has a downward motor axis 72, a driving axis 77 which is rotatably held at a bearing 90*e*, 90*f* attached to the base plate 31 and which is engaged with the motor axis 72 and a driving gear 78 which is held at the driving axis 77 and which is rotatable along the horizontal direction. The driving gear 78 and the gear 87 are engaged with each other.

When the toilet bowl 11 is washed, in the same manner as the above, the motor 71 of the driving device 7D is driven in accordance with the switch operation of the user. Then, the motor axis 72, the driving axis 77 and the driving gear 78 are rotated. Due to this, in the reverse direction of the driving gear 78, the gear 87 is rotated around an axis core P4 of the gear 87 along the horizontal direction, and the cam surface of the first cam 85D pushes the shaft 47 of the rim open/close valve 4R upward, namely, toward the direction of an arrow Y3. As a result, the rim open/close valve 4R is opened. If being explained by FIGS. 14 and 15, the push coil spring 52 is elastically contracted, and the piston 46 is detached from the seat face 41*x*, and the communication between the water-in port 42 and the water-out port 43 is opened. Accordingly, as above-mentioned, water is supplied to the rim channel 12 by way of the rim conduit 19, and an inner wall surface of the bowl portion 10 is washed.

When the cam surface of the first cam 85D doesn't come to push the shaft 47 of the rim open/close valve 4R toward the direction of an arrow Y3, the rim open/close valve 4R is closed. After that, the cam surface of the second cam 86D pushes the shaft 47 of the jet open/close valve 4J toward the direction of an arrow Y4, namely, downward, and the jet open/close valve 4J is opened. Accordingly, in the same manner as the above, water is suppled to the jet nozzle 15 by way of the jet conduit 18 to generate a siphon effect in the trap portion 14 forcibly.

Next, the cam surface of the second cam 86D doesn't come to push the shaft 47 of the jet open/close valve 4J toward the direction of an arrow Y4, and the jet open/close valve 4J is closed, and after that, the cam surface of the first cam 85D again pushes the shaft 47 of the rim open/close valve 4R toward the direction of an arrow Y3, and the rim open/close valve 4R is again opened. Accordingly, water is again supplied to the rim channel 12 by way of the rim conduit 19, and the bowl portion 10 is sealed with water.

Figure 22:
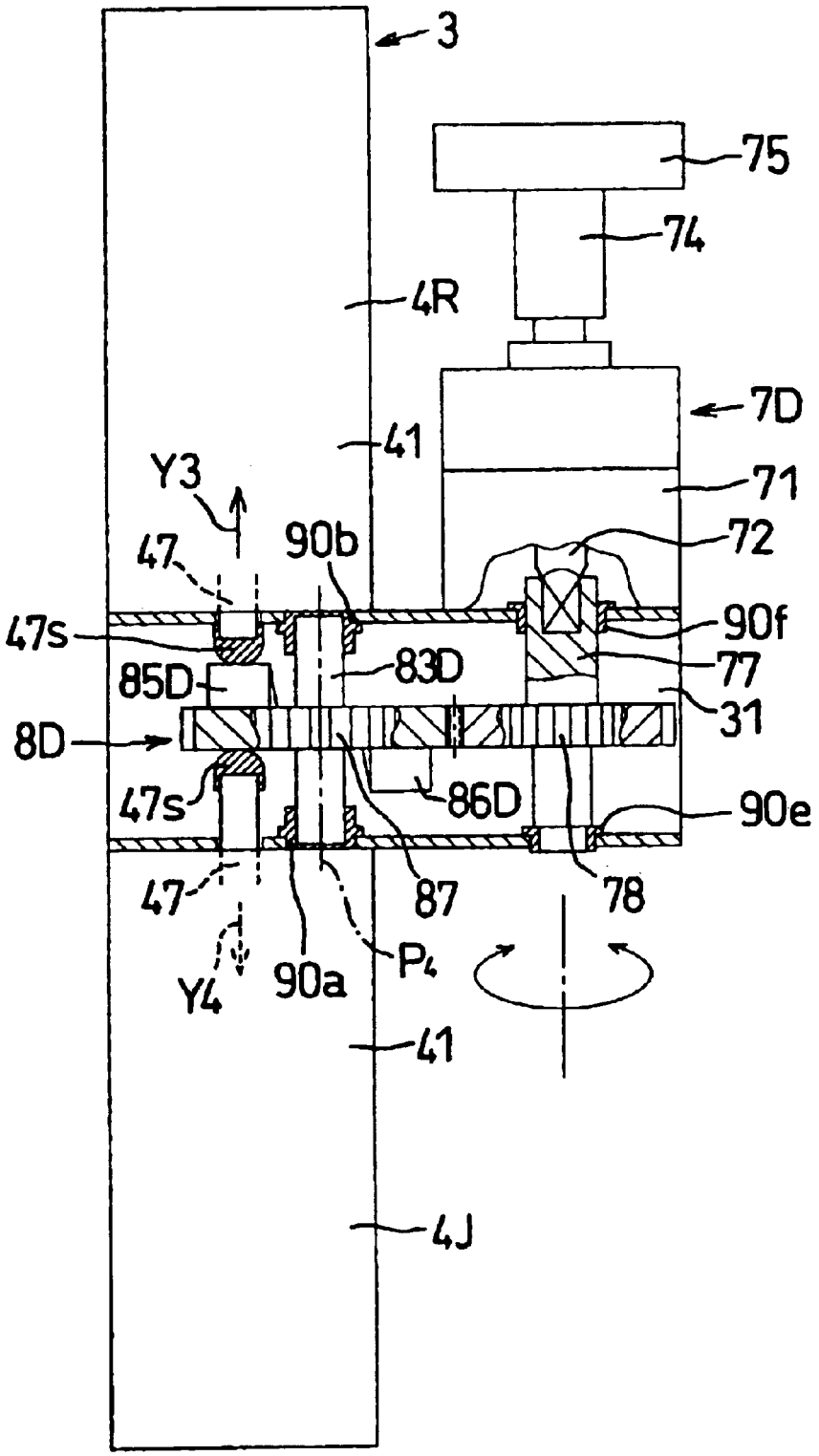
FIG. 22 is a front view with a part in cross section of a toilet washing water supply device which uses a jet open/close valve, a rim open/close valve and a cam device according to an embodiment 4 in the second invention.
Figure 23:
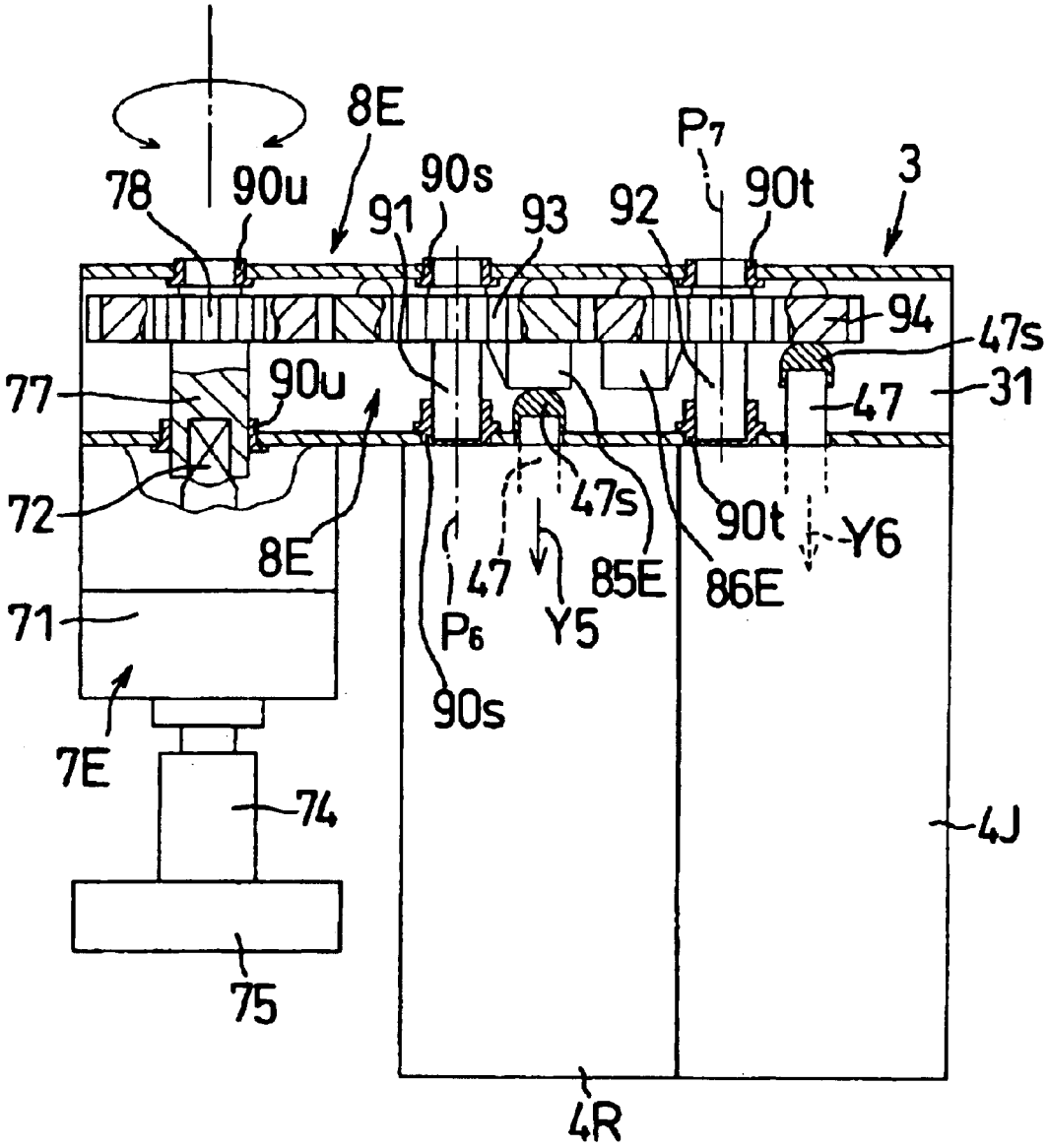
FIG. 23 is a front view with a part in cross section of a toilet washing water supply device which uses a jet open/close valve, a rim open/close valve and a cam device according to an embodiment 5 in the second invention.

In the embodiment 4, as shown in FIG. 22, the jet open/close valve 4J is positioned at a lower side, and the rim open/close valve 4R is positioned at an upper side. Reversely, it is possible that the jet open/close valve 4J is positioned at an upper side, and the rim open/close valve 4R is positioned at a lower side.

In the embodiment 4, in consideration of circumstances such as a mounting space and the like, a vertical-type rim open/close valve 4R and a vertical-type jet open/close valve 4J are faced to each other in such a manner that they are confronted with each other, and the rotation axis 83D, the driving axis 77 and the shaft 47 are positioned almost in parallel and in a vertical form. Therefore, it is possible to save a mounting space in the width direction of the open/close valves 4J and 4R.

Embodiment 5

The embodiment 5 is explained in conjunction with drawing 23. The embodiment 5 has basically the same constitution as that of the embodiment 4, and it exhibits the same operations and effects as those of the embodiment 4. In the embodiment 5, the common portions are labeled as the common symbols. Hereinafter, the portions which are different from the embodiment 4 are mainly explained.

To a lower surface portion of a base plate 31, a jet open/close valve 4J, a rim open/close valve 4R and a motor 71 of a driving device 7E are attached in the parallel condition. A cam device 8E includes a vertical-type first rotation axis 91 which is rotatably held at a bearing 90*s* of the base plate 31, a vertical-type second rotation axis 92 which is held at a bearing 90*t* of the base plate 31, a first gear 93 as a rotation body which is integrally mounted on the first rotation axis 91 and which is rotated around an axis core along the horizontal direction, a first cam 85E which is protruded to a lower surface portion of the first gear 93, a second gear 94 as a rotation body which is integrally mounted on the second rotation axis 92 and which is rotated around an axis core along the horizontal direction and at the same time which is engaged with the first gear 93 and a second cam 86E which is protruded to a lower surface portion of the second gear 94. The first cam 85E and the second cam 86E have a slant surface.

The driving device 7E includes a motor 71 which is attached to the lower surface portion of the base plate 31 and which has an upward motor axis 72, a vertical-type driving axis 77 which is rotatably held at a bearing 90*u* mounted on the base plate 31 and which is engaged with the motor axis 72 and a driving gear 78 which is held at the driving axis 77 and which is engaged with the first gear 93 to be rotatable horizontally.

When the toilet bowl 11 is washed, in the same manner as the above, the motor 71 of the driving device 7E is driven in accordance with the switch operation of the user. Then, the motor axis 72 and the driving axis 77 are rotated integrally, and the driving gear 78 is rotated. Due to this, in the reverse direction of the driving gear 78, the first gear 93 is rotated around an axis core P6 of the first gear 93 in the horizontal direction. At the same time, in the reverse direction of the first gear 93, the second gear 94 is rotated around an axis core P7 of the second gear 94 in the horizontal direction.

Due to the rotation of the first gear 93, a cam surface of the first cam 85E pushes a shaft 47 of the rim open/close valve 4R toward the direction of an arrow Y5, namely, downward to open the rim open/close valve 4R. If being explained by FIGS. 14 and 15, the push coil spring 52 is elastically contracted, and the piston 46 is detached from the seat face 41*x*, and the communication between the water-in port 42 and the water-out port 43 is opened. Accordingly, in the same manner as the above, water is supplied to the rim channel 12 by way of the rim conduit 19, and an inner wall surface of the bowl portion 10 is washed.

In accordance with the driving of the cam device 8E of the embodiment 5, the cam surface of the first cam 85E doesn't come to push the shaft 47 of the rim open/close valve 4R toward the direction of an arrow Y5, namely, downward, and the rim open/close valve 4R is closed. After that, a cam surface of the second cam 86E of the second gear 94 pushes the shaft 47 of the jet open/close valve 4J toward the direction of an arrow Y6, namely, downward, and the jet open/close valve 4J is opened. Accordingly, water is supplied to the jet nozzle 15 by way of the jet conduit 18 to generate a siphon effect in the trap portion 14 forcibly.

Next, in accordance with the driving of the cam device 8E of the embodiment 5, the cam surface of the second cam 86E doesn't come to push the shaft 47 of the jet open/close valve 4J toward the direction of an arrow Y6, and the jet open/close valve 4J is closed, and after that, the cam surface of the first cam 85E again pushes the shaft 47 of the rim open/close valve 4R toward the direction of an arrow Y5, and the rim open/close valve 4R is again opened. Accordingly, water is again supplied to the rim channel 12 by way of the rim conduit 19, and the bowl portion 10 is sealed with water.

In the cam device 8E of the embodiment 5, the first cam 85E is formed at the lower surface portion of the first gear 93, and at the same time, the second cam 86E is formed at the lower surface portion of the second gear 94. So, even in the long-term use, foreign materials such as dust or water can be prevented from being adhered to the first cam 85E and the second cam 86E, and the smooth operation of the first cam 85E and the second cam 86E can be ensured.

In the embodiment 5, in consideration of circumstances such as a mounting space and the like, a vertical-type rim open/close valve 4R and a vertical-type jet open/close valve 4J are mounted in parallel in such a manner that they are adjacent to each other.

Embodiment 6

The embodiment 6 is explained in conjunction with drawings 24 to 25. The embodiment 6 has basically the same constitution as that of the embodiment 5, and it exhibits the same operations and effects as those of the embodiment 5. In the embodiment 6, the common portions are labeled as the common symbols. Hereinafter, the portions which are different from the embodiment 5 are mainly explained.

Figure 25:
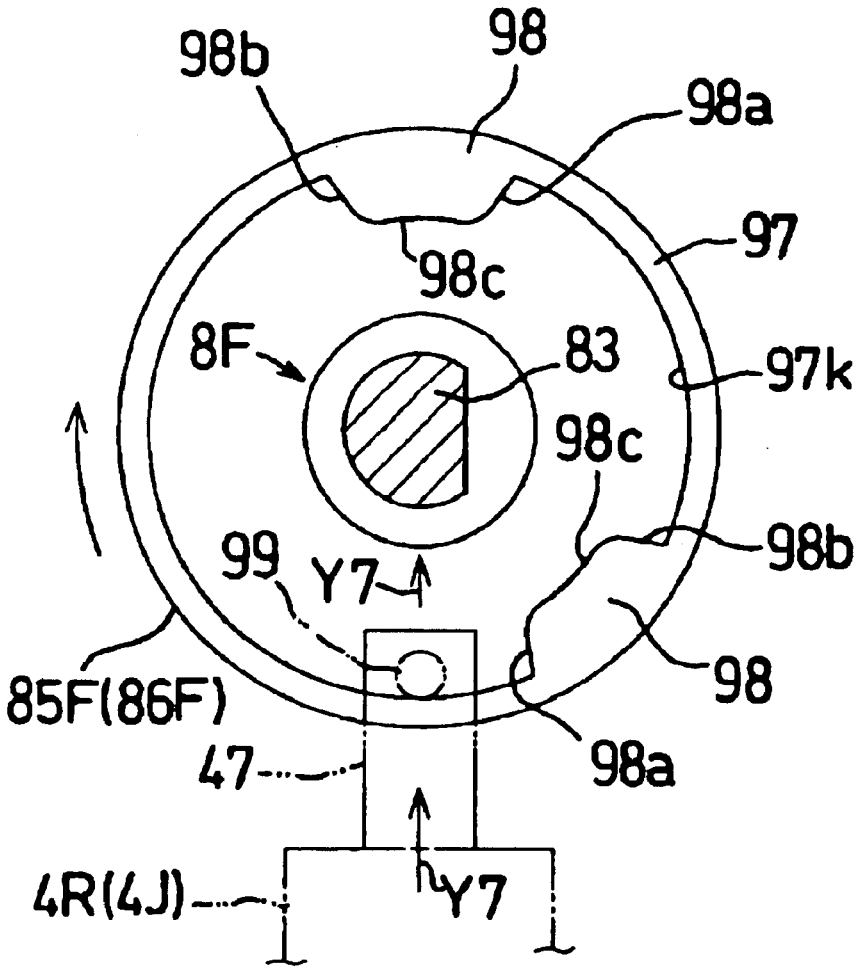
FIG. 25 is a side view of a cam device according to an embodiment 6 in the second invention.

A cam device 8F is attached to a bracket 82 having attachment pieces 81 which are opposed to each other, and the cam device 8F includes a rotation axis 83 which is erected along the horizontal direction of the attachment pieces 81, a first cam 85F and a second cam 86F which are held to the rotation axis 83 integrally and coaxially. As shown in FIG. 25, the first cam 85F has a ring wall portion 97 which encircles in the peripheral direction and plural cam portions 98 which are mounted on an inner peripheral surface of the ring wall portion 97 in such a manner that they are protruded inwardly. The cam portion 98 has slant surfaces 98*a*, 98*b* which are against to each other in the peripheral direction and a connecting surface 98*c* by which the slant surface 98*a* and the slant surface 98*b* are connected to each other.

The open/close valves 4R and 4J of the embodiment 6 show the form in which a shaft 47 is pulled to open the valve. At an upper end portion of the shaft 47 which is mounted on the open/close valves 4R and 4J, a pin-shaped stopper 99 which forms a cross-sectional circular shape is mounted.

When the first cam 85F is rotated in the peripheral direction by rotating the rotation axis 83 of the cam device 8F, the stopper 99 and the shaft 47 are pulled toward the direction of an arrow Y7, namely, upward, due to the slant surface 98*a* of the cam portion 98. Furthermore, the stopper 99 and the shaft 47 is continued to be pulled upward by the connecting surface 98*c* of the cam portion 98. Moreover, when the first cam 85F is rotated, the stopper 99 is moved down along the slant surface 98*b* due to a spring which pushes the shaft 47 or gravity. After that, the stopper 99 is relatively moved along an inner peripheral surface 97*k* of the ring wall portion 97. A peripheral length of the connecting surface 98*c* is an area where the stopper 99 and the shaft 47 are lifted to open the open/close valve 4R, so the peripheral length can be set properly.

The above explanation relates to a cam function of the first cam 85F which opens and closes the open/close valve 4R. However, the second cam 86F exhibits the same cam function as that of the first cam 85F, and it opens and closes the open/close valve 4J.

Figure 24:
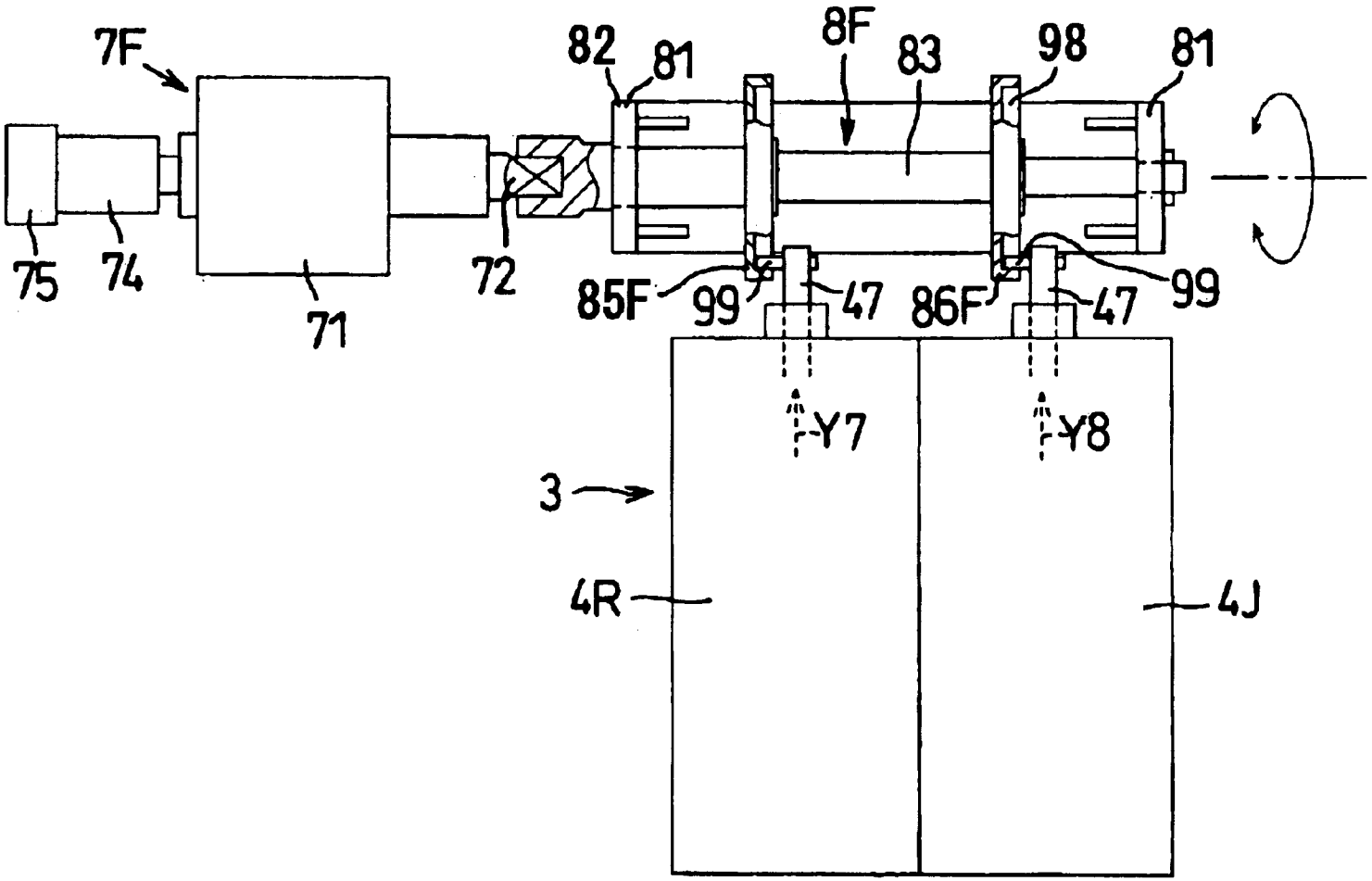
FIG. 24 is a front view of a toilet washing water supply device which uses a jet open/close valve, a rim open/close valve and a cam device according to an embodiment 6 in the second invention.

As shown in FIG. 24, a driving device 7F is coaxially mounted at an axial end portion of a rotation axis 83. The driving device 7F includes a motor 71 having a motor axis 72 which is engaged with an axial end portion of a rotation axis 73.

When the toilet bowl 11 is washed, in the same manner as the above, the motor 71 of the driving device 7F is driven. Then, the motor axis 72 and the rotation axis 83 are integrally rotated, and the first cam 85F and the second cam 86F are rotated. Due to the rotation of the first cam 85F, the cam portion 98 of the first cam 85F pulls the shaft 47 of the rim open/close valve 4R toward the direction of an arrow Y7, namely, upward, to open the rim open/close valve 4R. Accordingly, in the same manner as the above, water is supplied to the rim channel 12 by way of the rim conduit 19, and an inner wall surface of the bowl portion 10 is washed.

In accordance with further driving of the cam device 8F, the first cam 85F doesn't come to pull the shaft 47 of the rim open/close valve 4R toward the direction of an arrow Y7, the rim open/close valve 4R is closed. After that, the cam portion 98 of the second cam 86F pulls the shaft 47 of the jet open/close valve 4J toward the direction of an arrow Y8 to open the jet open/close valve 4J. Accordingly, water is supplied to the jet nozzle 15 by way of the jet conduit 18 to generate a siphon effect in the trap portion 14 forcibly.

Next, the second cam 86F doesn't come to pull the shaft 47 of the jet open/close valve 4J toward the direction of an arrow Y7, and the jet open/close valve 4J is closed. After that, the first cam 85F again pulls the shaft 47 of the rim open/close valve 4R toward the direction of an arrow Y7, and the rim open/close valve 4R is again opened. Accordingly, water is again supplied to the rim channel 12 by way of the rim conduit 19, and the bowl portion 10 is sealed with water.

Third Invention

Embodiments 1 to 6 which embody the third invention are explained hereinafter in conjunction with drawings 26 to 40.

Embodiment 1

Figure 26:
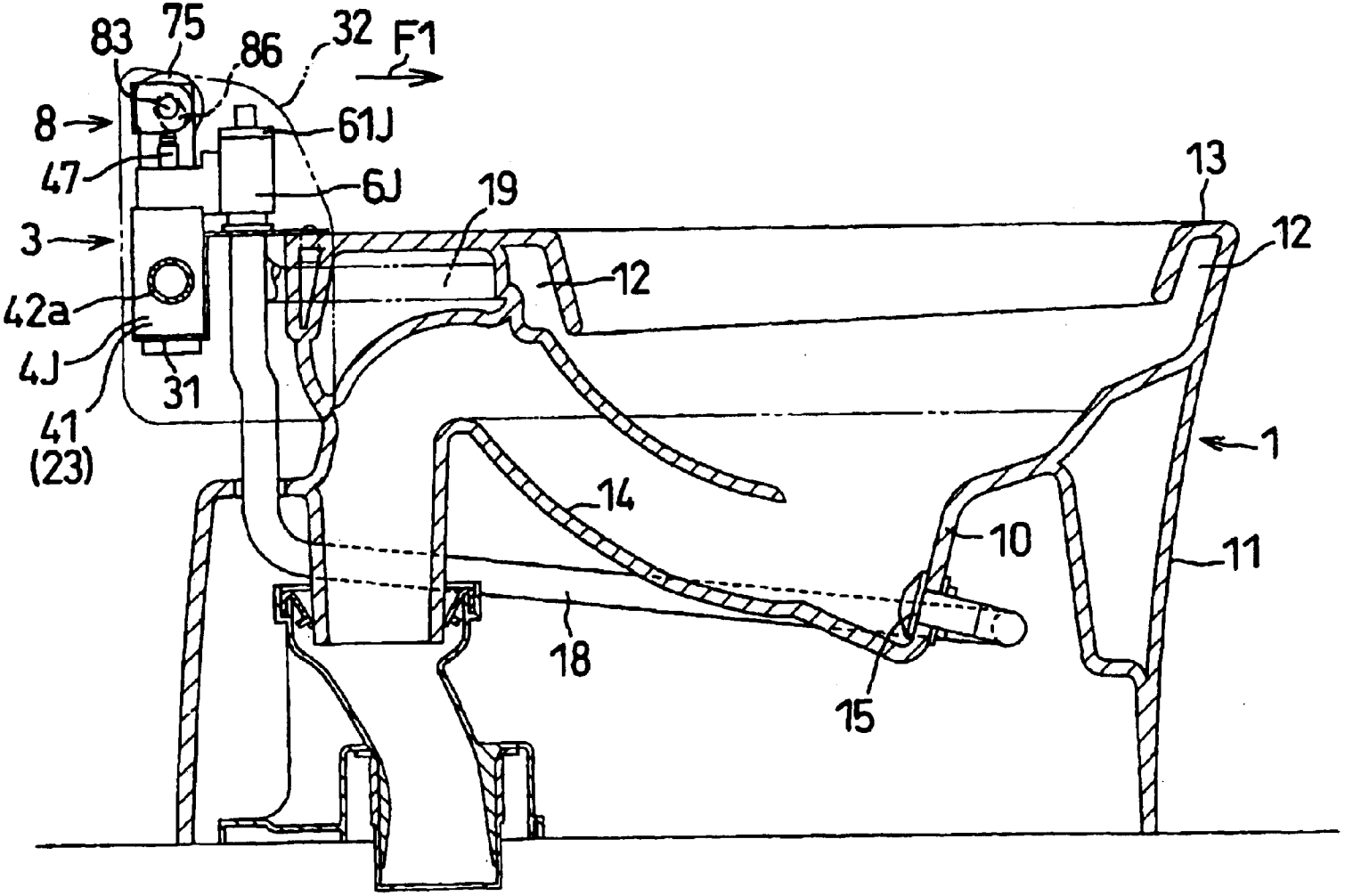
FIG. 26 is a cross-sectional view of an essential portion of a tankless western-style flush toilet according to an embodiment 1 in the third invention.

The embodiment 1 is explained in conjunction with drawings 26 to 32. As shown in FIG. 26, a western-style toilet body 1 includes a toilet bowl 11 having a bowl portion 10 which receives filth, a rim 13 having a rim channel 12 which encircles at an upper periphery of the bowl portion 10 and a trap portion 14 which is communicated with the bottom of the bowl portion 10 and which flows the filth out. At an inlet of the trap portion 14, a jet nozzle 15 is mounted.

Figure 28:
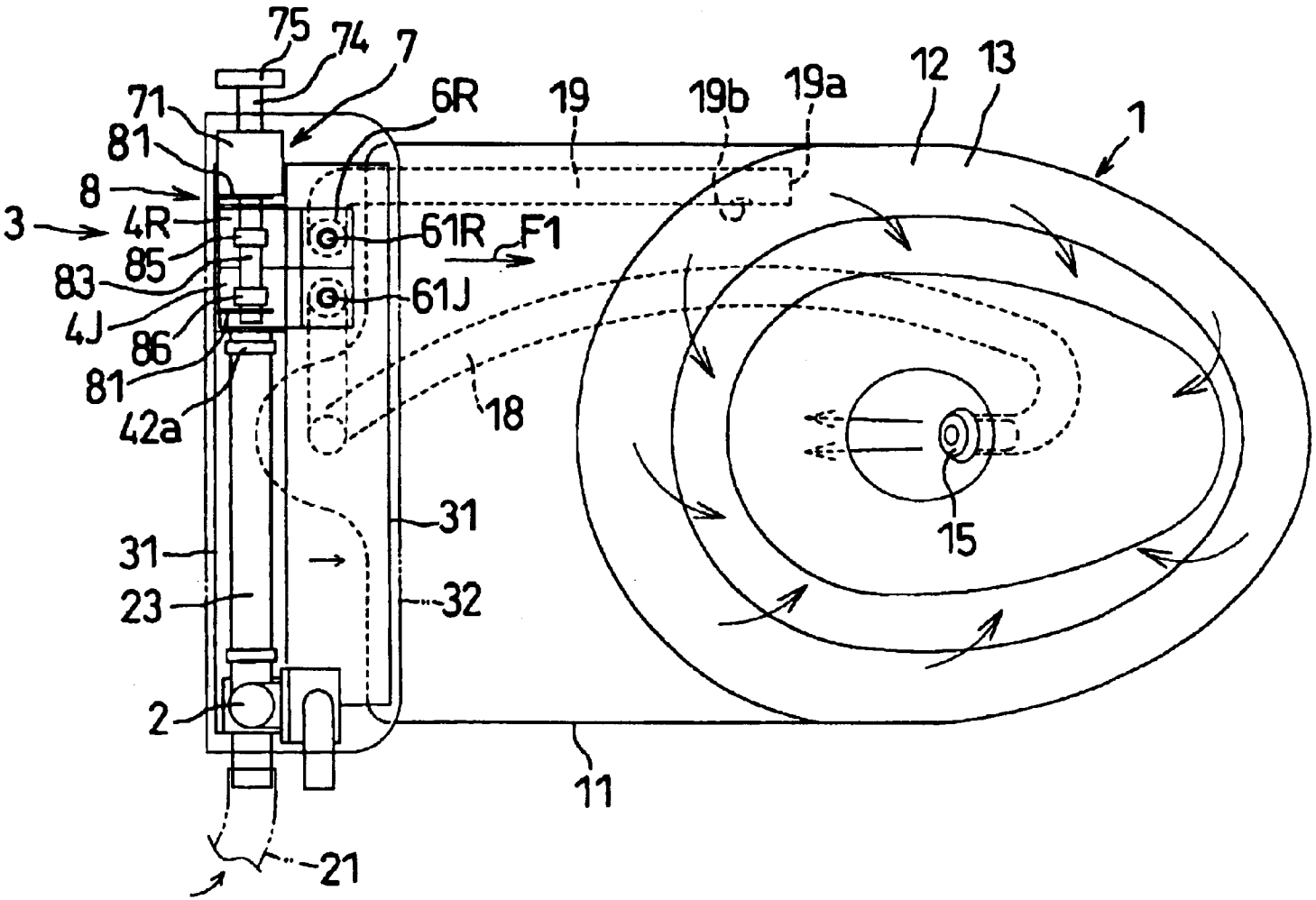
FIG. 28 is a plan view of an essential portion of a tankless western-style flush toilet according to an embodiment 1 in the third invention.

In the western-style toilet body 1, a jet conduit 18 as a passage for supplying water to the jet nozzle 15 and a rim conduit 19 as a passage for supplying water to the rim channel 12 are mounted. As shown in FIG. 28, the rim conduit 19 includes an opening 19*a* which opens toward a top end side and which is able to spout water clockwise, and an opening 19*b* which opens toward a side surface side and which is able to spout water counter-clockwise.

Figure 27:
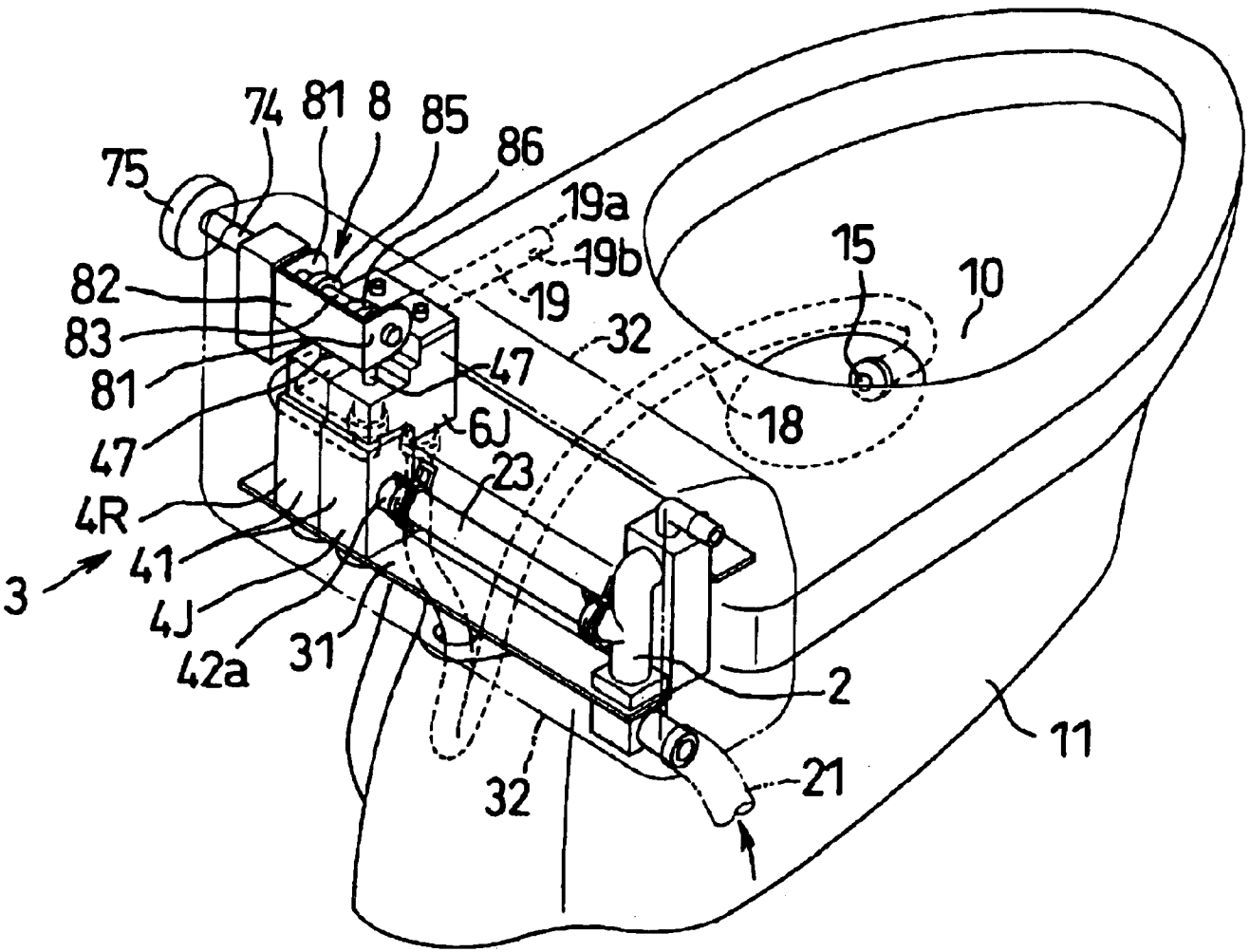
FIG. 27 is a perspective view of an essential portion of a tankless western-style flush toilet according to an embodiment 1 in the third invention.

As shown in FIGS. 27 and 28, at one side of a rear portion in the width direction of the western-style toilet body 1, a branch device 2 which divides water into water for washing a toilet and water for other use is mounted. The branch device 2 is connected to a water supply source such as a city water service pipe and so on by way of a stop cock not shown in the drawing due to a flexible hose 21. The branch device 2 and a toilet washing device 3 are communicated with each other by way of a conduit 23, and water which is divided by the branch device 2 is supplied to the toilet washing device 3 by way of the conduit 23. A toilet lid and a toilet seat are not shown in FIGS. 26 to 29.

Next, the toilet washing device 3 which is a main portion of the embodiment 1 is further explained. As shown in FIG. 27, the toilet washing device 3 is assembled to a base plate 31 which is held at the rear portion of the western-style toilet body 1 in such a manner that the toilet washing device 3 is positioned at the opposite side of the branch device 2, and the toilet washing device 3 is concealed by a cover 32.

Figure 29:
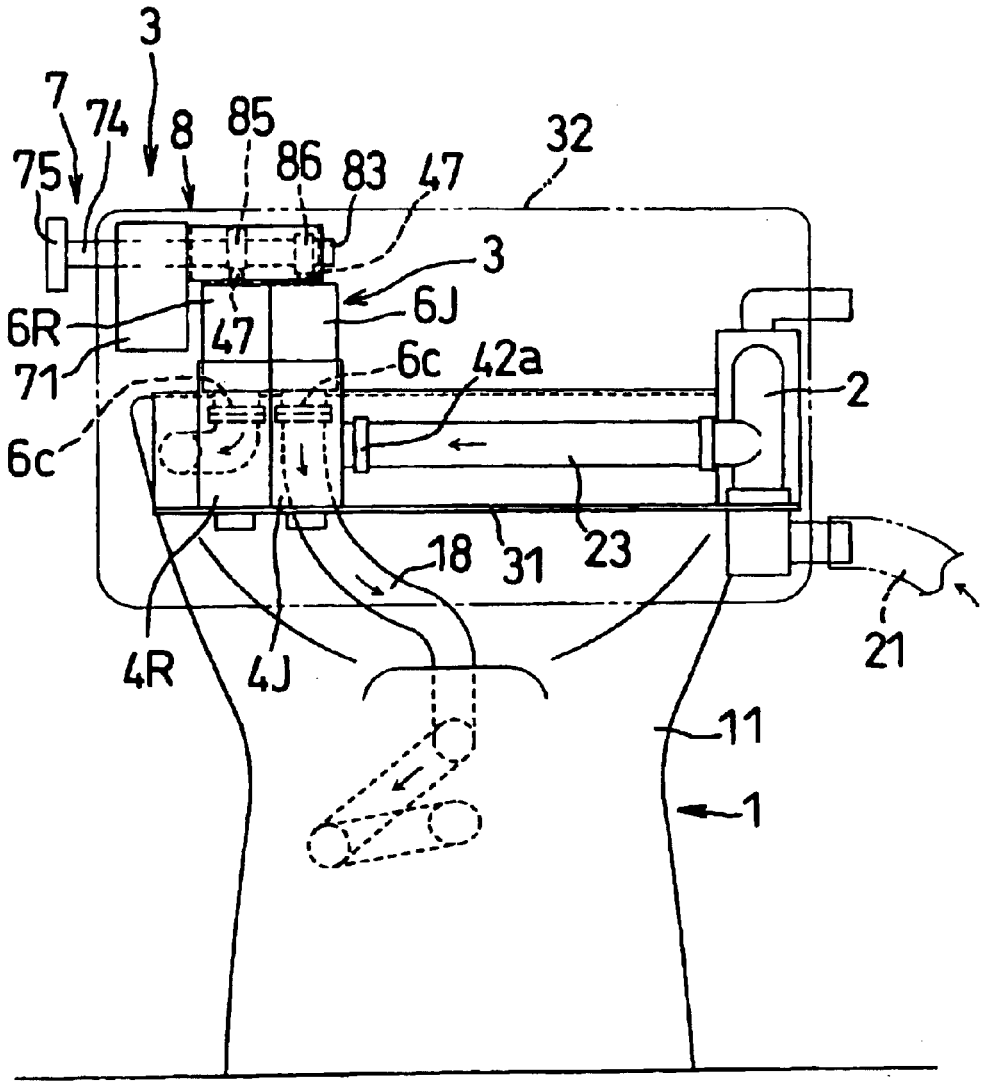
FIG. 29 is a back view of an essential portion of a tankless western-style flush toilet according to an embodiment 1 in the third invention.

The toilet washing device 3 includes rim open/close valve 4R for supplying water to a rim channel 12, a jet open/close valve 4J for supplying water to a jet nozzle 15 and a cam device 8 which is functioned as a common driving source for opening and closing the open/close valves 4R and 4J. As shown in FIGS. 27 to 29, two open/close valves 4R and 4J are in a longitudinal shape, and they are mounted in parallel in such a manner that they are adjacent to each other.

Figure 30:
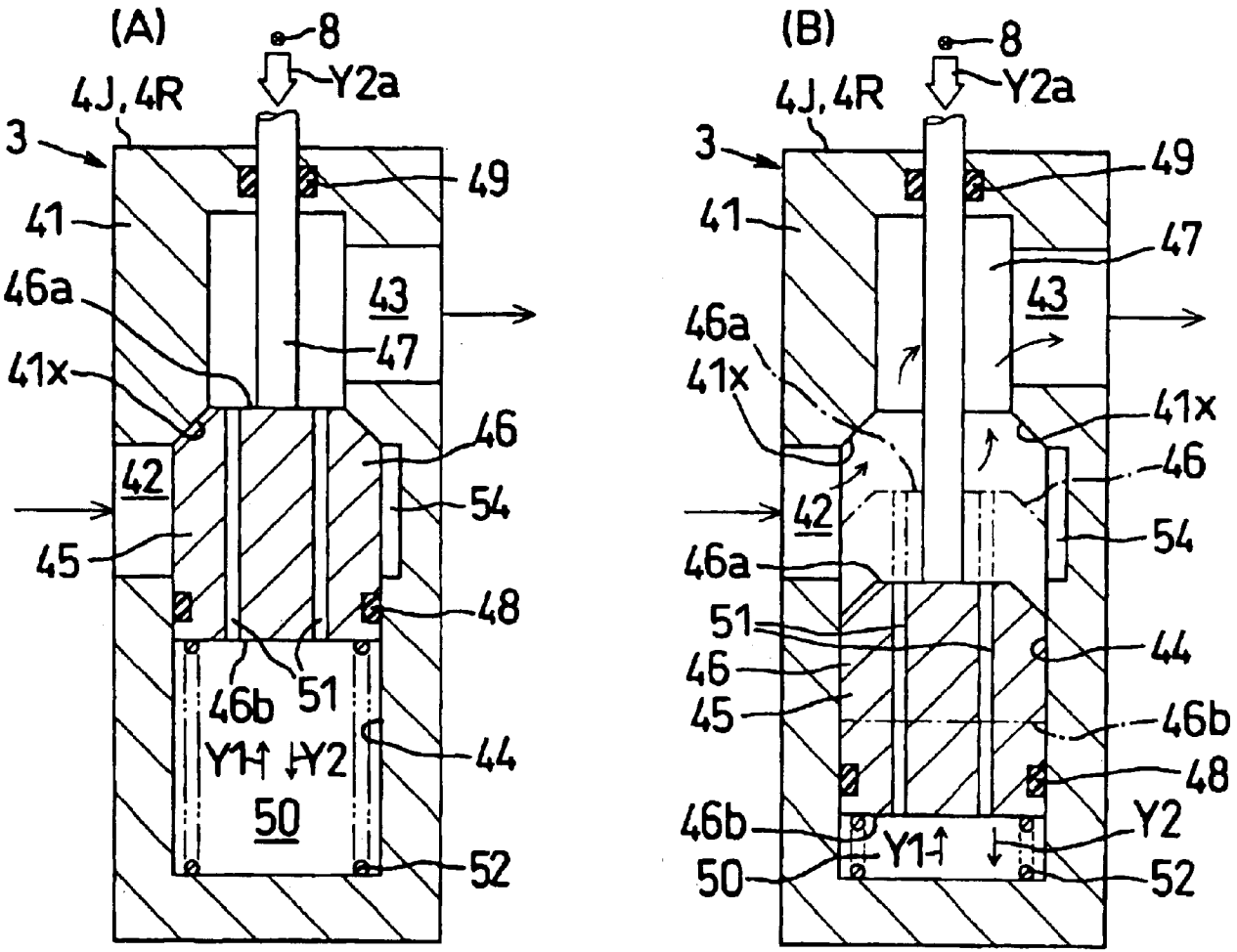
FIG. 30(A) is a cross-sectional view for typically showing an open/close valve which is in the closed condition according to an embodiment 1 in the third invention.
FIG. 30(B) is a cross-sectional view for typically showing an open/close valve which is in the open condition according to an embodiment 1 in the third invention.

An inner constitution of the jet open/close valve 4*j* is typically shown in FIGS. 30(A) and 30(B). The jet open/close valve 4J has a longitudinal-shape valve housing 41 which has a water-in port 42 for taking water in and a water-out port 43 for spouting water out, and a valve mechanism 45 which is mounted on the valve housing 41. In the inside of the valve housing 41, a piston room 44 which is communicated with the water-in port 41 and the water-out port 43 is formed. The valve mechanism 45 includes a piston 46 which is slidably mounted on the piston room 44, and a shaft 47 which is coaxially fixed to one end surface (an upper end surface) of the piston 46 in such a manner that the shaft 47 is protruded upward from an upper end of the valve housing 41.

The shaft 47 forms a cross-sectional circular shape, and it is formed of a metal or a hard resin. The shaft 47 is extended along the vertical direction of the western-style toilet body 1, namely, the height direction thereof. A boundary area between the shaft 47 and the valve housing 41 is sealed by an O ring 49.

In the valve housing 41, the water-in port 42 opens at an peripheral surface side of the piston 46, and it is communicated with a water supply source such as a city water service pipe and the like. The water-out port 43 opens while bending from the side of one end surface 46*a* of the piston 46 in the axial direction to a side surface side of the valve housing 41. In FIGS. 30(A) and 30(B), the water-out port 43 is not fundamentally shown in a cross section, but it is shown in a cross section in order to make the understanding easy. An O ring 48 is held at a ring groove at an outer peripheral portion of the piston 46, and a boundary area between the outer peripheral portion of the piston 46 and an inner wall surface of the valve housing 41 is sealed by the O ring 48.

In the piston room 44, a pressure offset room 50 is formed by the valve housing 41 and other end surface of the piston 46. The pressure offset room 50 is communicated with the side of the water-out port 43 by way of plural communication holes 51 as passages which are formed in the piston 46. Each communication hole 51 communicates the one end surface 46*a* of the piston 46 with the other end surface 46*b* of the piston 46 in the axial direction. In the pressure offset room 50, a push coil spring 52 as a force act means is coaxially arranged. The coil spring 52 is disposed between the valve housing 41 and the other end surface 46*b* of the piston 46, and it always pushes the piston 46 toward the direction of an arrow Y1, namely, upward to close the communication between the water-in port 42 and the water-out port 43.

As above-mentioned, the shaft 47 is protruded from the valve housing 41 toward the direction of an arrow Y1, namely, upward, and the shaft 47 is pushed toward the direction of an arrow Y2*a*, namely, downward by the cam device 8. When a top end of the shaft 47 is pushed toward the direction of an arrow Y2*a* by the cam device 8, the piston 46 is interlocked with the top end of the shaft 47 to be slided in the same direction as that of the top end of the shaft 47. Then, the piston 46 is detached from a seat face 41*x* to communicate the water-in port 42 with the water-out port 43.

An inner constitution of the rim open/close valve 4R is substantially the same as that of the jet open/close valve 4J, so an explanation thereof is omitted.

The water-in port 42 of the jet open/close valve 4J and the water-in port 42 of the rim open/close valve 4R are communicated with each other by way of a ring-shaped communication passage 54 which is formed between the valve housing 41 and an outer peripheral surface of the piston 46.

Figure 31:
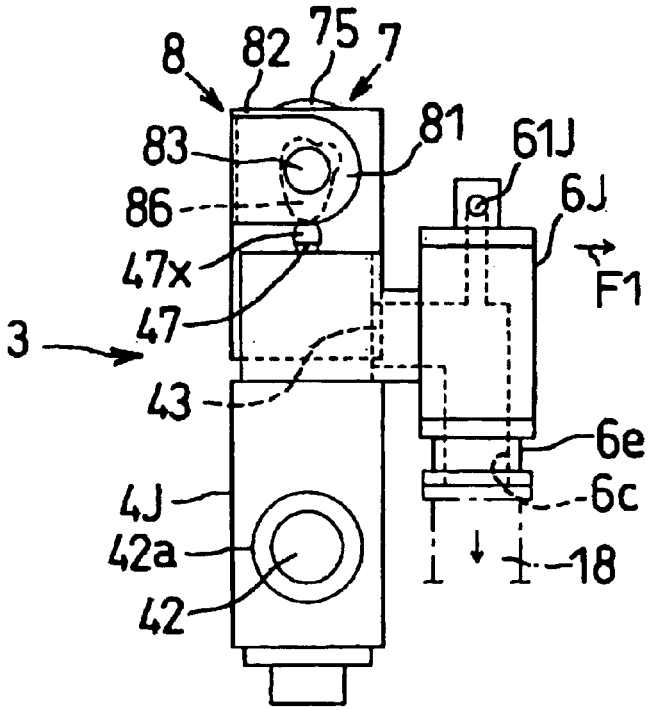
FIG. 31 is a side view of a toilet washing device which uses a jet open/close valve and a cam device according to an embodiment 1 in the third invention.
Figure 32:
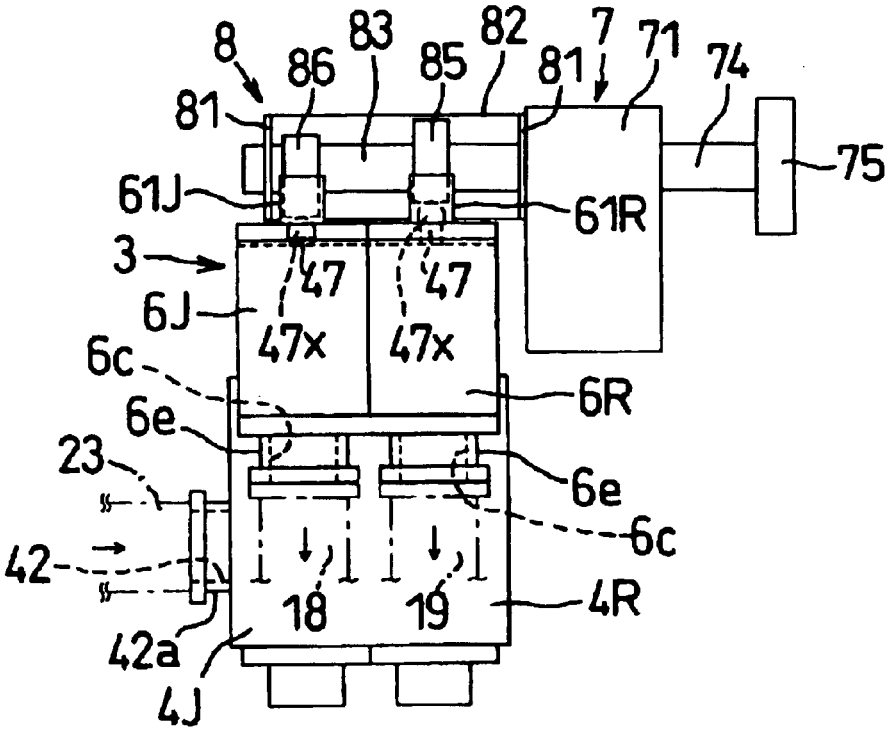
FIG. 32 is a front view of a toilet washing device which uses a jet open/close valve, a rim open/close valve and a cam device according to an embodiment 1 in the third invention.
Figure 33:
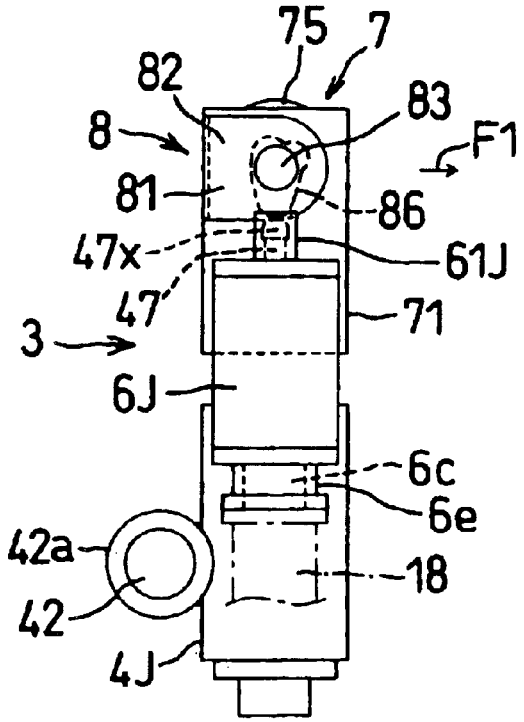
FIG. 33 is a side view of a toilet washing device which uses a jet open/close valve and a cam device according to an embodiment 2 in the third invention.

As shown in FIGS. 31 and 32, on an upper end of the shaft 47, a spherical portion 47*x* which ensures the smooth slidability with a first cam 85 of the cam device 8 is mounted. A flange 42*a* is formed at the water-in port 42 of the jet open/close valve 4J in such a manner that the flange 42*a* is protruded to a side surface side, and the flange 42*a* is connected to one end of the conduit 23.

In the toilet washing device 3, as shown in FIG. 31, a connecting member 6J is mounted on the jet open/close valve 4J in such a manner that the connecting member 6J is protruded toward the direction of an arrow F1, namely, toward a front portion of the toilet bowl 11. A vacuum breaker 61J to be released for an air is mounted at an upper end portion of the connecting member 6J. The water-out port 43 of the jet open/close valve 4J is communicated with a water-out port 6*c* of the connecting member 6J and an air hole of the vacuum breaker 61J. A flange 6*e* is formed at the water-out port 6*c* of the connecting member 6J in such a manner that the flange 6*e* is protruded downward, and the flange 6*e* is connected to the jet nozzle 15 due to the jet conduit 18.

On the other hand, as shown in FIG. 32, a connecting member 6R is mounted also on the rim open/close valve 4R, and a vacuum breaker 61R to be released for an air is connected to an upper end portion of the connecting member 6R. The water-out port 43 of the rim open/close valve 4R is connected to a water-out port 6*c* of the connecting member 6R and an air hole of the vacuum breaker 61R. At the water-out port 6*c* of the connecting member 6R of the rim open/close valve 4R, a flange 6*e* is formed in such a manner that the flange 6*e* is protruded downward, and the flange 6*e* is connected to the rim channel 12 by means of the rim conduit 19.

As shown in FIG. 27, the cam device 8, which is a main element of the toilet washing device 3, is mounted on an upper end of the open/close valves 4R and 4J in the axial direction. The cam device 8 is held at a bracket 82 having two mounting pieces 81 which are protruded toward a front portion, in other words, a front portion side of the toilet bowl 11. Namely, the cam device 8 includes a rotation axis 83 as a rotation body which is rotatably held at the mounting piece 81 in the horizontal condition, a first cam 85 and a second cam 86 which are mounted on the rotation axis 83 in such a manner that they are protruded in the axially right-angled direction. As shown in FIGS. 27 and 28, the rotation axis 83 is mounted in such a manner that the rotation axis 83 is extended along the width direction of the toilet bowl 11.

When the rotation axis 83 is rotated, the first cam 85 and the second cam 86 are rotated along the height direction of the toilet bowl 11. Due to this, a cam surface at an outer periphery of the first cam 85 is brought into contact with the shaft 47 (which corresponds to a follower) of the rim open/close valve 4R to move the shaft 47 downward. At the same time, a cam surface at an outer periphery of the second cam 86 is brought into contact with the shaft 47 (which corresponds to a follower) of the jet open/close valve 4J to move the shaft 47 downward.

As shown in FIGS. 27 to 29, a driving device 7 by which the cam device 8 is driven is mounted on the toilet washing device 3 in such a manner that the driving device 7 is adjacent to the cam device 8. The driving device 7 is fixed to one mounting piece 81 of the bracket 82, and a motor 71 and a reduction gear which transmits rotation force of the motor 71 to the rotation axis 83 are contained in the driving device 7. As a result, the rotation axis 83 can be rotatingly driven by controlling a controller which is not shown in the drawing. Furthermore, a manual axis 74 which rotates the rotation axis 83 of the cam device 8 manually is mounted on the driving device 7 in such a manner that the manual axis 74 is positioned at the side of the western-style toilet body 1. The manual axis 74 has an operation handle 75, and they can be detached with respect to the toilet washing device 3. When the user doesn't use the toilet, only if the manual axis 74 is detached, it is possible to attempt the saving of spaces.

As shown in FIG. 27, the above open/close valves 4R and 4J, the motor 71 and the cam device 8 are mounted at a rear portion of the western-style toilet body 1 by means of a single common base plate 31.

In the tankless western-style flush toilet which is constituted as above, water is supplied to the toilet washing device 3 by way of a water supply source, the stop cock, the flexible hose 21, the branch device 2 and the conduit 23. In the toilet washing device 3, as far as the user doesn't carry out the switch operation in order to wash the toilet bowl 11, both of the open/close valves 4J and 4R are closed. Namely, if being explained by FIGS. 30(A) and 30(B), the piston 46 is moved to one side in the axial direction, in other words, the direction of an arrow Y1, by act force of the push coil spring 52. Due to this, as shown in FIG. 30(A), the piston 46 is attached to the seat face 41*x* of the valve housing 41, and an outer peripheral surface of the piston 46 closes the water-in port 42. At the same time, one end surface 46*a* of the piston 46 closes the water-out port 43. Accordingly, the communication between the water-in port 42 and the water-out port 43 is closed, and water is not supplied to the western-style toilet body 1.

When the toilet bowl 11 is washed, in accordance with the switch operation of the user, the motor 71 of the driving device 7 is driven by a signal of the controller, and the rotation axis 83 is rotatingly driven. Due to this, a cam surface of the first cam 85 pushes the shaft 47 of the rim open/close valve 4R downward to open the rim open/close valve 4R. If being explained by FIGS. 30(A) and 30(B), the push coil spring 52 is elastically contracted, and the piston 46 is moved to the other direction of the axial direction, namely, toward the direction of an arrow Y2. Accordingly, as shown in FIG. 30(B), the piston 46 is detached from the seat face 41*x* of the valve housing 41 to open the communication between the water-in port 42 and the water-out port 43. As a result, the toilet washing device 3 supplies water to the rim channel 12 by way of the rim conduit 19, and an inner wall surface of the bowl portion 10 is washed.

In accordance with the driving of the cam device 8, the cam surface of the first cam 85 doesn't come to push the shaft 47 of the rim open/close valve 4R downward, and the rim open/close valve 4R is closed. After that, the cam surface of the second cam 86 pushes the shaft 47 of the jet open/close valve 4J downward to open the jet open/close valve 4J. Due to this, the toilet washing device 3 supplies water to the jet nozzle 15 by way of the jet conduit 18 to generate a siphon effect in the trap portion 14 forcibly.

Next, in accordance with the driving of the cam device 8, the cam surface of the second cam 86 doesn't come to push the shaft 47 of the jet open/close valve 4J downward, and the jet open/close valve 4J is closed. After that, the cam surface of the first cam 85 again pushes the shaft 47 of the rim open/close valve 4R downward to open the rim open/close valve 4R again. Due to this, the toilet washing device 3 supplies water to the rim channel 12 by way of the rim conduit 19 to seal the bowl portion 10 with water.

Hereinafter, if being explained by FIGS. 30(A) and 30(B), the communication between the water-in port 42 and the water-out port 43 is opened and closed by the piston 46, so the piston 46 receives the pressure on the other side, namely, in the direction of an arrow Y2, by means of water in the water-out port 43. Due to the pressure on the other side like this, there is a fear that the slidability of the piston 46 in the axial direction is hindered. In this respect, in the open/close valves 4J and 4R, the pressure offset room 50 is formed at the other side of the piston 46, and one side of the piston 46 is communicated with the pressure offset room 50 by plural communication holes 51. So, water existed in the side of one end surface 46*a* of the piston 46 from the water-out port 43 is moved to the pressure offset room 50 by way of the communication hole 51 to attempt to keep the balance between the pressure of water in the pressure offset room 50 and the pressure of water in the side of one end surface 46*a* of the piston 46. As a result, the difference of the pressure between them can be canceled or decreased. Due to this, the slidability of the piston 46 in the axial direction can be ensured.

As understood by the above explanation, in the embodiment 1, a new type toilet washing device 3 in which the open/close operation of the open/close valves 4J and 4R are carried out by pushing the shaft 47 due to the cams 85 and 86 of the cam device 8 to move the shaft 47 in the axial direction is adopted. Here, the shaft 47 of the open/close valves 4J and 4R is not extended in the lateral direction with respect to the western-style toilet body 1, and the shaft 47 is extended in the vertical direction of the western-style toilet body 1. So, a top end of the shaft 47 is not protruded toward the side or the rear of the western-style toilet body 1. Therefore, it is possible to save a mounting space of the toilet washing device 3 which is attached to a rear portion of the western-style toilet body 1.

Furthermore, the cam device 8 is mounted on an upper end in the axial direction of the open/close valves 4J and 4R. So, the cam device 8 can be overlapped on the mounting space of the open/close valves 4J and 4R, and it is possible to save the mounting space more.

Moreover, the driving device 7 having the motor 71 is mounted in adjacent to the cam device 8, so in this respect, it is possible to save the mounting space more.

In addition, in the embodiment 1, the shaft 47 has the constitution in which the shaft 47 is pushed by the cam device 8 in order to open the communication between the water-in port 42 and the water-out port 43. As a result, the constitution becomes relatively simple, and it is possible to reduce the production cost.

Furthermore, as shown in FIG. 32, the open/close valves 4J and 4R are arranged along the longitudinal direction of the rotation axis 83 which constitutes the cam device 8. So, the effect of the saving of the mounting space is large. Moreover, when each of plural open/close valves 4J and 4R is opened and closed by the first cam 85 and the second cam 86 of the rotation axis 83, the cam device 8 is utilized as a common driving source of the open/close valves 4J and 4R. So, it is possible to save the mounting space more.

In addition, the speed for opening and closing valve of the valve mechanism 45 of the open/close valves 4J and 4R can be set voluntarily by selecting a profile of the first cam 85 and the second cam 86, so it is possible to suppress a rapid opening or a rapid closing of the valve, and to suppress a noise, a water hammer phenomenon and the like.

Besides, when the valve is opened or closed, it is possible to stop driving the cam device 8 in the halfway by means of the switch operation in case of driving the cam device 8 by the motor 71, and by means of the manual operation in case of driving the cam device 8 by the manual axis 74. In the latter case, an amount for opening and closing valve of the valve mechanism 45 can be continuously maintained at an intermediate stage. Therefore, it is possible to continue to flow a small amount of water to the western-style toilet body 1. With such a constitution, this is advantageous to prevent the freezing of water during the cold season.

Embodiment 2

The embodiment 2 is explained in conjunction with drawings 33 to 34. The embodiment 2 has basically the same constitution as that of the embodiment 1, and it exhibits the same operations and effects as those of the embodiment 1. In the embodiment 2, the common portions are labeled as the common symbols. Hereinafter, the portions which are different from the embodiment 1 are mainly explained.

Figure 34:
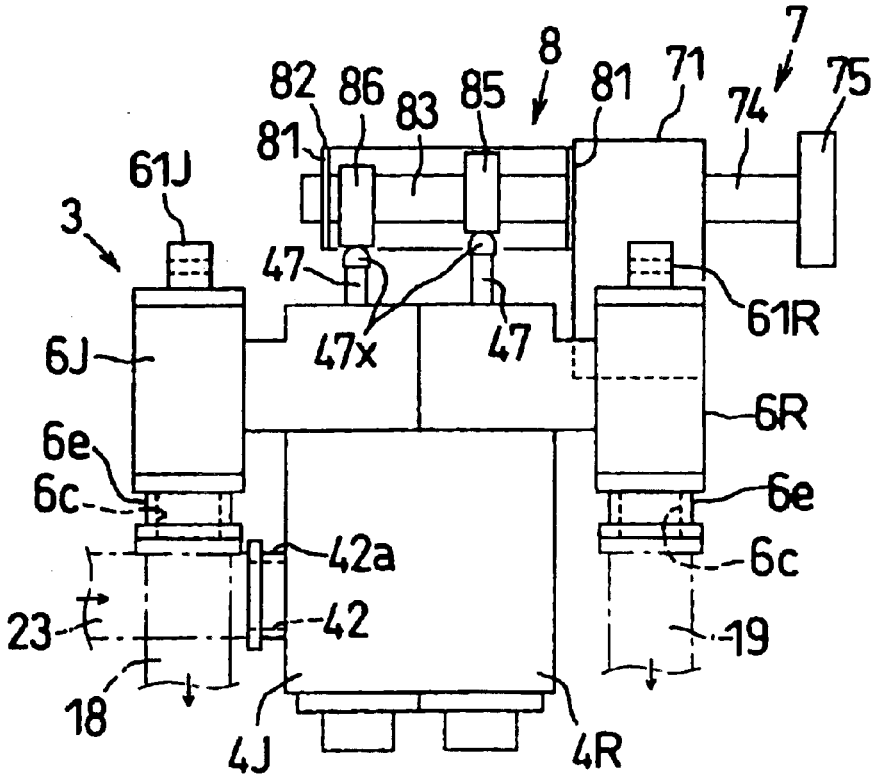
FIG. 34 is a front view of a toilet washing device which uses a jet open/close valve, a rim open/close valve and a cam device according to an embodiment 2 in the third invention.
Figure 35:
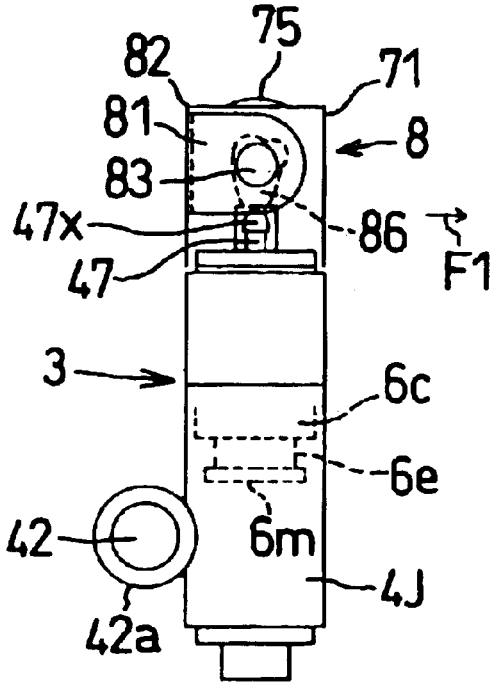
FIG. 35 is a side view of a toilet washing device which uses a jet open/close valve and a cam device according to an embodiment 3 in the third invention.

In the embodiment 2, a connecting member 6J of a jet open/close valve 4J and a connecting member 6R of a rim open/close valve 4R are protruded toward the side of a valve housing 41 of the jet open/close valve 4J and a valve housing 41 of the rim open/close valve 4R, namely, toward the side of a toilet bowl 11 in such a manner that the connecting member 6J and the connecting member 6R are separated from each other by the predetermined distance. This considers a mounting space, piping circumstances and the like. Therefore, as shown in FIG. 34, a first cam 85, a second cam 86 and the open/close valves 4J and 4R are positioned between the connecting member 6J and the connecting member 6R.

In also the embodiment 2, a shaft 47 of the open/close valves 4J and 4R is extended in the vertical direction, namely, the height direction of a western-style toilet body. So, it is suppressed that a top end of the shaft 47 is protruded toward the side or the rear, and it is possible to save amounting space.

Furthermore, the cam device 8 is mounted on an upper end in the axial direction of the open/close valves 4J and 4R, and the cam device 8 is mounted on the mounting space of the open/close valves 4J and 4R. In this respect, it is possible to save the mounting space more.

Embodiment 3

The embodiment 3 is explained in conjunction with drawings 35 to 36. The embodiment 3 has basically the same constitution as that of the embodiment 1, and it exhibits the same operations and effects as those of the embodiment 1. In the embodiment 3, the common portions are labeled as the common symbols. Hereinafter, the portions which are different from the embodiment 1 are mainly explained.

In the embodiment 1, the connecting member 6J of the jet open/close valve 4J and the connecting member 6R of the rim open/close valve 4R are separated from each other. But, in the embodiment 3, a connecting member 6C which is common to a jet open/close valve 4J and a rim open/close valve 4R is mounted therebetween.

The common connecting member 6C has a water-out port 6*m*, 6*n* which is communicated with a common vacuum breaker 61C which is communicated with an air. The water-out port 6*m* is communicated with a water-out port 43 of the jet open/close valve 4J, and at the same time, the water-out port 6*n* is communicated with a water-out port 43 of the rim open/close valve 4R.

In the embodiment 3, the common connecting member 6C is mounted between a first cam 85 and a second cam 86 in the axial length direction of a rotation axis 83. So, the axial length of the rotation axis 83 becomes long, and a clearance between the first cam 85 and the second cam 86 increases.

Figure 36:
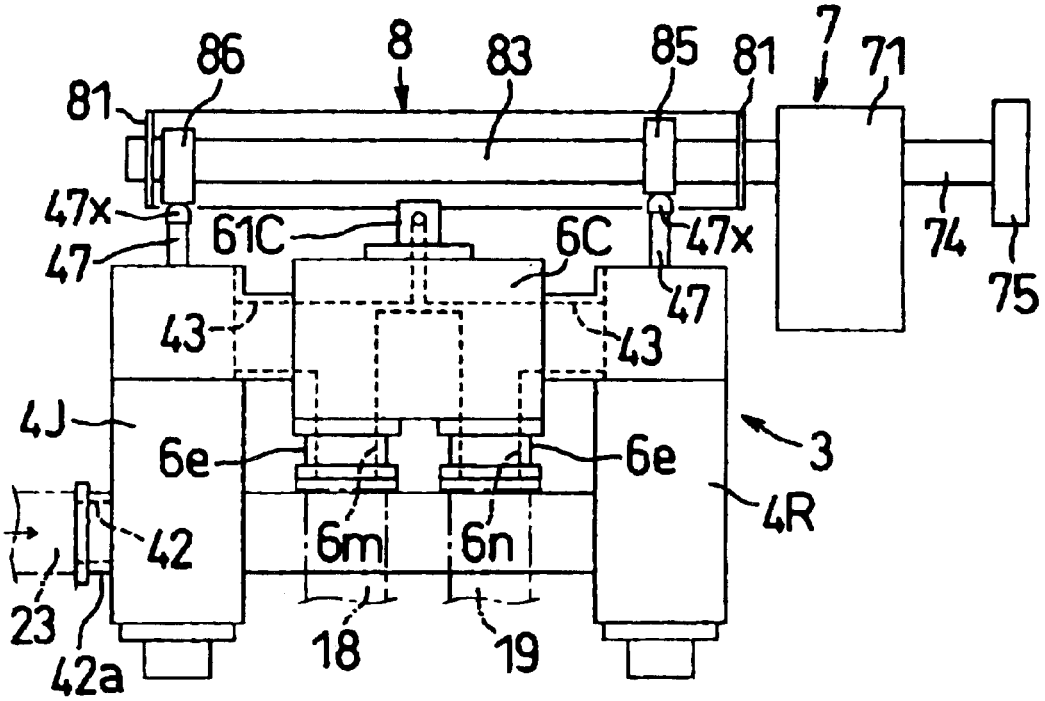
FIG. 36 is a front view of a toilet washing device which uses a jet open/close valve, a rim open/close valve and a cam device according to an embodiment 3 in the third invention.

In also the embodiment 3, as shown in FIG. 36, a shaft 47 of the open/close valves 4J and 4R is extended in the vertical direction of a western-style toilet body. So, it is suppressed that the shaft 47 is protruded toward the side or the rear, and it is possible to save a mounting space.

Furthermore, the cam device 8 is mounted on an upper end in the axial direction of the open/close valves 4J and 4R, and the cam device 8 is mounted on the mounting space of the open/close valves 4J and 4R. In this respect, it is possible to save the mounting space more.

Embodiment 4

The embodiment 4 is explained in conjunction with drawing 37. The embodiment 4 has basically the same constitution as that of the embodiment 1, and it exhibits the same operations and effects as those of the embodiment 1. In the embodiment 4, the common portions are labeled as the common symbols. Hereinafter, the portions which are different from the embodiment 1 are mainly explained.

In the embodiment 4, a rim open/close valve 4R and a jet open/close valve 4J are mounted on a base plate 31 in such a manner that they are opposed to each other, and also that they are positioned up and down. Furthermore, in the base plate 31, a driving device 7D is attached to the side of the rim open/close valve 4R.

A cam device 8D includes a rotation axis 83D which is held at the base plate 31, a gear 87 as a rotation body which is integrally mounted on the rotation axis 83D and which is rotated in the horizontal direction, a first cam 85D which is projectingly mounted at an upper surface portion of the gear 87 and a second cam 86D which is projectingly mounted at a lower surface portion of the gear 87. The first cam 85D and the second cam 86D have a cam surface which is slanted along the peripheral direction of the gear 87.

The rotation axis 83D is a vertical form, and it is rotatably supported by a bearing 90*a*, 90*b* which is fixed to the base plate 31. The first cam 85D is engaged with a sliding cap 47*s* which covers a shaft 47 of the rim open/close valve 4R. The second cam 86D is engaged with a sliding cap 47*s* which covers a shaft 47 of the jet open/close valve 4J. The sliding cap 47*s* is formed of an excellent wear-resistant material, and it has an outer surface in the spherical surface condition in order to decrease the frictional resistance.

The driving device 7D includes a motor 71 which is attached to the base plate 31 and which has a downward motor axis 72, a driving axis 77 which is rotatably held at a bearing 90*e*, 90*f* attached to the base plate 31 and which is engaged with the motor axis 72 and a driving gear 78 which is held at the driving axis 77 and which is rotatable along the horizontal direction. The driving gear 78 and the gear 87 are engaged with each other.

When the toilet bowl 11 is washed, in the same manner as the above, the motor 71 of the driving device 7D is driven in accordance with the switch operation of the user. Then, the motor axis 72, the driving axis 77 and the driving gear 78 are rotated. Due to this, in the reverse direction of the driving gear 78, the gear 87 is rotated around an axis core $P_4$ of the gear 87 along the horizontal direction, and the cam surface of the first cam 85D pushes the shaft 47 of the rim open/close valve 4R upward, namely, toward the direction of an arrow Y3. As a result, the rim open/close valve 4R is opened. Accordingly, water is supplied to the rim channel 12 by way of the rim conduit 19, and an inner wall surface of the bowl portion 10 is washed.

When the cam surface of the first cam 85D doesn't come to push the shaft 47 of the rim open/close valve 4R toward the direction of an arrow Y3, the rim open/close valve 4R is closed. After that, the cam surface of the second cam 86D pushes the shaft 47 of the jet open/close valve 4J toward the direction of an arrow Y4, namely, downward, and the jet open/close valve 4J is opened. Accordingly, in the same manner as the above, water is supplied to the jet nozzle 15 by way of the jet conduit 18 to generate a siphon effect in the trap portion 14 forcibly.

Next, the cam surface of the second cam 86D doesn't come to push the shaft 47 of the jet open/close valve 4J toward the direction of an arrow Y4, and the jet open/close valve 4J is closed, and after that, the cam surface of the first cam 85D again pushes the shaft 47 of the rim open/close valve 4R toward the direction of an arrow Y3, and the rim open/close valve 4R is again opened. Accordingly, water is again supplied to the rim channel 12 by way of the rim conduit 19, and the bowl portion 10 is sealed with water.

Figure 37:
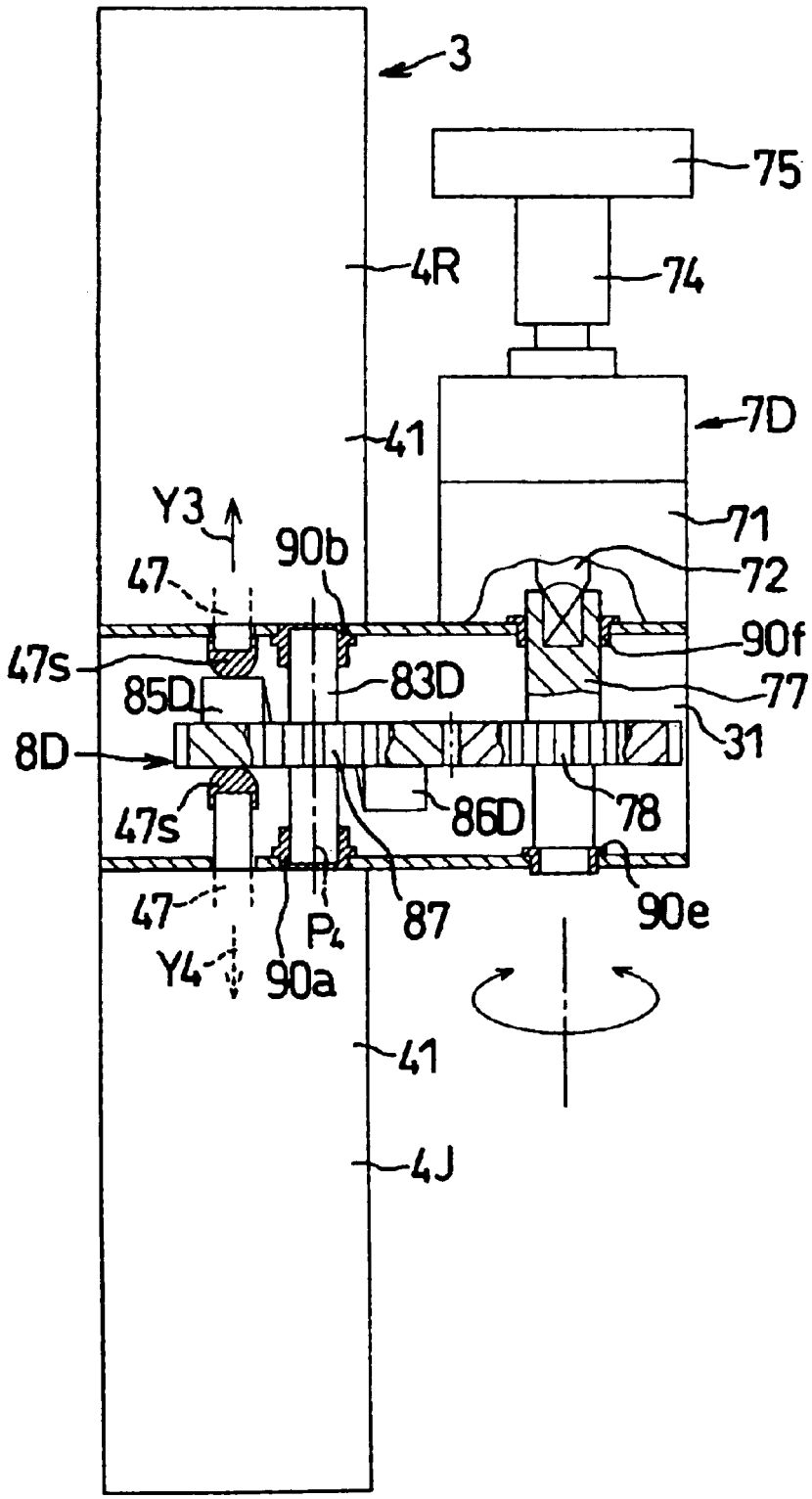
FIG. 37 is a front view with a part in cross section of a toilet washing device which uses a jet open/close valve, a rim open/close valve and a cam device according to an embodiment 4 in the third invention.
Figure 38:
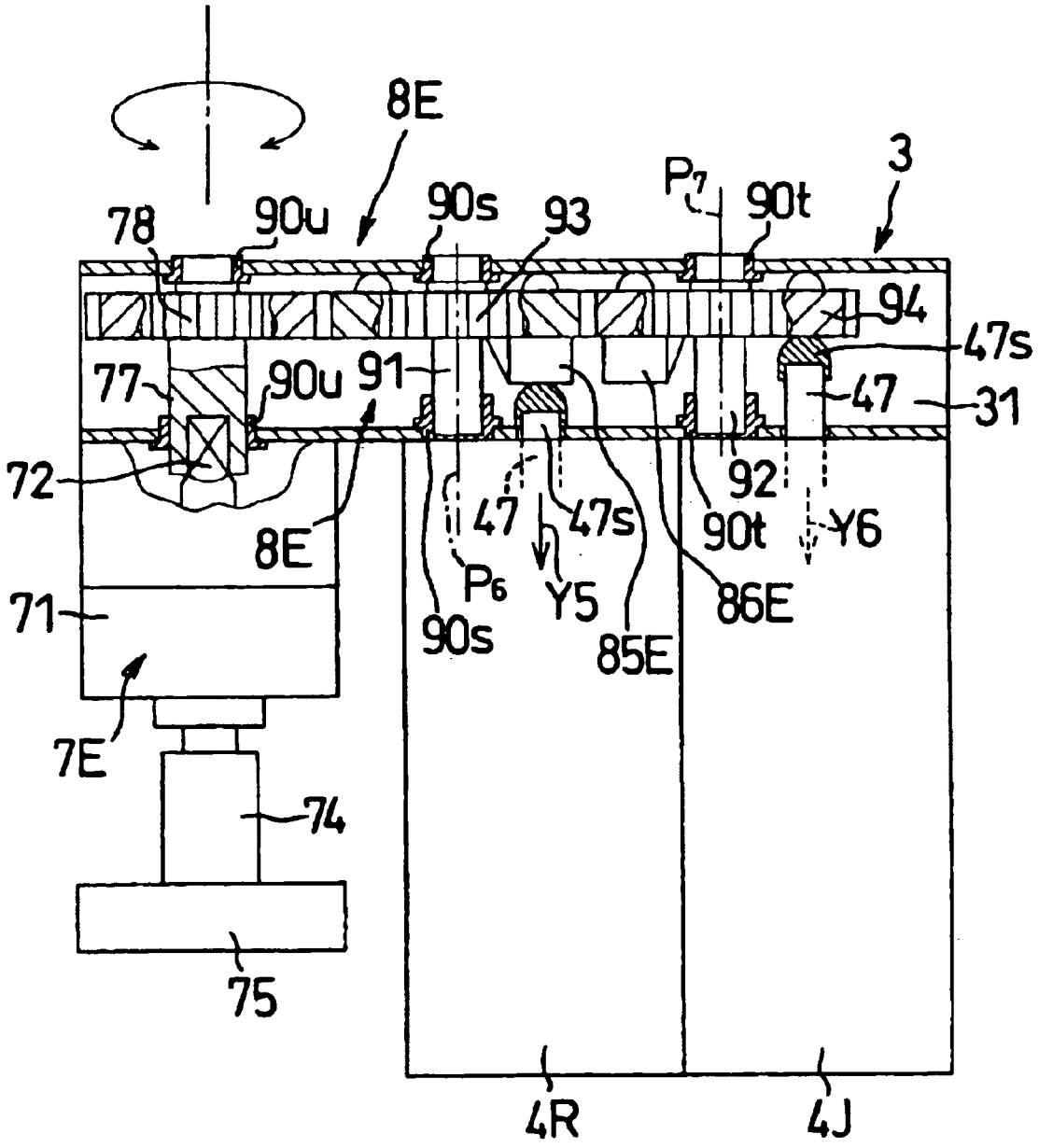
FIG. 38 is a front view with a part in cross section of a toilet washing device which uses a jet open/close valve, a rim open/close valve and a cam device according to an embodiment 5 in the third invention.

In also the embodiment 4, as shown in FIG. 37, the shaft 47 of the open/close valves 4J and 4R is extended in the vertical direction of a western-style toilet body. So, it is suppressed that the shaft 47 is protruded toward the side or the rear, and it is possible to save a mounting space.

Furthermore, the cam device 8 is disposed between the open/close valve 4J and the open/close valve 4R. In this respect, it is possible to save the mounting space.

Moreover, in the embodiment 4, as shown in FIG. 37, a longitudinal-shape rim open/close valve 4R and a longitudinal-shape jet open/close valve 4J are faced to each other in such a manner that they are against to each other. So, as the mounting space for plural open/close valves 4J and 4R, only the space for one open/close valve is satisfactory. In addition, together with the shaft 47, the rotation axis 83D and the driving axis 77 are positioned almost in parallel along the vertical direction. In this respect, it is possible to save the mounting space.

In the embodiment 4, as shown in FIG. 37, the jet open/close valve 4J is positioned at a lower side, and the rim open/close valve 4R is positioned at an upper side. Reversely, it is possible that the jet open/close valve 4J is positioned at an upper side, and the rim open/close valve 4R is positioned at a lower side.

Embodiment 5

The embodiment 5 is explained in conjunction with drawing 38. The embodiment 5 has basically the same constitution as that of the embodiment 4, and it exhibits the same operations and effects as those of the embodiment 4. In the embodiment 5, the common portions are labeled as the common symbols. Hereinafter, the portions which are different from the embodiment 4 are mainly explained.

In the embodiment 5, to a lower surface portion of a base plate 31, a jet open/close valve 4J, a rim open/close valve 4R and a motor 71 of a driving device 7E are attached in the parallel condition. A cam device 8E includes a vertical-type first rotation axis 91 which is rotatably held at a bearing 90*s* of the base plate 31, a vertical-type second rotation axis 92 which is rotatably held at a bearing 90*t* of the base plate 31, a first gear 93 as a rotation body which is integrally mounted on the first rotation axis 91 and which is rotated around an axis core $P_6$ along the horizontal direction, a first cam 85E which is protruded to a lower surface portion of the first gear 93, a second gear 94 as a rotation body which is integrally mounted on the second rotation axis 92 and which is rotated around an axis core $P_7$ in the horizontal direction and at the same time which is engaged with the first gear 93 and a second cam 86E which is protruded to a lower surface portion of the second gear 94. The first cam 85E and the second cam 86E have a slant surface.

The driving device 7E includes a motor 71 which is attached to the lower surface portion of the base plate 31 and which has an upward motor axis 72, a vertical-type driving axis 77 which is rotatably held at a bearing 90*u* mounted on the base plate 31 and which is engaged with the motor axis 72 and a driving gear 78 which is held at the driving axis 77 and which is engaged with the first gear 93 to be rotatable horizontally.

When the toilet bowl 11 is washed, in the same manner as the above, the motor 71 of the driving device 7E is driven in accordance with the switch operation of the user. Then, the motor axis 72 and the driving axis 77 are rotated integrally, and the driving gear 78 is rotated. Due to this, in the reverse direction of the driving gear 78, the first gear 93 is rotated around the axis core $P_6$ of the first gear 93 in the horizontal direction. At the same time, in the reverse direction of the first gear 93, the second gear 94 is rotated around the axis core $P_7$ of the second gear 94 in the horizontal direction.

Due to the rotation of the first gear 93, a cam surface of the first cam 85E pushes a shaft 47 of the rim open/close valve 4R toward the direction of an arrow Y5, namely, downward to open the rim open/close valve 4R. If being explained by FIGS. 30(A) and 30(B), the push coil spring 52 is elastically contracted, and the piston 46 is detached from the seat face 41*x*, and the communication between the water-in port 42 and the water-out port 43 is opened. Accordingly, in the same manner as the above, water is supplied to the rim channel 12 by way of the rim conduit 19, and an inner wall surface of the bowl portion 10 is washed.

In accordance with the driving of the cam device 8E of the embodiment 5, the cam surface of the first cam 85E doesn't come to push the shaft 47 of the rim open/close valve 4R toward the direction of an arrow Y5, namely, downward, and the rim open/close valve 4R is closed. After that, a cam surface of the second cam 86E of the second gear 94 pushes the shaft 47 of the jet open/close valve 4J toward the direction of an arrow Y6, namely, downward, and the jet open/close valve 4J is opened. Accordingly, water is supplied to the jet nozzle 15 by way of the jet conduit 18 to generate a siphon effect in the trap portion 14 forcibly.

Next, in accordance with the driving of the cam device 8E of the embodiment 5, the cam surface of the second cam 86E doesn't come to push the shaft 47 of the jet open/close valve 4J toward the direction of an arrow Y6, and the jet open/close valve 4J is closed, and after that, the cam surface of the first cam 85E again pushes the shaft 47 of the rim open/close valve 4R toward the direction of an arrow Y5, and the rim open/close valve 4R is again opened. Accordingly, water is supplied to the rim channel 12 by way of the rim conduit 19, and the bowl portion 10 is sealed with water.

In the cam device 8E of the embodiment 5, the first cam 85E is formed at the lower surface portion of the first gear 93, and at the same time, the second cam 86E is formed at the lower surface portion of the second gear 94. So, even in the long-term use, foreign materials such as dust or water can be prevented from being adhered to the first cam 85E and the second cam 86E, and the smooth operation of the first cam 85F and the second cam 86E can be ensured.

In also the embodiment 5, the shaft 47 of the open/close valves 4J and 4R is extended in the vertical direction of a western-style toilet body. So, it is suppressed that the shaft 47 is protruded toward the side or the rear, and it is possible to save a mounting space.

Furthermore, the cam device 8E is mounted on an upper end in the axial direction of the open/close valves 4J and 4R, and the cam device 8E is mounted on the mounting space of the open/close valves 4J and 4R. In this respect, it is possible to save the mounting space more.

Embodiment 6

The embodiment 6 is explained in conjunction with drawings 39 to 40. The embodiment 6 has basically the same constitution as that of the embodiment 5, and it exhibits the same operations and effects as those of the embodiment 5. In the embodiment 6, the common portions are labeled as the common symbols. Hereinafter, the portions which are different from the embodiment 5 are mainly explained.

Figure 40:
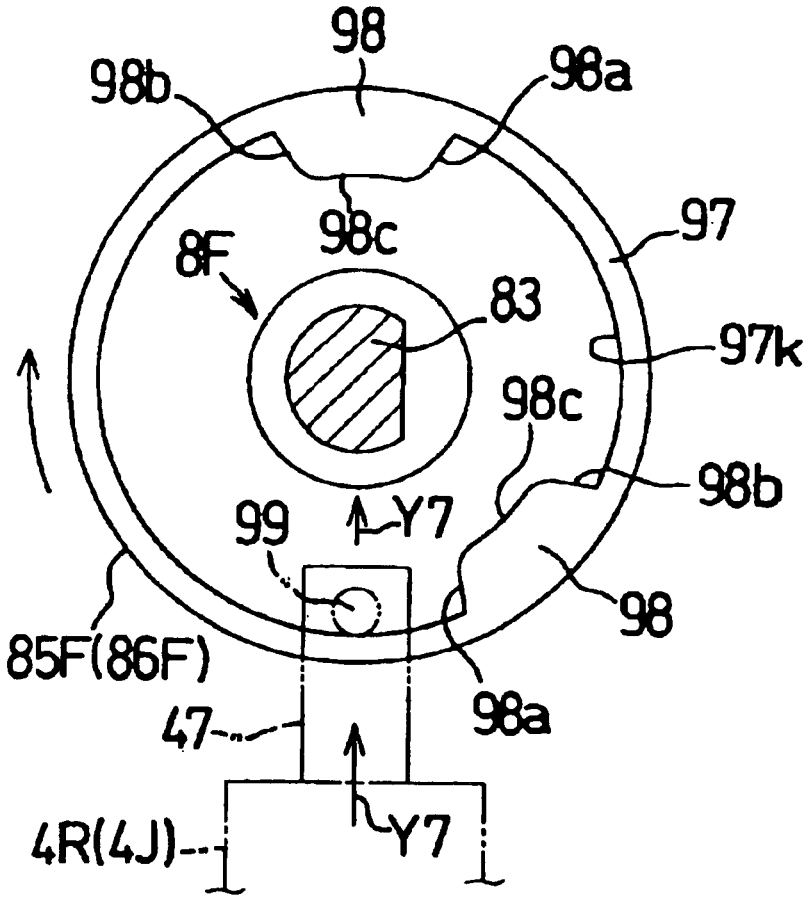
FIG. 40 is a side view of a cam device according to an embodiment 6 in the third invention.

A cam device 8F is attached to a bracket 82 having attachment pieces 81 which are opposed to each other, and the cam device 8F includes a rotation axis 83 which is erected along the horizontal direction of the attachment pieces 81, a first cam 85F and a second cam 86F which are held to the rotation axis 83 integrally and coaxially. As shown in FIG. 40, the first cam 85F has a ring wall portion 97 which encircles in the peripheral direction and plural cam portions 98 which are mounted on an inner peripheral surface of the ring wall portion 97 in such a manner that they are protruded inwardly. The cam portion 98 has slant surfaces 98*a*, 98*b* which are against to each other in the peripheral direction and a connecting surface 98*c* by which the slant surface 98*a* and the slant surface 98*b* are connected to each other.

The open/close valves 4R and 4J of the embodiment 6 show the form in which a shaft 47 is pulled to open the valve. At an upper end portion of the shaft 47 which is mounted on the open/close valves 4R and 4J, a pin-shaped stopper 99 which forms a cross-sectional circular shape is mounted.

When the first cam 85F is rotated in the peripheral direction by rotating the rotation axis 83 of the cam device 8F, the stopper 99 and the shaft 47 are pulled toward the direction of an arrow Y7, namely, upward, due to the slant surface 98*a* of the cam portion 98. Furthermore, the stopper 99 and the shaft 47 is continued to be pulled upward by the connecting surface 98*c* of the cam portion 98. Moreover, when the first cam 85F is rotated, the stopper 99 is moved down along the slant surface 98*b* due to a spring which pushes the shaft 47 or gravity. After that, the stopper 99 is relatively moved along an inner peripheral surface 97*k* of the ring wall portion 97. A peripheral length of the connecting surface 98*c* is an area where the stopper 99 and the shaft 47 are lifted to open the open/close valve 4R, so the peripheral length can be set properly.

The above explanation relates to a cam function of the first cam 85F which opens and closes the open/close valve 4R. However, the second cam 86F exhibits the same cam function as that of the first cam 85F, and it opens and closes the open/close valve 4J.

Figure 39:
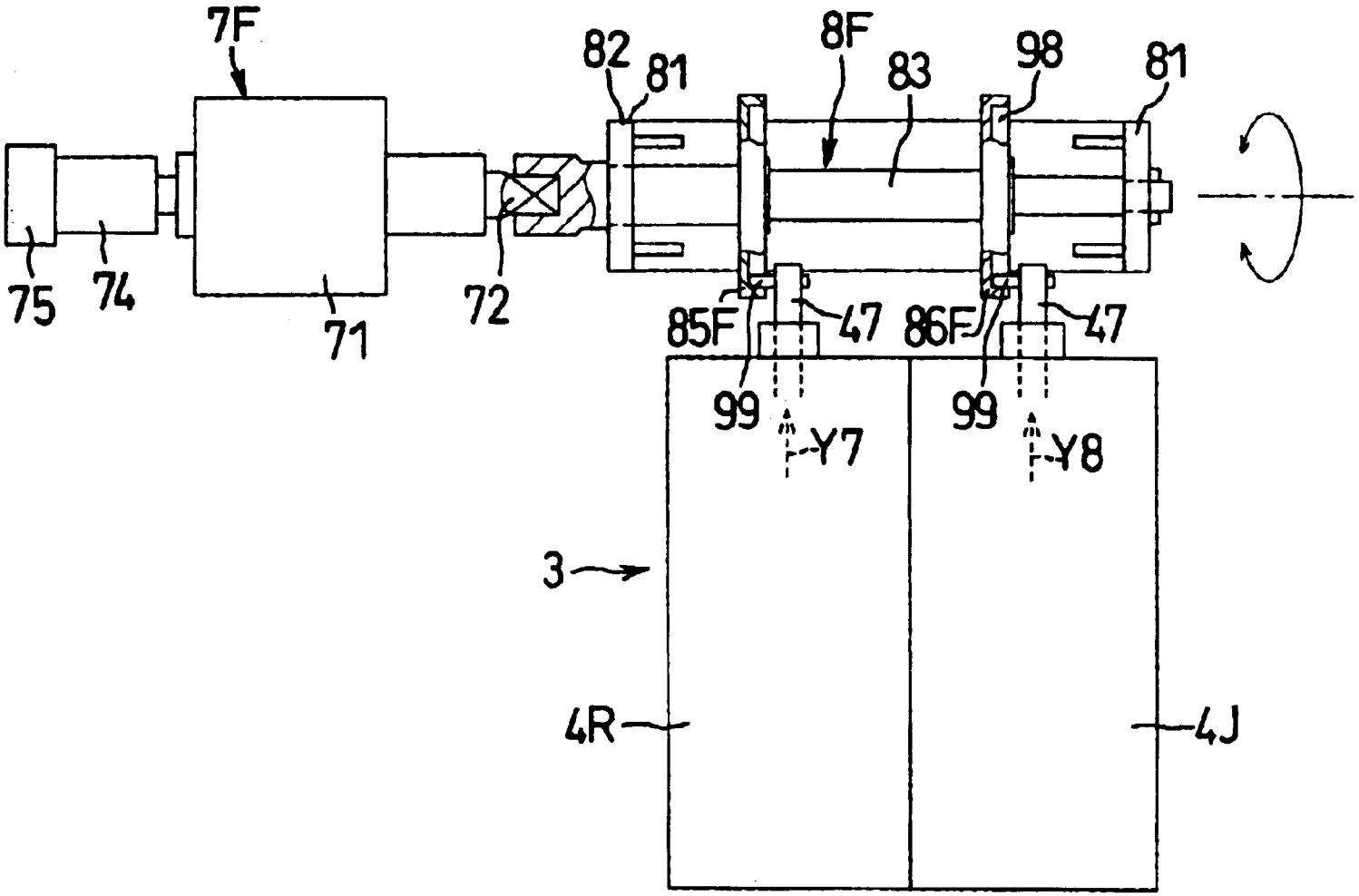
FIG. 39 is a front view of a toilet washing device which uses a jet open/close valve, a rim open/close valve and a cam device according to an embodiment 6 in the third invention.

As shown in FIG. 39, a driving device 7F is coaxially mounted at an axial end portion of a rotation axis 83. The driving device 7F includes a motor 71 having a motor axis 72 which is engaged with an axial end portion of a rotation axis 73.

When the toilet bowl 11 is washed, in the same manner as the above, the motor 71 of the driving device 7F is driven.

Then, the motor axis 72 and the rotation axis 83 are integrally rotated, and the first cam 85F and the second cam 86F are rotated. Due to the rotation of the first cam 85F, the cam portion 98 of the first cam 85F pulls the shaft 47 of the rim open/close valve 4R toward the direction of an arrow Y7, namely, upward, to open the rim open/close valve 4R. Accordingly, in the same manner as the above, water is supplied to the rim channel 12 by way of the rim conduit 19, and an inner wall surface of the bowl portion 10 is washed.

In accordance with further driving of the cam device 8F, the first cam 85F doesn't come to pull the shaft 47 of the rim open/close valve 4R toward the direction of an arrow Y7, the rim open/close valve 4R is closed. After that, the cam portion 98 of the second cam 86F pulls the shaft 47 of the jet open/close valve 4J toward the direction of an arrow Y8 to open the jet open/close valve 4J. Accordingly, water is supplied to the jet nozzle 15 by way of the jet conduit 18 to generate a siphon effect in the trap portion 14 forcibly.

Next, the second cam 86F doesn't come to pull the shaft 47 of the jet open/close valve 4J toward the direction of an arrow Y7, and the jet open/close valve 4J is closed. After that, the first cam 85F again pulls the shaft 47 of the rim open/close valve 4R toward the direction of an arrow Y7, and the rim open/close valve 4R is again opened. Accordingly, water is supplied to the rim channel 12 by way of the rim conduit 19, and the bowl portion 10 is sealed with water.

In also the embodiment 6, the shaft 47 of the open/close valves 4J and 4R is extended in the vertical direction of a western-style toilet body. So, it is suppressed that a top end of the shaft 47 is protruded toward the side or the rear, and it is possible to save a mounting space.

Furthermore, the cam device 8F is mounted on an upper end in the axial direction of the open/close valves 4J and 4R, and the cam device 8F is mounted on the mounting space of the open/close valves 4J and 4R. In this respect, it is possible to save the mounting space more.

Fourth Invention

Embodiments 1 and 2 which embody the fourth invention are explained hereinafter in conjunction with drawings 41 to 57.

Embodiment 1

Figure 41:
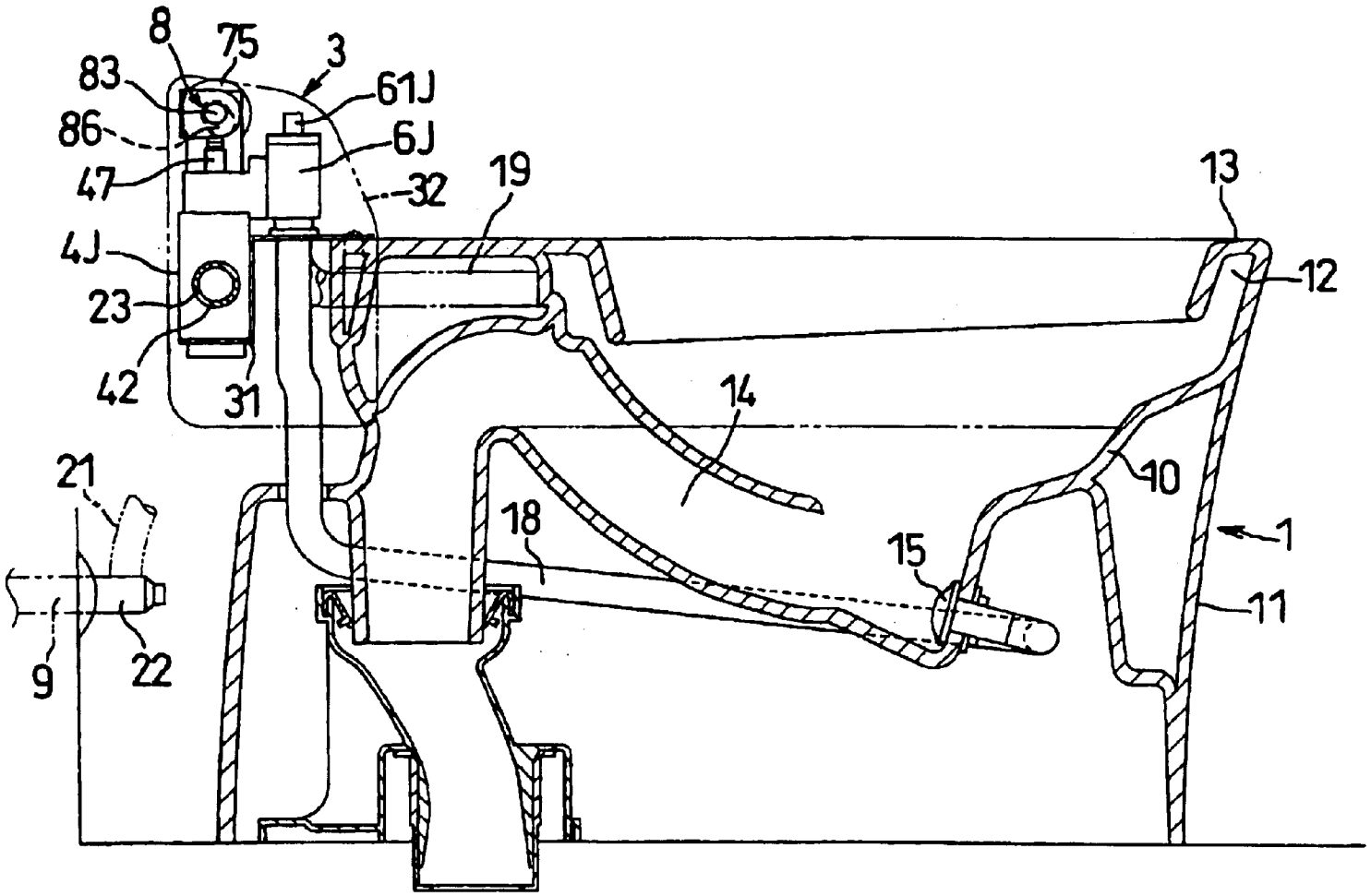
FIG. 41 is a cross-sectional view of an essential portion of a tankless western-style flush toilet according to an embodiment 1 in the fourth invention.

The embodiment 1 is explained in conjunction with drawings 41 to 47. In the embodiment 1, as a western-style flush toilet, a tankless western-style flush toilet having no toilet washing tank embodies the fourth invention. In the tankless western-style flush toilet, as shown in FIG. 41, water is flown in a flow amount of 100% at a stop cock 22 as a flow amount switching valve which is connected to a city water service pipe 9 to try to carry out a flow mode by the divergence of open/close valves 4R and 4J.

A western-style toilet body 1 includes a toilet bowl 11 having a bowl portion 10 which receives filth, a rim 13 having a rim channel 12 which encircles at an upper periphery of the bowl portion 10 and a trap portion 14 which is communicated with the bottom of the bowl portion 10 and which flows the filth out. At an inlet of the trap portion 14, a jet nozzle 15 is formed.

Figure 43:
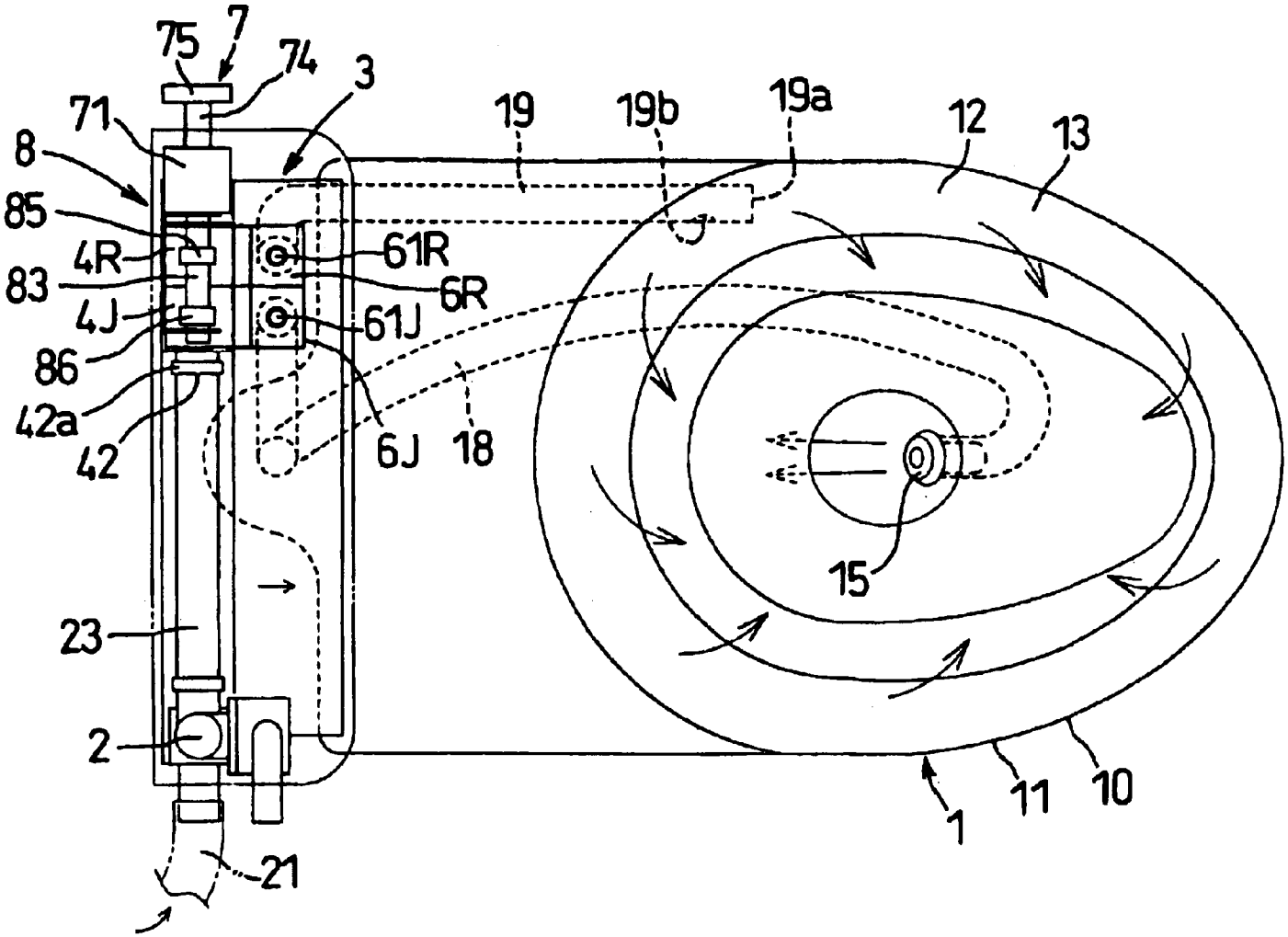
FIG. 43 is a plan view of an essential portion of a tankless western-style flush toilet according to an embodiment 1 in the fourth invention.
Figure 44:
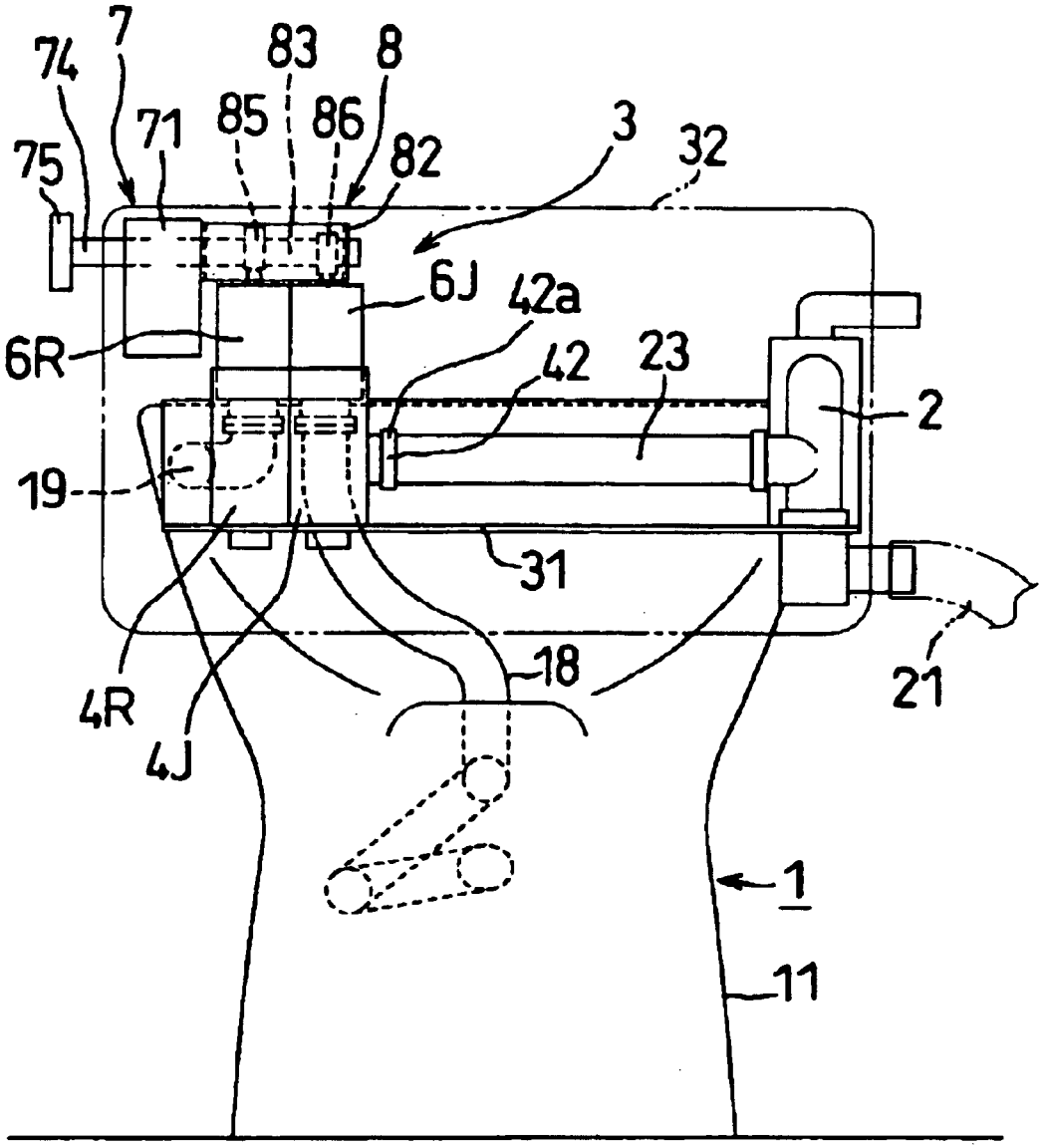
FIG. 44 is a back view of an essential portion of a tankless western-style flush toilet according to an embodiment 1 in the fourth invention.

In the western-style toilet body 1, a jet conduit 18 as a passage for supplying water to the jet nozzle 15 and a rim conduit 19 as a passage for supplying water to the rim channel 12 are mounted. As shown in FIG. 43, the rim conduit 19 includes an opening 19*a* which opens toward a top end side and which is able to spout water clockwise, and an opening 19*b* which opens toward a side surface side and which is able to spout water counter-clockwise.

Figure 42:
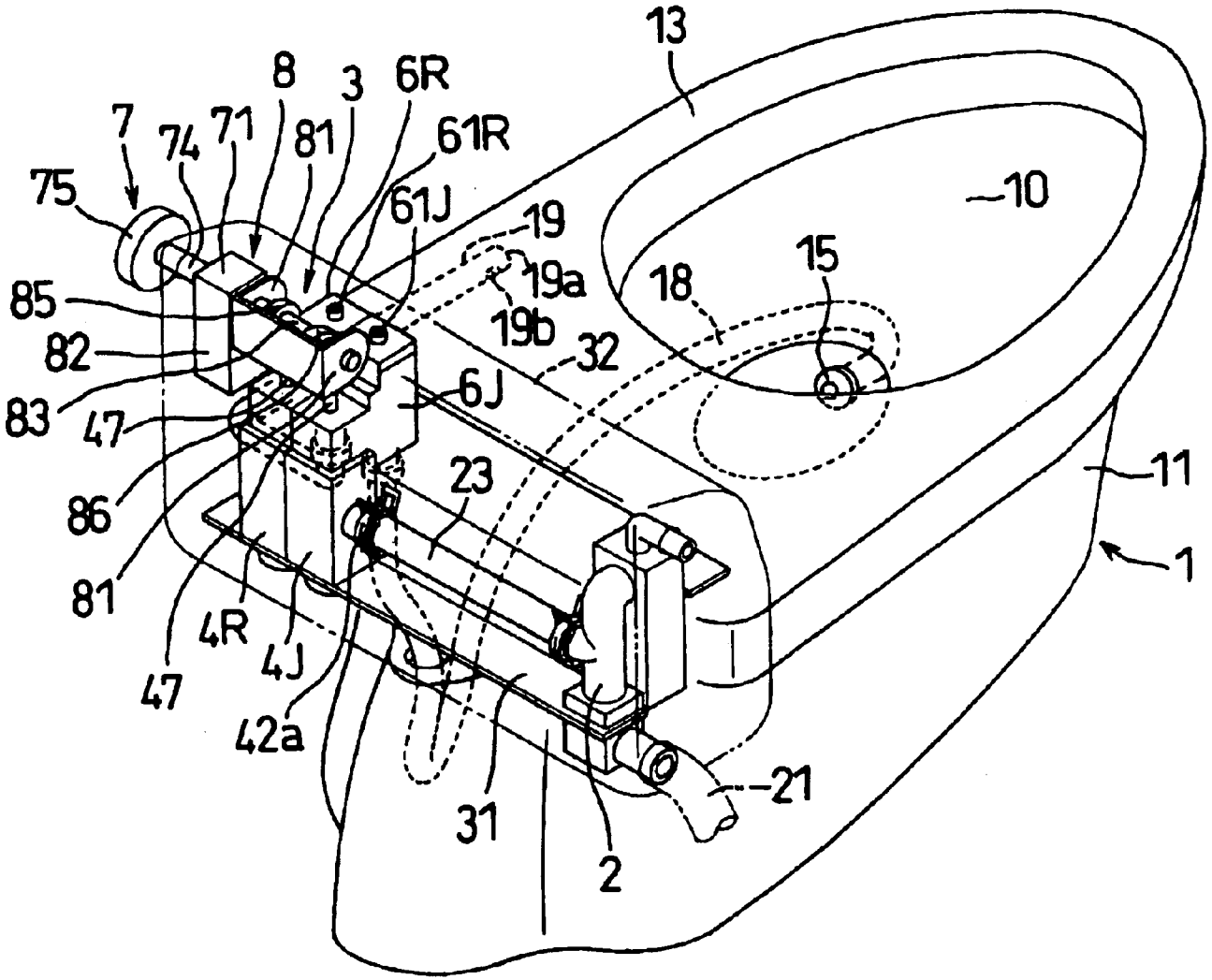
FIG. 42 is a perspective view of an essential portion of a tankless western-style flush toilet according to an embodiment 1 in the fourth invention.

As shown in FIG. 42, at one side of a rear portion in the width direction of the western-style toilet body 1, a branch device 2 which divides water into water for washing a toilet and water for other use is mounted. The branch device 2 is connected to the city water service pipe 9 by way of the stop cock 22 due to a flexible hose 21 which is a part of a water supply system. The stop cock 22 is a well-known rotation top type. The branch device 2 and a toilet washing device 3 are communicated with each other by way of a conduit 23 which is a part of a water supply system, and water which is divided by the branch device 2 is supplied to the toilet washing device 3 which is the rest part of a water supply system by way of the conduit 23. Here, the stop cock 22 to which the flexible hose 21 is connected and the open/close valves 4J and 4R constitute a flow amount switching means. A toilet lid and a toilet seat are not shown in FIGS. 41 to 44.

As shown in FIG. 42, the toilet washing device 3 is assembled to a base plate 31 which is held at the rear portion of the western-style toilet body 1 in such a manner that the toilet washing device 3 is positioned at the opposite side of the branch device 2, and the toilet washing device 3 is concealed by a cover 32. The toilet washing device 3 comprises a rim open/close valve 4R, a jet open/close valve 4J and a cam device 8 which is functioned as a common driving source for opening and closing the open/close valves 4R and 4J. Two open/close valves 4R and 4J are in a longitudinal shape, and they are arranged in such a manner that they are adjacent to each other. Due to this, it is attempted that the toilet washing device 3 becomes compact.

Figure 45:
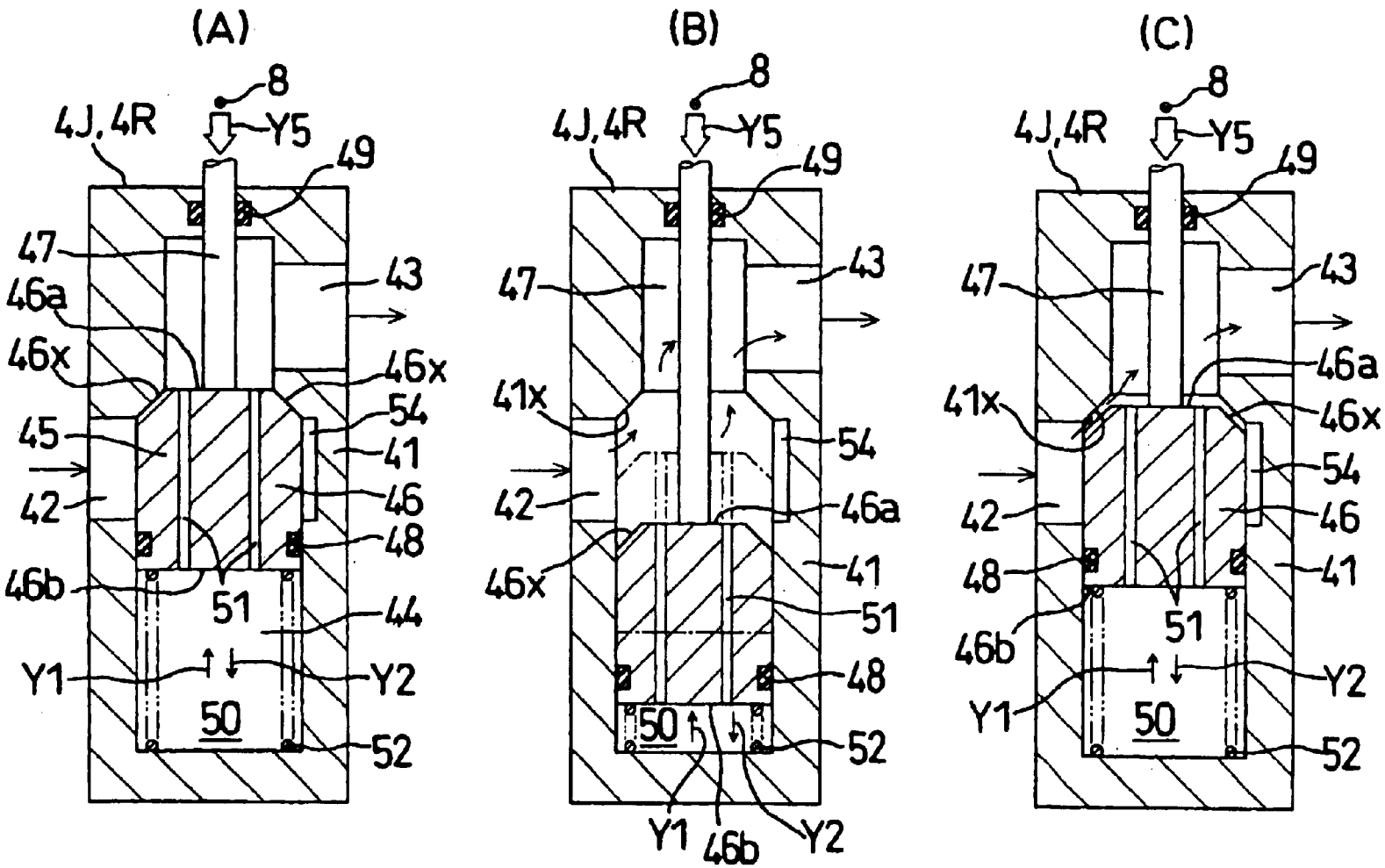
FIG. 45(A) is a cross-sectional view of an open/close valve which is in the closed condition according to an embodiment 1 in the fourth invention.
FIG. 45(B) is a cross-sectional view of an open/close valve which is in the open condition according to an embodiment 1 in the fourth invention and FIG. 45(C) is a cross-sectional view of an open/close valve in a flow mode according to an embodiment 1 in the fourth invention.
Figure 46:
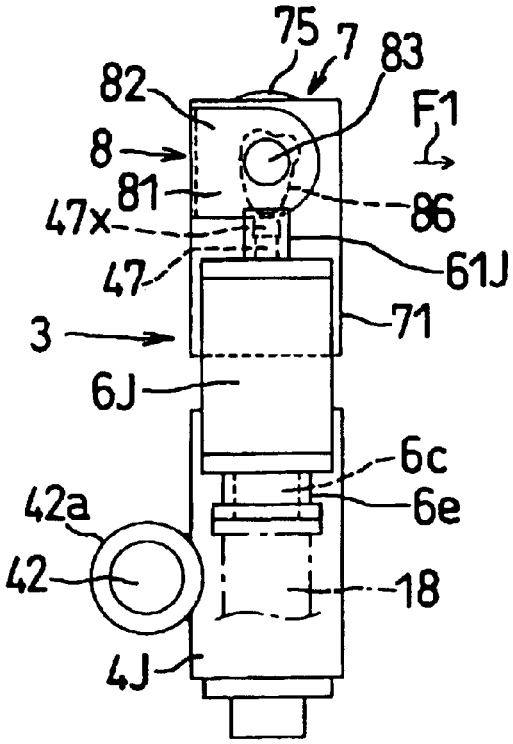
FIG. 46 is a side view of a toilet washing device according to an embodiment 1 in the fourth invention.

As shown in FIGS. 45(A) and 45(B), the jet open/close valve 4J has a longitudinal-shape valve housing 41 which has a water-in port 42 for taking water in and a water-out port 43 for spouting water out, and a valve mechanism 45 which is mounted on the valve housing 41. In the inside of the valve housing 41, a piston room 44 which is communicated with the water-in port 41 and the water-out port 43 is formed. The valve mechanism 45 comprises a piston 46 which is slidably mounted on the piston room 44, and a shaft 47 which is coaxially fixed to one end surface (an upper end surface) 46*a* of the piston 46 in such a manner that the shaft 47 is protruded upward from an upper end of the valve housing 41. The shaft 47 is positioned upward from the piston 46, and it forms a cross-sectional circular shape. The shaft 47 is formed of a metal or a hard resin, and it has rigidity, which is different from a chain. The shaft 47 is extended along the vertical direction of the western-style toilet body 1, namely, the height direction of the western-style toilet body 1. Thus, if the shaft 47 is extended in the vertical direction, a top end portion of the shaft 47 can be prevented from being protruded remarkably toward the rear of the western-style toilet body 1, and this can contributes to the saving of the mounting space. A boundary area between the shaft 47 and the valve housing 41 is sealed by an O ring 49.

In the valve housing 41, the water-in port 42 opens at a peripheral surface side of the piston 46, and it is communicated with the conduit 23. The water-out port 43 opens while bending from the side of one end surface 46*a* of the piston 46 in the axial direction to a side surface side of the valve housing 41. In FIGS. 45(A) and 45(B), the water-out port 43 is not fundamentally shown in a cross section, but it is shown in a cross section in order to make the understanding easy. An O ring 48 is held at a ring groove at an outer peripheral portion of the piston 46, and a boundary area between the outer peripheral portion of the piston 46 and an inner wall surface of the valve housing 41 is sealed by the O ring 48.

In the piston room 44, a pressure offset room 50 is formed by the valve housing 41 and other end surface 46*b* of the piston 46. The pressure offset room 50 is communicated with the side of the water-out port 43 by way of plural communication holes 51 as passages which are formed in the piston 46. Each communication hole 51 communicates the side of one end surface 46*a* of the piston 46 with the side of the other end surface 46*b* of the piston 46 in the axial direction. In the pressure offset room 50, a push coil spring 52 as a force act means is coaxially arranged. The push coil spring 52 is disposed between the valve housing 41 and the other end surface 46*b* of the piston 46, and it always pushes the piston 46 toward the direction of an arrow Y1, namely, upward. So, a slant surface 46*x* of the piston 46 is attached to a seat face 41*x* in the slanted condition of a valve housing 41*k*, and the communication between the water-in port 42 and the water-out port 43 is closed.

If being explained more, the communication between the water-in port 42 and the water-out port 43 is opened and closed by the piston 46, so the piston 46 receives the pressure on the other side, namely, in the direction of an arrow Y2, by means of water in the water-out port 43. Due to the pressure on the other side like this, there is a fear that the smooth slidability of the piston 46 in the axial direction is hindered. In this respect, in the open/close valves 4J and 4R, the pressure offset room 50 is formed at the other side of the piston 46, and the side of one end surface 46*a* of the piston 46 is communicated with the pressure offset room 50 by plural communication holes 51. So, water existed in the side of one end surface 46*a* of the piston 46 is moved to the pressure offset room 50 by way of the communication hole 51 to attempt to keep the balance between the pressure of water in the pressure offset room 50 and the pressure of water in the side of one end surface 46*a* of the piston 46. As a result, the difference of the pressure between them can be canceled or decreased. Due to this, the slidability of the piston 46 in the axial direction can be ensured.

The shaft 47 is protruded upward from the valve housing 41, and the shaft 47 is pushed toward the direction of an arrow Y5, namely, downward by the cam device 8. When a top end of the shaft 47 is pushed toward the direction of an arrow Y5 by the cam device 8, the piston 46 is interlocked with the top end of the shaft 47 to be slided in the same direction as that of the top end of the shaft 47. Then, the piston 46 is detached from the seat face 41*x* to communicate the water-in port 42 with the water-out port 43.

An inner constitution of the rim open/close valve 4R is substantially the same as that of the jet open/close valve 4J, so an explanation thereof is omitted. The water-in port 42 of the jet open/close valve 4J and the water-in port 42 of the rim open/close valve 4R are communicated with each other by way of a ring-shaped communication passage 54 which is formed between the valve housing 41 and an outer peripheral surface of the piston 46.

In the toilet washing device 3, as shown in FIG. 42, a connecting member 6J is mounted on the jet open/close valve 4J in such a manner that the connecting member 6J is protruded toward a front portion of the toilet bowl 11. A vacuum breaker 61J is integrally mounted at an upper end portion of the connecting member 6J. The vacuum breaker 61J is communicated with the water-out port 43 of the jet open/close valve 4J, and at the same time, it is communicated with an air. As shown in FIG. 42, a connecting member 6R is mounted on the rim open/close valve 4R in such a manner that the connecting member 6R is protruded toward a front portion of the toilet bowl 11. A vacuum breaker 61R is integrally mounted at an upper end portion of the connecting member 6R. The vacuum breaker 61R is communicated with the water-out port 43 of the jet open/close valve 4R, and at the same time, it is communicated with an air.

Figure 47:
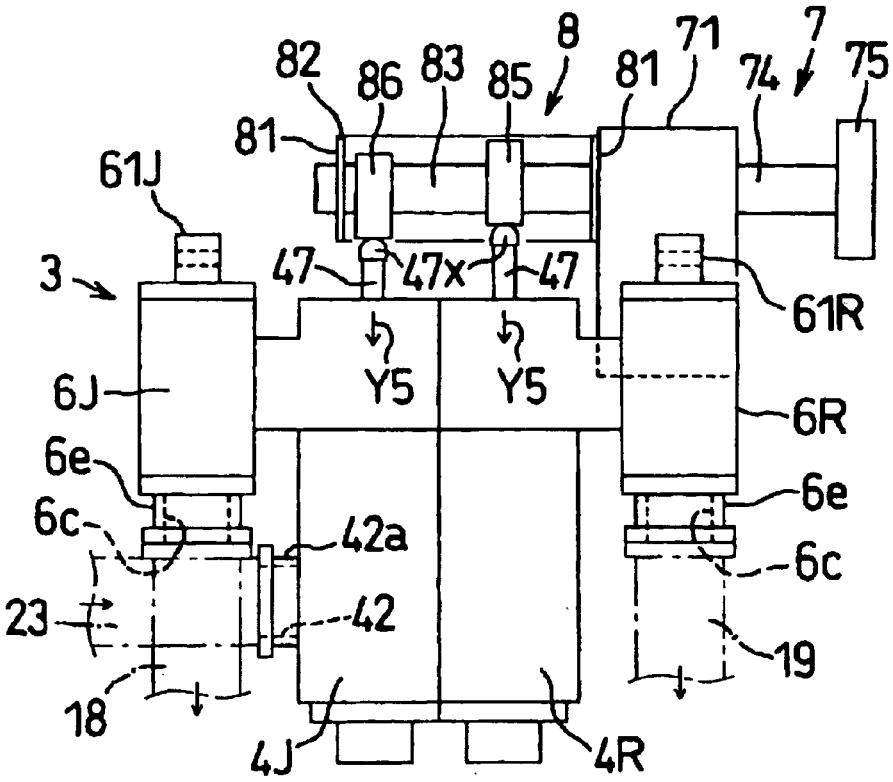
FIG. 47 is a front view of a toilet washing device according to an embodiment 1 in the fourth invention.

As shown in FIG. 47, a flange 42*a* is formed at the water-in port 42, and a top end of the conduit 23 is connected to the flange 42*a*. Furthermore, a flange 6*e* is formed at the connecting members 6J and 6R respectively, and a water-out port 6*c* of each flange 6*e* is connected to the jet conduit 18 and the rim conduit 19 respectively.

As shown in FIG. 42, the toilet washing device 3 includes the cam device 8 for carrying out the open/close operation of the jet open/close valve 4J and the rim open/close valve 4R. The cam device 8 is mounted on an upper end of the open/close valves 4R and 4J in the axial direction, and it is fixed to a bracket 82 having two mounting pieces 81 which are protruded forward, in other words, toward a front portion side of the toilet bowl 11. Namely, the cam device 8 comprises a rotation axis 83 as a rotation body which is rotatably held at the mounting piece 81 in the horizontal condition, a first cam 85 and a second cam 86 which are mounted in parallel on the rotation axis 83 in such a manner that they are protruded in the axially right-angled direction. The rotation axis 83 is mounted in such a manner that the rotation axis 83 is extended along the width direction of the toilet bowl 11. When the rotation axis 83 is rotated, the first cam 85 and the second cam 86 are rotated along the height direction of the toilet bowl 11. Due to this, as shown in FIG. 47, a cam surface at an outer periphery of the first cam 85 is brought into contact with a slider 47*x* at an upper end of the shaft 47 of the rim open/close valve 4R to move the slider 47*x* downward (toward the direction of an arrow Y5). At the same time, a cam surface at an outer periphery of the second cam 86 is brought into contact with a slider 47*x* at an upper end of the shaft 47 of the jet open/close valve 4J to move the slider 47*x* downward.

In the toilet washing device 3, a driving device 7 by which the cam device 8 is driven is mounted in such a manner that the driving device 7 is adjacent to the cam device 8. The driving device 7 is fixed to one mounting piece 81 of the bracket 82, and a motor 71 and a reduction gear which transmits rotation force of the motor 71 to the rotation axis 83 are contained in the driving device 7. The rotation axis 83 can be rotatingly driven by controlling a controller which is not shown in the drawing. Furthermore, a manual axis 74 which rotates the rotation axis 83 of the cam device 8 manually is mounted on the driving device 7 in such a manner that the manual axis 74 is positioned at the side of the western-style toilet body 1. The manual axis 74 has an operation handle 75, and they can be detached with respect to the toilet washing device 3. When the user doesn't use the toilet, only if the manual axis 74 is detached, it is possible to attempt the saving of spaces. Moreover, as shown in FIG. 42, the above open/close valves 4R and 4J, the motor 71 and the cam device 8 are mounted at a rear portion of the western-style toilet body 1 by means of a single common base plate 31.

In the tankless western-style flush toilet which is constituted as above, water is supplied to the toilet washing device 3 by way of the city water service pipe 9, the stop cock 22, the flexible hose 21, the branch device 2 and the conduit 23. In the toilet washing device 3, as far as the user doesn't carry out the switch operation in order to wash the toilet bowl 11, both of the open/close valves 4J and 4R are closed. Namely, if being explained by FIGS. 45(A) and 45(B), the piston 46 is moved to one side in the axial direction, in other words, the direction of an arrow Y1, by act force of the push coil spring 52. Due to this, as shown in FIG. 45(A), the slant surface 46*x* of the piston 46 is attached to the seat face 41*x* of the valve housing 41, and an outer peripheral surface of the piston 46 closes the water-in port 42. At the same time, one end surface 46*a* of the piston 46 closes the water-out port 43. Accordingly, the communication between the water-in port 42 and the water-out port 43 is closed, and water is not supplied to the western-style toilet body 1.

When the toilet bowl 11 is washed, in accordance with the switch operation of the user, the motor 71 of the driving device 7 is driven by a signal of the controller, and the rotation axis 83 is rotatingly driven. Due to this, a cam surface of the first cam 85 pushes the shaft 47 of the rim open/close valve 4R downward (toward the direction of an arrow Y5) to open the rim open/close valve 4R. If being explained by FIGS. 45(A) and 45(B), the push coil spring 52 is elastically contracted, and the piston 46 is moved to the other direction of the axial direction, namely, it is moved down toward the direction of an arrow Y2. Accordingly, as shown in FIG. 45(B), the piston 46 is detached from the seat face 41*x* of the valve housing 41 to open the communication between the water-in port 42 and the water-out port 43. As a result, the toilet washing device 3 supplies water to the rim channel 12 by way of the rim conduit 19, and an inner wall surface of the bowl portion 10 is washed.

In accordance with the driving of the cam device 8, the cam surface of the first cam 85 doesn't come to push the shaft 47 of the rim open/close valve 4R downward, and the rim open/close valve 4R is closed. After that, the cam surface of the second cam 86 pushes the shaft 47 of the jet open/close valve 4J downward to open the jet open/close valve 4J. Due to this, the toilet washing device 3 supplies water to the jet nozzle 15 by way of the jet conduit 18 to generate a siphon effect in the trap portion 14 forcibly.

Next, in accordance with the driving of the cam device 8, the cam surface of the second cam 86 doesn't come to push the shaft 47 of the jet open/close valve 4J downward, and the jet open/close valve 4J is closed. After that, the cam surface of the first cam 85 again pushes the shaft 47 of the rim open/close valve 4R downward to open the rim open/close valve 4R again. Due to this, the toilet washing device 3 supplies water to the rim channel 12 by way of the rim conduit 19 to seal the bowl portion 10 with water.

During the cold season, there is a possibility that the city water service pipe 9, the stop cock 22, the flexible hose 21, the branch device 2 and the conduit 23 are frozen. So, when the freezing is expected, a flow mode by the open/close valves 4J and 4R are previously carried out. Namely, in the flow mode according to the embodiment 1, the opening degree of the stop cock 22 is maintained in order to flow water in a flow amount of 100%. At the same time, as shown in FIG. 45(C), the divergence of the open/close valves 4J and 4R becomes small in order to carry out the flow mode due to the open/close valves 4J and 4R. In this flow mode, the divergence is made to be approximately 2 to 5% by setting a profile of the cam surface of the first cam 85 and the second cam 86 of the cam device 8 if the divergence of the open/close valves 4J and 4R for communicating the water-in port 42 and the water-out port 43 completely is made to be 100%.

In such a flow mode, the balance between upward act force due to the push coil spring 52 and downward force due to the cam device 8 is kept, and the piston 46 is slightly detached from the seat face 41*x* of the valve housing 41 to be maintained. In this condition, the water-in port 42 and the water-out port 43 are opened very slightly, and it is possible to flow a small amount of water continuously to the western-style toilet body 1, and it is possible to prevent the freezing of the city water service pipe 9, the stop cock 22, the flexible hose 21, the branch device 2 and the conduit 23 during the cold season. Since the freezing can be prevented like this, when the western-style toilet body 1 is used during the cold season, only if the user drives the cam device 8 by the switch operation, it is possible to flow water to the western-style toilet body 1 to remove filth excellently. Accordingly, in a tankless western-style flush toilet which adopts such a water supply method, there is no restriction for use which becomes hindrance in a daily life, and also, this tankless western-style flush toilet becomes sanitary.

Furthermore, even at the time of power failure or breakdown of the motor, only if the operation handle 75 is operated and the rotation axis 83 of the cam device 8 is manually driven by the manual axis 74, not only the washing of the western-style toilet body 1 but also the flow mode is carried out.

Moreover, in the flow mode according to the embodiment 1, if the first cam 85 and the second cam 86 of the cam device 8 is rotated in a small angle, it is possible to spout water continuously to the western-style toilet body 1 to prevent the freezing of water, and at the same time, it is possible to make the divergence of the open/close valves 4J and 4R small at every predetermined time. Due to this, it is possible to intermittently reduce the amount of water to be spouted to achieve the saving of water.

In addition, in the embodiment 1, the shaft 47 has a constitution in which the shaft 47 is pushed by the cam device 8 in order to open the communication between the water-in port 42 and the water-out port 43. So, the constitution becomes relatively simple, and it is possible to reduce the manufacturing cost.

Embodiment 2

Figure 48:
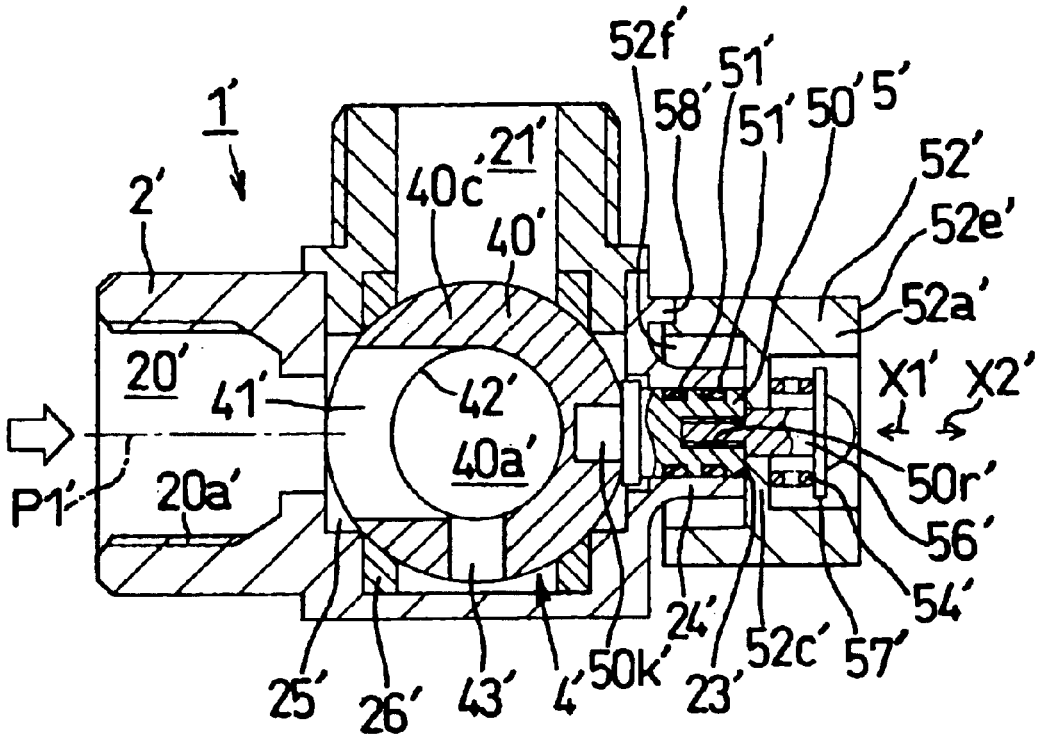
FIG. 48 is a cross-sectional view of a step stop cock for showing the condition that a flow amount of water spouted from a water-out port is 0% according to an embodiment 2 in the fourth invention.

The embodiment 2 is explained in conjunction with drawings 48 to 57. In a tankless western-style flush toilet of the embodiment 2, as shown in FIG. 48, a flow mode is carried out by a step stop cock 1' which is connected to a city water service pipe 9', and water is flown in a flow amount of 100% in the same open/close valve as that of the embodiment 1.

The main constituent elements of the step stop cock 1' are a housing 2' having a water-in port 20' and a water-out port 21' which is formed in the direction that the water-in port 20' is crossed over the water-out port 21', and a valve mechanism 4' which is able to stop water between the water-in port 20' and the water-out port 21'.

At an inner peripheral portion of the water-in port 20', a female screw portion 20*a*' is formed. By screwing the female screw portion 20*a*' into a male screw portion at an outer peripheral portion of the city water service pipe 9' (refer to FIG. 47), the step stop cock 1' is attached to the city water service pipe 9' (refer to FIG. 57).

In the housing 2', a valve room 25' which is communicated with both of the water-in port 20' and the water-out port 21' is formed therebetween. Furthermore, in the housing 2', a cylinder portion 24' having a communication hole 23' is coaxialy formed at the opposite side of the water-in port 20'. The valve mechanism 4' is contained in the valve room 25', and it has a spherical valve body 40' which has a hollow room 40*a*' and which can be rolled. The valve body 40' is held at a valve holder 26' of the valve room 25' in such a manner that the valve body 40' can be rotated around an axis core P1' of the water-in port 20'. The valve 40' has a first main opening 41' which has a large opening area and which is opposite to the water-in port 20', a second main opening 42' which has almost the same opening area as that of the first main opening 41' and a sub opening 43' which has a smaller opening area than that of the first main opening 41' and the second main opening 42' The first main opening 41', the second main opening 42' and the sub opening 43' are passed through along the radial direction of the valve body 40' in such a manner that they are crossed with each other to be communicated with the hollow room 40*a*'. If the valve body 40' is rotated around the axis core P1', the main opening 41' is always opposite to the water-in port 20'.

On the housing 2', an operation portion 5' which is operated for opening and closing the valve body 40' is mounted. The operation portion 5' includes a rotation axis 50' which is held in the communication hole 23' of the housing 2' in such a manner that the rotation axis 50' can be rotated around the axis core P1' of the water-in port 20', an operation lug 52' which can be rotated by the user and a force act spring 54' which is functioned as a force act means. An O ring 51' is disposed between the rotation axis 50' and an inner peripheral surface of the communication hole 23', and water is prevented from being dropped between the rotation axis 50' and the housing 2'.

Figure 49:
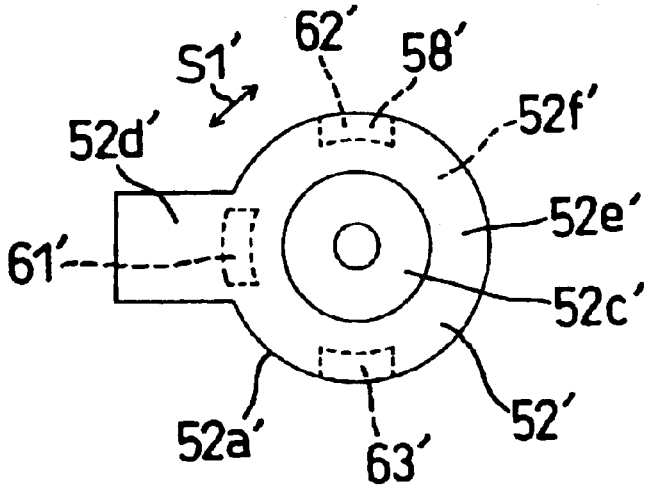
FIG. 49 is an end view of an operation lug of the step stop cock in the condition shown in FIG. 48 according to an embodiment 2 in the fourth invention.

The operation lug 52' has a ring portion 52*a*' which is mounted in such a manner that the ring portion 52*a*' is almost coaxial with the housing 2', and a contact wall portion 52*c*' which is protruded inwardly to the ring portion 52*a*' and at the same time with which an axial end surface of the cylinder portion 24' of the housing 2 is brought into contact. Furthermore, as shown in FIG. 49, at the ring portion 52*a*' of the operation lug 52', a handle portion 52*d*' is protruded in consideration of an operability. The handle portion 52*d*' is protruded outwardly from the operation lug 52' in the radial direction.

Figure 50:
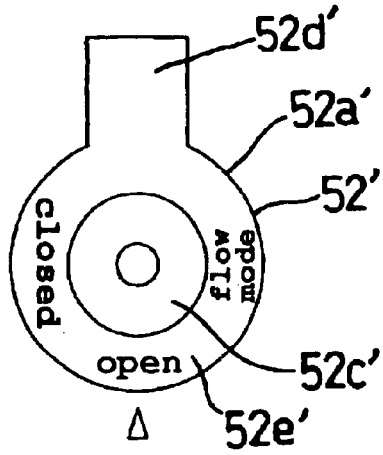
FIG. 50 is an end view of an operation lug according to an embodiment 2 in the fourth invention.

As shown in FIG. 50, on a surface 52*e*' of the operation lug 52', the character of "open" which means the use at an open mode of the step stop cock 1', and the character of "closed" which means the use at a closed mode of the step stopcock 1' are indicated, and at the same time, the character of "flow" which means the use at a flow mode of the step stopcock 1' is indicated. The open mode means that an amount of water which is spouted from the water-out port 21' of the step stop cock 1' is set to be 100%. The closed mode means that an amount of water which is spouted from the water-out port 12' is set to be 0%. The flow mode means that a flow amount of water which is spouted from the water-out port 21' is set to be an intermediate amount (for example, 2 to 5%) with respect to 100%.

Furthermore, as shown in FIG. 48, an attachment portion 50*k*' at a top end of the rotation axis 50' is engaged with and attached to a hole of the valve body 40', and they are rotated integrally. At an axial end surface of the rotation axis 50', a spring hole 50*r*' is formed. An attachment spring 56' is inserted into a transparent hole of the contact wall portion 52*c*' of the operation lug 52', and the male screw portion at a top end of the attachment screw 56' is attached to a spring hole 50*r*'. As a result, the operation lug 52' is rotatably held at the housing 2' of the step stop cock 1'.

The force act spring 54' is disposed between a seat plate 57' of the attachment screw 56' and the contact wall portion 52*c*' of the operation lug 52'. Due to this, the force act spring 54' pushes the operation lug 52' toward the housing 2', namely, toward the direction of an arrow Y1. When force toward the direction of an arrow X2' is acted on the operation lug 52', the force act spring 54' is elastically contracted, and the operation lug 52' can be moved toward the direction which is far from the housing 2', namely, toward the direction of an arrow X2'.

As shown in FIG. 48, in the housing 2', an engaged portion 58' is formed at the opposite portion of a back surface 52*f*' of the operation lug 52'. As shown in FIG. 49, at the back surface 52*f*' of the operation lug 52', a first engage portion 61', a second engage portion 62' and a third engage portion 63' are concavely mounted along the peripheral direction of the operation lug 52*f*' by the predetermined distance. The first engage portion 61' is used at the open mode of the step stop cock 1'. The second engage portion 62' is used at the closed mode of the step stop cock 1'. The third engage portion 63' is used at the flow mode of the step stop cock 1'.

Figure 51:
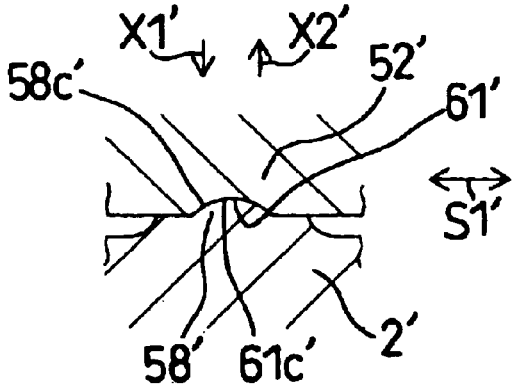
FIG. 51 is a cross-sectional view of an essential portion of a step stop cock according to an embodiment 2 in the fourth invention.
Figure 52:
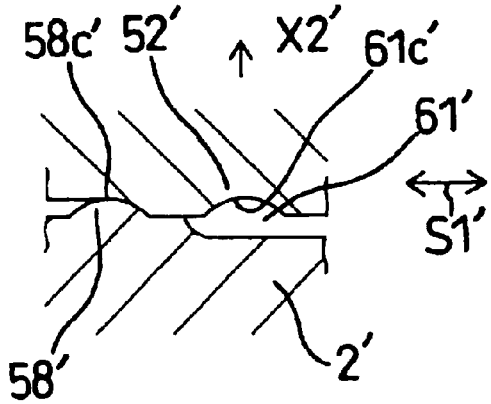
FIG. 52 is a cross-sectional view of an essential portion of a step stop cock according to an embodiment 2 in the fourth invention.

As shown in FIGS. 51 and 52, the engaged portion 58' formed at the housing 2' is in a projected shape, and it includes a gentle circular projected surface 58*c*'. On the other hand, the first engage portion 61' is in a concaved shape, and it is formed by a gentle circular concaved surface 61*c*'. As shown in FIG. 51, when the user carries out the rotation operation of the operation lug 52' toward the peripheral direction, namely, toward the direction of an arrow S1', the first engage portion 61' are detachably engaged with the engaged portion 58'. In this condition, the force act spring 54' pushes the operation lug 52' toward the direction of an arrow X1', so the engaged condition between the first engage portion 61' and the engaged portion 58' is maintained excellently.

As shown in FIG. 52, when the user further carries out the rotation operation of the operation lug 52', the first engage portion 61' is detached from the engaged portion 58' to release the engagement. In this condition, the force act spring 54' is elastically contracted, and the operation lug 52' can be moved toward the direction which is far from the housing 2', namely, toward the direction of an arrow X2'. So, the engagement and the release between the first engage portion 61' and the engaged portion 58' are carried out excellently.

Figure 53:
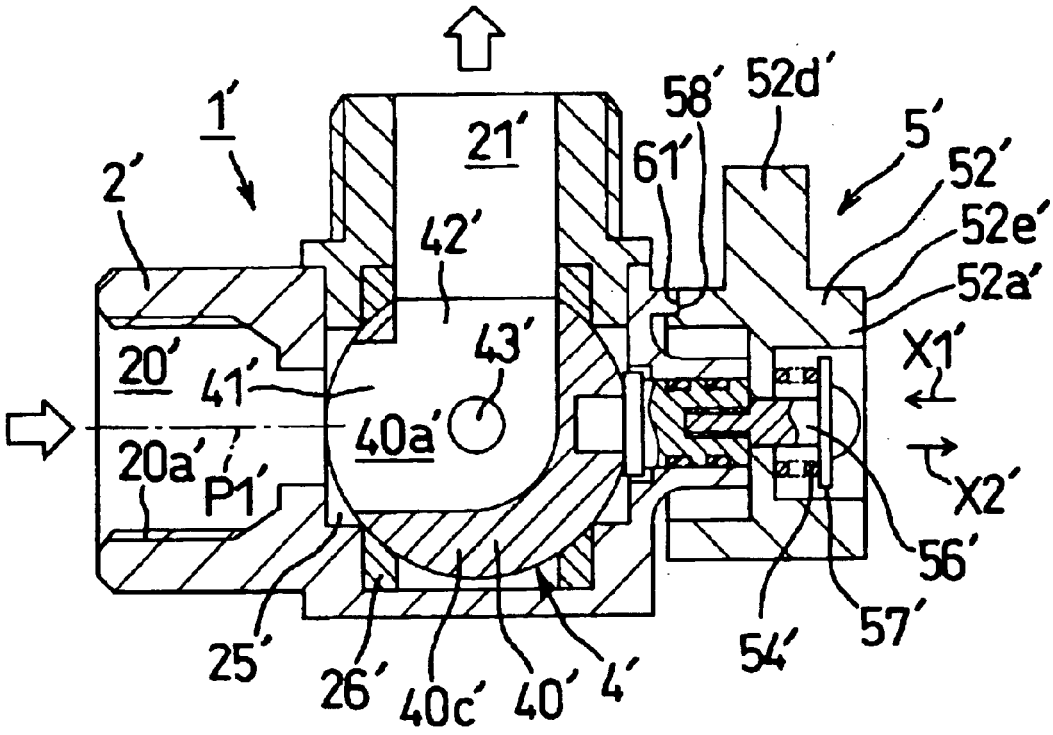
FIG. 53 is a cross-sectional view of a step stop cock for showing the condition that a flow amount of water spouted from a water-out port is 100% according to an embodiment 2 in the fourth invention.
Figure 54:
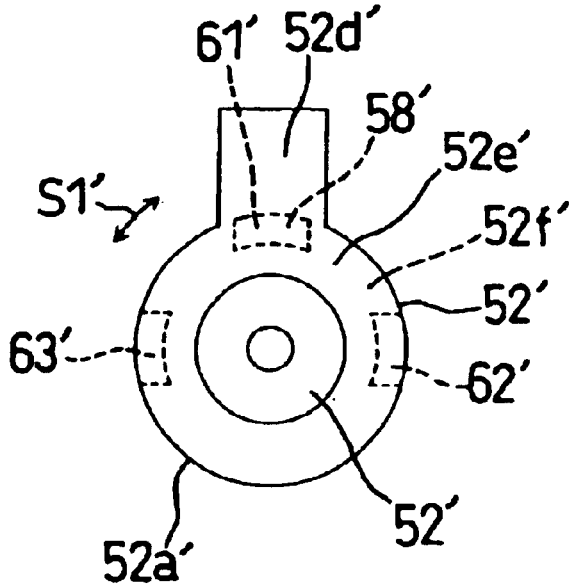
FIG. 54 is an end view of an operation lug of the step stop cock in the condition shown in FIG. 53 according to an embodiment 2 in the fourth invention.
Figure 56:
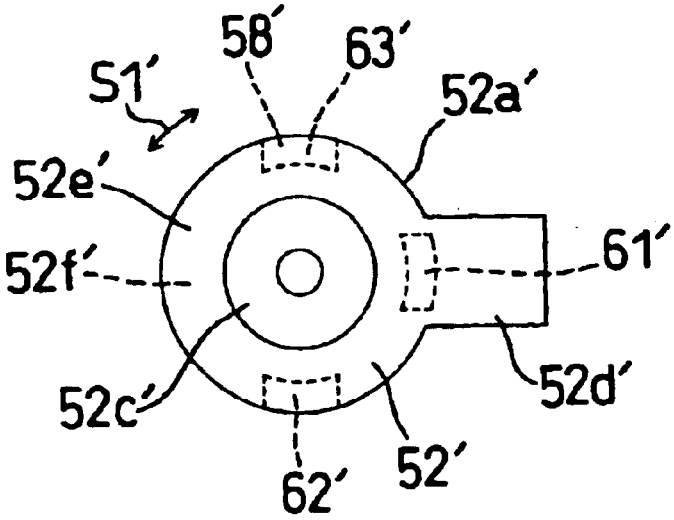
FIG. 56 is an end view of an operation lug of the step stop cock in the condition shown in FIG. 55 according to an embodiment 2 in the fourth invention.

The second engage portion 62' and the third engage portion 63' has also the same costitution as that of the first engage portion 61' although this is not shown in the drawing. So, in accordance with the rotation operation of the operation lug 52', at the time of the closed mode, as shown in FIG. 53, the second engage portion 62' is detachably engaged with the engaged portion 58'. Furthermore, at the time of the flow mode, as shown in FIG. 56, the third engage portion 63' is detachably engaged with the engaged portion 58'.

Figure 57:
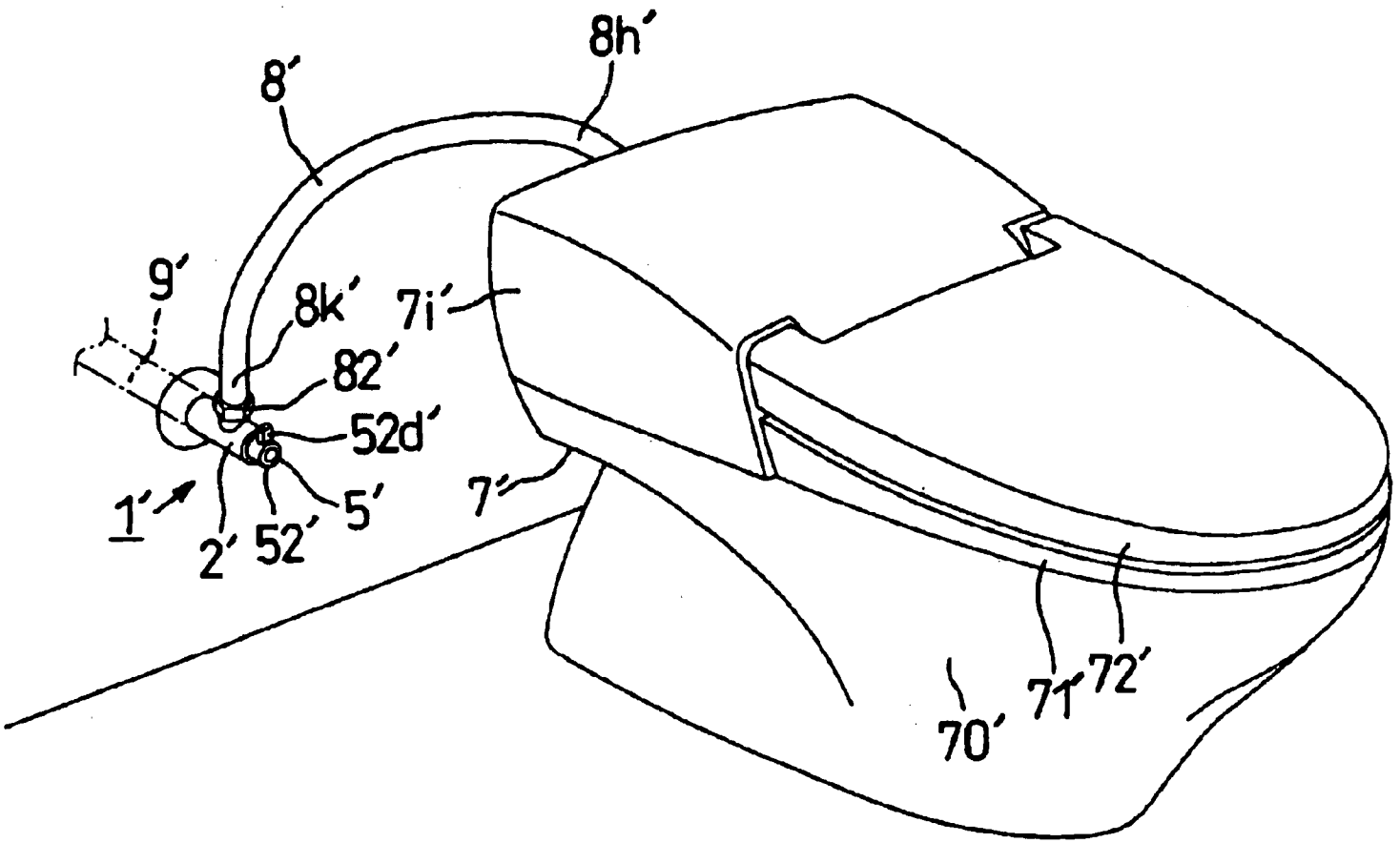
FIG. 57 is a perspective view of a tankless western-style flush toilet according to an embodiment 2 in the fourth invention.

As shown in FIG. 57, a western-style toilet body 7' which is connected to a city water service pipe 9' by way of a step stop cock 1' includes a toilet bowl 70', a toilet seat 71' which is rockably mounted at an upper portion of the toilet bowl 70' and a toilet lid 72'. The western-style toilet body 7' constitutes a tankless western-style flush toilet having no toilet washing tank. The western-style toilet body 7' also includes the same rim open/close valve and the same jet open/close valve as that of the embodiment 1 although this is not shown in the drawing.

Figure 55:
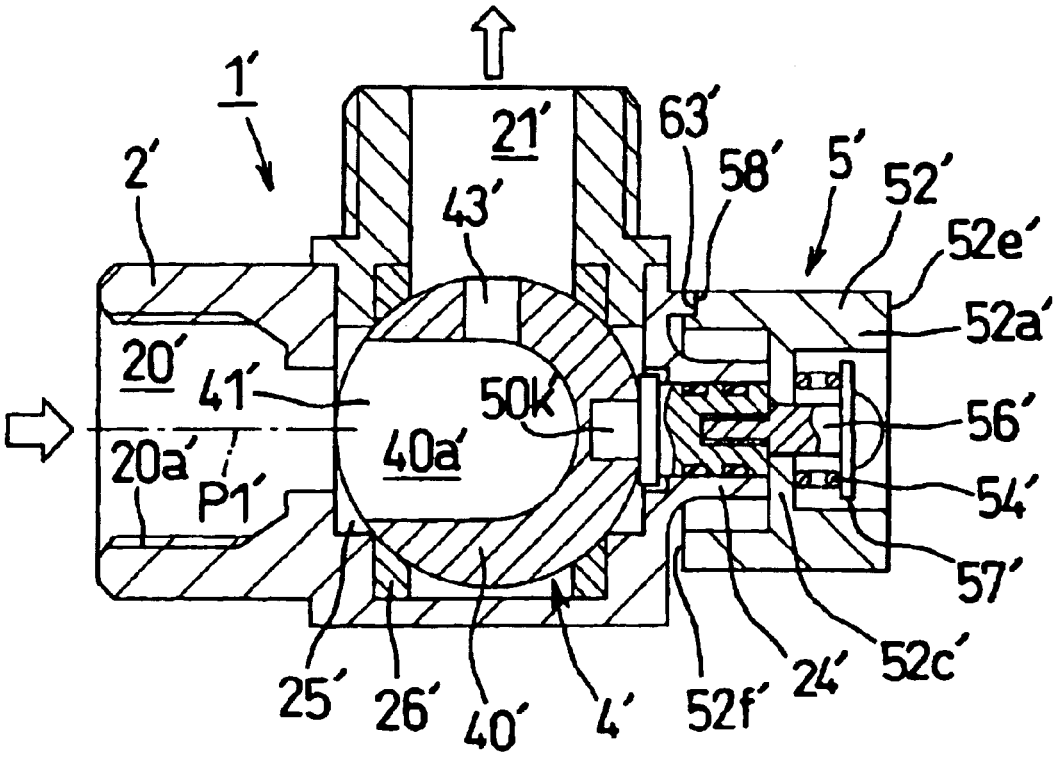
FIG. 55 is a cross-sectional view of a step stop cock for showing the condition of a flow mode according to an embodiment 2 in the fourth invention.

In such a tankless western-style flush toilet, when the freezing of the city water service pipe 9' and the like is expected during the cold season, the user carries out the rotation operation of the operation portion 5' of the step stop cock 1' to switch the operation lug 52' to the flow mode. At the flow mode, in the step stop cock 1', as shown in FIG. 56, the third engage portion 63' is engaged with the engaged portion 58'. In this condition, as shown in FIG. 55, the valve body 40' is rotated around the axis core P1', and the sub opening 43' is opposite to the water-out port 21'. The second main opening 42' faces to this side of a paper face of FIG. 55, so it is not shown in FIG. 55. In the flow mode, the water-in port 20', the sub opening 43' and the water-out port 21' are communicated with each other, so water which is supplied from the city water service pipe 9' is spouted to the water-out port 21' by way of the water-in port 20' and the sub opening 43' of the valve body 40'. So, a small amount of water which is supplied from the city water service pipe 9' is always spouted continuously. At this time, the divergence of the open/close valve which is mounted on the western-style toilet body 7' is maintained at 100%. Thus, in the flow mode, it is possible to prevent the freezing of water at an upstream of the western-style toilet body 7'. Accordingly, in the tankless western-style flush toilet of the embodiment 2, the same effect as that of the embodiment 1 can be exhibited.

Furthermore, in the middle of carrying out the flow mode, when the western-style toilet body 7' is used, it is necessary that a large amount of water is flown to the western-style toilet body 7'. So, the user carries out the rotation operation of the operation lug 52' of the step stop cock 1' to release the flow mode, and to return to the open mode. If the mode is returned to the open mode like this, it is possible to flow water to the western-style toilet body 7' by the switch operation of the user, and it is possible to flow water to remove filth in the western-style toilet body 7'.

Fifth Invention

Embodiments 1 to 6 which embody the fifth invention are explained hereinafter in conjunction with drawings 58 to 73.

Embodiment 1

Figure 58:
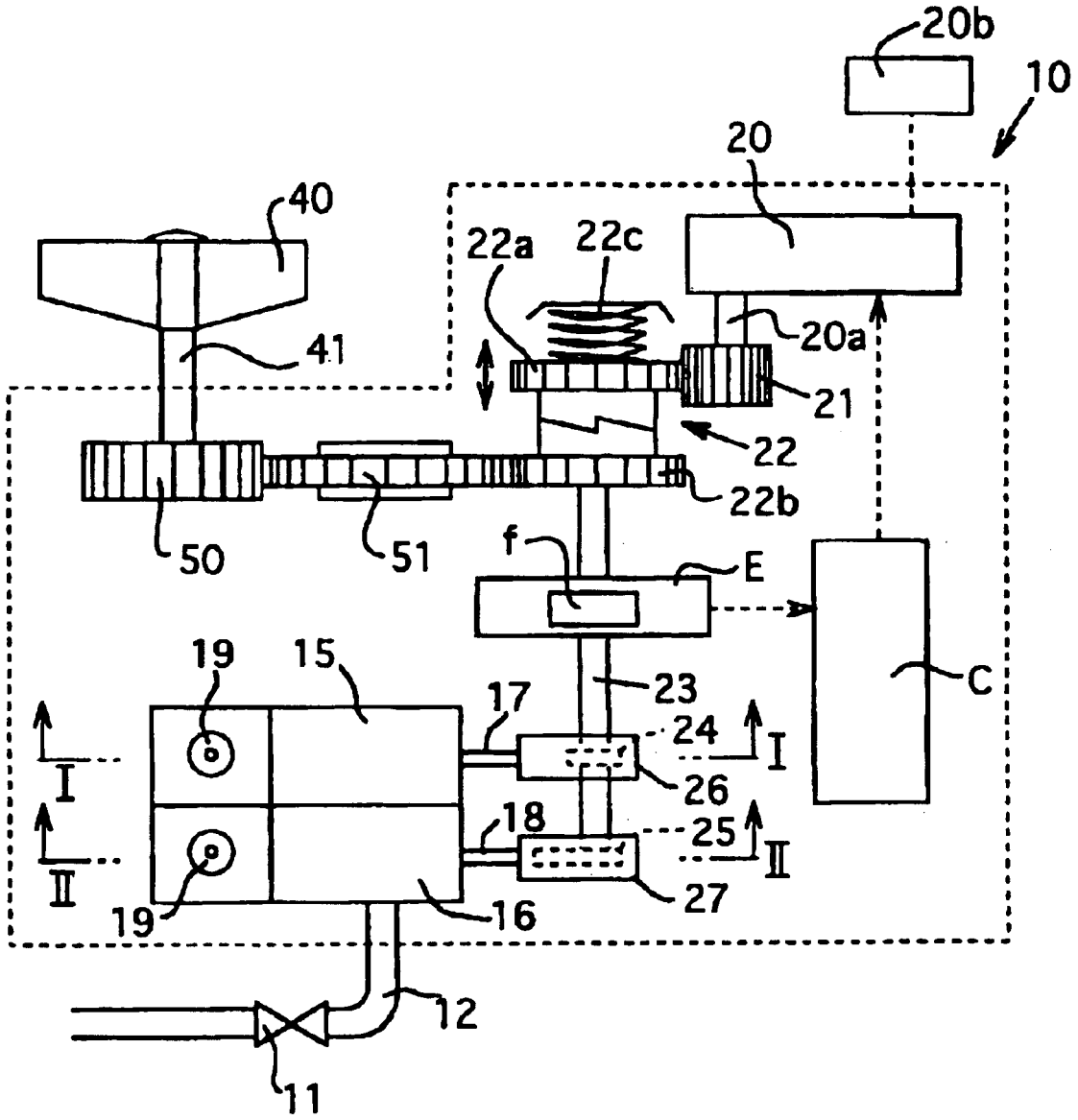
FIG. 58 is a plan view of a flow switching means for showing an outline constitution according to an embodiment 1 of the fifth invention.
Figure 122:
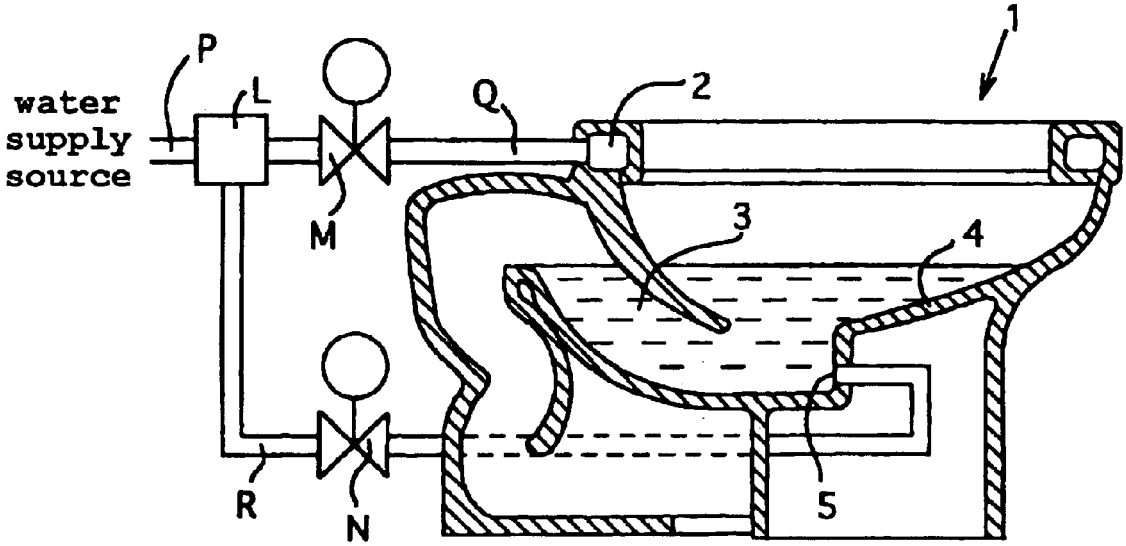

The embodiment 1 is explained in conjunction with drawings 58 to 62. FIG. 58 shows an embodiment in which the fifth invention is applied to a flow passage switching device 10, which generates a siphon effect forcibly by not overlapping the time for supplying water to a rim channel 2 with the time for supplying water to a jet hole 5, instead of, for example, a conventional flow passage switching device of a forced siphon toilet 1 as shown in FIG. 122. Other constitutions of the forced siphon toilet 1 is the same as those of the conventional toilet.

In the embodiment 1, the flow passage switching device 10 is attached to a valve device. In the valve device, water which is supplied from a water supply source by way of a valve 11 and a primary water supply pipe 12 to the rim channel 2 and the jet hole 5. The valve device comprises an open/close valve 15 for the rim channel 2 and an open/close valve 16 for the jet hole 5. It is preferable that a constant flow amount mechanism is contained in the open/close valves 15 and 16, or that the valve 11 is a constant flow amount valve without containing a constant flow amount mechanism in the open/close valves 15 and 16.

In the flow passage switching means 10, an output gear 21 is fixed to an output axis 20*a* of a motor 20, and a cam 24 and a cam 25 are integrally mounted on a rotation axis 23 which is rotatingly driven by the output gear 21 via a clutch 22. Furthermore, the cams 24 and 25 are brought into contact with an inner surface of cam receiving boxes 26 and 27 as an acceptance tool which are attached to a bottom end of valve axes 17 and 18 of each of the open/close valves 15 and 16 respectively.

The clutch 22 is a one-way clutch, and the output gear 21 which is fixed to the motor 20 is connected to an input gear 22*a* on which force is acted by a spring 22*c* in the clutch 22. On the other hand, the rotation axis 23 is connected to an output gear 22*b* of the clutch 22, and at the same time, a manual operation means as mentioned later is connected to the output gear 22*b* of the clutch 22.

In the embodiment 1, the valve axes 17 and 18 are projected in parallel from each of the open/close valves 15 and 16 respectively which are mounted in parallel, and the rotation axis 23 is arranged in right-angled with respect to the valve axes 17 and 18. So, it is possible to make the constitution of the flow passage switching device 10 compact.

As shown in FIG. 59(A), the cam 24 for the rim channel 2 is formed in such a manner that the cam 24 is symmetrically projected in both directions with respect to the rotation axis 23. On the contrary, as shown in FIG. 58(B), the cam 25 for the jet hole 5 is formed in such a manner that the cam 25 is projected in only one direction with respect to the rotation axis 23. Furthermore, the cam 24 for the rim channel 2 and the cam 25 for the jet hole 5 are mounted on the rotation axis 23 in such a manner that each projected direction doesn't overlap with each other by 90 degrees.

When the cams 24 and 25 are rotated together with the rotation axis 23 by the motor 20 as shown in FIG. 58, the valve axes 17 and 18 together with the cam receiving boxes 26 and 27 are moved toward the axial direction to carry out the open/close operation of the open/close valves 15 and 16. As the motor 20, the one in which the rotation angle can be controlled to be the predetermined angle, for example, a geared motor, a stepping motor and the like are used. Furthermore, a rotary encoder E for monitoring a rotation amount of the rotation axis 23, and a control device C for controlling the operation of the motor 20 are mounted at the right place. Moreover, it is better that a window portion f is formed at the rotary encoder E so that the user can confirm a rotation position of the cams 24 and 25 by his eyes.

As shown in FIG. 59(A), by opening and closing the open/close valve 15 in accordance with the rotation of the cam 24 shown in FIG. 58, water which is supplied from the primary water supply pipe 12 to the rim channel 2 is flown to the open/close valve 15 by way of a flow inlet 13, and then, the water is supplied to a branch water pipe Q for the rim channel 2 by way of a vacuum breaker 19. On the other hand, as shown in FIG. 59(B), by opening and closing the open/close valve 16 in accordance with the rotation of the cam 25 shown in FIG. 58, water which is supplied to the jet hole 5 is flown from a flow inlet 14 to the open/close valve 16, and then, the water is supplied to a branch water pipe R for the jet hole 5 by way of a vacuum breaker 19.

In a manual operation mechanism for carrying out the manual operation of opening and closing the open/close valves 15 and 16, as shown in FIG. 58, a gear 50 is connected to a rotation axis 41 which is continuously mounted to a handle 40, and the gear 50 is engaged with a gear 51 which has a different gear ratio, so the gear 50 is connected to the output gear 22*b* of the clutch 22. By making the clutch 22 a one-way clutch, it is possible to freely carry out the rotation operation of the rotation axis 23 by the manual operation mechanism with respect to the motor 20. Therefore, the manual operation never acts a negative load on the motor 20 such as a geared motor and the like.

Figure 59:
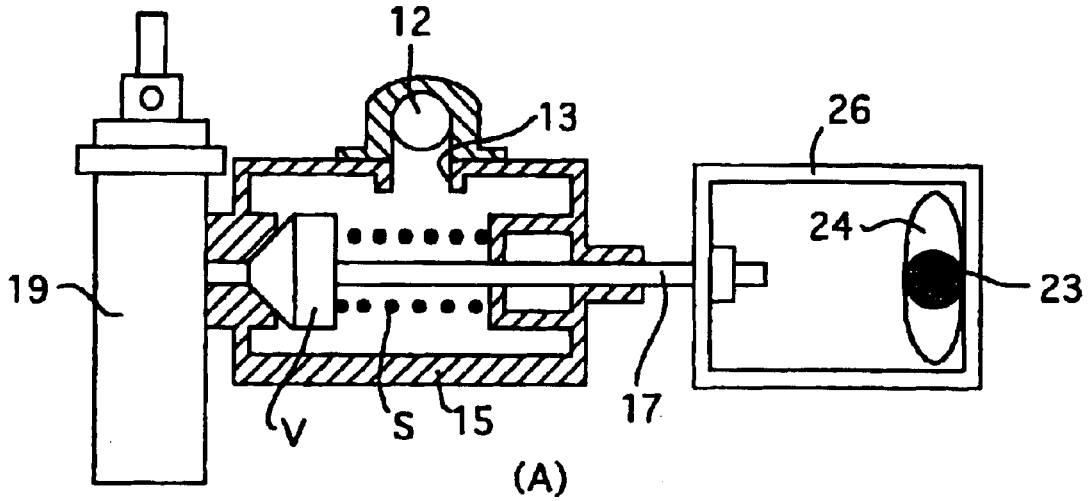
FIG. 59 shows the initial condition according to an embodiment 1 in the fifth invention.
Figure 59:
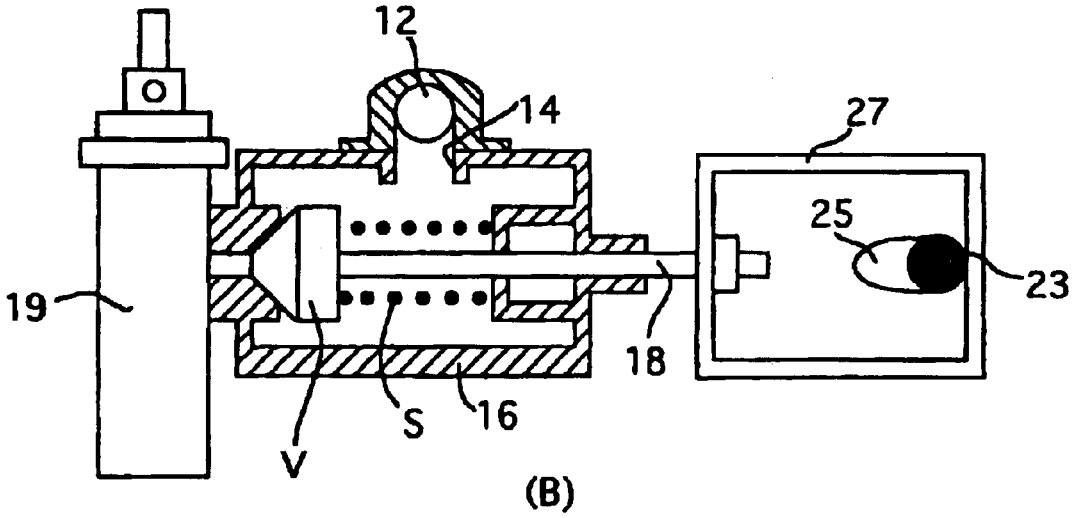

Next, the flow passage device 10 is explained in conjunction with drawings 59 to 62. In each figure, Figure (A) shows the open/close valve 15 for the rim channel 2 which corresponds to a cross-sectional view at II—II line in FIG. 58, and Figure (B) shows the open/close valve 16 for the jet hole 5 which corresponds to a cross-sectional view at I—I line in FIG. 58. FIG. 59 shows the initial condition, namely, the condition that both of the open/close valves 15 and 16 are closed and no water is flown through. In FIG. 59, a valve body V in the open/close valves 15 and 16 are pushed by a spring S toward the seated direction to close a flow passage.

Figure 60:
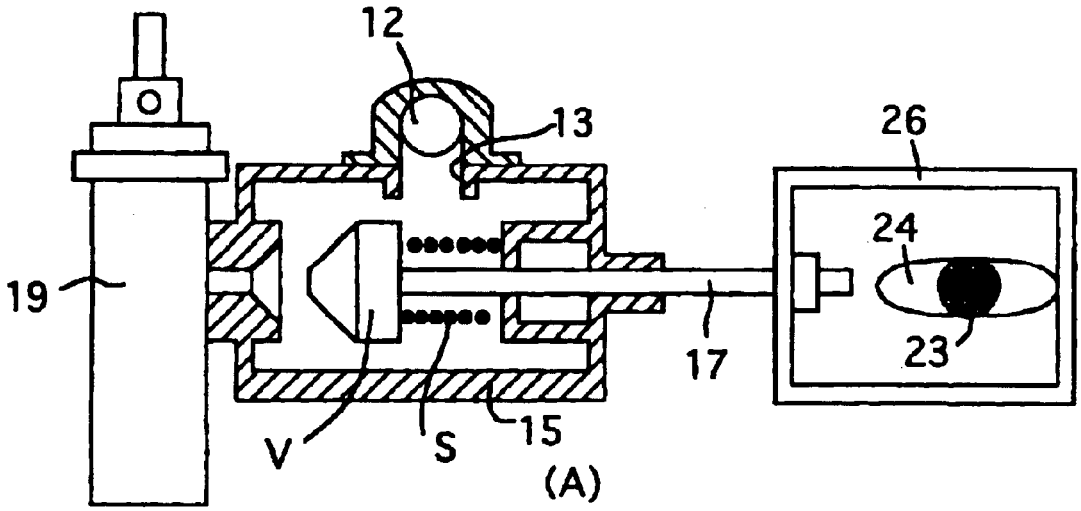
FIG. 60 shows the condition for the first supplying water to a rim channel according to an embodiment 1 in the fifth invention.
Figure 60:
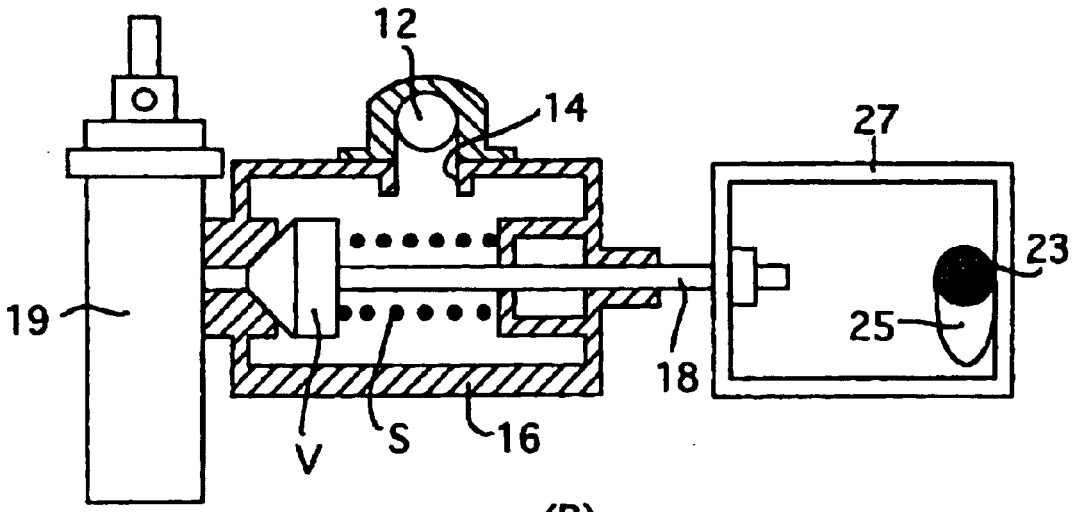

When the user instructs to wash a toilet under the above condition, the motor 20 is driven by the control device C shown in FIG. 58, and the cams 24 and 25 in the condition of FIG. 59 are rotated in 90 degrees counter-clockwise to be the condition of FIG. 60. Then, as shown in FIG. 60(A), only the cam receiving box 26 on the side of the rim channel 2 is moved to the right hand of the figure by the rotation of the cam 24, and the valve body V is detached by way of the valve axis 17. Due to this, water is flown from the primary water supply pipe 12 to the open/close valve 15 by way of the flow inlet 13, and the water is supplied to the rim channel 2 by way of the vacuum breaker 19. As a result, water is released to a toilet bowl 4 to carry out the first washing of the toilet bowl 4.

Figure 61:
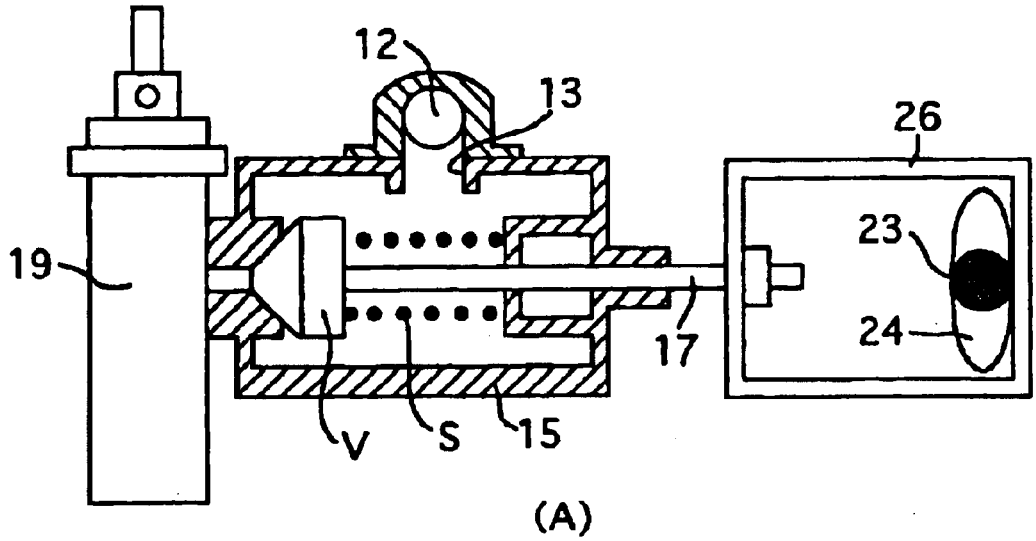
FIG. 61 shows the condition for supplying water to a jet hole 5 according to an embodiment 1 in the fifth invention.
Figure 61:
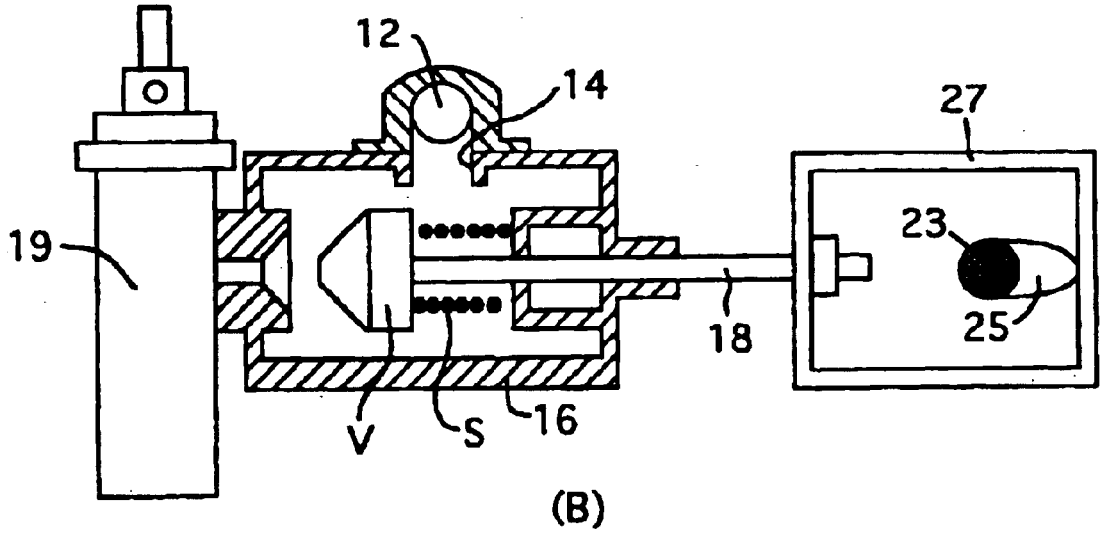

The washing of the toilet bowl 4 is carried out only for the predetermined time (for example, 7 seconds). Namely, if the predetermined time has been passed since the beginning of the washing of the toilet bowl 4, the motor 20 is driven by the control device C shown in FIG. 58, and the cams 24 and 25 in the condition of FIG. 60 are further rotated in 90 degrees counter-clockwise to be the condition of FIG. 61. Due to this, as shown in FIG. 61(B), the cam receiving box 27 on the side of the jet hole 5 is moved to the right hand by the cam 25, and the valve body V is detached by way of the valve axis 18, so water can be passed through the open/close valve 16. As a result, water is supplied to the jet hole 5, and it is begin to be spouted to a discharge pipe 3. At the same time, as shown in FIG. 61(A), a projection portion of the cam 24 stops pushing the cam receiving box 26 on the side of the rim channel 2, so the valve body V is pushed by the spring S to be seated, and water supply to the rim channel is stopped.

Figure 62:
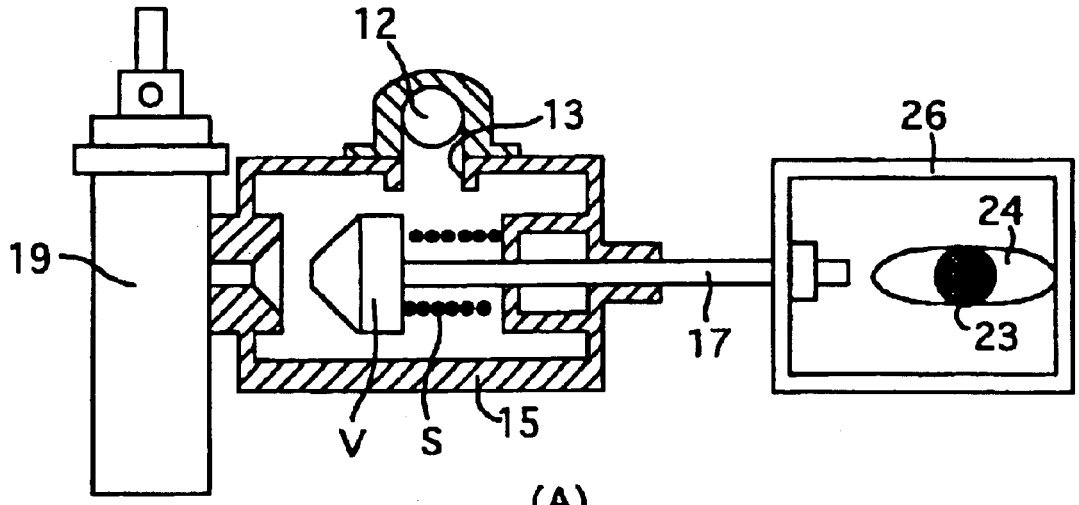
FIG. 62 shows the condition for supplying water to a rim channel after finishing a siphon according to an embodiment 1 in the fifth invention.
Figure 62:
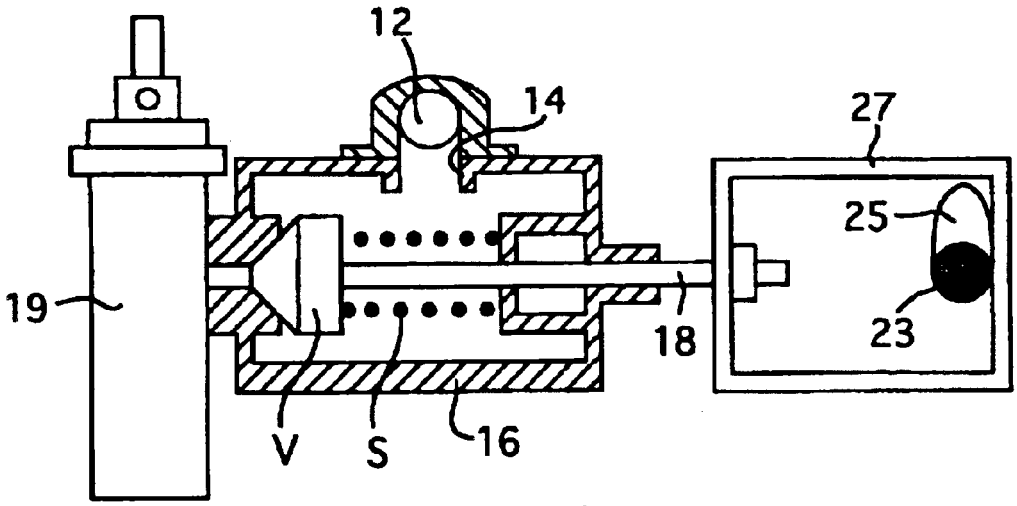

To supply water to the jet hole 5 is maintained only for the time which is required for generating a siphon effect forcibly (for example, approximately 7 seconds). So, if the predetermined time has been passed since the beginning of water supply to the jet hole 5, the motor 20 shown in FIG. 58 is again driven, and the cams 24 and 25 are rotated in 90 degrees to be the condition in FIG. 62. At this time, as shown in FIG. 62(B), the valve body V of the open/close valve 16 is seated to stop supplying water to the jet hole 5, and as shown in FIG. 62(A), the valve body V of the open/close valve 15 is detached to supply water from the rim channel 2 to the toilet bowl 4. Thus, after discharging water due to generation of the siphon effect, by supplying water from the rim channel 2 to the toilet bowl 4, it is possible to form a water sealing in the toilet bowl 4. As for the process for supplying water to the toilet bowl 4 by way of the rim channel 2, it is enough that water supply is maintained for the predetermined time (for example, 7 seconds). If the predetermined time has been passed after the beginning of water supply from the rim channel 2 to the toilet bowl 4, the cams 24 and 25 are rotated by the motor 20 shown in FIG. 58 to return to the initial condition shown in FIG. 59.

As shown in FIG. 58, the flow passage switching device 10 of the embodiment 1 comprises a mechanism in which the open/close operation of the open/close valves 15 and 16 are carried out manually, so even at the time of power failure or breakdown of the motor 20, it is possible to carry out the washing of the toilet which accompanies a siphon effect. In case the washing of the toilet is carried out manually, it is enough that the operation of the handle 40 is carried out in accordance with a driving mode of the cams 24 and 25 due to the motor 20. Namely, if the user carries out the operation in which the handle 40 is rotated in 90 degrees at every predetermined time (for example, every 7 seconds), the same washing of the toilet as that by the driving of the motor 20 can be performed. In this case, it is preferable that the means for confirming the position of the cams 24 and 25 is mounted. This means, for example, that a peripheral surface of the rotation axis 23 is divided into four areas to be distinguished by each color, so it is possible to observe the color of the rotation axis 23 from the window portion f of the rotary encoder E. Due to this, it is possible to confirm a rotation angle of the rotation axis 23, namely, a rotation position of the cams 24 and 25.

Furthermore, when power failure is occurred during the operation of the flow passage switching means 10, the rotation axis 23 is stopped, so either or both of the open/close valves 15 and 16 is/are in the released condition depending on the position of the cams 24 and 25, and it is impossible to stop supplying water to the jet hole 5 and/or the rim channel 2. So, it is considered that a backup electric source 20*b* such as a battery and the like is mounted, and the motor 20 is driven to rotate the rotation axis 23 to the predetermined position. Concretely, at the time of generating power failure, if the position of the cams 24 and 25 is confirmed by the rotary encoder E and the like, and 1 cycle of the washing of the toilet is carried out by driving the motor 20 due to the backup electric source 20*b*, the washing of the toilet can be completed, and at the same time, the open/close valves 15 and 16 are in the closed condition surely.

Furthermore, when the manual operation mechanism is stopped at the middle stage, there arises a problem that water supply to the jet hole 5 and/or the rim channel 2 cannot be stopped. Such a problem can be solved by the following measure. A sensor for detecting a flow amount or a flow time of water in the open/close valves 15 and 16 is mounted, and then, when the flow amount or the flow time of water is not normal, an alarm is generated and a means for rotating the rotation axis 23 forcibly to move the cams 24 and 25 to the position where the open/close valves 15 and 16 are closed is mounted.

Embodiment 2

The embodiment 2 is explained in conjunction with drawing 63. In the flow passage switching device 10 according to the embodiment 1 as shown in FIG. 58, the clutch 22 is assembled so as not to act a negative load on the motor 20 at the time of the manual operation. So, it is possible that the rotation axis 23 to which the cams 24 and 25 are attached is freely rotated with respect to the motor 20. Due to this, when the cam 24 on the side of the rim channel 2 makes the open/close valve 15 in the closed condition, the rotation axis 23 is rapidly rotated, and the open/close valve 15 is rapidly closed, and there is a fear that a water hammer is generated.

Figure 63:
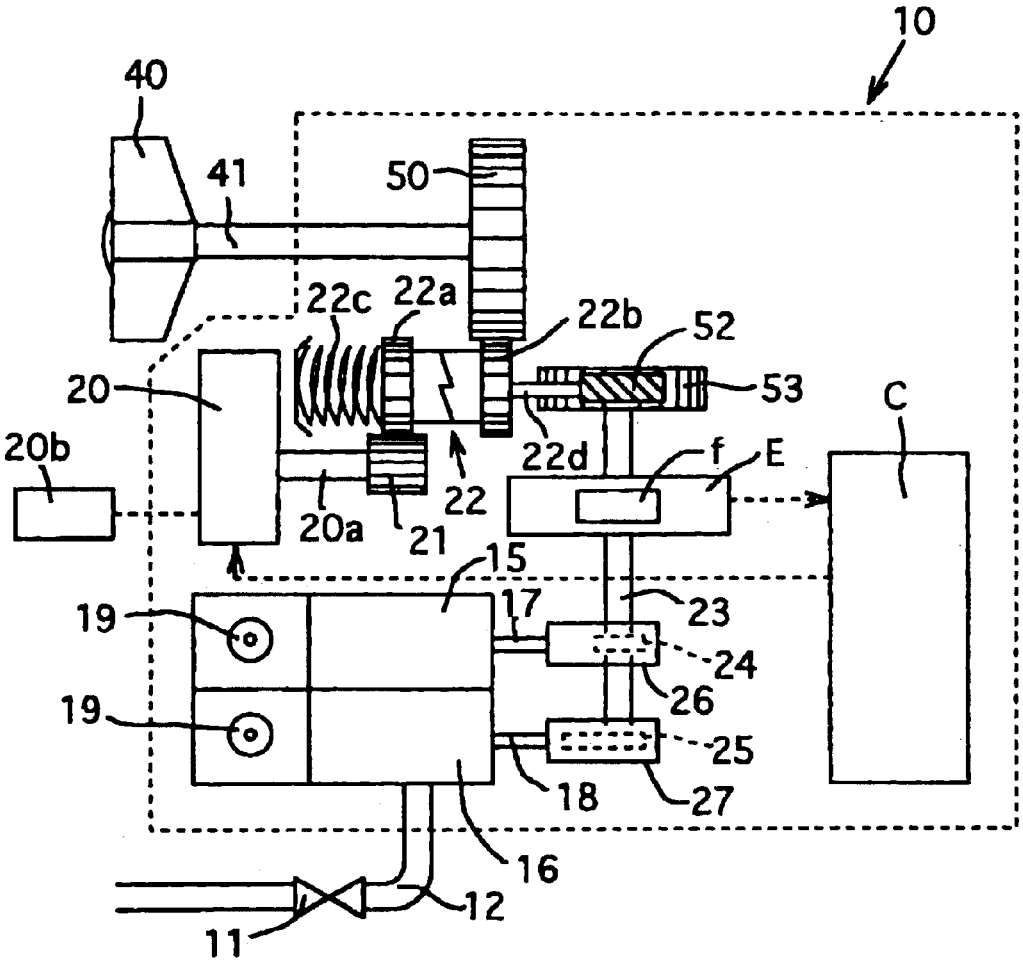
FIG. 63 is a plan view of a flow switching means for showing an outline constitution according to an embodiment 2 of the fifth invention.
Figure 64:
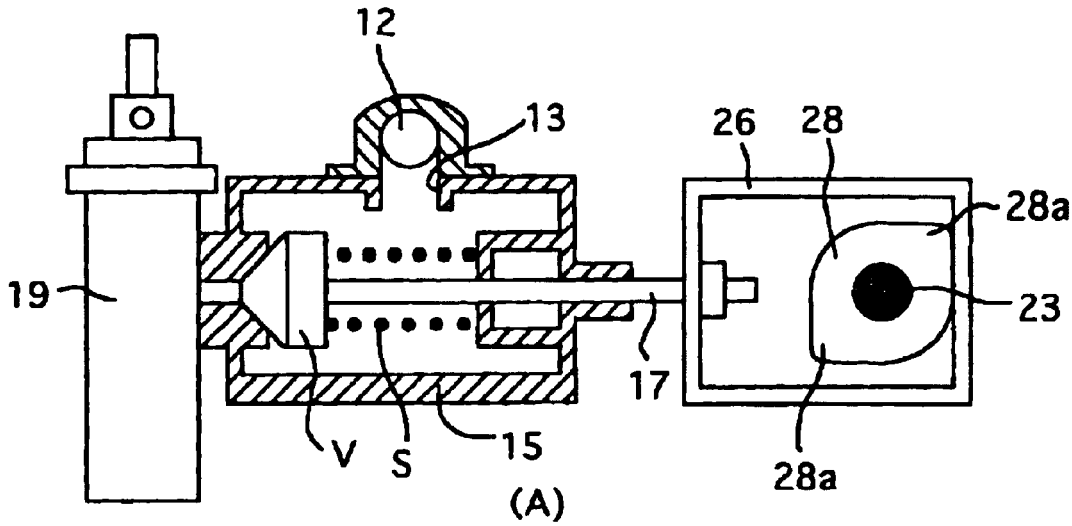
FIG. 64 shows the initial condition according to an embodiment 3 in the fifth invention.
Figure 64:
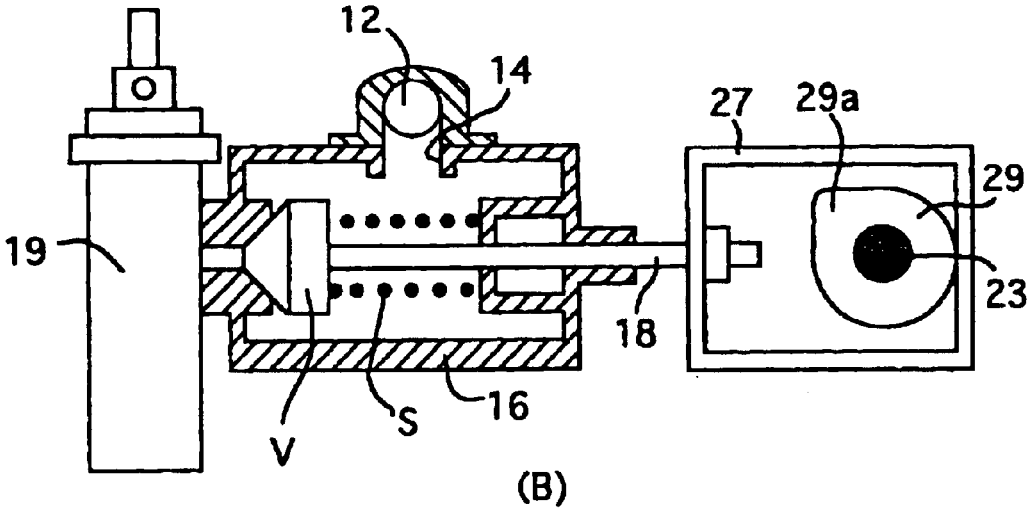
Figure 65:
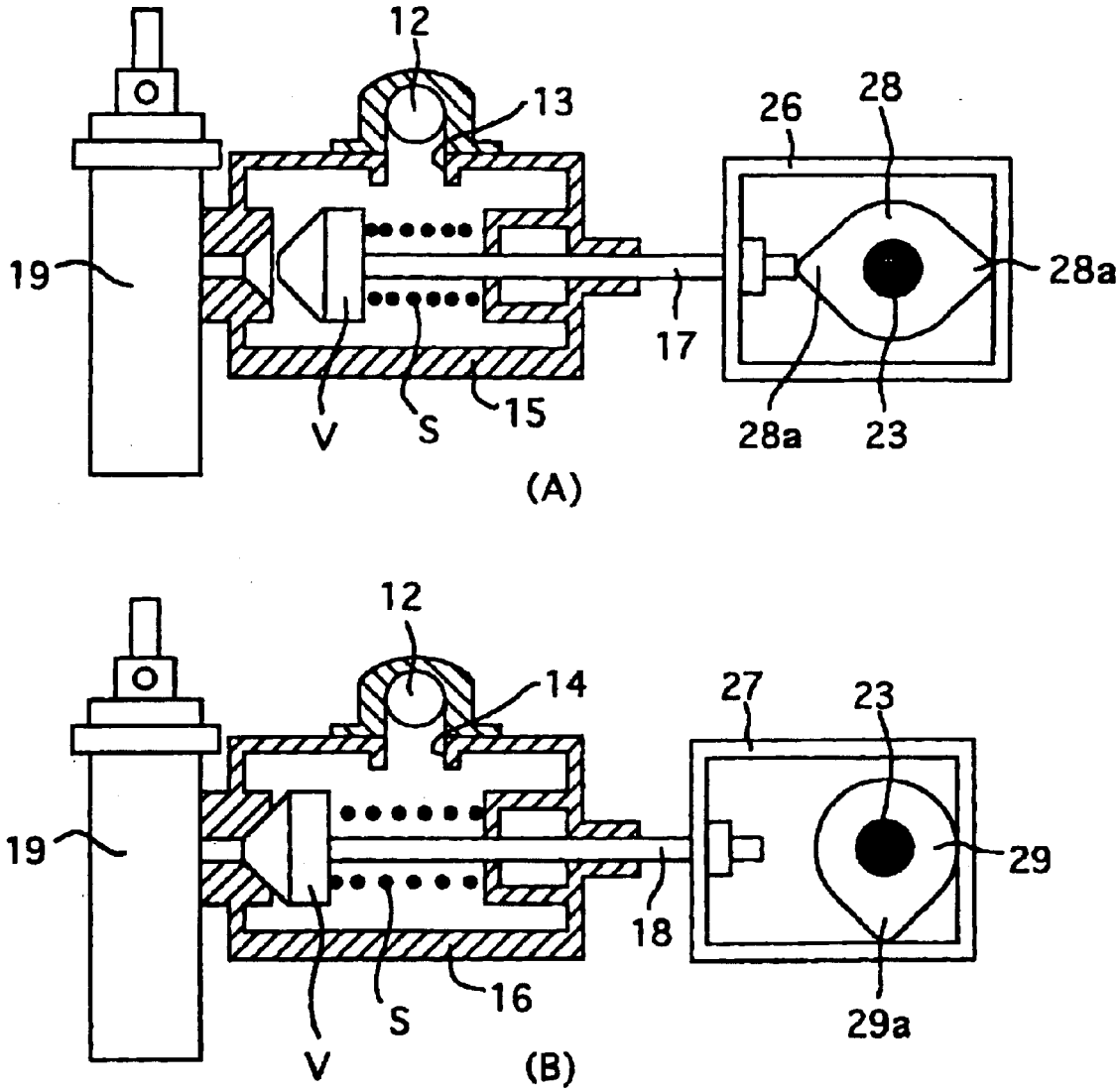
FIG. 65 shows the condition for the first supplying water to a rim channel according to an embodiment 3 in the fifth invention.
Figure 66:
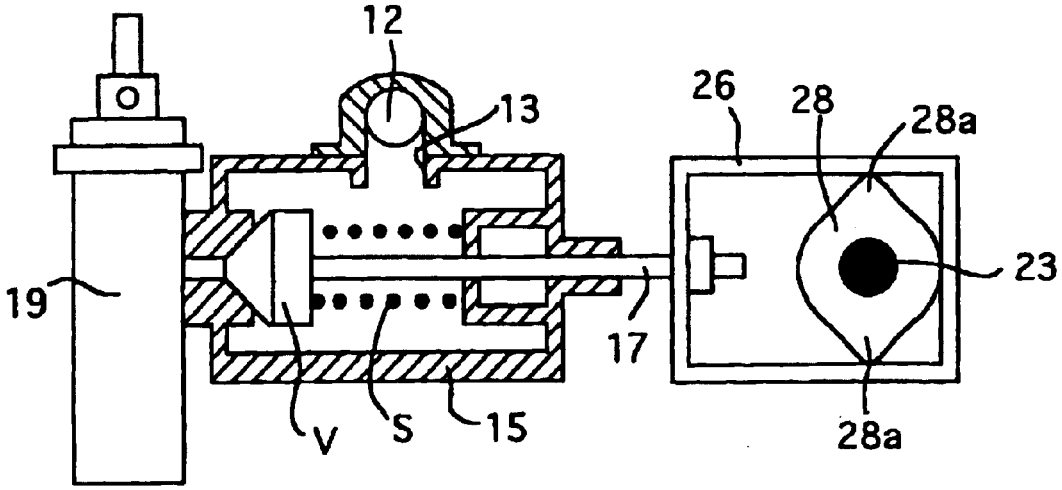
FIG. 66 shows the condition for supplying water to a jet hole 5 according to an embodiment 3 in the fifth invention.
Figure 66:
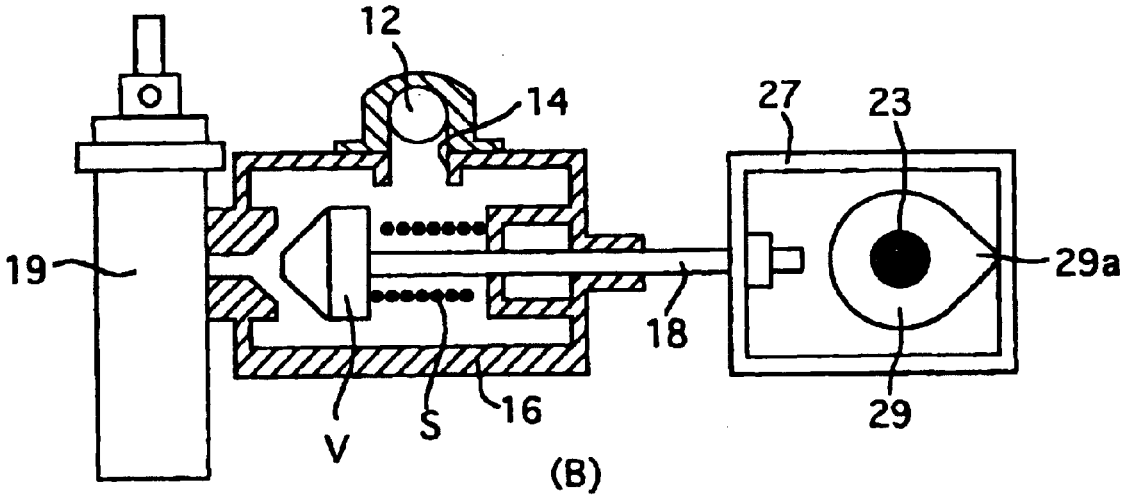
Figure 67:
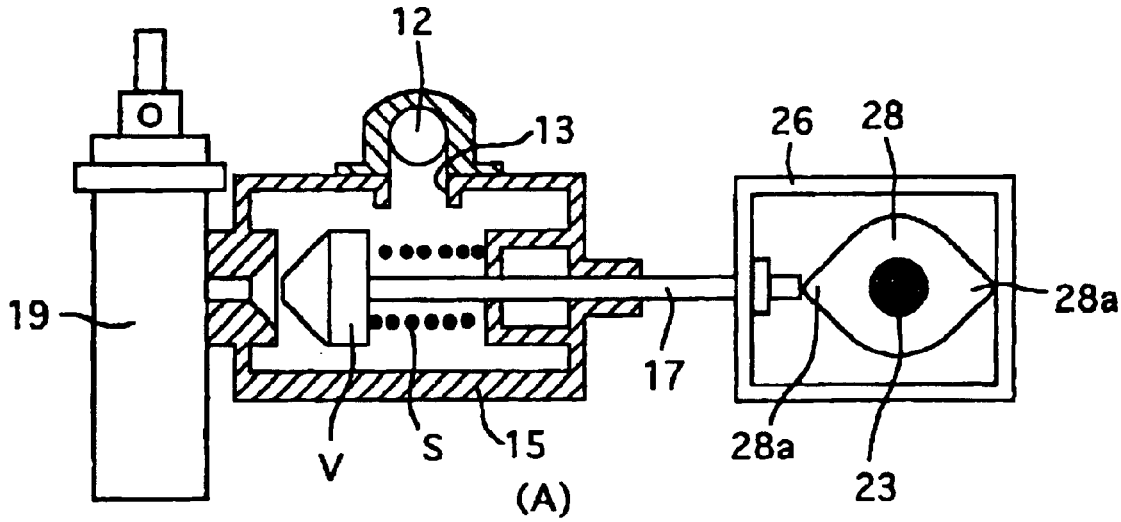
FIG. 67 shows the condition for supplying water to a rim channel after finishing a siphon according to an embodiment 3 in the fifth invention.
Figure 67:
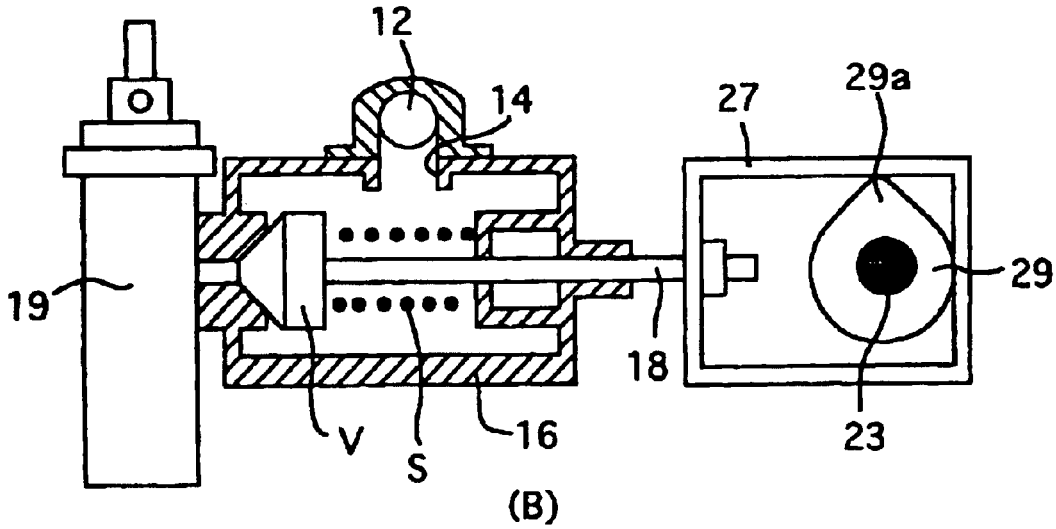

Then, as shown in FIG. 63, the flow passage switching device 10 according to the embodiment 2 has the constitution that a warm gear 52 is attached to an output axis 22*d* of the clutch 22, and the warm gear 52 is connected to a warm wheel 53 which is connected to the rotation axis 23 to transmit rotation operation force. Accordingly, it is possible to hinder a rapid rotation of the rotation axis 23.

Other constitutions, operations and effects are the same as those of the embodiment 1.

Embodiment 3

FIGS. 64 to 67 show an embodiment in which the shape of cams 28 and 29 which are brought into contact with the cam receiving boxes 26 and 27 is modified. In the embodiment 3, as shown in FIGS. 64 to 67(A), the cam 28 on the side of the rim channel 2 has an approximately lemon-like shape in which symmetrical two portions are protruded from a circle plate. Furthermore, as shown in FIGS. 64 to 67(B), the cam 29 on the side of the jet hole 5 has an approximately waterdrop-like shape in which one portion of a circle plate is protruded. Each of cams 28 and 29 is attached to the rotation axis 23 in such a manner that projection portions 28*a* and 29*a* doesn't overlap with each other by 90 degrees.

If the cams 28 and 29 have such a shape, it is possible to switch the flow passage by rotating the rotation axis 23 at constant speed.

In other words, when the rotation axis 23 is rotated counter-clockwise from the initial condition shown in FIG.

64 to reach a rotation angle of 90 degrees, as shown in FIG. 64(A), the projection portion 28*a* of the cam 28 on the side of the rim channel 2 begins to push the cam receiving box 26 to the right hand, and as shown in FIG. 65(A), the valve body V of the open/close valve 15 is detached to begin supplying water to the rim channel 2. Such water supply to the rim channel 2 is continued while the cam 28 begins to push the cam receiving box 26 to be rotated in further 90 degrees. As shown in FIG. 66(A), after the valve body V of the open/close valve 15 is seated to wash the toilet bowl 4, the rotation of the rotation axis 23 is continued.

Thus, as shown in FIG. 66(B), the projection portion 29*a* of the cam 29 on the side of the jet hole 5 pushes the cam receiving box 27 to the right hand, the valve body V of the open/close valve 16 is detached to begin making water pass through the jet hole 5. Due to this, water is spouted from the jet hole 5 to the discharge pipe 3, and a siphon effect is forcibly generated. As shown in FIG. 67(B), making water pass through the jet hole 5 is continued while the cam 29 begins to push the cam receiving box 27 to be rotated in 90 degrees. When making water pass through the jet hole 5 is finished, as shown in FIG. 67(A), the cam on the side of the rim channel 2 again moves the cam receiving box 26 to the right hand, and the valve body V of the open/close valve 15 is detached to carry out water supply to the rim channel 2. As shown in FIG. 64(A), such water supply to the rim channel 2 is also continued while the cam 28 is rotated in 90 degrees. By supplying water to the rim channel 2, water supply to the toilet bowl 4 is carried out after finishing a siphon effect, and water sealing is formed in the toilet bowl 4. When the cam 28 is rotated to return to the initial condition, water supply to the rim channel 2 is finished.

In the flow passage switching device 10 of the embodiment 3, the shape of the cams 28 and 29 is constituted as above, so the control of the motor 20 is not the intermittent rotation driving in the embodiment 1, but the continuous rotation driving. In other words, it is possible to wash the toilet desirably only by rotating the cams 28 and 29 at constant rotation speed. Furthermore, the open/close valves 15 and 16 are not rapidly closed, so there is an advantage that a water hammer is hardly generated.

Other constitutions, operations and effects are same as those of the embodiment 1.

Embodiment 4

The embodiment 4 is explained in conjunction with drawings 68 to 70. The embodiment 4 is mainly adopted to a toilet for the cold areas, and for example, the purpose of this toilet is to always flow a small amount of water in order to prevent the freezing. For such a purpose, in the embodiment 4, as shown in FIG. 68, a projection portion 31 is formed at a cam 30 for the jet hole 5.

Figure 68:
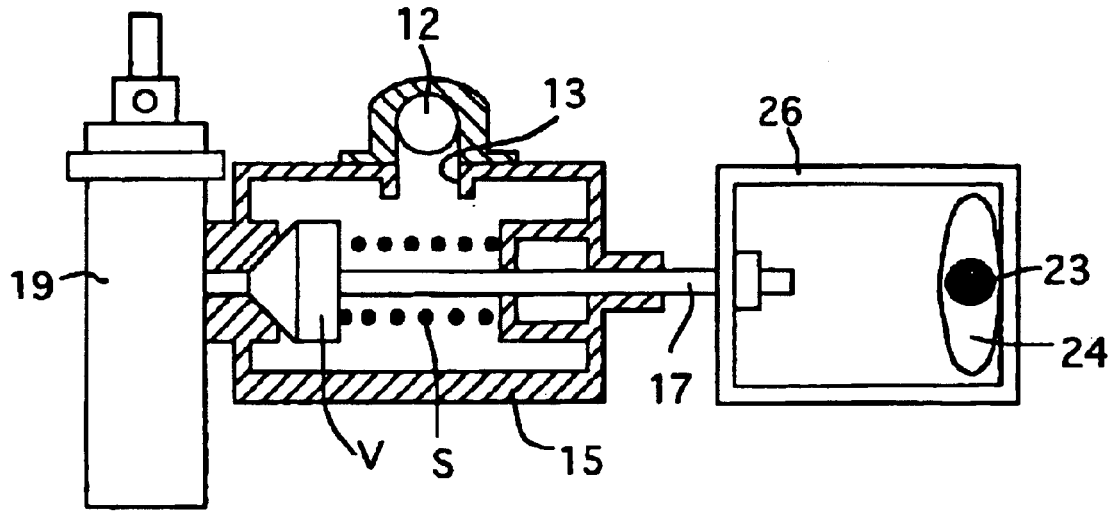
FIG. 68 shows the initial condition according to an embodiment 4 in the fifth invention.
Figure 68:
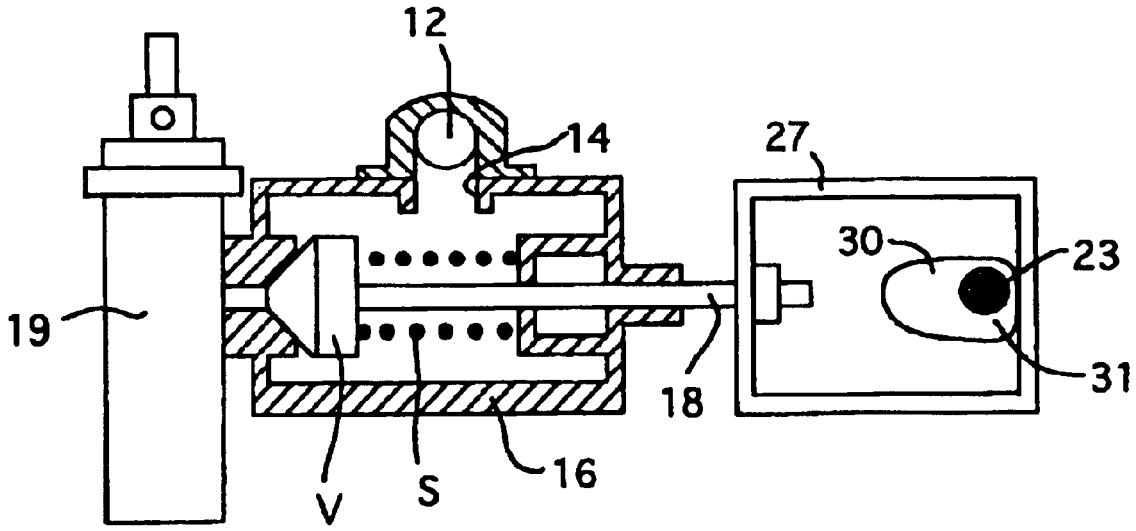
Figure 69:
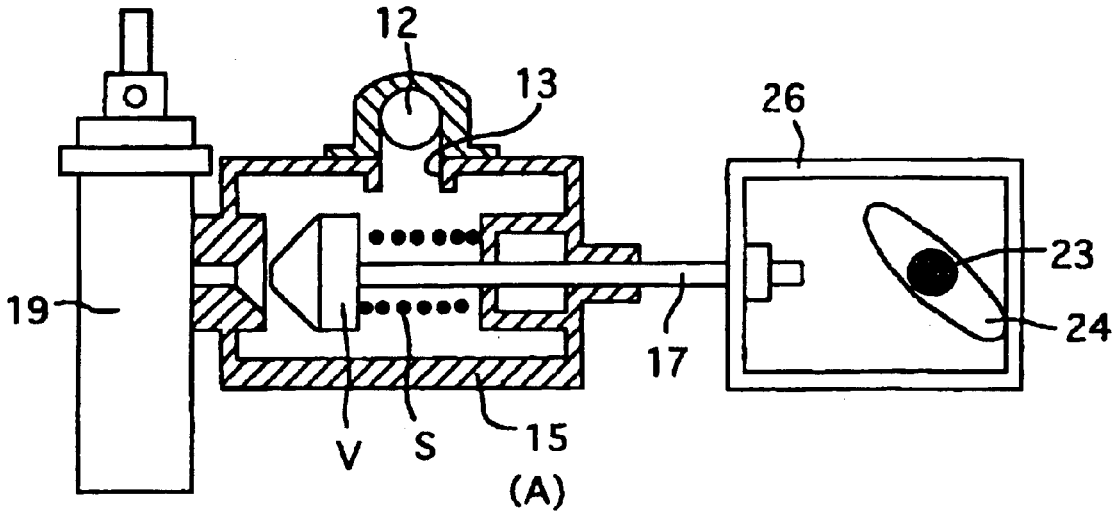
FIG. 69 shows a flow mode according to an embodiment 4 in the fifth invention.
Figure 69:
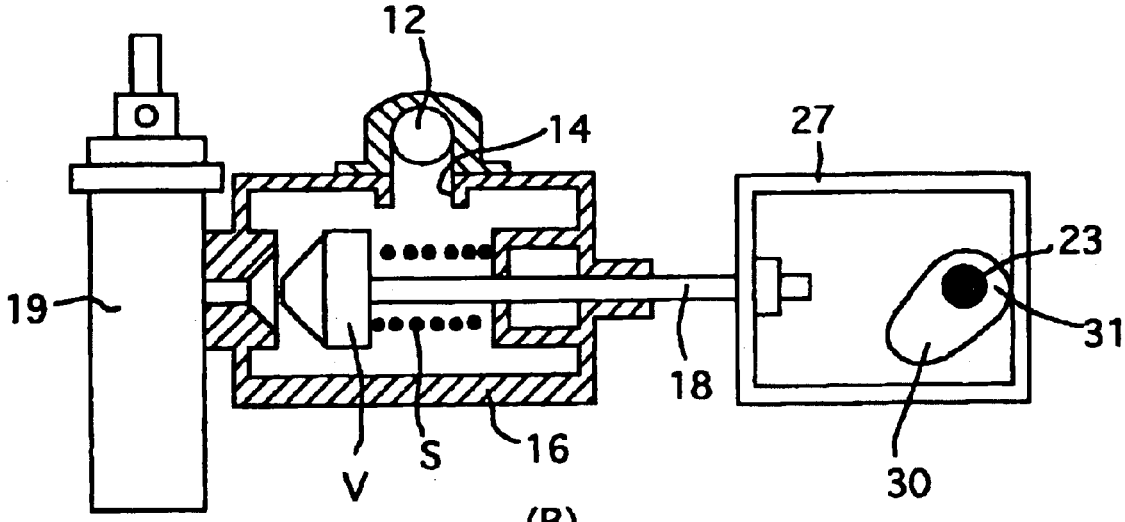

When the cam 30 in the condition of FIG. 68 is rotated in 45 degrees to be the condition of FIG. 69, the projection portion 31 of the cam 30 pushes the cam receiving box 27 to open the valve body V of the open/close valve 16 slightly. At this time, the cam 24 for the rim channel 2 is rotated in 45 degrees in the same manner as that of the cam 30 to open the open/close valve 15 slightly. Therefore, by maintaining the cams 24 and 30 at a rotation position of 45 degrees, a small amount of water is always supplied to the rim channel 2 and the jet hole 5, and it is possible to maintain the flow condition to prevent the freezing.

Figure 70:
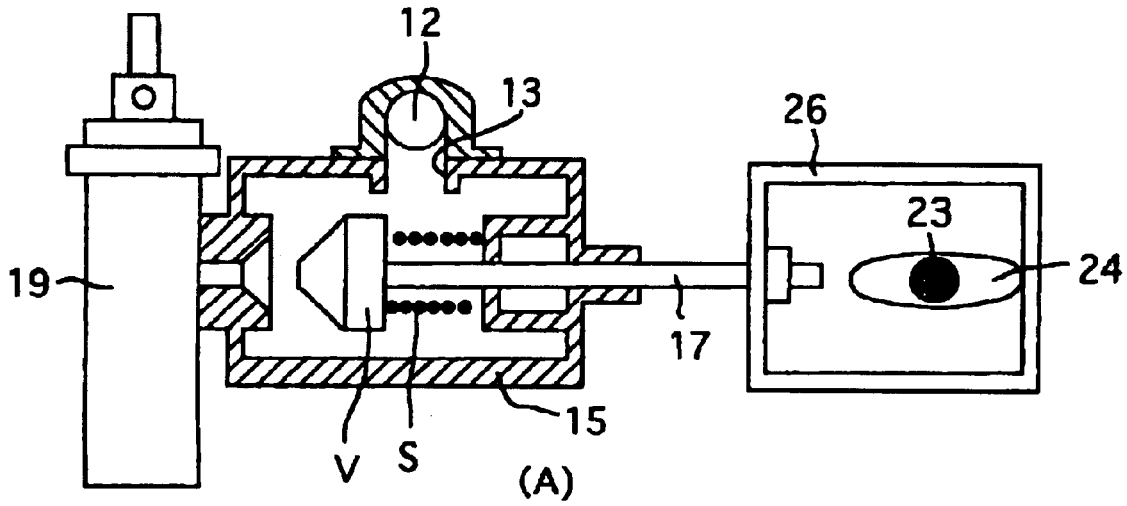
FIG. 70 shows the condition for supplying water to a rim channel according to an embodiment 4 in the fifth invention.
Figure 70:
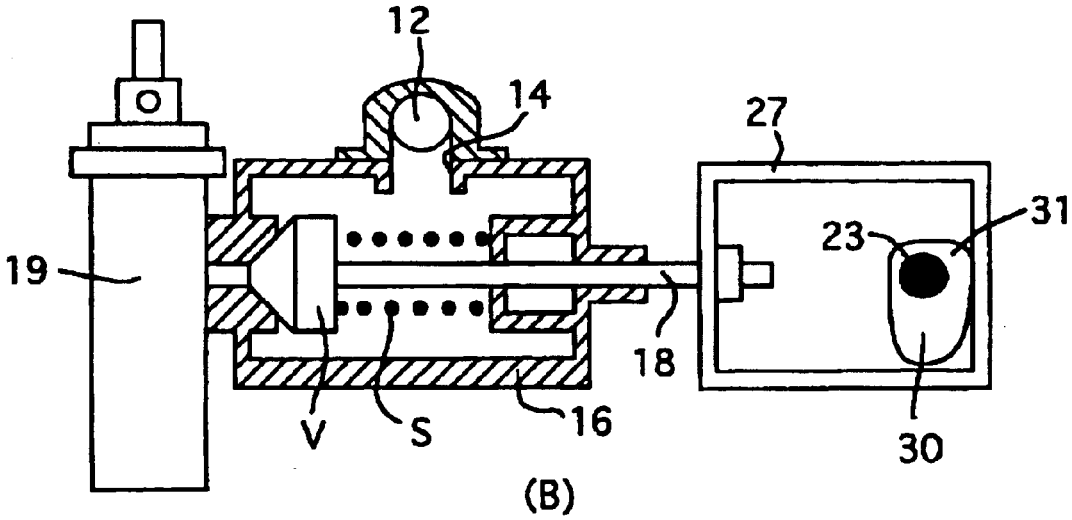

After that, the condition shown in FIG. 70 is the same as the condition shown in FIG. 60 in the embodiment 1. Hereinafter, other constitutions, operations and effects are the same as those of the embodiment 1.

Moreover, in the embodiment 4, it is preferable that a flow mode for rotating the rotation axis 23 in only 45 degrees is set in the rotary encoder E shown in FIG. 58 which monitors and controls a rotation amount of the rotation axis 23. In addition, in the valve 11 which is mounted on the primary water supply pipe 12, it is possible to change a flow amount depending on two modes such as a normal mode and a flow mode, so a flow amount at the flow mode can be controlled to be reduced as compared with a normal mode.

Embodiment 5

Figure 71:
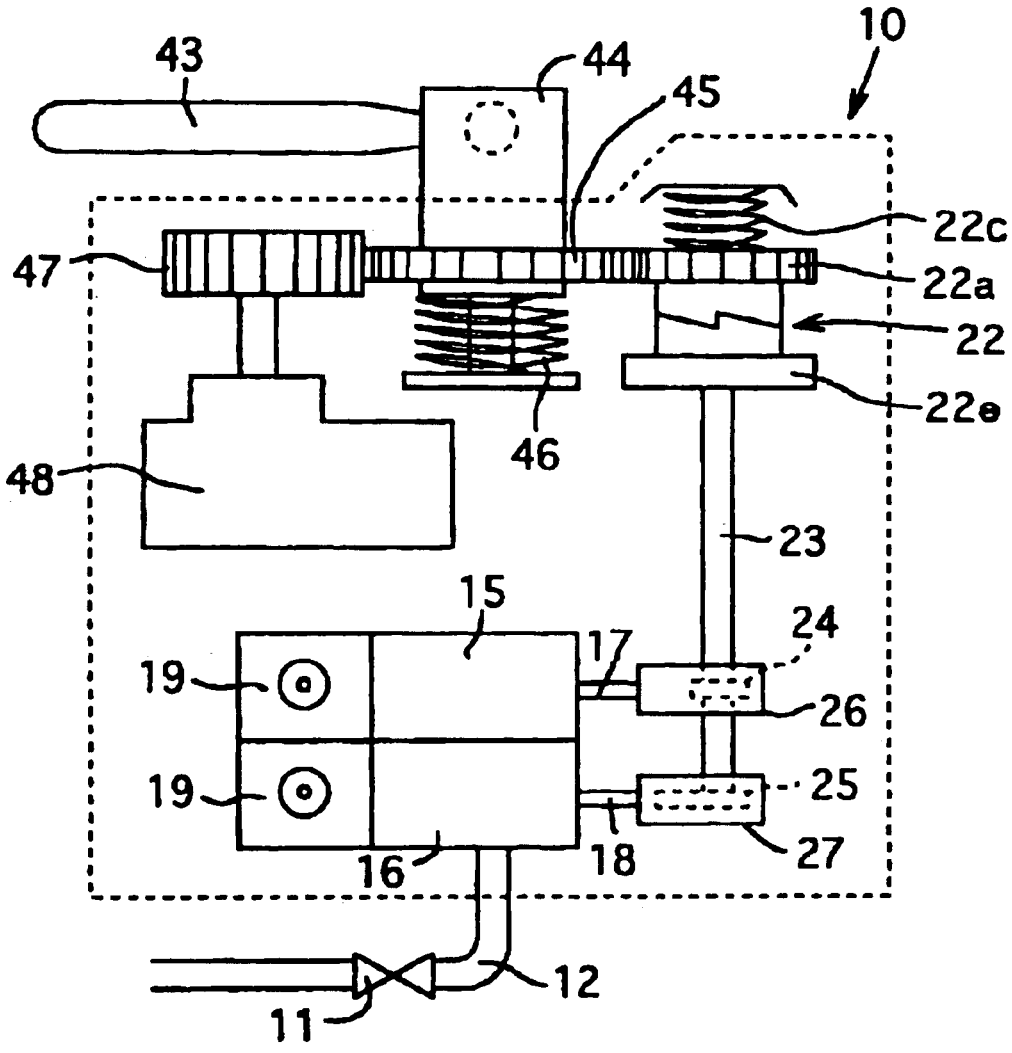
FIG. 71 is a plan view of a flow switching means for showing an outline constitution according to an embodiment 5 of the fifth invention.

FIG. 71 shows an embodiment in which the operation of the flow passage switching device 10 is carried out only by a manual operation mechanism. In the embodiment 5, the rotation axis 23 to which the cams 24 and 25 are attached is connected to an output portion 22*e* of the clutch 22, and an operation gear 45 which is mounted integrally with an input axis 44 to which an operation lever 43 is attached is connected to the input gear 22*a* of the clutch 22. Furthermore, a return spring 46 in the rotation direction is mounted on the above operation gear 45, and at the same time, a spiral spring and the like are contained in the operation gear 45. A speed control gear 47 of a speed controller 48 which controls a rotation speed to be constant is connected to the operation gear 45.

In the embodiment 5, the clutch 22 is assembled between the operation gear 45 and the rotation axis 23, so the rotation operation of the operation gear 45 can be freely carried out with respect to the rotation axis 23. Besides, in the manual operation means having such a constitution, when the user releases his hand after rotating the operation lever 43 in the predetermined angle, due to act force in the rotation direction which is applied to the return spring 46, the operation gear 45 attempts to make a return rotation toward the opposite direction of the rotation operation direction. However, the speed control gear 47 of the speed controller 48 is connected to the operation gear 45, so the rotation speed of the operation gear 45 is controlled to be the predetermined speed. Due to this, it is possible to control the speed for rotating the rotation axis 23 by way of the clutch 22 to be the predetermined speed, so the open/close operation of the open/close valves 15 and 16 are carried out by every desired time, and it is possible to carry out the required washing of the toilet.

Other constitutions, operations and effects are the same as those of the embodiment 1.

Furthermore, in the embodiment 5, if a gear ratio of the operation gear 45 to the input gear 22*a* of the clutch 22 is set to be, for example, 4:1, the rotation axis 23 makes one rotation (=rotation of 360 degrees) by rotating the operation lever 43 in only 90 degrees.

Embodiment 6

Figure 72:
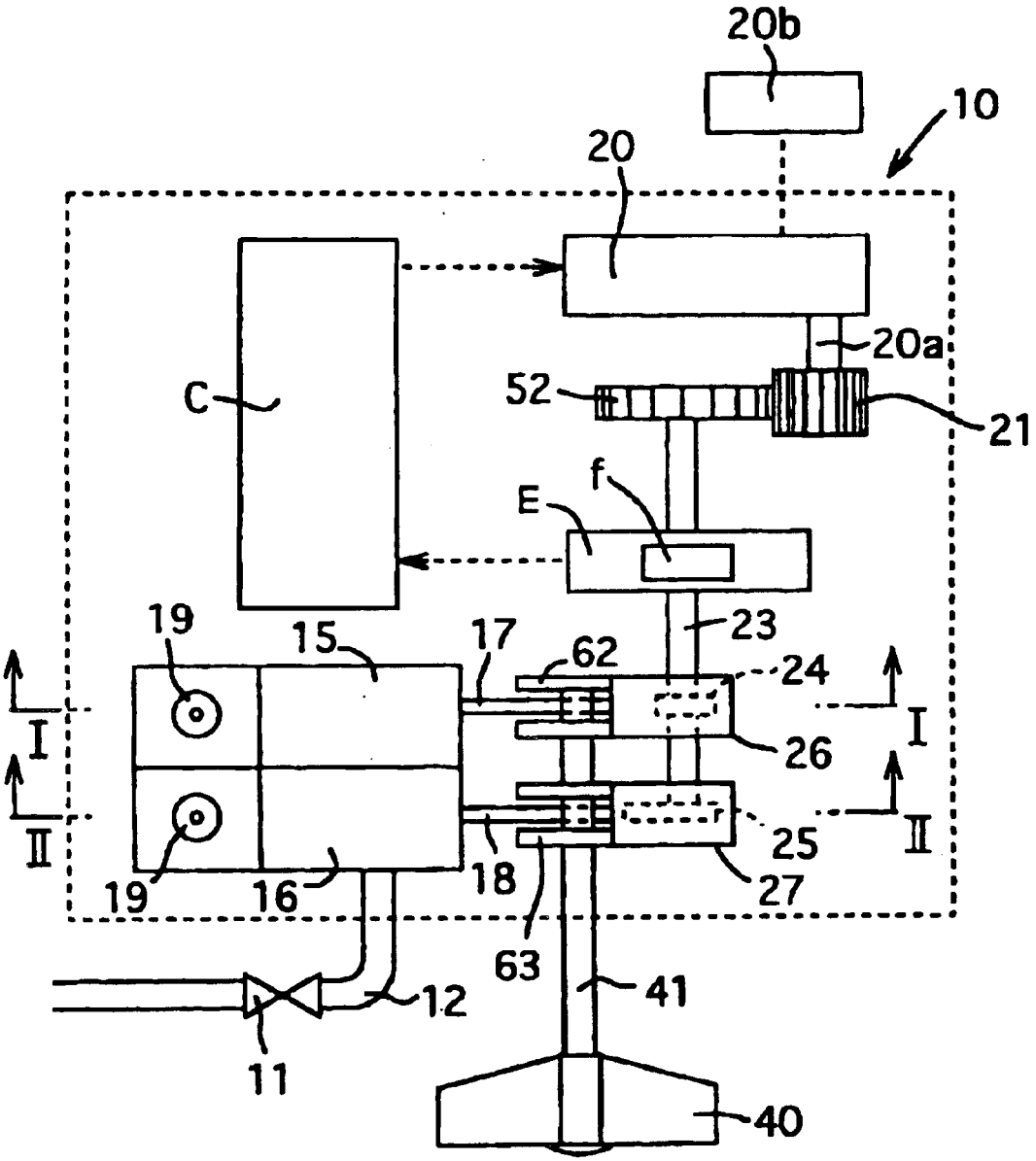
FIG. 72 is a plan view of a flow switching means for showing an outline constitution according to an embodiment 6 of the fifth invention.
Figure 73:
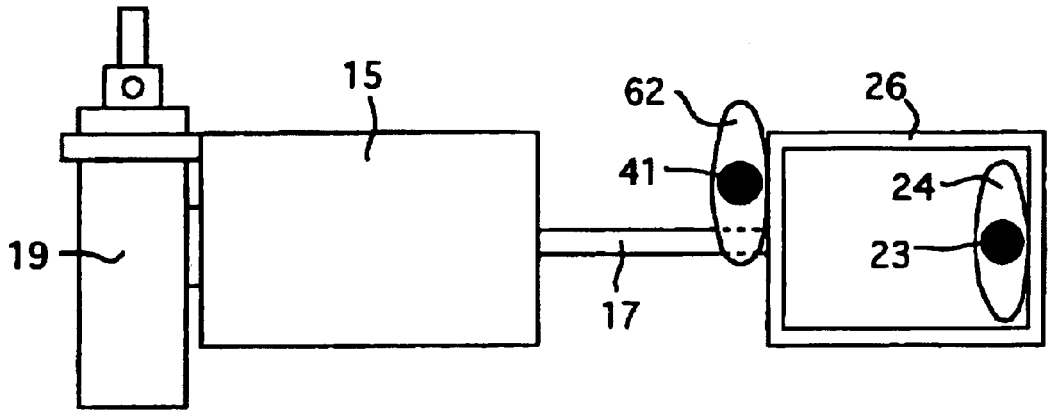
FIG. 73(A) is a side cross-sectional view of an essential portion which corresponds to I—I line shown in FIG. 72 according to an embodiment 6 in the fifth invention.
FIG. 73(B) is a side cross-sectional view of an essential portion which corresponds to II—II line shown in FIG. 72 according to an embodiment 6 in the fifth invention.
Figure 73:
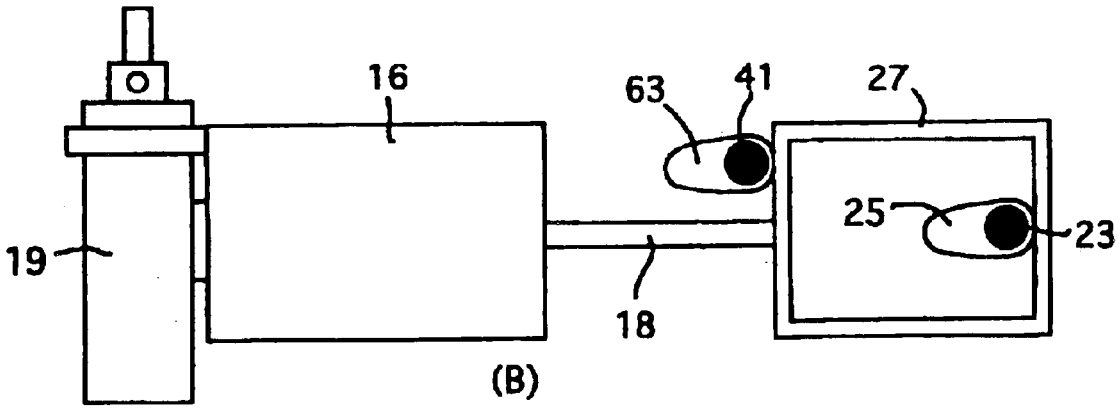

FIGS. 72 and 73 show other embodiment of the manual operating mechanism. In the embodiment 6, cams 62 and 63 which are brought into contact with an outer peripheral surface of the cam receiving boxes 26 and 27 are mounted on the rotation axis 41 which is connected to the handle 40. The shape of the cams 62 and 63 are the same as that of the cams 24 and 25 of the embodiment 1 which is rotatingly driven by the motor 20.

Other constitutions, operations and effects are the same as those of the embodiment 1.

Other Embodiments

The embodiments 1 to 6 describes each case in which the fifth invention is applied to the flow passage switching device 10 of the forced siphon toilet 1. However, it is not hindered that the fifth invention is applied to other flow passage switching device. Besides, the fifth invention can be applied to the case in which an open/close valve is mounted on not less than three flow passages.

Sixth Invention

An embodiment which embodies the sixth invention is explained hereinafter in conjunction with drawings 74 to 78.

Figure 74:
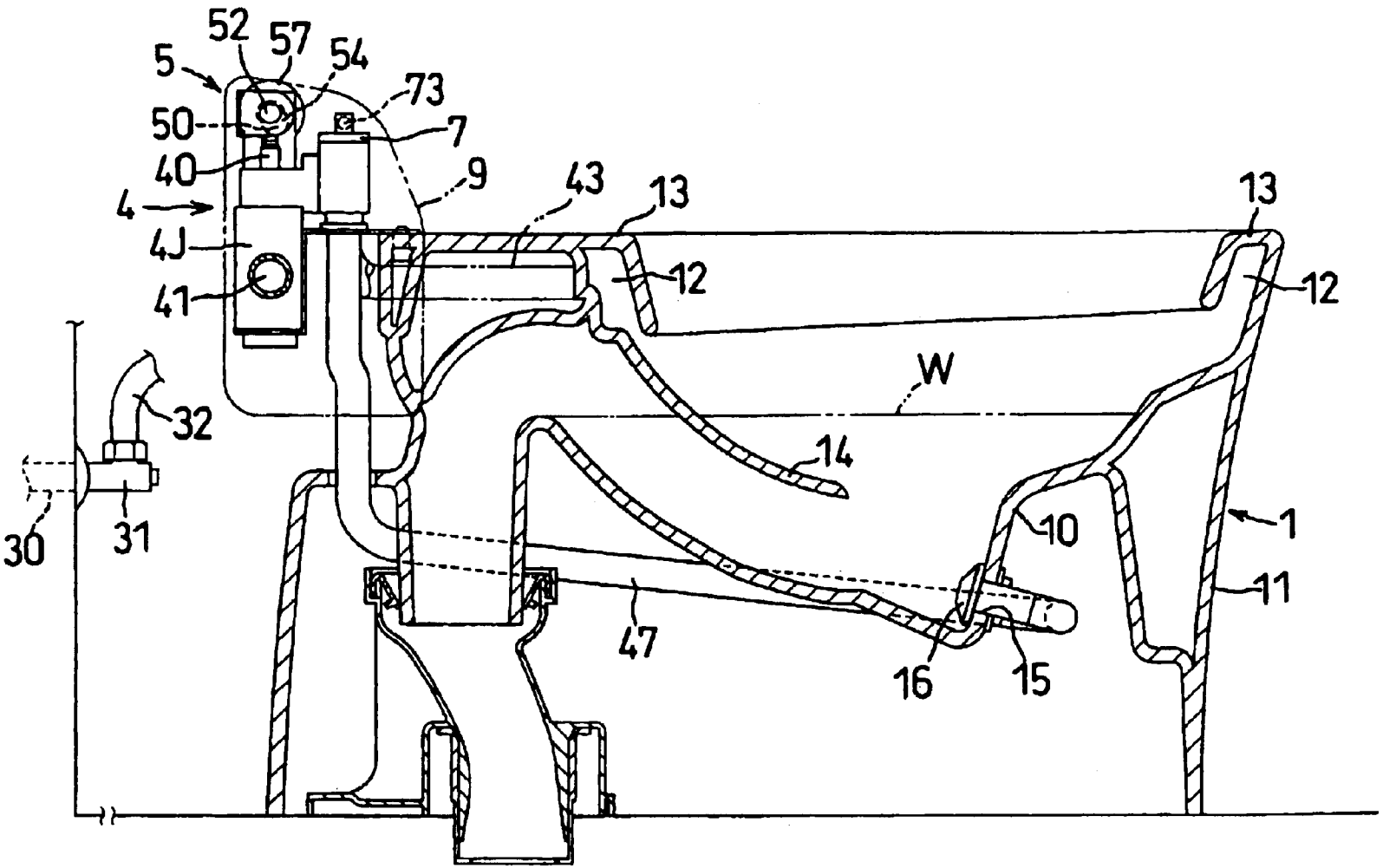
FIG. 74 is a cross-sectional view of an essential portion of a tankless western-style flush toilet according to an embodiment in the sixth invention.

As shown in FIG. 74, a tankless western-style flush toilet 1 according to the embodiment is a tankless type which has no toilet washing tank such as a low tank and so on. The tankless western-style flush toilet includes a western-style toilet body 11 having a bowl portion 10 which receives filth, a rim 13 having a rim channel 12 which encircles at an upper periphery of the western-style toilet body 11, a trap portion 14 which is communicated with the bottom of the western-style toilet body 11 and which flows the filth in the bowl portion 10, a jet hole 15 which is attached to an inlet of the trap portion 14 and a jet nozzle 16 which is mounted on the jet hole 15.

At a wall of a room in which the tankless western-style flush toilet 1 is installed, a water supply pipe 30 which is connected to a city water service pipe as a water supply source, a stop cock 31 which is attached to the water supply pipe 30 and a flexible hose 32 which has flexibility and which is guided from the stop cock 31 to the tankless western-style flush toilet 1 are mounted.

Figure 75:
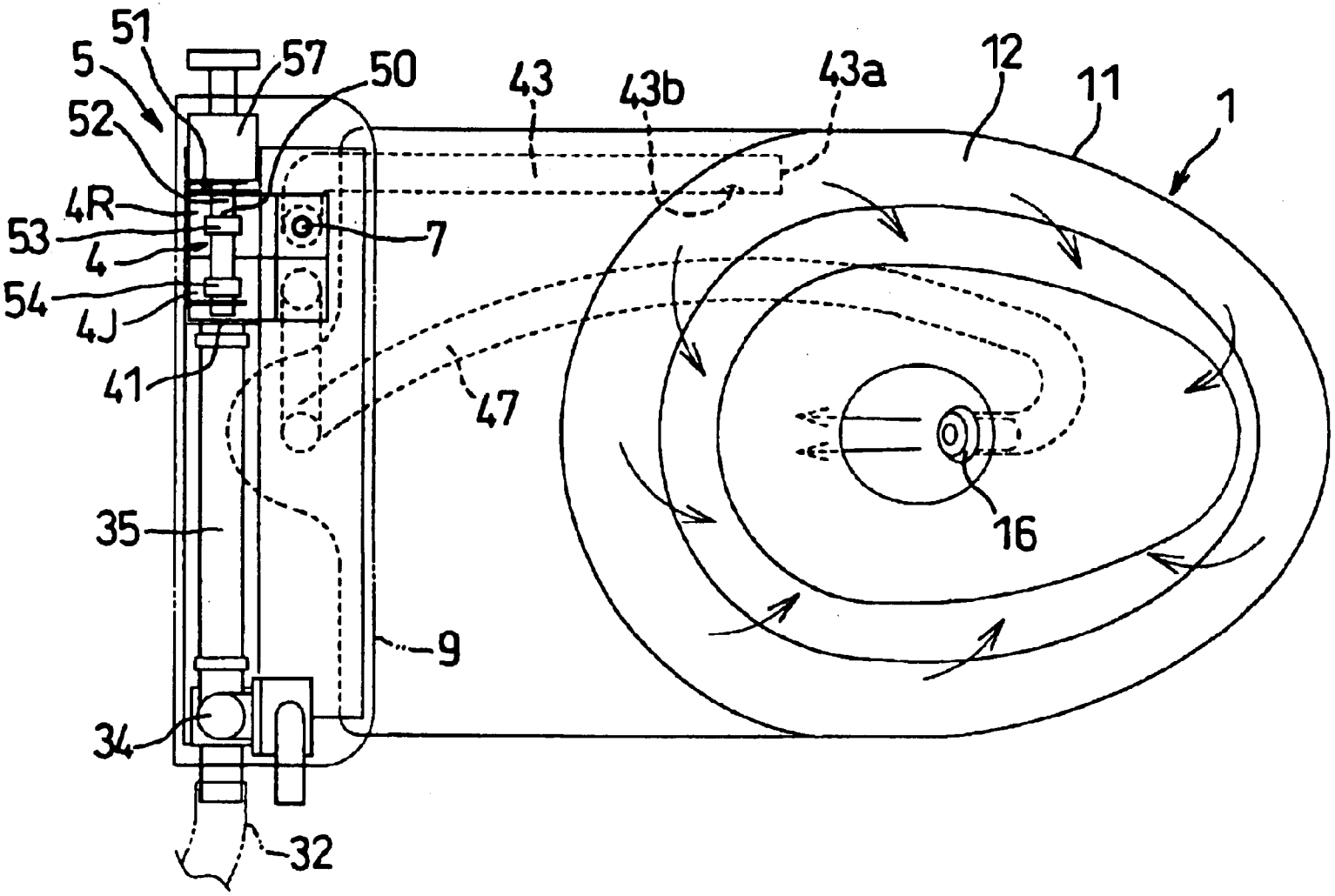
FIG. 75 is a plan view of an essential portion of a tankless western-style flush toilet according to an embodiment in the sixth invention.

In the tankless western-style flush toilet 1, a jet conduit 47 for supplying water to the jet nozzle 16 and a rim conduit 43 for supplying water to the rim channel 12 are mounted. As shown in FIG. 75, the rim conduit 43 includes an opening 43*a* which opens toward a top end and which is able to spout water clockwise, and an opening 43*b* which opens toward a side surface side and which is able to spout water counter-clockwise.

Furthermore, at a rear portion of the tankless western-style flush toilet 1, a branch device 34 which is connected to a top end portion of the flexible hose 32 is mounted. The branch device 34 is to divide water into water for washing a toilet and water for other use.

Moreover, at a rear portion of the tankless western-style flush toilet 1, a valve means 4 is mounted in such a manner that the valve means 4 is positioned at the opposite side of the branch device 34. The valve means 4 includes a rim open/close valve 4R and a jet open/close valve 4J. Two open/close valves 4R and 4J are adjacent to each other to be one body. A water-in port 41 of the jet open/close valve 4J is connected to a main conduit 35 which is guided from the branch device 34. A water-in port not shown in the drawing of the rim open/close valve 4R is communicated with the water-in port 41 of the jet open/close valve 4J. Due to this, water is supplied from the conduit 35 to the open/close valves 4R and 4J.

At a rear portion of the tankless western-style flush toilet 1, a driving device 5 is mounted. The driving device 5 is to open and close the rim open/close valve 4R and is to open and close the jet open/close valve 4J. The driving device S includes a cam device 50 and a motor device 57 for driving the cam device 50. The cam device 50 is mounted upward from the valve means 4, and it comprises a rotation axis 52 which is rotatably held at a mounting piece 51 in the horizontal condition, a first cam 53 and a second cam 54 which are mounted on the rotation axis 52 in such a manner that they are protruded in the axially right-angled direction. The rotation axis 52 is mounted in such a manner that the rotation axis 52 is extended along the width direction of the tankless western-style flush toilet 1. The motor device 57 is fixed to the mounting piece 51, and the motor device 57 and a reduction gear which transmits rotation force of the motor device 57 to the rotation axis 52 are contained, and the rotation axis 52 can be rotatingly driven by controlling a controller which is not shown in the drawing. The driving device 5, the valve means 4 and the like are covered by an outer case 9. The inside of the outer case 9 is communicated with an air by way of an opening or a clearance which is not shown in the drawing.

Figure 76:
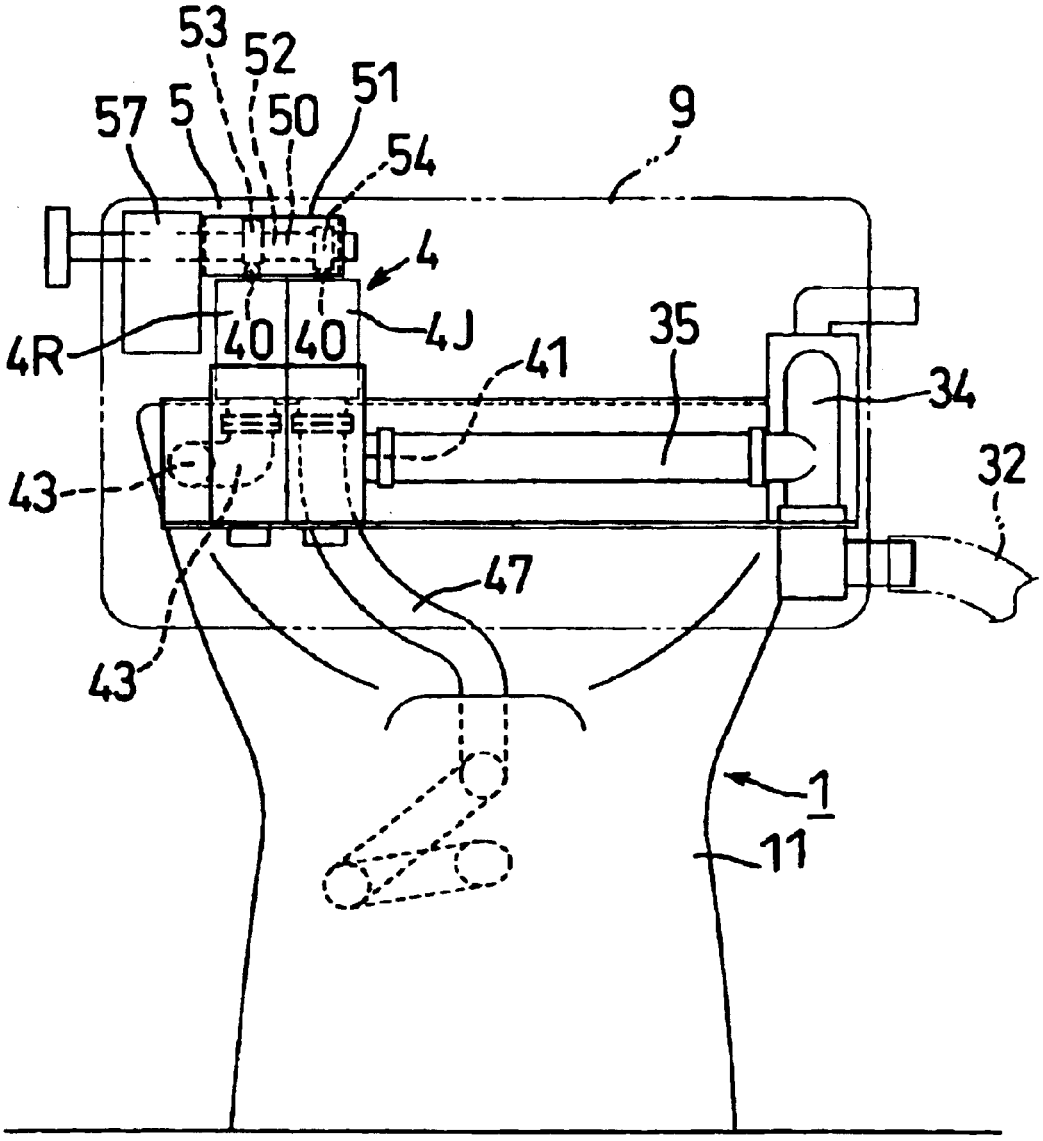
FIG. 76 is a back view of an essential portion of a tankless western-style flush toilet according to an embodiment in the sixth invention.

When the rotation axis 52 is rotated by the motor device 57, the first cam 53 and the second cam 54 are rotated along the height direction of the tankless western-style flush toilet 1. Due to this, as shown in FIG. 76, a cam surface at an outer periphery of the first cam 53 is brought into contact with a shaft 40 of a valve mechanism of the rim open/close valve 4R to move the shaft 40 downward, and a valve mechanism of the rim open/close valve 4R is opened. When the first cam 53 is further rotated, the valve mechanism of the rim open/close valve 4R is closed by a return spring which is not shown in the drawing and which is contained in the rim open/close valve 4R.

A cam surface at an outer periphery of the second cam 54 is brought into contact with a shaft 40 of a valve mechanism of the jet open/close valve 4J to move the shaft 40 downward. When the second cam 54 is further rotated, the valve mechanism of the jet open/close valve 4J is closed by a return spring which is not shown in the drawing and which is contained in the jet open/close valve 4J.

Figure 78:
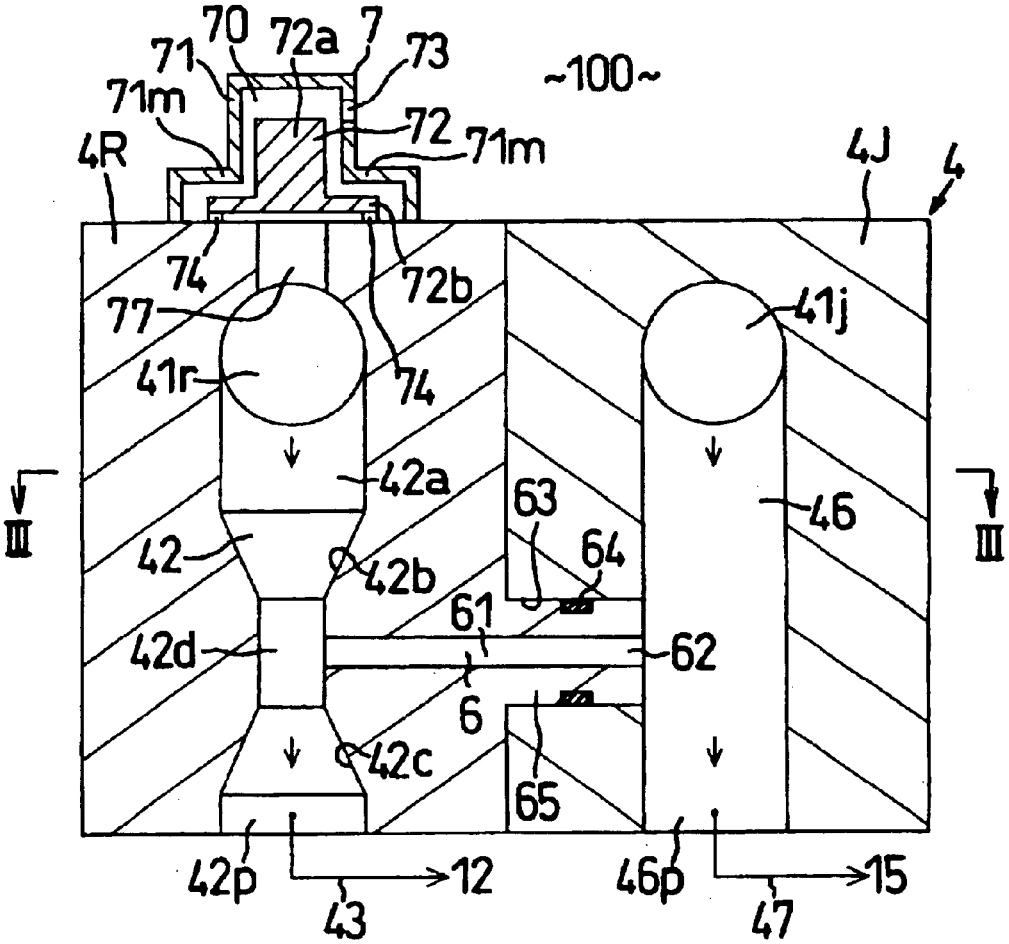
FIG. 78 is a cross-sectional view of a valve means according to an embodiment in the sixth invention.

As shown in FIG. 78, in the inside of a housing of the rim open/close valve 4R, a rim flow passage 42 which is communicated with a water-out port 41*r* is formed. A port 42*p* of the rim flow passage 42 is communicated with the rim channel 12 by way of the rim conduit 43. When the valve mechanism not shown in the drawing of the rim open/close valve 4R is opened, water is supplied to the rim channel 12 by the rim flow passage 42 and the rim conduit 43. When the valve mechanism of the rim open/close valve 4R is closed, water supply to the rim channel 12 is stopped.

The rim flow passage 42 which is formed in the inside of the housing of the rim open/close valve 4R includes a first passage 42*a* which is mounted extending from the water-out port 41*r* of the rim open/close valve 4R and whose cross-sectional area is identical at the whole length, a contracted-diameter passage 42*b* in a conical shape which is mounted extending to the first passage 42*a* and whose cross-sectional area is reduced toward a downstream, an enlarged-diameter passage 42*c* in a conical shape which is mounted extending to the first passage 42*a* and whose cross-sectional area is increased toward a downstream and a throttle passage 42*d* which is formed between the contracted-diameter passage 42*b* and the enlarged-diameter passage 42*c* and whose cross-sectional area is smaller than that of the first passage 42*a*.

In the inside of a housing of the jet open/close valve 4J, a jet flow passage 46 which is communicated with a water-out port 41*j* is formed. A port 46*p* of the jet flow passage 46 is communicated with the jet hole 15 by way of the jet conduit 47. When the valve mechanism not shown in the drawing of the jet open/close valve 4J is opened, water is supplied to the jet hole 15 by way of the jet flow passage 46 and the jet conduit 47. When the valve mechanism of the jet open/close valve 4J is closed, water supply to the jet hole 15 is stopped.

Furthermore, a communication passage 6 is formed in the inside of a housing of the valve means 4. The communication passage 6 is extended in the crossed direction with respect to the extended direction of the rim flow passage 42 and the jet flow passage 46. The throttle passage 42*d* of the rim flow passage 42 and the jet flow passage 46 are communicated with each other by the communication passage 6.

Figure 77:
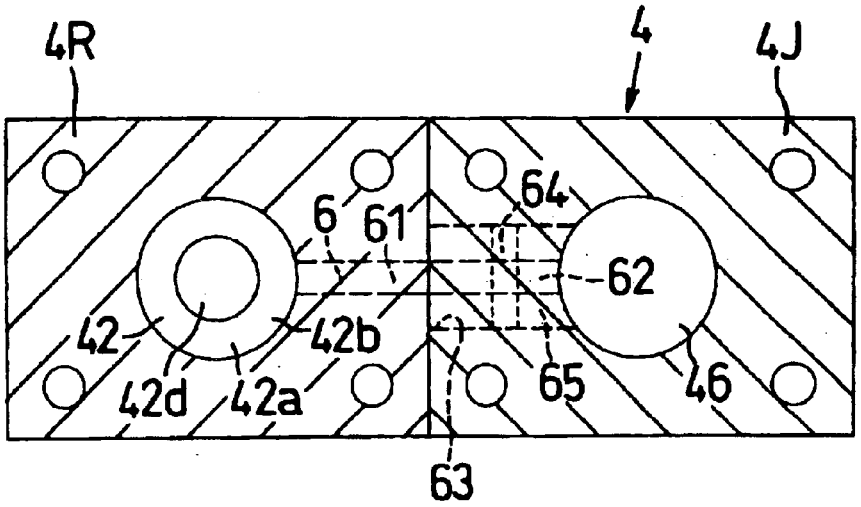
FIG. 77 is a cross-sectional view of III—III line shown in FIG. 78 according to an embodiment in the sixth invention.

As shown in FIGS. 78 and 77, the communication passage 6 is formed by a first passage hole 61 which is formed at the housing of the rim open/close valve 4R, a second passage hole 62 of a cylinder portion 65 which is inserted into an inserted hole 63 formed at the housing of the jet open/close valve 4J by way of a sealing member 64. Furthermore, as mentioned below, the throttle passage 42*d* and the communication passage 6 can be functioned as a suction means for sucking an air which is remained in the jet flow passage 46.

As shown in FIG. 78, a vacuum breaker 7 is mounted at an upper portion of the rim open/close valve 4R among the valve means 4. The vacuum breaker 7 is communicated with the rim flow passage 42 and an air 100. Namely, the vacuum breaker 7 is held at the upper portion of the rim open/close valve 4R, and it includes a case 71 having an air communication room 70, a movable type lid portion 72 which is arranged floatably in the air communication room 70 of the case 71 and an intake port 73 which is mounted on the case 71. The air communication room 70 and the rim flow passage 42 are connected by a connection passage 77 which is formed at the upper portion of the rim open/close valve 4R.

The intake port 73 of the vacuum breaker 7 is communicated with the communication room 70 and the air 100 upward from the uppermost surface of the rim flow passage 12 of the tankless western-style flush toilet 1. Thus, the intake port 73 is mounted upward from the uppermost surface of the rim flow passage 12 of the tankless western-style flush toilet 1, so it is possible to suppress the outflow of water from the intake port 73.

The lid portion 72 includes a body portion 72*a*, a flange portion 72*b* which is mounted extending from a lower portion of the body portion 72*a* in the lateral outer direction and a leg 74 which is mounted extending from the flange portion 72*b*. The leg 74 forms a space for communicating the air communication room 70 with the rim flow passage 42. Even if the lid portion 72 is floated up by the influence of water from the rim flow passage 42, the flange portion 72*b* is brought into contact with a portion 71*m* of the case 71, so water from the rim flow passage 42 is suppressed to be entered to the side of the intake port 73.

In the tankless western-style flush toilet 1 constituted as above, water is supplied to the valve means 4 by way of the water supply pipe 30 which is connected to a city water service pipe, the stop cock 31, the flexible hose 32, the branch device 34 and the main conduit 35. As far as the user doesn't carry out the switch operation in order to wash the bowl portion 10, both of the open/close valves 4J and 4R are closed, and water is not supplied to the tankless western-style flush toilet 1.

When the bowl portion 10 is washed, in accordance with the switch operation of the user, a motor of the driving device 5 is driven by a signal of a controller, and the rotation axis 52 is rotatingly driven. Due to this, the first rim water-through operation is carried out. In other words, the cam surface of the first cam 53 pushes the shaft 40 of the rim open/close valve 4R downward to open the valve mechanism of the rim open/close valve 4R. Accordingly, water is flown to the rim flow passage 42 by way of the water-out port 41*r* of the rim open/close valve 4R, and furthermore, the water is supplied to the rim channel 12 by way of the rim conduit 43. Then, the water is flown downward from the rim channel 12 along an inner wall surface of the bowl portion 10 to wash the inner wall surface of the bowl portion 10.

In accordance with the driving of the cam device 50, the cam surface of the first cam 53 doesn't come to push the shaft 40 of the rim open/close valve 4R downward, and the valve mechanism of the rim open/close valve 4R is closed. After that, the cam surface of the second cam 54 pushes the shaft 40 of the jet open/close valve 4J downward to open the valve mechanism of the jet open/close valve 4J. Due to this, the jet water-through operation is carried out. In other words, water is flown to the jet flow passage 46 by way of the water-out port 41*j* of the jet open/close valve 4J, and furthermore, the water is supplied to the jet hole 15 by way of the jet conduit 47 to generate a siphon effect in the trap portion 14 forcibly.

Next, in accordance with the driving of the cam device 50, the cam surface of the second cam 54 doesn't come to push the shaft 40 of the jet open/close valve 4J downward, and the valve mechanism of the jet open/close valve 4J is closed. After that, the cam surface of the first cam 53 again pushes the shaft 40 of the rim open/close valve 4R downward to open the valve mechanism of the rim open/close valve 4R again. Due to this, the second rim water-through operation is carried out. In other words, water is flown to the rim flow passage 42 by way of the water-out port 41*r* of the rim open/close valve 4R, and furthermore, the water is supplied to the rim channel 12 by way of the rim conduit 43. Then, the water is flown downward along an inner wall surface of the bowl portion 10. Accordingly, the bowl portion 10 is sealed with water to finish the washing of the western-style toilet body 11. In FIG. 74, a water level of the sealed water surface of the bowl portion 10 is indicated as W. As shown in FIG. 74, the intake port 73 of the vacuum breaker 7 is mounted at the uppermost portion in a water supply system for supplying water to the rim channel 12 and the jet hole 15, so the intake port 73 of the vacuum breaker 7 is positioned upward from the sealed water surface W, the rim 13, the rim conduit 43, the jet conduit 47 and the open/close valves 4R and 4J.

In the tankless western-style flush toilet 1, there exists a possibility that a negative pressure is generated at an upstream side of the rim flow passage 42 and the jet flow passage 46 to generate a back flow of filth water after the open/close valves 4R and 4J which are in the open condition for supplying water are closed to stop supplying water to the rim channel 12 or the jet hole 15. In this case, in the tankless western-style flush toilet 1, the rim flow passage 42 is communicated with the jet flow passage 46 by way of the communication passage 6, and at the same time, the vacuum breaker 7 which is mounted on the rim flow passage 42 has the intake port 73 which is communicated with the air 100 upward from the uppermost surface of the rim channel 12. So, the rim flow passage 42, the jet flow passage 46 and the communication passage 6 are communicated with the air 100, and it is possible to prevent a back flow of filth water which is flown by way of the rim flow passage 42 and the jet flow passage 46. Namely, in the tankless western-style flush toilet 1, although the rim flow passage 42 and the jet flow passage 46 are separate paths which are independent from each other, both passages are communicated by the communication passage 6. So, the vacuum breaker 7 is able to cancel a negative pressure on an upstream side of the rim flow passage 42, and at the same time, to cancel a negative pressure on an upstream side of the jet flow passage 46. In other words, the vacuum breaker 7 is common between the rim flow passage 42 and the jet flow passage 46, so it is unnecessary to mount a vacuum breaker which is used for the rim flow passage 42 exclusively and a vacuum breaker which is used for the jet flow passage 46 exclusively. Furthermore, the number of components can be decreased, and there is an advantage in the reduction of the cost.

Furthermore, in the tankless western-style flush toilet 1, as shown in FIG. 74, the open/close valves 4J and 4R are arranged upward from the sealed water surface W of the bowl portion 10. So, an air is likely to be remained at the upper portion from the water level of the sealed water surface W of the jet conduit 47 in the jet flow passage 46 after carrying out the washing of the bowl portion 10. The air which is remained in the jet conduit 47 is released from the jet nozzle 16 at the bottom of the bowl portion 10, so the air is supplied as bubbles in water which is reserved near the bottom of the bowl portion 10, and a bubble floating noise as a noise is likely to be generated. In this respect, in the tankless western-style flush toilet 1, even if an air is remained in the jet conduit 47, when the first rim water-through operation is carried out by the rim open/close valves 4R, water is flown from the first passage 42*a* whose flow passage area is large to the throttle passage 42*d* whose flow passage area is small. As a result, a flow speed of water as a fluid in the throttle passage 42*d* is increased, and the effect of the reduction of the pressure is generated in the throttle passage 42*d* according to Bernoulli's theorem. Due to this, the air which is remained in the jet conduit 47 is sucked into the rim flow passage 42 by way of the communication passage 6 at the time of carrying out the first rim water-through operation. The air which is sucked into the rim flow passage 42 is released to the rim channel 12 by way of the rim conduit 43 together with water which is flown in the rim flow passage 42. Even if the air is released to the rim channel 12, the problem of the bubble floating noise as a noise is not occurred.

Other Embodiments

Figure 79:
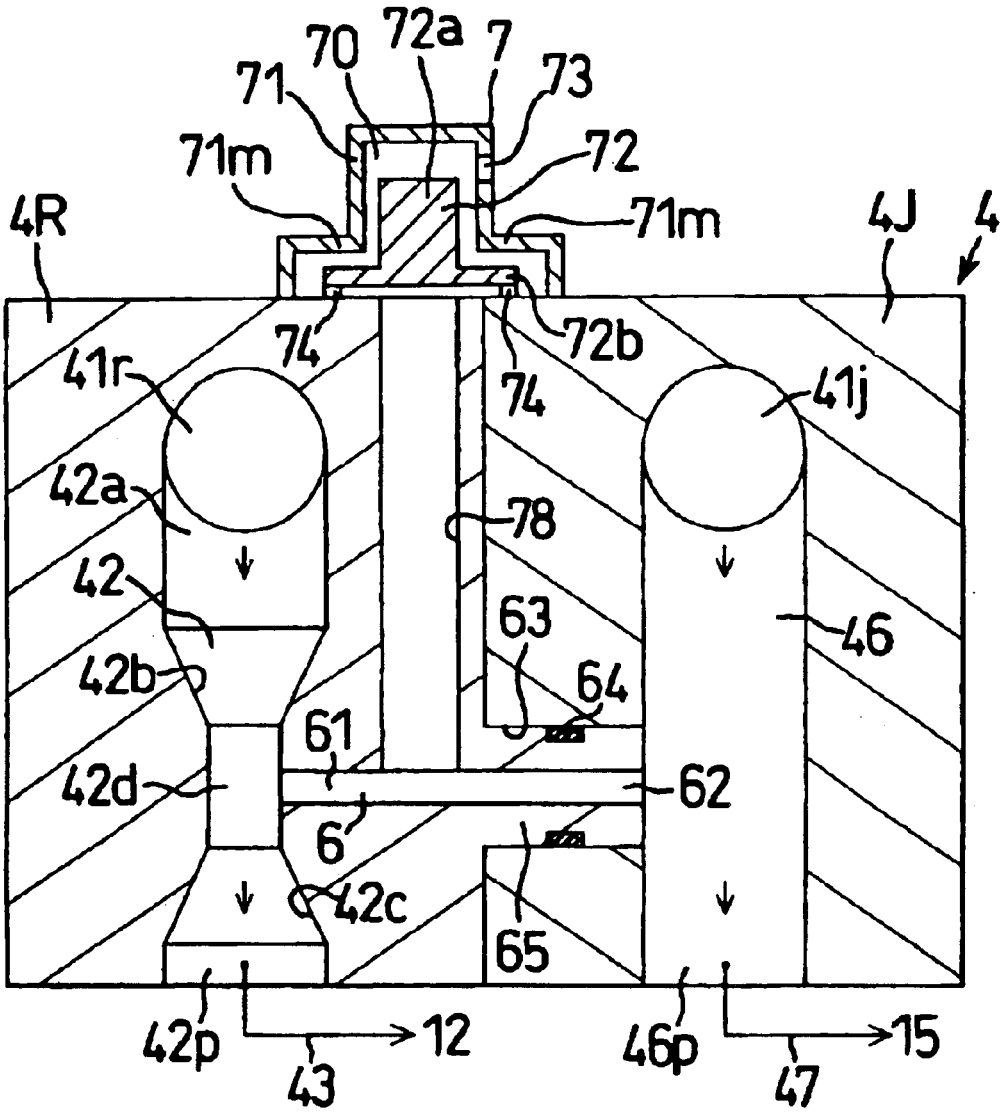
FIG. 79 is a cross-sectional view of a valve means according to other embodiment in the sixth invention.

In the above embodiment, the vacuum breaker 7 is mounted on the rim flow passage 42. However, in the tankless western-style flush toilet 1 of the sixth invention, as shown in FIG. 79, it is preferable that the vacuum breaker 7 is mounted not in the rim flow passage 42, but in the communication passage 6 which communicates the rim flow passage 42 with the jet flow passage 46. In this case, the air communication room 70 of the vacuum breaker 7 can be connected with the communication passage 6 by way of a connection passage 78 which is mounted extending upward from the communication passage 6. With such a constitution, the communication passage 6 is not filled with water, and both of the cancellation of the negative pressure on the upstream side of the rim flow passage 42 and the cancellation of the negative pressure on the upstream side of the jet flow passage 46 can be surely achieved.

In the tankless western-style flush toilet 1 of the sixth invention, a vacuum breaker may be mounted in the jet flow passage 46, not in the rim flow passage 42.

Seventh Invention

An embodiment which embodies the seventh invention is explained hereinafter in conjunction with drawings 80 to 82.

Figure 80:
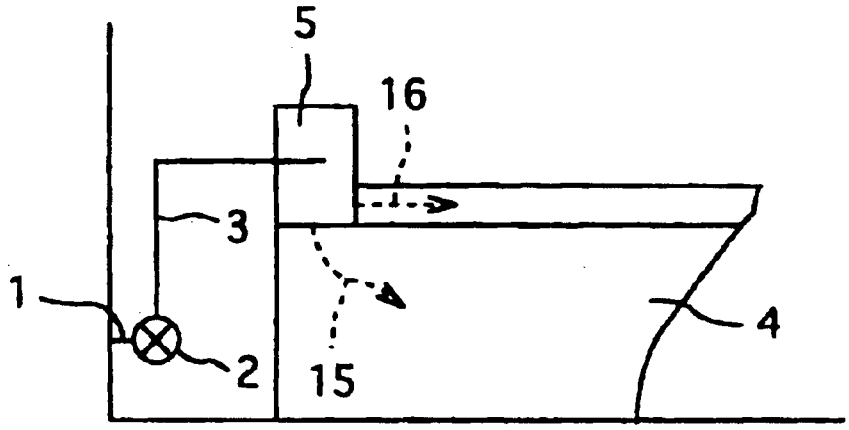
FIG. 80 is a typically side view of a tankless western-style flush toilet according to an embodiment in the seventh invention.

In this embodiment, the seventh invention is embodied by a tankless western-style flush toilet having no toilet washing tank as a flush toilet. In this tankless western-style flush toilet, as shown in FIG. 80, a flexible hose 3 is connected to a water supply pipe 1 such as a city water service pipe and the like by way of a stop cock 2. The flexible hose 3 is connected to a toilet washing device 5 which is mounted on a western-style toilet body 4.

Figure 81:
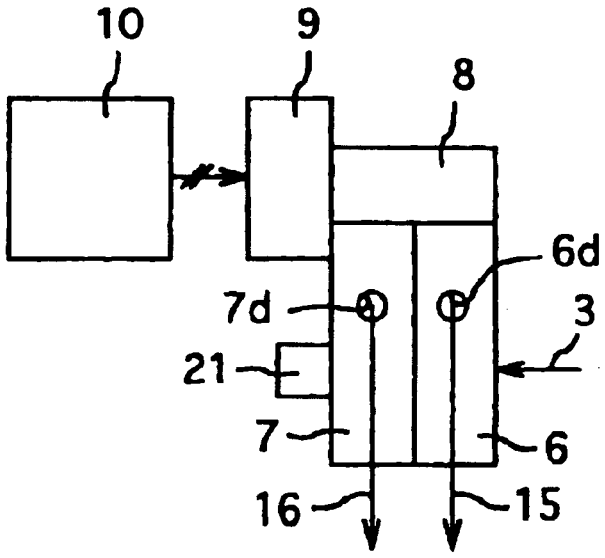
FIG. 81 is a typically back view of a toilet washing device of a tankless western-style flush toilet according to an embodiment in the seventh invention.

As shown in FIG. 81, the toilet washing device 5 comprises a jet open/close valve 6 which is connected to the flexible hose 3, a rim open/close valve 7 which is fixed together with the jet open/close valve 6 to be one body, a flow open/close valve 21 which is fixed together with the rim open/close valve 7 to be one body, a cam device 8 which is fixed to an upper end of the open/close valves 6 and 7 and a motor device 9 which is adjacent to the cam device 8 and which drives the cam device 8. The motor device 9 is electrically connected to a controller 10.

Figure 82:
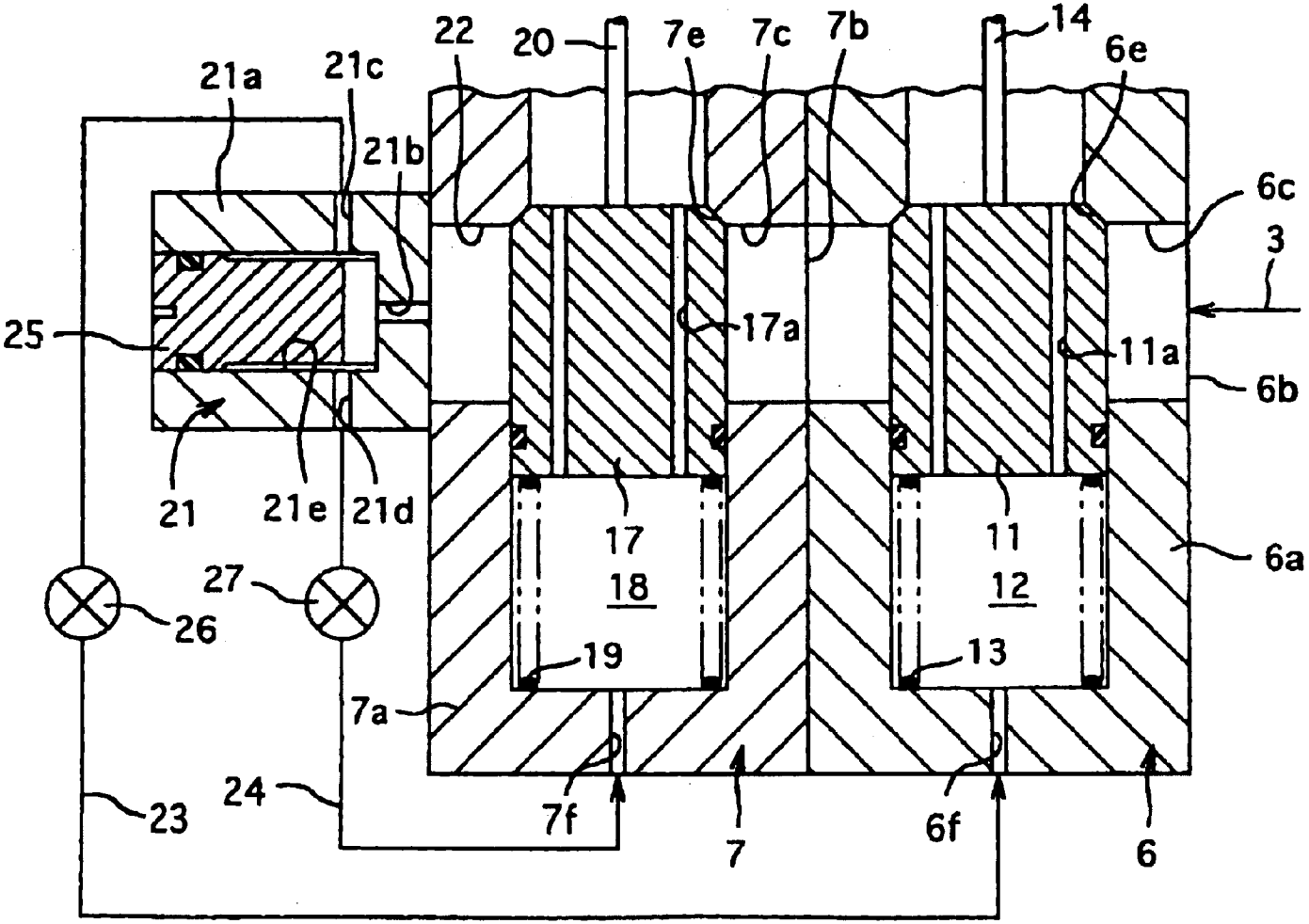
FIG. 82 is a cross-sectional view of an open/close valve and the like of a tankless western-style flush toilet according to an embodiment in the seventh invention.

As shown in FIG. 82, in the jet open/close valve 6, a water-in port 6*b* opens at a side surface of a longitudinal housing 6*a*, and the water-in port 6*b* is connected to the flexible hose 3. In the housing 6*a*, a main water passage 6*c* which is connected to the water-in port 6*b* and which is crossed in the width direction and is extended upward at the center is formed. As shown in FIG. 81, an upper end of the main water passage 6*c* is a water-out port 6*d* which opens at a side surface of the housing 6*a*. The water-out port 6*d* is connected to a jet conduit 15, and as shown in FIG. 80, the jet conduit 15 is connected to a jet nozzle which is mounted on the western-style toilet body 4 and which is not shown in the drawing.

As shown in FIG. 82, in the housing 6*a* of the jet open/close valve 6, a piston 11 as a main valve body is mounted in such a manner that the piston 11 can be slided up and down, and a pressure offset room 12 is formed downward from the piston 11. At the main water passage 6*c*, a seat face 6*e* to which an upper end of the piston 11 can be attached is formed, and the piston 11 is pushed to the side of the seat face 6*e* by a spring 13 as a force act means which is mounted in the pressure offset room 12. Furthermore, plural communication holes 11*a* as passages which are extended upward and downward and which communicate the main water passage 6*c* with the pressure offset room 12 are mounted in the piston 11. A shaft 14 which is extended upward is fixed to an upper end of the piston 11, and the shaft 14 is driven up and down by the cam device 8 which is shown in FIG. 81. Moreover, at a lower end of the housing 6*a*, a small hole 6*f* which is communicated with the pressure offset room 12 and whose diameter is smaller than that of the main water passage 6*c* is formed.

As shown in FIG. 82, also in the rim open/close valve 7, a water-in port 7*b* opens at a side surface of a longitudinal housing 7*a*, and the water-in port 7*b* is connected to the main water passage 6*c* of the jet open/close valve 6. In the housing 7*a*, a main water passage 7*c* which is connected to the water-in port 7*b* and which is extended in the width direction and then extended upward at the center is formed. As shown in FIG. 81, an upper end of the main water passage 7*c* is a water-out port 7*d* which opens at a side surface of the housing 7*a*. The water-out port 7*d* is connected to a rim conduit 16, and as shown in FIG. 80, the rim conduit 16 is connected to a rim channel which is mounted on the western-style toilet body 4 and which is not shown in the drawing.

As shown in FIG. 82, in the housing 7*a* for the rim open/close valve 7, a piston 17 as a main valve body is mounted in such a manner that the piston 17 can be slided up and down, and a pressure offset room 18 is formed downward from the piston 17. At the main water passage 7*c*, a seat face 7*e* to which an upper end of the piston 17 can be attached is formed, and the piston 17 is pushed to the side of the seat face 7*e* by a spring 19 as a force act means which is mounted in the pressure offset room 18. The main water passage 7*c* is extended in the width direction in such a manner that the main water passage 7*c* crosses the housing 7*a* to become a water inlet 22 which constitutes a part of a sub water passage mentioned later. Namely, the water inlet 22 of the sub water passage is connected to a terminal end portion at a primary side of the main water passages 6*c* and 7*c*. Furthermore, plural communication holes 17*a* as passages which are extended upward and downward and which communicate the main water passage 7*c* with the pressure offset room 18 are mounted in the piston 17. A shaft 20 which is extended upward is fixed to an upper end of the piston 17, and the shaft 20 is driven up and down by the cam device 8 which is shown in FIG. 81. The cam device 8 is driven by the motor device 9, and the motor device 9 is driven based on an electric signal of the controller 10. Moreover, at a lower end of the housing 7*a*, a small hole 7*f* which is communicated with the pressure offset room 18 and whose diameter is smaller than that of the main water passage 7*c* is formed.

As shown in FIG. 82, the flow open/close valve 21 has a short rectangular housing 21*a*. At the housing 21*a*, a small hole 21*b* which is communicated with a water inlet of a sub water passage 22 and whose diameter is smaller than that of the main water passage 7*c* is formed, and at the same time, small holes 21*c* and 21*d* which are communicated with the small holes 6*f* and 7*f* by way of pipes 23 and 24 are similarly formed. Such small holes 21*b*, 21*c* and 21*d* are communicated with each other by a valve room 21*e* which is extended in the lateral direction. In the valve room 21*e*, a sub valve body 25 is screwed in such a manner that the sub valve body 25 can be manually operated, and the divergence of the small holes 21*c* and 21*d* can be adjusted by the position into which the sub valve body 25 is screwed. To the pipes 24 and 25, constant flow amount valve mechanisms 26 and 27 are connected.

Thus, in such open/close valves 6, 7 and 21, the main water passage 6*c* and the piston 11 for the rim, and the main water passage 7*c* and the piston 17 for the jet are assembled in such a manner that the water-in port 6*b* is common between them. Due to this, the rim open/close valve 7 and the jet open/close valve 6 become one body, so the mountability on the tankless western-style flush toilet is excellent. At the same time, pipes are not required, and it is possible to achieve the reduction of the cost. Then, the single water inlet 22 of the sub water passage is connected to the main water passage 7*c*, and the communication holes 11*a* and 17*a* which constitute two water outlets of the sub water passage are connected to the water-out port 6*d* for the rim and the water-out port 7*d* for the jet.

Furthermore, in the open/close valves 6, 7 and 21, the water inlet 22, the small hole 21*b*, the valve room 21*e*, the small hole 21*c*, the pipe 23, the small hole 6*f*, the pressure offset room 12 and the communication hole 11*a* constitute one sub water passage, and the water inlet 22, the small hole 21*b*, the valve room 21*e*, the small hole 21*d*, the pipe 24, the small hole 7*f*, the pressure offset room 18 and the communication hole 17*a* constitute the other sub water passage. Such sub water passages are able to spout water in the flow amount which can prevent the freezing at an upstream side of the western-style toilet body 4 or the freezing of a trap not shown in the drawing of the western-style toilet body 4 by adjusting the position into which the sub valve body 25 is screwed and by the function of the constant flow amount valve mechanisms 26 and 27.

In addition, in the open/close valves 6, 7 and 21, the housings 6*a*, 7*a* and 21*a* are connected with each other to constitute a single housing. Due to this, in such open/close valves 6, 7 and 21, the main valve mechanism comprising the main water passages 6*c* and 7*c* and the pistons 11 and 17, and the sub valve mechanism comprising the sub water passage 22 or the like and the sub valve body 25 become one body, so the mountability on the tankless western-style flush toilet is excellent. At the same time, pipes are not required, and it is possible to achieve the reduction of the cost.

In the tankless western-style flush toilet including the open/close valves 6, 7 and 21 which is constituted as above, by an input of a switch, the main water passage 7*c* is released by the piston 17 first, and a large flow amount of water is flown into a rim channel of the western-style toilet body 4, and the washing of a toilet bowl is carried out. Next, the main water passage 6*c* is released by the piston 11, and a large flow amount of water is flown into the jet nozzle which is mounted in the western-style toilet body 4, and a siphon effect is forcibly generated. After that, the main water passage 7*c* is again released by the piston 17, and a large flow amount of water is flown into the rim channel of the western-style toilet body 4, and water sealing of the toilet bowl is carried out.

Moreover, during the cold season, while the pistons 11 and 17 close the main water passages 6*c* and 7*c* for a long time of period, by releasing the sub water passage due to the sub valve body 25, a small flow amount of water can be flown into the rim channel or/and the jet nozzle. Due to this, it is possible to prevent the freezing of a water supply system reaching the water supply pipe 1 or the western-style toilet body, or the freezing of the trap of the western-style toilet body 4 and the freezing at the downstream side thereof during the cold season, and to achieve an inexpensive maintenance fee.

Furthermore, in the open/close valves 6, 7 and 21, the sub water passage includes the communication holes 11*a* and 17*a* which pass through the pistons 11 and 17, so dead water is hardly generated near the pressure offset rooms 12 and 18, and near the pistons 11 and 17, as far as a small amount of water is flown. Especially, the water inlet 22 of the sub water passage is connected to a terminal end at the primary side of the main water passages 6*c* and 7*c*, so dead water is not generated between near the water inlet 22 of the sub water passage and the terminal end at the primary side of the main water passages 6*c* and 7*c*. Therefore, there is no possibility that the contamination and the freezing of dead water are generated.

In addition, in the open/close valves 6, 7 and 21, the slidability in the axial direction of the pistons 11 and 17 is ensured, and the operation responsibility becomes stable, and it is possible to improve the reliability about the washability and the like in the tankless western-style flush toilet. Besides, water existed in one side of the pistons 11 and 17 from the water-in port 6*b* or the water-out ports 6*d* and 7*d* is moved to the pressure offset rooms 12 and 18 by way of the communication holes 11*a* and 17*a* to attempt to keep the balance between the pressure of water in the pressure offset rooms 12 and 18 and the pressure of water in one side of the pistons 11 and 17. As a result, the difference of the pressure between them can be canceled or decreased.

Furthermore, in the above embodiment, a part of the sub water passage is constituted by the pipes 23 and 24, but they can be constituted by the flow passage which is formed in the housings 6*a* and 7*a*. In this case, the constant flow amount valve mechanism can be contained in the housing 6*a* and 7*a*.

Eighth Invention

Embodiments 1 and 2 which embody the eighth invention are explained hereinafter in conjunction with drawings 83 to 94.

Embodiment 1

Figure 83:
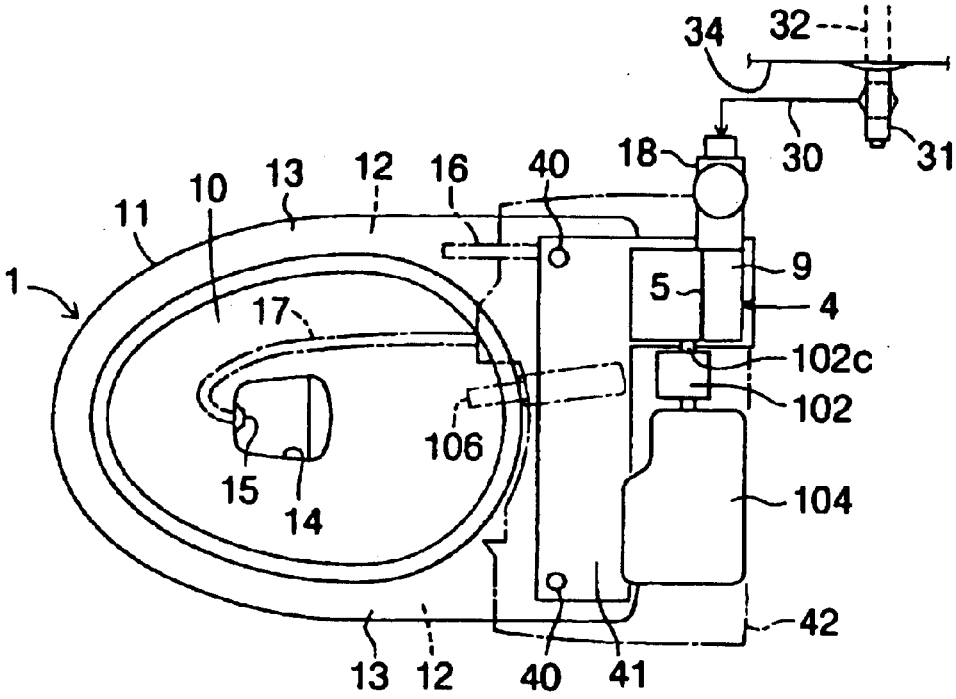
FIG. 83 is a plan view of an essential portion of a tankless western-style flush toilet according to an embodiment 1 in the eighth invention.
Figure 84:
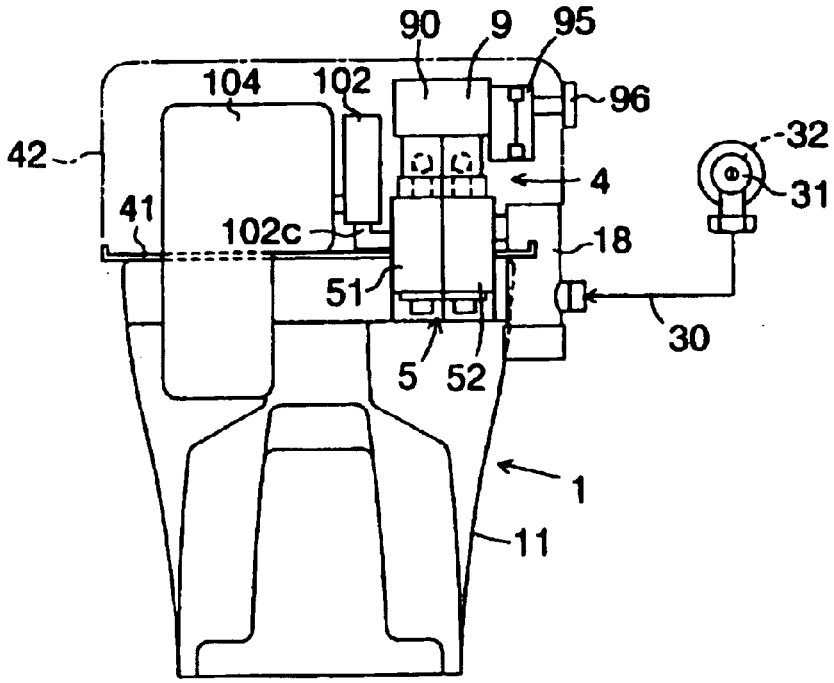
FIG. 84 is a back view of an essential portion of a tankless western-style flush toilet according to an embodiment 1 in the eighth invention.

The embodiment 1 is explained in conjunction with drawings 83 to 87. In the embodiment 1, a tankless western-style flush toilet having no toilet washing tank as a flush toilet embodies the eighth invention. As shown in FIGS. 83 and 84, the tankless western-style flush toilet comprises a western-style toilet body 1 and a toilet washing device 4 which is arranged at a rear end portion of the western-style toilet body 1. The western-style toilet body 1 includes a toilet bowl 11 having a bowl portion 10 which receives filth, a rim 13 having a rim channel 12 which encircles at an upper periphery of the bowl portion 10 and a trap portion 14 which is communicated with the bottom of the bowl portion 10 and which flows the filth out. At an inlet of the trap portion 14, a jet nozzle 15 which is functioned as a channel is mounted, and a water receiving portion 18 is mounted at a side surface of a rear portion of the toilet bowl 11. A toilet seat and a toilet lid are not shown in the drawing.

The toilet washing device 4 is held by a base plate 41 which is fixed by an attachment tool 40 at a rear end of the western-style toilet body 1, and the toilet washing device 4 includes an open/close valve 5 which constitutes a main portion of the embodiment 1 and which is held at one side of the base plate 41, a driving device 9 for opening and closing the open/close valve 5 and a controller which is not shown in the drawing. The equipments such as the toilet washing device 4 and the like are concealed by a cover 41.

Figure 85:
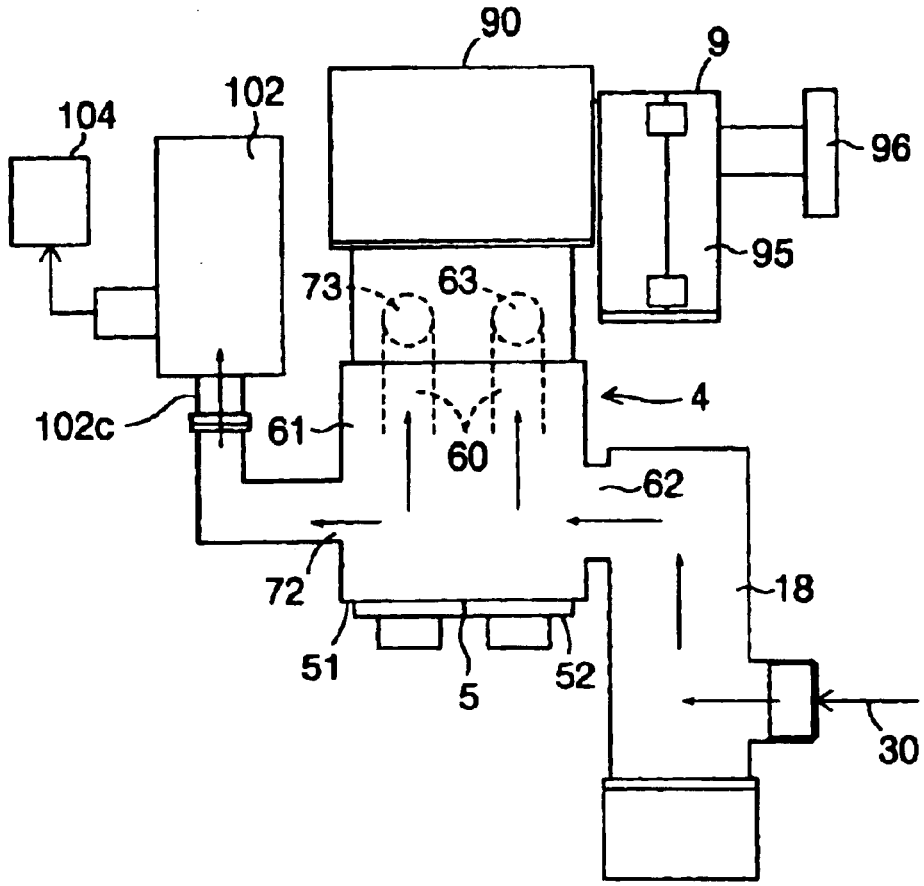
FIG. 85 is a constitutional view of an essential portion of a toilet washing device which includes a jet open/close valve and a rim open/close valve according to an embodiment 1 in the eighth invention.

As shown in FIG. 85, the open/close valve 5 is formed in such a manner that a jet open/close valve 51 and a rim open/close valve 52 are in parallel and they are integrally assembled.

Figure 87:
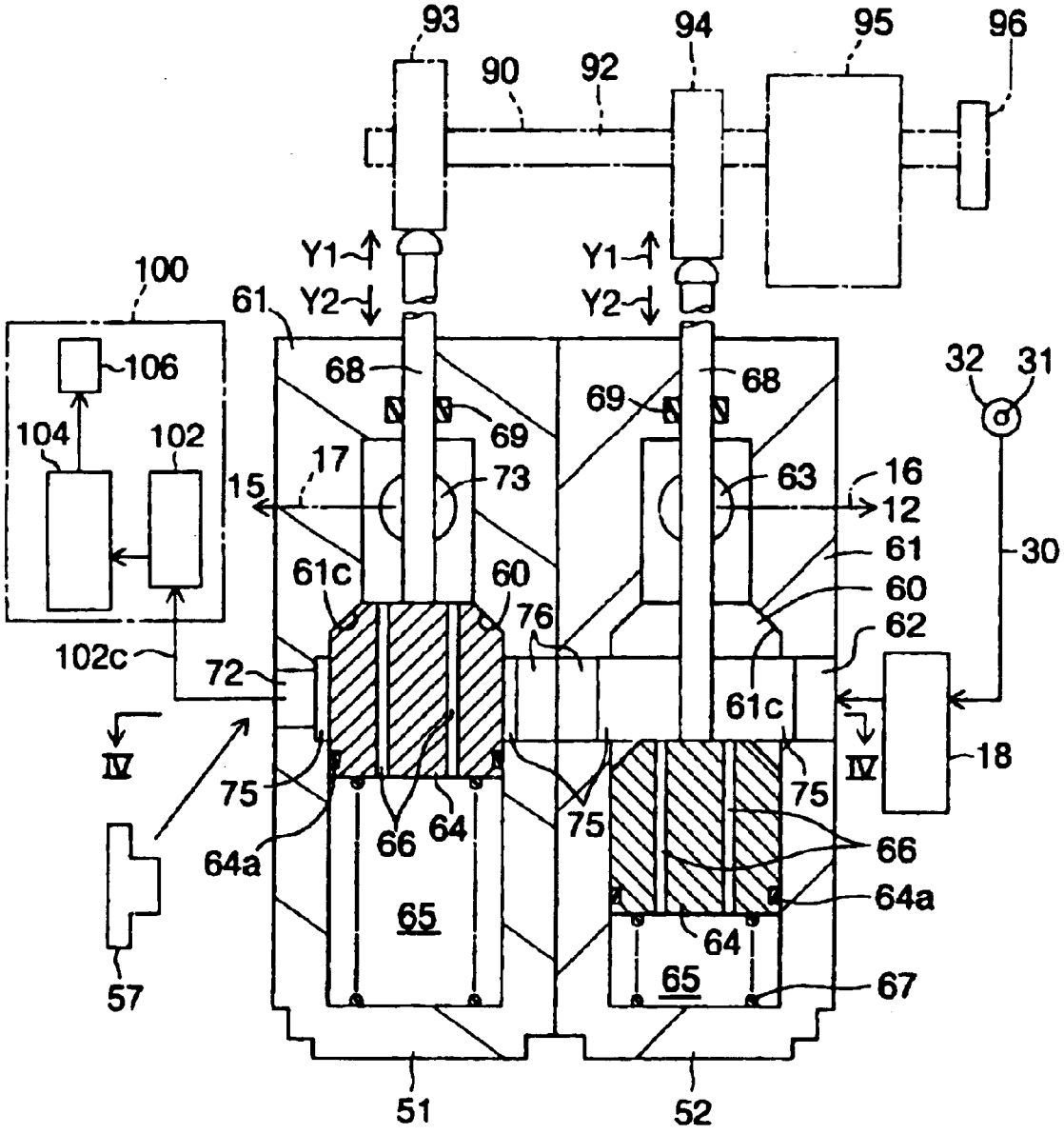
FIG. 87 is a cross-sectional view of an open/close valve which includes a jet open/close valve and a rim open/close valve according to an embodiment 1 in the eighth invention.

In an inner construction of the open/close valve 5 shown in FIG. 87, the rim open/close valve 52 has a housing 61 having a piston room 60, a first port 62 which is mounted in one of the right and left sides (right side of the drawing) of the housing 61, a water-out port 63 for spouting water in the piston room 60 and a piston 64 which is slidably held in the piston room 60 as a valve mechanism having rigidity. The first port 62 and the water-out port 63 are communicated with the piston room 60. An O ring 64*a* is held by a ring groove at an outer peripheral portion of the piston 64 to seal a boundary area between the outer peripheral portion of the piston 64 and an inner wall surface of the housing 61. In the piston room 60, a pressure offset room 65 is formed by the housing 61 and the other end surface of the piston 64. The pressure offset room 65 is communicated with the side of the water-out port 63 by way of plural communication holes 66 as passages which are formed in the piston 64. In the pressure offset room 65, a push coil spring 67 as a force act means is coaxially arranged. The push coil spring 67 is disposed between the housing 61 and the other end surface of the piston 64. The push coil spring 67 always pushes the piston 64 to one side, namely, toward the direction of an arrow Y1, and it has act force toward the direction for closing the communication between the first port 62 and the water-out port 63. The water-out port 63 of the rim open/close valve 52 is communicated with the rim channel 12 by way of the rim conduit 16.

At one end surface of the piston 64, a shaft 68 which is able to move the piston 64 in the axial direction is coaxially fixed, and the shaft 68 is protruded from the housing 61 toward one direction, namely, the direction of an arrow Y1. A boundary area between the shaft 68 and the housing 61 is sealed by the O ring 69.

The jet open/close valve 51 has basically the same constitution as that of the rim open/close valve 52. In other words, the jet open/close valve 51 has a housing 61 having a piston room 60, a second port 72 which is mounted in the other of the right and left sides (left side of the drawing) of the housing 61, a water-out port 73 for spouting water in the piston room 60 and a piston 64 which is slidably held in the piston room 60 as a valve mechanism having rigidity. An opening area of the second port 72 is set to be smaller than that of the first port 62. The reason of this is, as described below, that the second port 72 is to supply water to a part washing device 100, and less amount of water than that for washing the bowl portion 10 is required. The second port 72 and the water-out port 73 are communicated with the piston room 60.

The pressure offset room 65 is formed at a lower portion in the piston room 60. The pressure offset room 65 according to the jet open/close valve 51 is communicated with the side of the water-out port 73 by way of plural communication holes 66 as passages which are formed in the piston 64. In the pressure offset room 65, a push coil spring 67 as a force act means is coaxially arranged. The push coil spring 67 is disposed between the housing 61 and the other end surface of the piston 64, and the push coil spring 67 always pushes the piston 64 to one side, namely, toward the direction of an arrow Y1.

Figure 86:
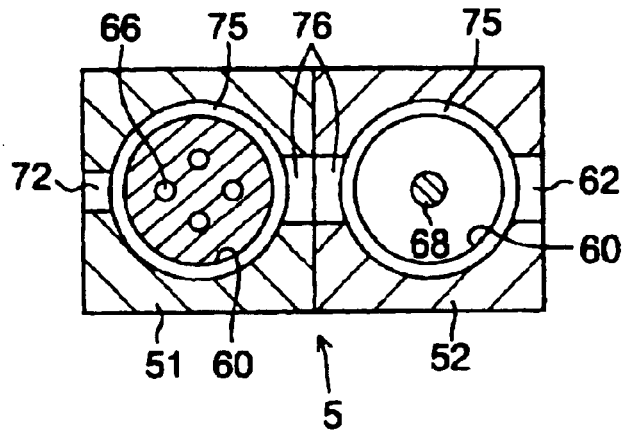
FIG. 86 is a cross-sectional view along IV—IV line shown in FIG. 87 according to an embodiment 1 in the eighth invention.

FIG. 86 shows a cross-section along IV—IV line in FIG. 87. As shown in FIG. 86, in the inside of the open/close valve 5, a ring-shaped intermediate communication passage 75 is coaxially formed along the peripheral direction of each piston room 60 in such a manner that the ring-shaped intermediate communication passage 75 is positioned at an outer peripheral side of each piston room 60. At the same time, a communication passage 76 for communicating the intermediate communication passages 75 with each other is formed. The first port 62 and the second port 72 of the open/close valve 5 are communicated with each other by way of the intermediate communication passage 75 and the communication passage 76. As a result, without being relevant to the operation for opening and closing the rim open/close valve 52, namely, without being relevant to supplying water or stopping water supply to the rim channel 12, the first port 62 and the second port 72 are always communicated with each other. In the same manner, without being relevant to the operation for opening and closing the jet open/close valve 51, namely, without being relevant to supplying water or stopping water supply to the jet nozzle 15, the first port 62 and the second port 72 are always communicated with each other.

As shown in FIG. 87, the driving device 9 is to open and close the first and second open/close valves 51 and 52, and the driving device 9 is formed by a cam device 90 which is arranged upward from the first and second open/close valves 51 and 52, and a motor device 95 for operating the cam device 90. The cam device 90 includes a rotation axis 92 which is rotatably held in the horizontal condition at a bracket not shown in the drawing that is fixed to the first and second open/close valves 51 and 52, and the first and second cams 93 and 94 which are fixed to the rotation axis 92. In the motor device 95, a motor and a transmission gear for reducing the rotation speed of the motor are contained, and the rotation axis 92 can be rotatory driven by controlling the controller. To the driving device 9, a handle 96 for the manual operation is attached, and the rotation axis 92 of the cam device 90 can be manually rotated at the time of power failure and the like.

As shown in FIG. 83, in a toilet room, a water supply pipe 32 is attached to a wall 34, and a stop cock 31 is attached to a top end of the water supply pipe 32. The water supply pipe 32 is connected to the water receiving portion 18 by way of a flexible hose 30 as a connecting pipe. In this condition, as shown in FIG. 87, water in the water supply pipe 32 is supplied to the first port 62 of the open/close valve 5 by way of the stop cock 31, the flexible hose 30 and the receiving portion 18. Therefore, the first port 62 is functioned as a water-in port which is connected to the water supply pipe 32.

When the part washing device 100 having a function for washing a part of human body is mounted as an attached equipment in the toilet body 1, the part washing device 100 has a water supply valve 102 which is connected to the second port 72 of the open/close valve 5 by way of a passage 102*c*, a hot water tank 104 which is connected to the water supply valve 102 and in which an electric heater for heating water is contained, and an extendable shower nozzle 106 for spouting water in the hot water tank 104 toward a part of human body who sits on the toilet seat. Thus, the second port 72 of the open/close valve 5 is connected to the water supply valve 102 on the side of the part washing device 100, and it is functioned as a water supply port for supplying water to the part washing device 100.

In the tankless western-style flush toilet having the above constitution, as far as the user doesn't carry out the switch operation for washing the toilet bowl 10, both of the open/close valves 51 and 52 of the toilet washing device 4 are closed, and water in the water supply pipe 32 is not supplied to the rim channel 12 and the jet nozzle 15. Namely, in FIG. 87, the piston 64 of the first and second open/close valves 51 and 52 is attached to a seat face 61*c* of the housing 61 to be closed, and the communication between the first port 62 and the water-out port 63 is shut down. At the same time, the communication between the first port 62 and the water-out port 73 is also shut down.

Furthermore, in this tankless western-style flush toilet, as above mentioned, without being relevant to supplying water or stopping water supply to the rim channel 12, namely, without being relevant to the operation for opening and closing the rim open/close valve 52, the first port 62 and the second port 72 of the open/close valve 5 are always communicated with each other. In the same manner, without being relevant to supplying water or stopping water supply to the jet nozzle 15, namely, without being relevant to the operation for opening and closing the jet open/close valve 51, the first port 62 and the second port 72 of the open/close valve 5 are always communicated with each other. As a result, when water in the water supply pipe 32 is supplied to the first port 62 of the open/close valve 5, it is possible to supply water automatically to both of the jet open/close valve 51 and the rim open/close valve 52 respectively, and furthermore, water can be automatically supplied to the second port 72 of the open/close valve 5. So, water can also be automatically supplied to the hot water tank 104 of the part washing device 100 which is connected to the second port 72, by way of the water supply valve 102.

When the part washing device 100 is used, by a signal of the controller in accordance with the switch operation by the user, a nozzle portion at a top end of the shower nozzle 106 is approached to a part of human body who sits on the toilet seat, and hot water in the hot water tank 104 is spouted to the part of human body to wash the part. After the washing of the part, the nozzle portion at the top end of the shower nozzle 106 is drawn back.

When water in the hot water tank 104 is decreased in accordance with the use of the part washing device 100, the controller in which a water level sensor detects such a condition opens the water supply valve 102. Due to this, without being relevant to the opening and closing of the rim open/close valve 52 and the jet open/close valve 51, water from the water supply pipe 32 is supplied to the hot water tank 104 of the part washing device 100 by way of the water receiving portion 18, the first port 62 of the open/close valve 5, the communication passage 76, the intermediate communication passage 75, the second port 72 and the water supply valve 102.

Then, after the washing of the part, the toilet bowl 10 is washed. In this case, the motor device 95 is driven by a signal of the controller in accordance with the switch operation of the user, and the rotation axis 92 of the cam device 90 is rotatory driven. Due to this, a cam surface of the cam 94 pushes the shaft 68 of the rim open/close valve 52 to the other direction, namely, toward the direction of an arrow Y2. Then, the push coil spring 67 is elastically contracted, and the piston 64 is moved toward the direction of an arrow Y2. Accordingly, the piston 64 of the rim open/close valve 52 is detached from the seat face 6*c* of the housing 61, and the communication between the first port 62 and the water-out port 63 is opened. Due to this, the rim open/close valve 52 supplies water to the rim channel 12 by way of the rim conduit 16, and an inner wall surface of the bowl portion 10 is washed.

Next, the cam 94 doesn't come to push the shaft 68 of the rim open/close valve 52 downward, and the rim open/close valve 52 is closed. After that, the cam surface of the cam 93 pushes the shaft 68 of the jet open/close valve 51 toward the other direction, namely, toward the direction of an arrow Y2 to open the jet open/close valve 51. Due to this, the piston 64 of the jet open/close valve 51 is detached from the seat face 1 of the housing 61 to open the jet open/close valve 51, and the first port 62 and the water-out port 73 are communicated with each other by way of the intermediate communication passage 75. Accordingly, the jet open/close valve 51 supplies water to the jet nozzle 15 by way of a jet conduit 17 to generate a siphon effect forcibly.

Next, the cam surface of the cam 93 doesn't come to push the shaft 68 of the jet open/close valve 51, and the jet open/close valve 51 is closed. After that, the cam 94 again pushes the shaft 68 of the rim open/close valve 52 to open the rim open/close valve 52. Due to this, water is supplied to the rim channel 12 by way of the rim conduit 16 to seal the bowl portion 10 with water. Then, the washing of the bowl portion 10 is finished.

As above described, without being relevant to supplying water or stopping water supply to the rim channel 12, or without being relevant to supplying water or stopping water supply to the jet nozzle 15, the second port 72 of the open/close valve 5 is communicated with the first port 62. Therefore, as shown in FIG. 87, only if the first port 62 of the open/close valve 5 is connected to the water supply pipe 32 by way of the stop cock 31 and the flexible hose 30, water is supplied to the second port 72 without being relevant to supplying water or stopping water supply to the rim channel 12 and the jet nozzle 15. Accordingly, it is possible to supply water to the hot water tank 104 of the part washing device 100 by way of the open/close valve 5.

As a result, a connecting pipe by which the part washing device 100 and the water supply pipe 32 are directly connected becomes unnecessary, so it is possible to prevent plural connecting pipes from being arranged in parallel, which is not different from the conventional technique. Accordingly, the space for arranging connecting pipes becomes small, and furthermore, it is possible to prevent the degradation of an appearance.

The above explanation is on the assumption that the part washing device 100 is mounted in the western-style toilet body 1. However, when the part washing device 100 is not mounted in the western-style toilet body 1, a lid member 57 shown in FIG. 87 may be detachably mounted on the second port 72 of the open/close valve 5 to seal the second port 72.

Second Embodiment

The embodiment 2 is explained in conjunction with drawings 89 to 94. The embodiment 2 has basically the same constitution as that of the embodiment 1, and it exhibits the same operations and effects as those of the embodiment 1. In the embodiment 2, the common portions are labeled as the common symbols, and the detailed explanation may be omitted.

Figure 88:
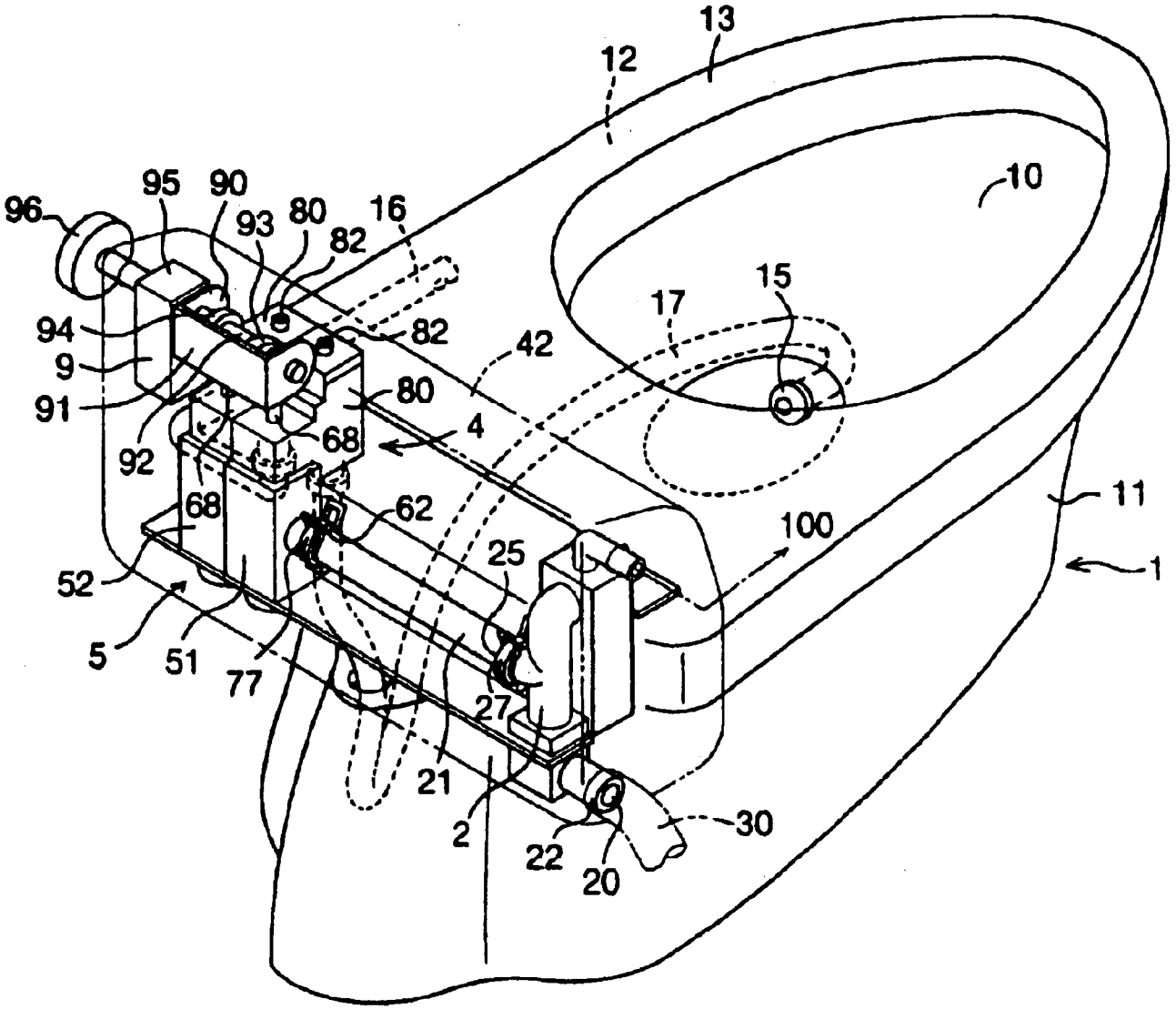
FIG. 88 is a perspective view of an essential portion of a tankless western-style flush toilet according to an embodiment 2 in the eighth invention.
Figure 89:
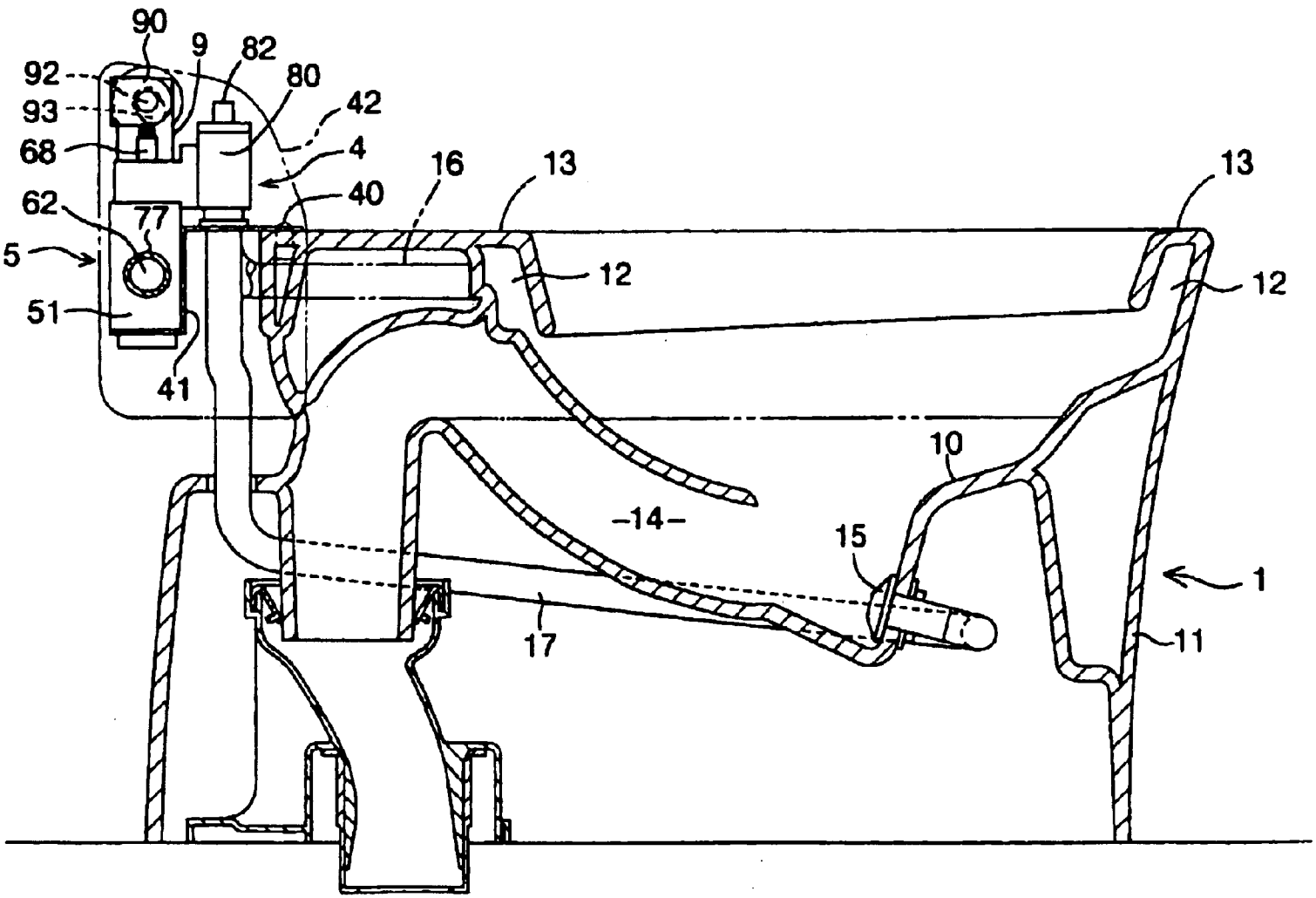
FIG. 89 is a cross-sectional view of an essential portion of a tankless western-style flush toilet according to an embodiment 2 in the eighth invention.

A tankless western-style flush toilet in the embodiment 2 is the same as that of the embodiment 1, namely, a tankless western-style flush toilet having no toilet washing tank. As shown in FIGS. 88 and 89, the tankless western-style flush toilet includes a western-style toilet body 1 and a toilet washing device 4 which is arranged at a rear end portion of the western-style toilet body 1. The western-style toilet body 1 includes a toilet bowl 11 having a bowl portion 10 which receives filth, a rim 13 having a rim channel 12 which encircles at an upper periphery of the bowl portion 10 and a trap portion 14 which is communicated with the bottom of the bowl portion 10 and which flows the filth out. At an inlet of the trap portion 14, a jet nozzle 15 is mounted.

As shown in FIG. 89, the toilet washing device 4 is held at a base plate 41 which is fixed by an attachment tool 40 at a rear end of the western-style toilet body 1. As shown in FIG. 88, the toilet washing device 4 includes a branch device 2 which is held at one side of the base plate 41, an open/close valve 5 which is held at the other side of the base plate 41, a driving device 9 for opening and closing the open/close valve 5 and a controller which is not shown in the drawing. The main portions of the toilet washing device 4 are concealed by a cover 42.

The branch device 2 is to divide water into a water supply passage of the toilet washing device 4, and a water supply passage of a hot water tank of a part washing device 100. The branch device 2 has a flange portion 22 for forming a branch port 20 which opens at an outer side, and a flange portion 27 for forming a spout port 25 which opens at an inner side.

Figure 90:
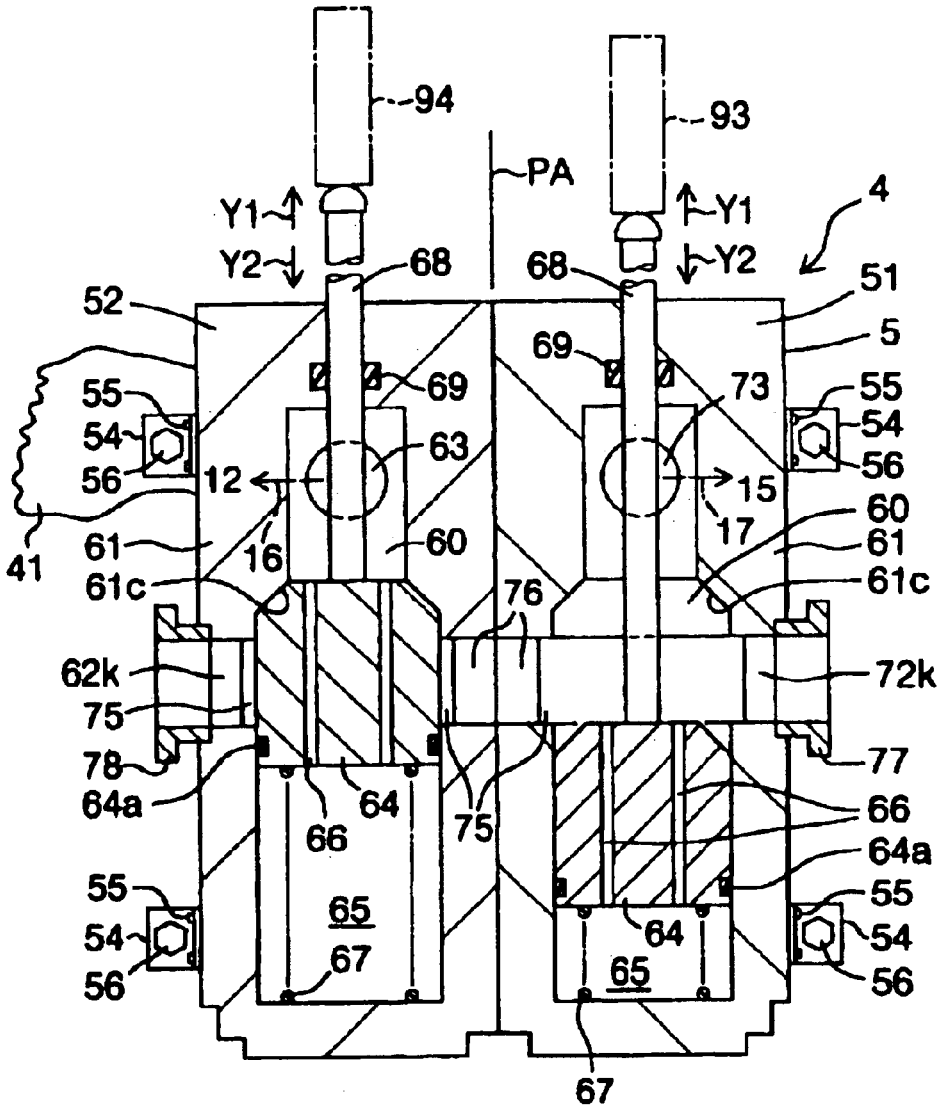
FIG. 90 is a cross-sectional view of an open/close valve which includes a jet open/close valve and a rim open/close valve according to an embodiment 2 in the eighth invention.

FIG. 90 shows a cross-section of the open/close valve 5. In FIG. 90, a jet open/close valve 51 is shown at a right side of the drawing, and a rim open/close valve 52 is shown at a left side of the drawing, which is different from FIG. 87. As shown in FIG. 90, in the open/close valve 5, the jet open/close valve 51 and the rim open/close valve 52 are formed in such a manner that they are mounted in parallel and they are integrally assembled.

The jet open/close valve 51 has a housing 61 having a piston room 60, a second port 72*k* which is communicated with the piston room 60, a water-out port 73 which is communicated with the piston room 60 and which spouts water in the piston room 60 and a piston 64 which is slidably held in the piston room 60 as a valve mechanism having rigidity. An O ring 64*a* is held by a ring groove at an outer peripheral portion of the piston 64 to seal a boundary area between the outer peripheral portion of the piston 64 and an inner wall surface of the housing 61. In the piston room 60, a pressure offset room 65 is formed by the housing 61 and the other end surface of the piston 64. The pressure offset room 65 is communicated with the side of the water-out port 73 by way of plural communication holes 66 as passages which are formed in the piston 64. In the pressure offset room 65, a push coil spring 67 is coaxially arranged. The push coil spring 67 is disposed between the housing 61 and the other end surface of the piston 64, and it always pushes the piston 64 to one side, namely, toward the direction of an arrow Y1. At one end surface of the piston 64, a shaft 68 which is able to move the piston 64 in the axial direction is coaxially fixed, and the shaft 68 is protruded from the housing 61 toward one direction, namely, the direction of an arrow Y1. A boundary area between the shaft 68 and the housing 61 is sealed by the O ring 69.

The rim open/close valve 52 has basically the same constitution as that of the jet open/close valve 51. In other words, the rim open/close valve 52 has a housing 61 having a piston room 60, a first port 62*k* which is communicated with the piston room 60 and which takes water in the housing 61, a water-out port 63 which is communicated with the piston room 60 and which spouts water in the piston room 60 and a piston 64 which is slidably held in the piston room 60 as a valve mechanism having rigidity. The first port 62*k* and the water-out port 63 are communicated with the piston room 60. In the piston room 60, the pressure offset room 65 is formed. The pressure offset room 65 according to the rim open/close valve 52 is communicated with the side of the water-out port 63 by way of plural communication holes 66 as passages which are formed in the piston 64. In the pressure offset room 65, a push coil spring 67 is coaxially arranged. The push coil spring 67 is disposed between the housing 61 and the other end surface of the piston 64. The push coil spring 67 always pushes the piston 64 to one side, namely, toward the direction of an arrow Y1, and it has act force toward the direction for closing the water-out port 63.

The second port 72*k* of the jet open/close valve 5 and the first port 62*k* of the rim open/close valve 5 as above mentioned are mounted in such a manner that they are symmetrical with each other by way of a center line PA of the open/close valve 5. In the same manner as that of the embodiment 1, the first port 62*k* and the second port 72*k* are communicated with each other by way of a ring-shaped intermediate communication passage 75 and a communication passage 76 for communicating the intermediate communication passages 75 with each other. Namely, without being relevant to supplying water or stopping water supply to the rim channel 12, or without being relevant to supplying water or stopping water supply to the jet nozzle 15, the first port 62*k* and the second port 72*k* are always communicated with each other.

Furthermore, at the second port 72*k* of the jet open/close valve 5, a flange portion 77 is formed in such a manner that the flange portion 77 is protruded to a side surface side. At the first port 62*k* of the rim open/close valve 5, a flange portion 78 is formed in such a manner that the flange portion 78 is protruded to a side surface side. The flange portion 77 and the flange portion 78 are mounted in such a manner that they are symmetrical with each other by way of the center line PA of the open/close valve 5.

Then, at an outer side surface of the open/close valve 5, plural attachment pieces 54 having plural bolt inserting holes are detachably held by a set screw 55 at the symmetrical position. The open/close valve 5 is detachably held at the base plate 41 of the toilet washing device 4 by making the condition that an attachment bolt 56 which is inserted into the bolt inserting hole of each attachment piece 54 is inserted into a hole of the base plate 41, and by fastening the attachment bolt 56. In other drawings except FIG. 90, the attachment piece 54 and the attachment bolt 56 are not shown in the drawing.

Figure 91:
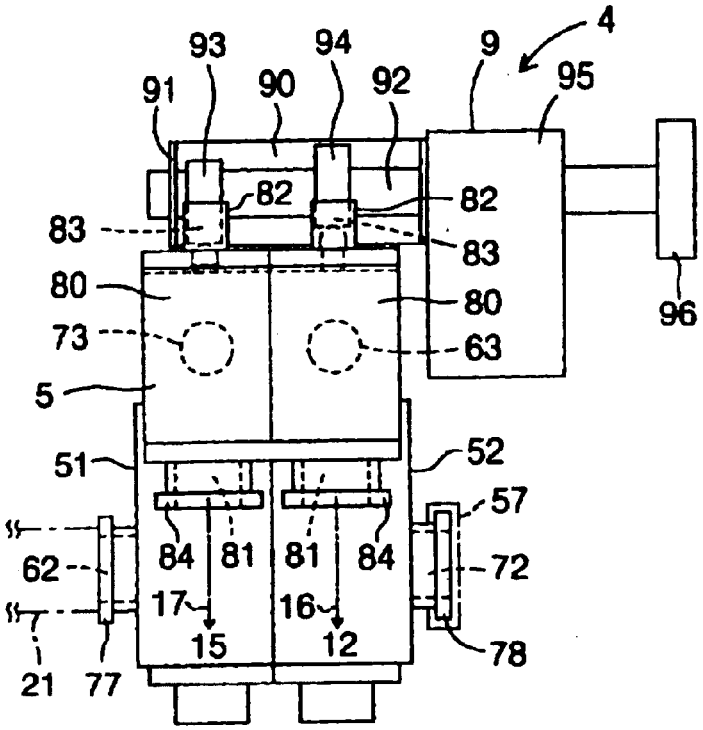
FIG. 91 is a front view of an open/close valve which includes a jet open/close valve and a rim open/close valve according to an embodiment 2 in the eighth invention.
Figure 92:
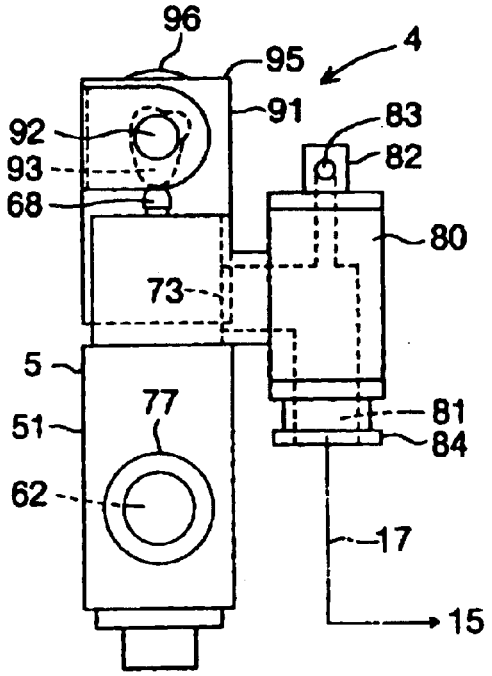
FIG. 92 is a side view of an open/close valve which includes a jet open/close valve and a rim open/close valve according to an embodiment 2 in the eighth invention.

As shown in FIGS. 91 and 92, a connecting member 80 is connected to the jet open/close valve 51, and a vacuum breaker 82 is connected to an upper end of the connecting member 80. On the other hand, a connecting member 80 is connected to the rim open/close valve 52, and a vacuum breaker 82 is connected to an upper end of the connecting member 80.

The water-out port 73 of the jet open/close valve 51 is connected to a water-out port 81 of the connecting member 80 and an air hole 83 of the vacuum breaker 82. At the water-out port 81 of the connecting member 80, an intermediate flange portion 84 is formed in such a manner that the intermediate flange portion 84 is protruded downward. The intermediate flange portion 84 of the jet open/close valve 51 is connected to the jet nozzle 15 by way of a jet conduit 17.

The water-out port 63 of the rim open/close valve 52 is connected to the water-out port 81 of the connecting member 80 and the air hole 83 of the vacuum breaker 82. At the water-out port 81 of the connecting member 80, an intermediate flange portion 84 is formed in such a manner that the intermediate flange portion 84 is protruded downward. The intermediate flange portion 84 of the rim open/close valve 52 is connected to the rim channel 12 by way of a rim conduit 16.

As shown in FIG. 88, the driving device 9 is to open and close the first and second open/close valves 51 and 52, and the driving device 9 is formed by a cam device 90 which is arranged upward from the first and second open/close valves 51 and 52, and a motor device 95 for operating the cam device 90. The cam device 90 includes a bracket 91 which is fixed to the first and second open/close valves 51 and 52 and whose ends are protruded forward, a rotation axis 92 which is rotatably held in the horizontal condition by the bracket 91, and the first and second cams 93 and 94 which are fixed to the rotation axis 92.

Figure 93:
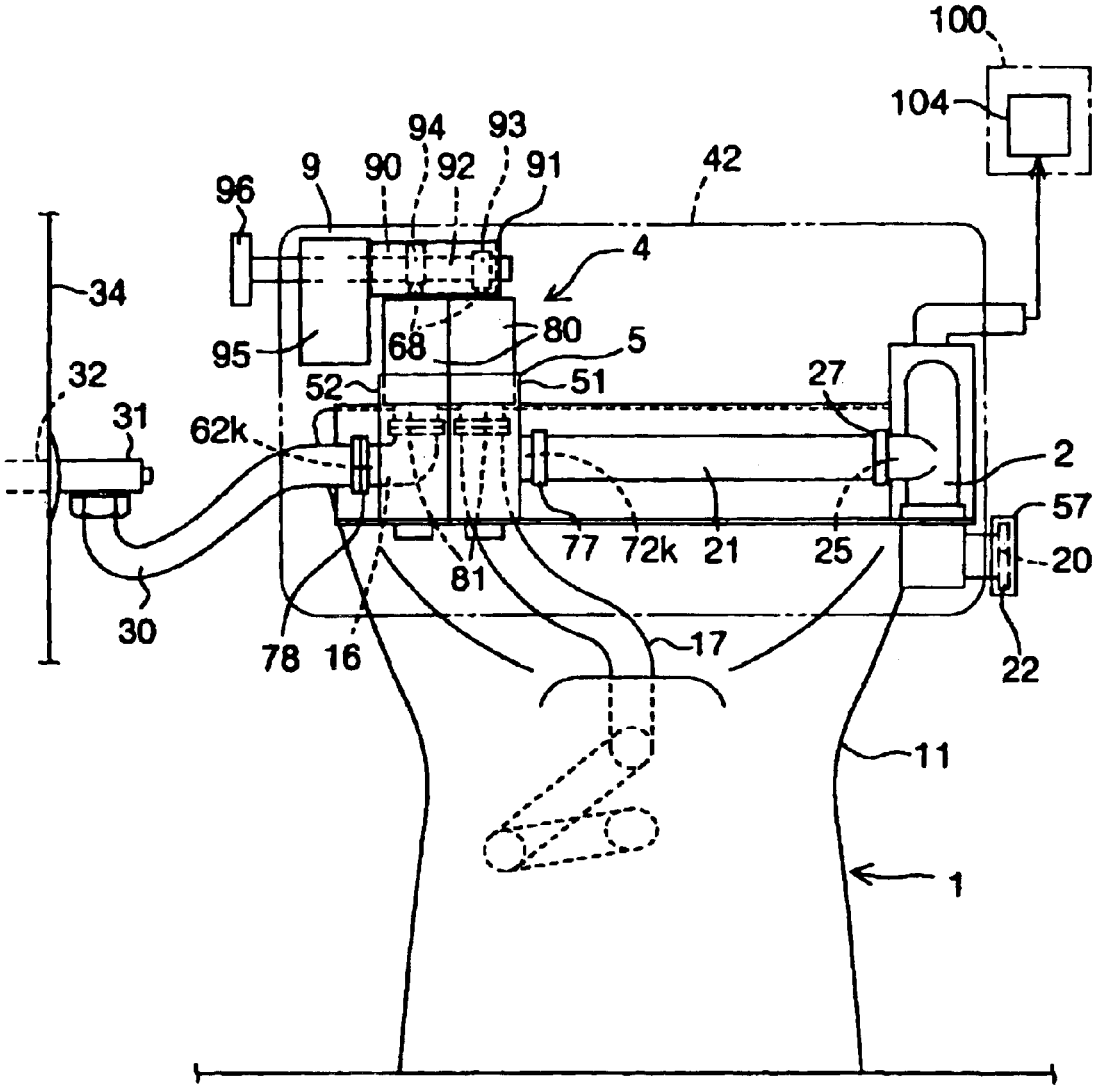
FIG. 93 is a back view of an essential portion of a tankless western-style flush toilet when a water supply source is mounted on the opposite side of a branch device according to an embodiment 2 in the eighth invention.
Figure 94:
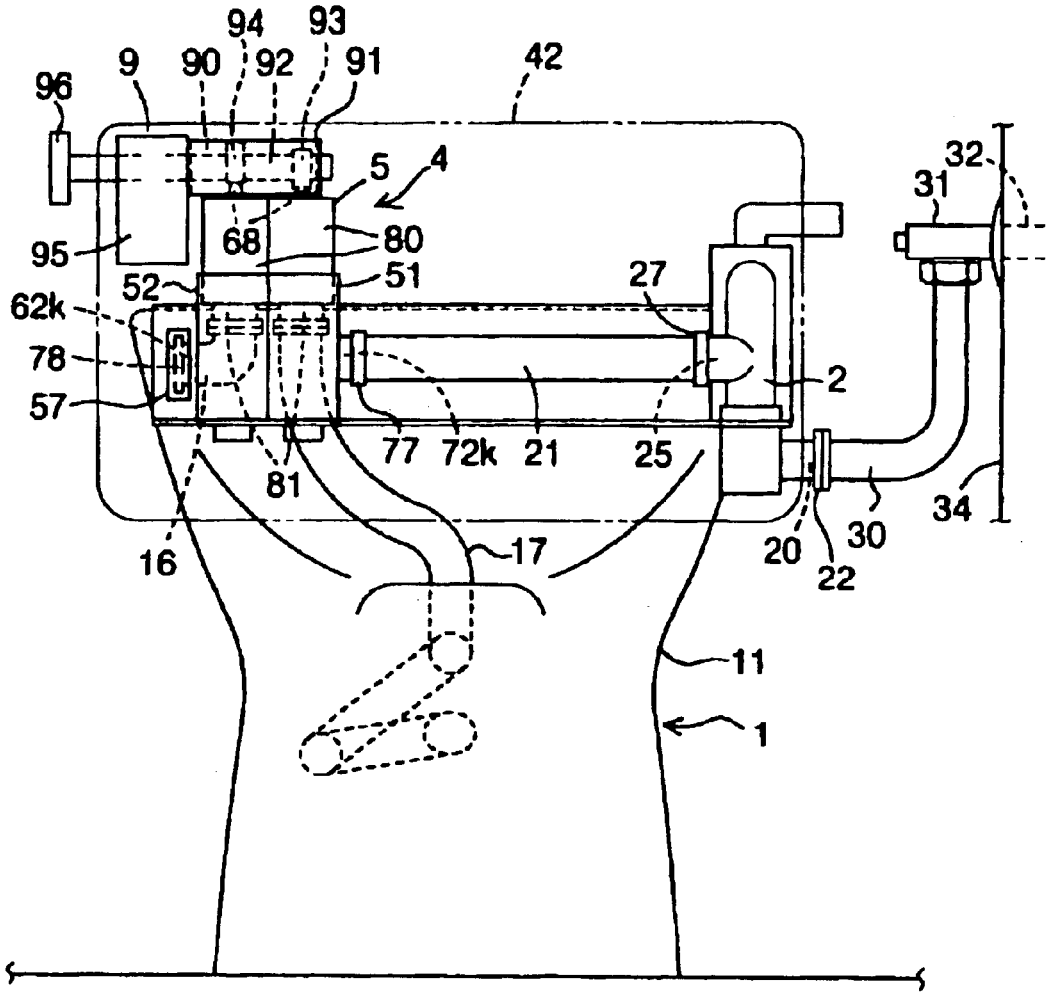
FIG. 94 is a back view of an essential portion of a tankless western-style flush toilet when a water supply source is mounted on the side of a branch device according to an embodiment 2 in the eighth invention.

In the tankless western-style flush toilet, as shown in FIGS. 93 and 94, a lid member 57 for water tight closing is mounted. The lid member 57 can be detachably attached to the flange portions 77 and 78 of the open/close valve 5, and to the flange portion 22 of the branch device 2, respectively. Namely, as shown in FIG. 93, when the lid member 57 is attached to the flange portion 22 of the branch device 2, the branch port 20 of the toilet washing device 4 is closed to be sealed watertightly. On the other hand, as shown in FIG. 94, when the lid member 57 is attached to the flange portion 78, the first port 62*k* of the open/close valve 5 of the toilet washing device 4 is closed to be sealed watertightly.

As shown in FIG. 93, in a toilet room, a water supply pipe 32 which is attached to a wall 34, and a stop cock 31 which is attached to the water supply pipe 32 may be mounted on the opposite side (left side of the drawing) of the branch device 2 of the western-style toilet body 1. In this case, the water supply pipe 32 is close to the first port 62*k* of the open/close valve 5, so the water supply pipe 32 is connected to the flange portion 78 of the first port 62*k* of the open/close valve 5 by way of the stop cock 31 and the flexible hose 30 as a connecting pipe. Therefore, the first port 62*k* is functioned as a water-in port of the open/close valve 5. On the other hand, the second port 72*k* of the open/close valve 5 is connected to the hot water tank 104 of the part washing device 100 by way of a conduit 21 and the branch device 2, and the second port 72*k* is functioned as a water supply port for supplying water to the part washing device 100. As shown in FIG. 93, the branch port 20 of the toilet washing device 4 is closed by attaching the lid member 57 to the flange portion 22, to be sealed watertightly.

In this condition, water which is supplied from the water supply pipe 32 passes through the inside of the open/close valve 5 by way of the stop cock 31, the flexible hose 30 and the first port 61*k* of the open/close valve 5, and then reaches the branch device 2 by way of the second port 72*k* of the open/close valve 5 and the conduit 21, and further reaches the hot water tank of the part washing device 100. Namely, without being relevant to the washing treatment of the bowl portion 10 due to the open/close valve 5, water in the water supply pipe 32 can be supplied to the hot water tank 104 of the part washing device 100 by way of the second port 72*k* of the open/close valve S. Accordingly, the second port 72*k* is connected to the part washing device 100, and it is functioned as a water supply port for supplying water to the part washing device 100.

Moreover, when the part washing device 100 is not mounted in the western-style toilet body 1, the lid member 57 is attached to the flange portion 77 of the second port 72*k* of the toilet washing device 4 under the condition that the conduit 21 is detached. Accordingly, the second port 72*k* may be closed to be sealed watertightly.

On the contrary, as shown in FIG. 94, in other toilet room, a water supply pipe 32 which is attached to a wall 34, and a stop cock 31 which is attached to the water supply pipe 32 may be mounted on the side of the branch device 2 (right side of the drawing) of the western-style toilet body 1. In this case, the water supply pipe 32 is close to the branch port 20, so the water supply pipe 32 is connected to the flange portion 22 of the branch port 20 of the toilet washing device 4 by way of the stop cock 31 and the flexible hose 30 as a connecting pipe. Besides, an end portion of the conduit 21 which is guided from the branch device 2 is connected to the flange portion 77 of the second port 72*k* of the jet open/close valve 51. On the other hand, the first port 62*k* of the open/close valve 5 is closed by attaching the lid member 57 to the flange portion 78, to be sealed watertightly.

In this condition, water in the water supply pipe 32 is supplied to the stop cock 31, the flexible hose 30 and the branch port 20, and is supplied to the second port 72*k* of the open/close valve 5 by way of the branch device 2 and the conduit 21, and is further supplied to both of the rim open/close valve 52 and the jet open/close valve 51.

In the toilet washing device 4 having the above constitution, the washing of the bowl portion 10 is carried out in the same manner as that of the embodiment 1. In other words, as far as the user doesn't carry out the switch, both of the open/close valves 51 and 52 are closed, and water in the water supply pipe 32 is not supplied to the rim channel 12 and the jet nozzle 15. Namely, the piston 64 of the first and second open/close valves 51 and 52 is attached to a seat face 61*c* of the housing 61.

When the toilet bowl 10 is washed, the motor device 95 is driven by a signal of the controller in accordance with the switch operation of the user, and the rotation axis 92 of the cam device 90 is rotatory driven. Due to this, a cam surface of the second cam 94 pushes the shaft 68 of the rim open/close valve 52 to the other direction, namely, toward the direction of an arrow Y2. Then, the push coil spring 67 is elastically contracted, and the piston 64 is moved toward the direction of an arrow Y2. Accordingly, the piston 64 of the rim open/close valve 52 is detached from the seat face 61*c* of the housing 61, and the communication between the intermediate port 75 and the water-out port 63 is opened. Due to this, the rim open/close valve 52 supplies water to the rim channel 12 by way of the rim conduit 16, and an inner wall surface of the bowl portion 10 is washed.

Next, the second cam 94 doesn't come to push the shaft 68 of the rim open/close valve 52 downward, and the rim open/close valve 52 is closed. After that, the cam surface of the first cam 93 pushes the shaft 68 of the jet open/close valve 51 toward the other direction, namely, toward the direction of an arrow Y2 to open the jet open/close valve 51. Due to this, the piston 64 of the jet open/close valve 51 is detached from the seat face 61*c* of the housing 61, and the communication passage 76 of the jet open/close valve 51 and the water-out port 73 are communicated with each other. Accordingly, the jet open/close valve 51 supplies water to the jet nozzle 15 by way of the jet conduit 17 to generate a siphon effect in the trap portion 14 forcibly.

Next, the cam surface of the first cam 93 doesn't come to push the shaft 68 of the jet open/close valve 51, and the jet open/close valve 51 is closed. After that, the second cam 94 again pushes the shaft 68 of the rim open/close valve 52 to open the rim open/close valve 52. Due to this, water is supplied to the rim channel 12 by way of the rim conduit 16 to seal the bowl portion 10 with water. Then, the washing of the bowl portion 10 is finished.

As above described, in the embodiment 2, without being relevant to supplying water or stopping water supply to the rim channel 12, or without being relevant to supplying water or stopping water supply to the jet nozzle 15, the second port 72*k* of the open/close valve 5 is always communicated with the first port 62*k*. Therefore, as shown in FIG. 93, only if the first port 62*k* of the open/close valve 5 is connected to the water supply pipe 32 at the wall 34 by way of the stop cock 31, water is supplied to the second port 72 without being relevant to supplying water or stopping water supply to the rim channel 12 and the jet nozzle 15. Accordingly, it is possible to supply water to the hot water tank 104 of the part washing device 100 by way of the second port 72*k* of the open/close valve 5, the conduit 21 and the branch device 2.

As a result, a connecting pipe by which the part washing device 100 and the water supply pipe 32 are directly connected becomes unnecessary. So, it is possible to prevent plural connecting pipes from being arranged in parallel. Accordingly, the space for arranging connecting pipes becomes small, and furthermore, it is possible to prevent the degradation of an appearance.

Additional Note

According to the above description, the following technical thought can be understood.

In a tankless western-style flush toilet including a western-style toilet body having at least a rim channel, and a toilet washing device which has no toilet washing tank, and which guides water that is supplied from a water supply pipe at least to the rim channel to carry out the washing of the western-style toilet body, the improvement is characterized in that the toilet washing device comprises a housing including an open/close valve which is able to supply water or stop supplying water to at least the rim channel, and which has a first port and a second port, both of them being apart from each other, and at the same time, an water-out port which is communicated with the rim channel; and a valve mechanism which is mounted in the housing, and which supplies water or stops water supply to a channel by way of the water-out port, and the second port is communicated with the first port without being relevant to supplying water or stopping water supply to the channel.

As apparent from the above description, the second port is communicated with the first port without being relevant to supplying water or stopping water supply to the channel such as the rim channel or the like. So, only by connecting either one of the first port and the second port of the open/close valve to the water supply pipe to supply water, water is supplied to the other of the first port and the second port of the open/close valve without being relevant to supplying water or stopping water supply to the channel. Therefore, a connecting pipe for directly connecting the other of the first port and the second port to the water supply pipe becomes unnecessary, and it is possible to prevent plural connecting pipes from being arranged in parallel. Accordingly, the space for arranging connecting pipes becomes small, and furthermore, it is possible to prevent the degradation of an appearance.

Ninth Invention

Figure 95:
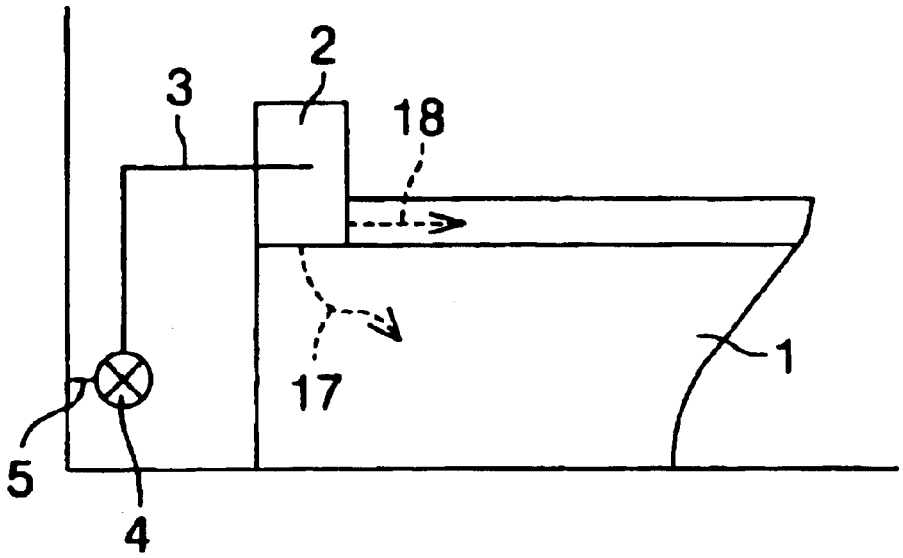
FIG. 95 is a typically side view of a tankless western-style flush toilet according to an embodiment in the ninth invention.

An embodiment which embodies the ninth invention is explained hereinafter in conjunction with drawings 95 to 97. In this embodiment, a flush toilet open/close valve (merely described as an open/close valve hereinafter) is used for a tankless western-style flush toilet which is shown in FIG. 95.

In the tankless western-style flush toilet, a toilet washing device 2 is mounted on a western-style toilet body 1 made of porcelain. To the toilet washing device 2, a flexible hose 3 is connected, and the flexible hose 3 is connected to a city water service pipe 5 as a water supply source by way of a stop cock 4.

Figure 96:
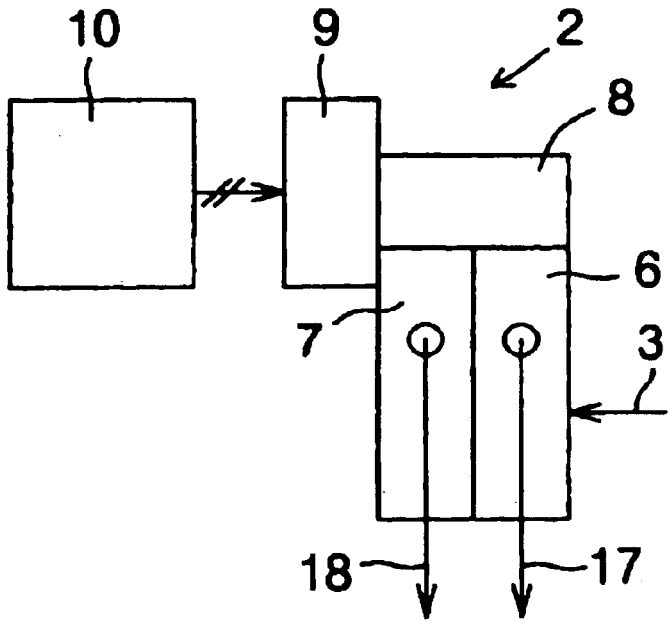
FIG. 96 is a typically front view of a toilet washing device of a tankless western-style flush toilet according to an embodiment in the ninth invention.

As shown in FIG. 96, the toilet washing device 2 has a jet open/close valve 6 which is connected to the flexible hose 3, a rim open/close valve 7 which is fixed together with the jet open/close valve 6 to be one body, a cam device 8 which is fixed to an upper end of the open/close valves 6 and 7 and a motor device 9 which is adjacent to the cam device 8 and which drives the cam device 8. The motor device 9 is electrically connected to a controller 10.

Figure 97:
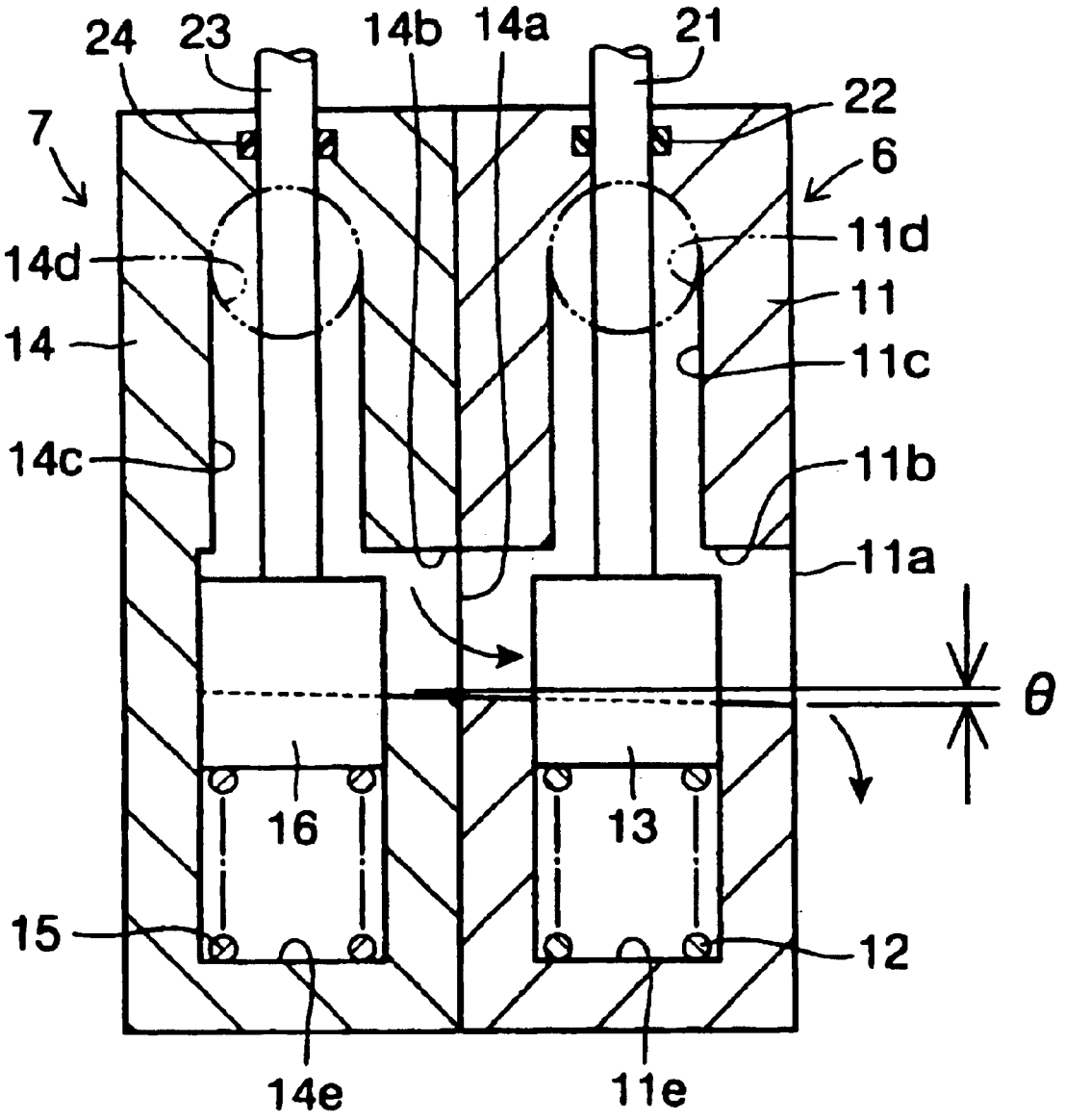
FIG. 97 is a cross-sectional view of a jet open/close valve and a rim open/close valve according to an embodiment in the ninth invention.

As shown in FIG. 97, in the jet open/close valve 6, a water-in port 11*a* which is communicated with the flexible hose 3 opens at a side surface of a longitudinal housing 11. In the housing 11, a main communication passage 11*b* which is communicated with the water-in port 11*a* is mounted in the width direction, and a sub communication passage 11*c* which is extended upward and is bent toward this side is communicated with the center of the main communication passage 11*b*. The sub communication passage 11*c* is communicated with a water-out port 11*d* which opens at the front surface of the housing 11. The main communication passage 11*b* and the sub communication passage 11*c* are communication passages.

Furthermore, a piston room lie which is extended downward is communicated with the center of the main communication passage 11*b*, and a piston 13 which is able to open and close the communication between the main communication passage 11*b* and the sub communication passage 11*c* by means of a push coil spring 12 is slidably mounted in the main communication passage 11*b* and the piston room 11*e*. The piston 13 and the push coil spring 12 are valve mechanisms.

At the piston 13, a shaft 21 which is extended upward is fixed, and the shaft 21 is protruded upward by way of an O ring 22 which is disposed between the shaft 21 and the housing 11. The shaft 21 is slided and brought into contact with a cam of the cam device 8 whish is shown in FIG. 96.

As shown in FIG. 97, in the rim open/close valve 7, a water-in port 14*a* which is communicated with the main communication passage 11*b* of the jet open/close valve 6 opens at a side surface of a longitudinal housing 14. In the housing 14, a main communication passage 14*b* which is communicated with the water-in port 14*a* is concavely mounted in the width direction, and a sub communication passage 14*c* which is extended upward and is bent toward this side is communicated with the center of the main communication passage 14*b*. The sub communication passage 14*c* is communicated with a water-out port 14*d* which opens at the front surface of the housing 14. The main communication passage 14*b* and the sub communication passage 14*c* are communication passages.

Furthermore, a piston room 14*e* which is extended downward is communicated with the center of the main communication passage 14*b*, and a piston 16 which is able to open and close the communication between the main communication passage 14*b* and the sub communication passage 14*c* by means of a push coil spring 15 is slidably mounted in the piston room 14*e*. The piston 16 and the push coil spring 15 are valve mechanisms.

Also at the piston 16, a shaft 23 which is extended upward is fixed, and the shaft 23 is protruded upward by way of an O ring 24 which is disposed between the shaft 23 and the housing 14. The shaft 23 is also slided and brought into contact with other cam of the cam device 8 which is shown in FIG. 96.

Then, as shown in FIG. 96, the water-out port 11*d* of the jet open/close valve 6 which is shown in FIG. 97 is connected to a jet conduit 17. As shown in FIG. 95, the jet conduit 17 is connected to a jet nozzle which is not shown in the drawing and which is mounted in the western-style toilet body 1. Furthermore, as shown in FIG. 96, the water-out port 14*d* of the rim open/close valve 7 which is shown in FIG. 97 is connected to a rim conduit 18. As shown in FIG. 95, the rim conduit 18 is connected to a rim channel not shown in the drawing of the western-style toilet body 1.

As shown in FIG. 97, the characterized constitution of the jet open/close valve 6 and the rim open/close valve 7 is that the bottom surface of the main communication passages 11*b* and 14*b* is formed in such a manner that the bottom surface is moved downward with a very small angle of θ toward the water-out port lid of the jet open/close valve 6 with respect to the horizontal surface.

In the tankless western-style flush toilet which is constituted as above, the cam device 8 is operated by inputting a switch. Due to this, first, the shaft 23 of the rim open/close valve 7 moves the piston 16 down to open the communication between the main communication passage 14*b* and the sub communication passage 14*c*. Accordingly, a large amount of water flows into the rim channel of the western-style toilet body 1 to carry out the washing of the toilet bowl. Next, the piston 16 rises up in accordance with act force of the push coil spring 15 to close the communication between the main communication passage 14*b* and the sub communication passage 14*c*.

Then, the shaft 21 of the jet open/close valve 6 moves the piston 13 down to open the communication between the main communication passage 11*b* and the sub communication passage 11*c*. Accordingly, a large amount of water flows into the jet nozzle of the western-style toilet body 1 to generate a siphon effect forcibly. Next, the piston 13 rises up in accordance with act force of the push coil spring 12 to close the communication between the main communication passage 11*b* and the sub communication passage 11*c*.

After that, the shaft 23 of the rim open/close valve 7 again moves the piston 16 down to open the communication between the main communication passage 14*b* and the sub communication passage 14*c*. Accordingly, a large amount of water flows into the rim channel of the western-style toilet body 1 to carry out water sealing. Next, the piston 16 rises up in accordance with act force of the push coil spring 15 to close the communication between the main communication passage 14*b* and the sub communication passage 14*c*. In this manner, a series of washing of the western-style toilet body 1 is finished.

Under the low temperature condition of the cold area and the like, when the condition that the flush toilet is not used is continued, a drain pipe which is not shown in the drawing is opened after closing a main cock of a city water service pipe. After that, the cam device 8 is operated by a manual operation or an input of the switch, and the shafts 21 and 23 of the jet open/close valve 6 and the rim open/close valve 7 moves the pistons 13 and 16 down to open the communication between the main communication passages 11*b* and 14*b* and the sub communication passages 11*c* and 14*c*. Due to this, water in the main communication passages 11*b* and 14*b* and the sub communication passages 11*c* and 14*c* and the downstream side therefrom is drained away.

At this time, in the jet open/close valve 6 and the rim open/close valve 7, since the bottom surface of the main communication passages 11*b* and 14*b* is formed downward to the water-in port 11*a*, water in the inside flows toward the water-in port 11*a*, and water is not remained in the inside. Then, water which is guided to the water-in port 11*a* flows backward in the flexible hose 3 and the stop cock 4 to be wasted in the ground by way of the drain pipe. Accordingly, in this case, water is not remained in the main communication passages lib and 14*b* and the sub communication passages 11*c* and 14*c*, and the freezing of water in these communication passages is prevented.

At the next time, when the user tries to use the tankless western-style flush toilet, the drain pipe is closed, and the main cock of the city water service pipe is opened. Due to this, water in the city water pipe 5 is supplied to the toilet washing device 2 by way of the stop cock 4 and the flexible hose 3, and the tankless western-style flush toilet can be normally used.

Therefore, in the jet open/close valve 6 and the rim open/close valve 7 according to this embodiment, the damage which is caused by the freezing of water is not occurred after draining water away, and it is possible to use the tankless western-style flush toilet immediate at the next time. So, there arises no disadvantage in the preferable use at the next time.

Tenth Invention

Embodiments 1 and 2 which embody the tenth invention are explained hereinafter in conjunction with drawings 98 to 103.

Embodiment 1

Figure 98:
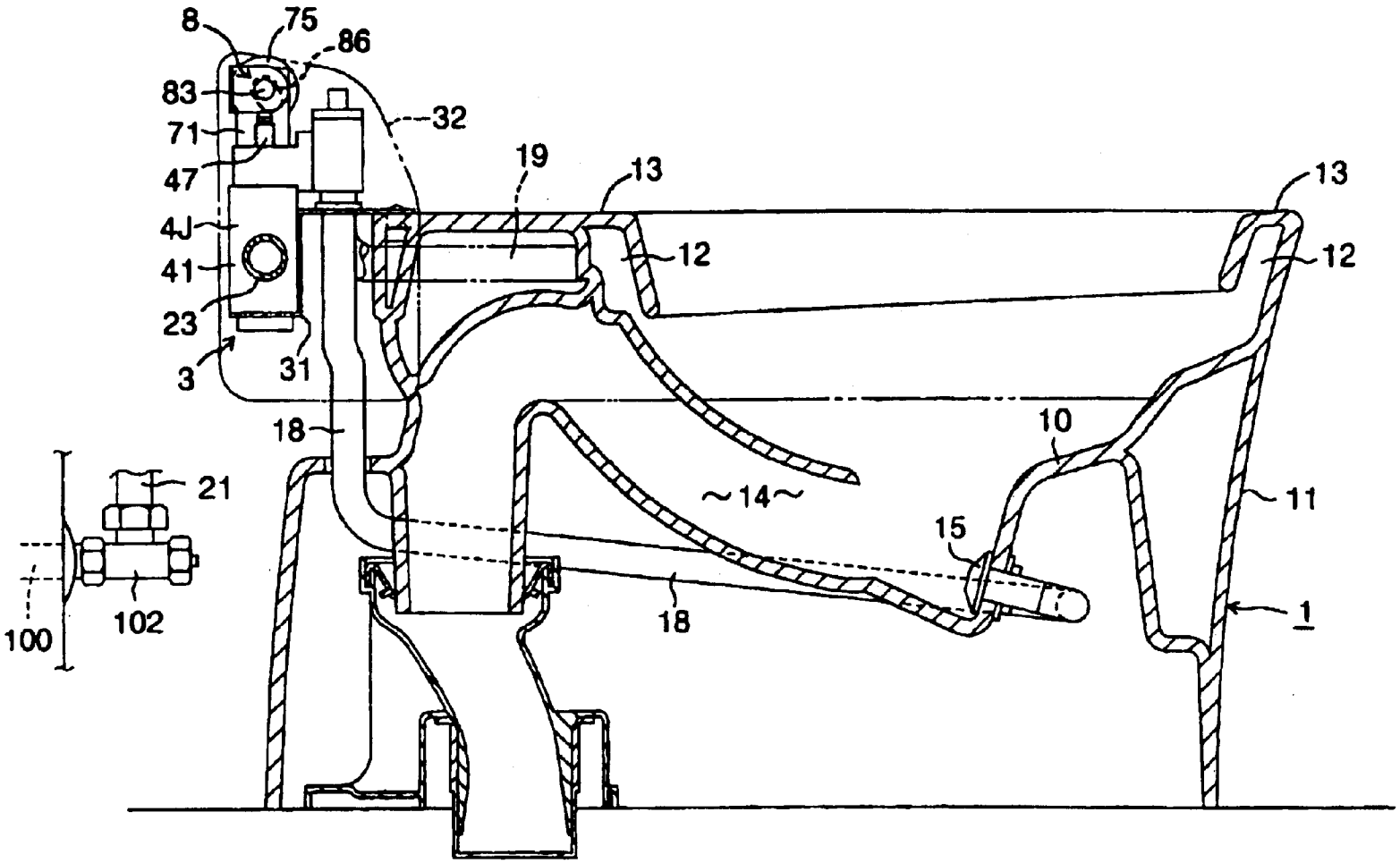
FIG. 98 is a cross-sectional view of an essential portion of a tankless western-style flush toilet according to an embodiment 1 in the tenth invention.
Figure 99:
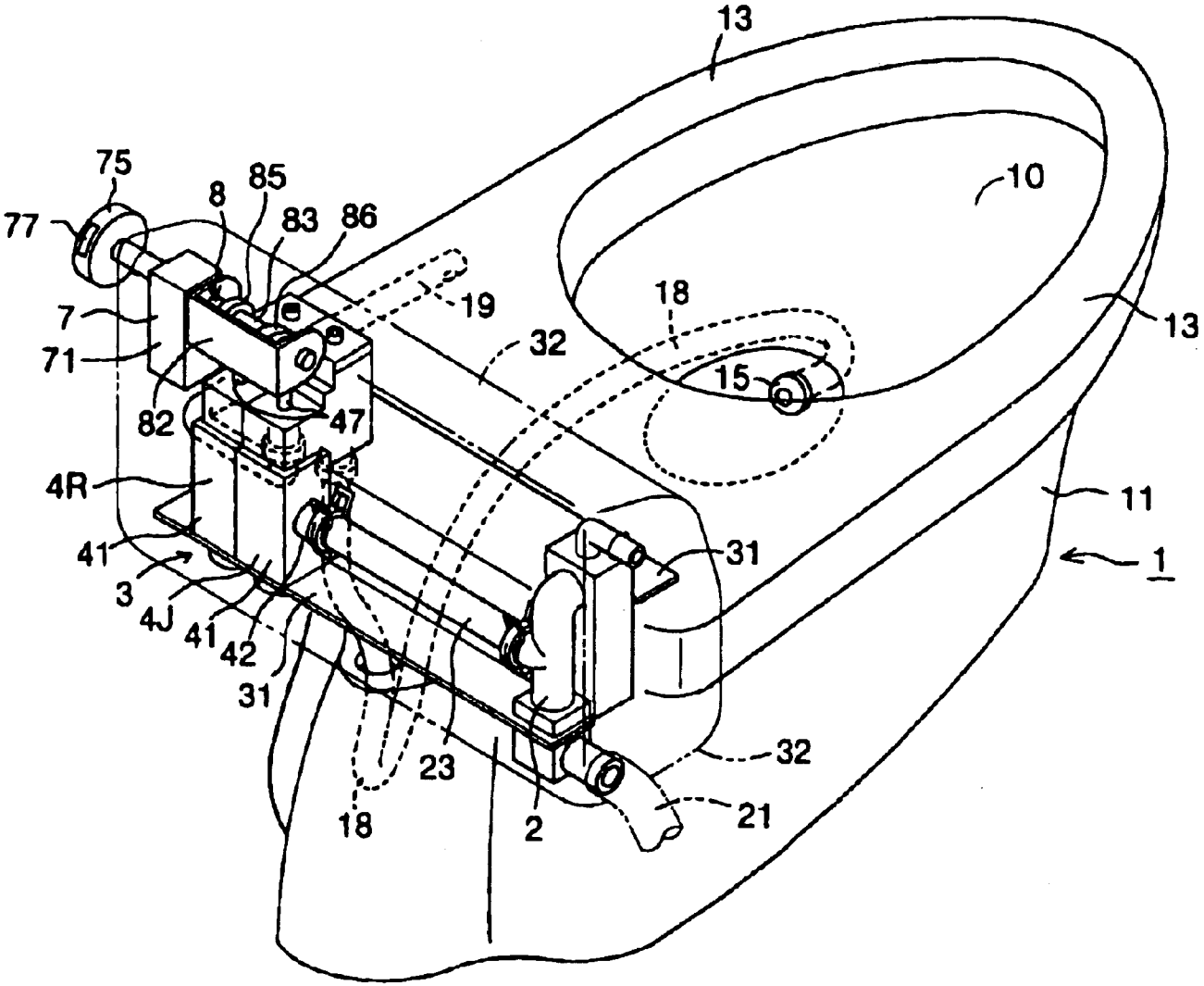
FIG. 99 is a perspective view of an essential portion of a tankless western-style flush toilet according to an embodiment 1 in the tenth invention.

The embodiment 1 is explained in conjunction with drawings 98 to 103. As shown in FIGS. 98 and 99, a tankless western-style flush toilet in the embodiment 1 has no toilet washing tank.

A western-style toilet body 1 includes a toilet bowl 11 having a bowl portion 10 which receives filth, a rim 13 having a rim channel 12 which encircles at an upper periphery of the bowl portion 10 and a trap portion 14 which is communicated with the bottom of the bowl portion 10 and which flows the filth out. At an inlet of the trap portion 14, a jet nozzle 15 is mounted.

In the western-style toilet body 1, a jet conduit 18 for supplying water to the jet nozzle 15 and a rim conduit 19 for supplying water to the rim channel 12 are mounted. A water supply pipe 100 such as a city water service pipe and the like is arranged in a toilet wall, and a stop cock 102 is attached to the water supply pipe 100. A toilet lid and a toilet seat are not shown in FIGS. 98 and 99.

As shown in FIG. 99, a branch device 2 for dividing water into water for washing a toilet and water for other use is mounted at one side of a rear portion in the width direction of the western-style toilet body 1. The branch device 2 is connected to the stop cock 102 by way of a flexible hose 21. The branch device 2 is communicated with a toilet washing device 3 by way of a water supply conduit 23, and water which is supplied from the stop cock 102 and which is divided by the branch device 2 is supplied to the toilet washing device 3 by way of the water supply conduit 23.

The toilet washing device 3 is assembled to a base plate 31 which is held at the rear portion of the western-style toilet body 1, and the toilet washing device 3 is concealed by a cover 32. The toilet washing device 3 includes a rim open/close valve 4R for supplying water to the rim channel 12, a jet open/close valve 4J for supplying water to the jet nozzle 15 and a cam device 8 for opening and closing the open/close valves 4R and 4J. Two open/close valves 4R and 4J are positioned in such a manner that they are adjacent to each other.

Figure 100:
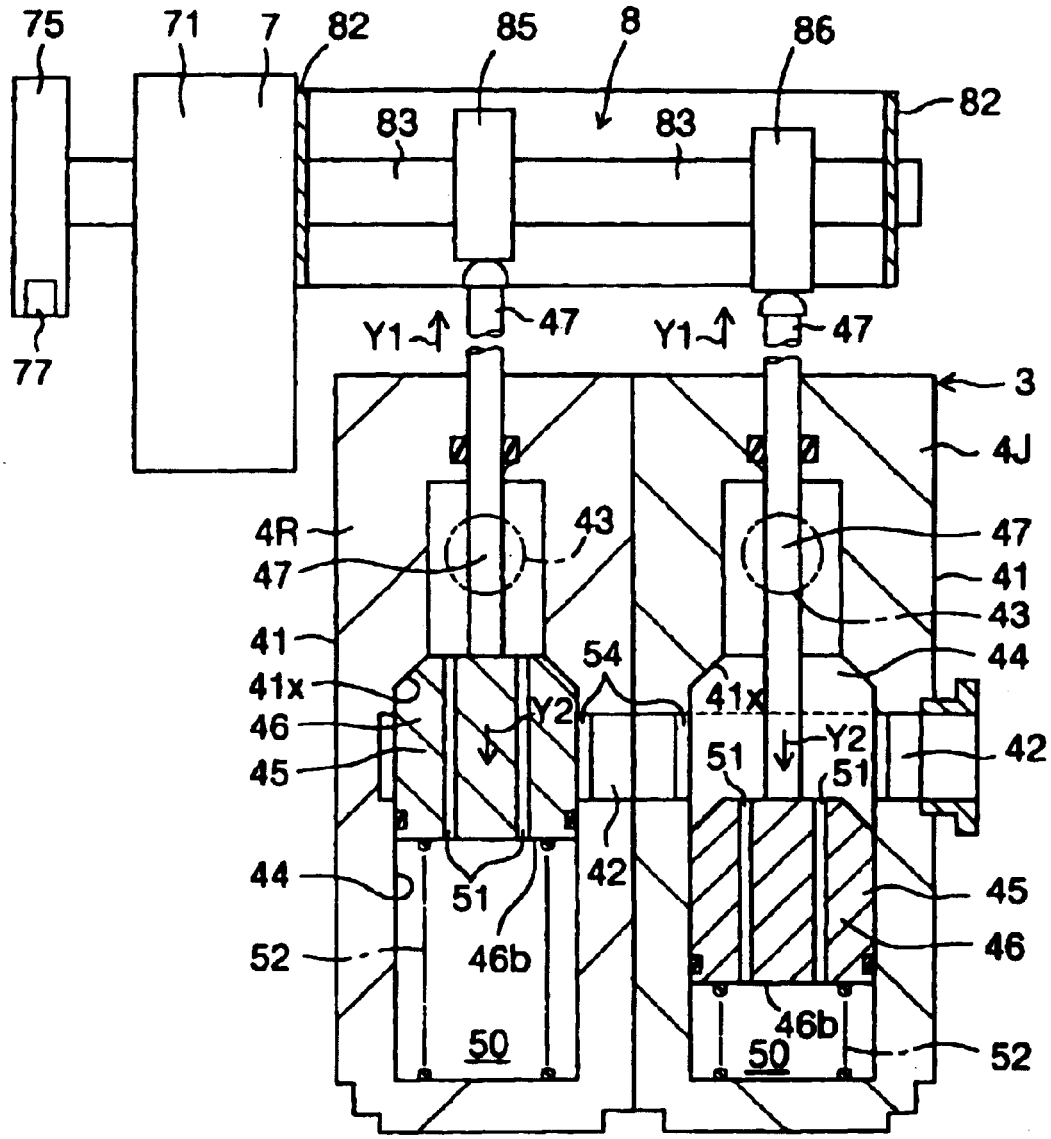
FIG. 100 is a cross-sectional view of a rim open/close valve and a jet open/close valve which includes a cam device according to an embodiment 1 in the tenth invention.

An inner constitution of the jet open/close valve 4J is shown in FIG. 100. The jet open/close valve 4J has a valve housing 41 which has a water-in port 42 for taking water in and a water-out port 43 for spouting water out, and a valve mechanism 45 which is mounted on the valve housing 41. In the inside of the valve housing 41, a piston room 44 which is communicated with the water-in port 42 and the water-out port 43 is formed. The valve mechanism 45 of the open/close valve 4J is constituted by a piston 46 which is slidably mounted on the piston room 44, and a shaft 47 which is coaxially fixed to one end surface (an upper end surface) of the piston 46 in such a manner that the shaft 47 is protruded upward from an upper end of the valve housing 41. In the piston room 44, a pressure offset room 50 is formed. The pressure offset room 50 is communicated with the side of the water-out port 43 by way of plural communication holes 51 as passages which are formed in the piston 46. In the pressure offset room 50, a spring 52 as a force act means is arranged. The spring 52 is disposed between the valve housing 41 and the other end surface 46*b* of the piston 46. The spring 52 always pushes the piston 46 toward the direction of an arrow Y1, namely, upward to close the communication between the water-in port 42 and the water-out port 43. A top end portion of the shaft 47 is protruded upward from the valve housing 41, and it can be pushed downward by the cam device 8.

An inner constitution of the rim open/close valve 4R is substantially the same as the inner constitution of the jet open/close valve 4J, so an explanation thereof is omitted. The water-in port 42 of the jet open/close valve 4J and the water-in port 42 of the rim open/close valve 4R are communicated with each other by way of a ring-shaped intermediate communication passage 54 which is formed in the valve housing 41.

The cam device 8 is held at a bracket 82 which is arranged upward from the open/close valves 4R and 4J. The cam device 8 includes a rotation axis 83 as a rotation body which is rotatably held at the bracket 82 in the horizontal condition, a first cam 85 and a second cam 86 which are mounted on the rotation axis 83 in such a manner that they are protruded in the axially right-angled direction. When the rotation axis 83 is rotated, the first cam 85 and the second cam 86 are rotated. Then, a cam surface at an outer periphery of the first cam 85 is brought into contact with the shaft 47 of the rim open/close valve 4R to move the shaft 47 downward. At the same time, a cam surface at an outer periphery of the second cam 86 is brought into contact with the shaft 47 of the jet open/close valve 4J to move the shaft 47 downward.

A driving device 7 is fixed to the bracket 82, and an electric motor 71 and a reduction gear which is not shown in the drawing and which transmits rotation force of the electric motor 71 to the rotation axis 83 are contained in the driving device 7. The driving device 7 is to open the open/close valves 4R and 4J by fluctuating a manual handle 75 or by operating the cam device 8.

At an axial end of the rotation axis 83, the manual handle 75 which is rotated by a manual operation of the user is mounted. The manual handle 75 is to open and close the open/close valves 4R and 4J by operating the cam device 8 manually at the time of an emergency such as power failure and the like.

On the manual handle 75, a handle sensor 77 which is functioned as a detection means is mounted. The handle sensor 77 is to detect that the user touches the manual handle 75 or that a very small angle deviation is generated on the manual handle 75. The handle sensor 77 is constituted by a pressure sensitive touch sensor.

Figure 101:
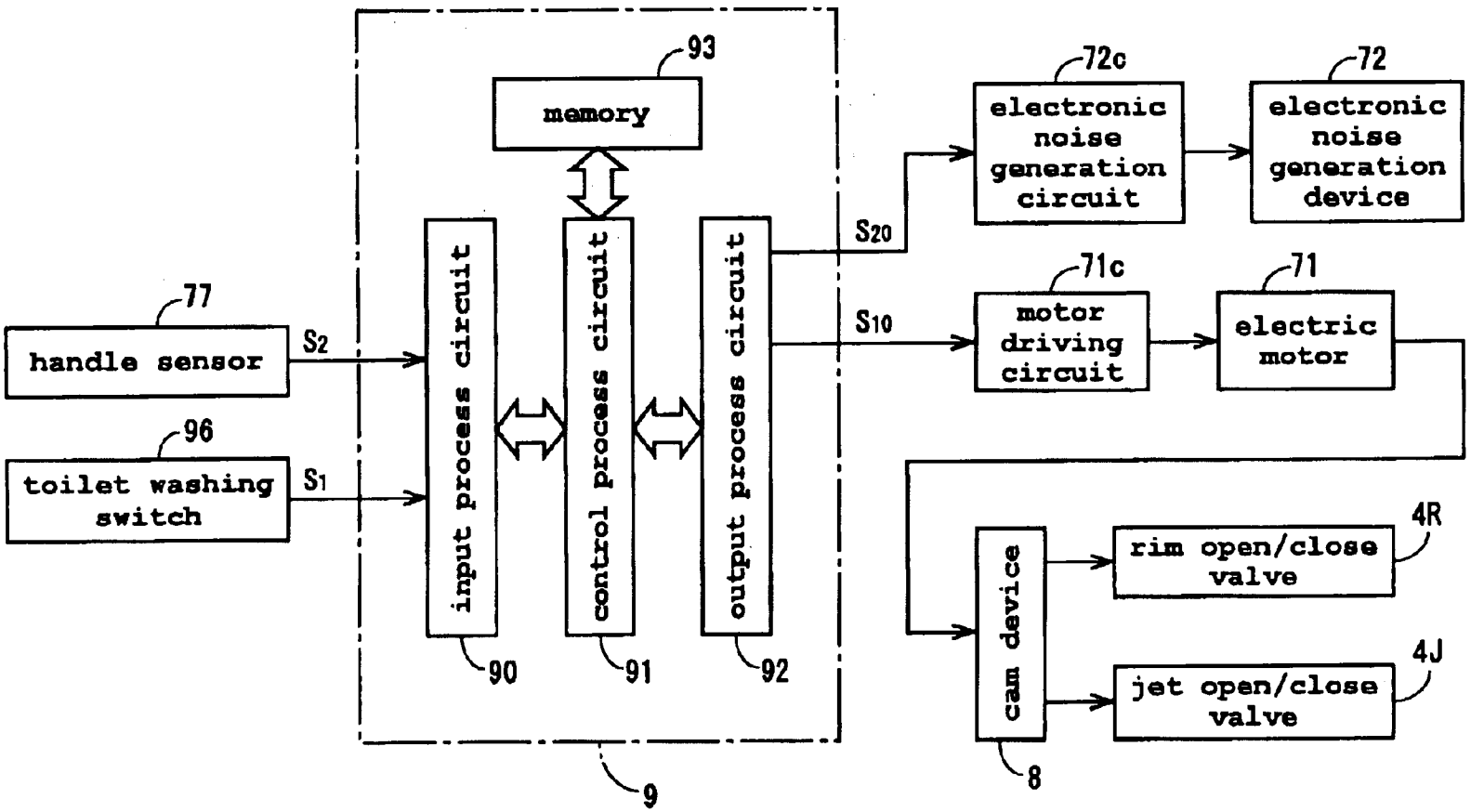
FIG. 101 is a block view of a control system which includes a controller according to an embodiment 1 in the tenth invention.

At a housing which is integral with the cover 32 shown in FIGS. 98 and 99, a toilet washing switch 96 which is shown in FIG. 101 is mounted. The toilet washing switch 96 is subjected to a push operation by the user who sits on the toilet seat, and the electric motor 71 is driven to carry out the washing of the toilet bowl 11 of the western-style toilet body 1 as a normal mode.

A controller 9 has an input process circuit 90 for processing an input signal, a control process circuit 91 in which a CPU for outputting a signal based on a signal from the input process circuit 90 is contained, an output process circuit 92 for outputting a control signal based on a signal of the control process circuit 91 and a memory 93 for storing program and data. In the input process circuit 90 of the controller 9, a washing start signal S1 from the toilet washing switch 96 and a touch signal S2 from the handle sensor 77 are inputted. When the user carries out a push operation of the toilet washing switch 96, the washing start signal S1 is inputted from the toilet washing switch 96 to the controller 9. Based on the washing start signal S1, a motor control signal S10 is inputted from the output process circuit 92 of the controller 9 to a motor driving circuit 71*c*, and the electric motor 71 is controlled.

When the finger of the user touches the manual handle 75, the touch signal S2 is inputted from the handle sensor 77 to the controller 9. Based on the touch signal S2, the motor control signal S10 and an intermittent noise generation signal S20 are generated from the output process circuit 92 of the controller 9. The motor control signal S10 is inputted to the motor driving circuit 71*c* to control the electric motor 71. The intermittent noise generation signal S20 is inputted to an electronic noise generation circuit 72*c* to operate an electronic noise generation device 72, and an intermittent electronic noise is generated.

In the western-style toilet body 1 of the tankless western-style flush toilet which is constituted as above, water is supplied to the toilet washing device 3 by way of the water supply pipe 100, the stop cock 102, the flexible hose 21, the branch device 2 and the water supply conduit 23. In the toilet washing device 3, as far as the user doesn't carry out an operation of the toilet washing switch 96 in order to wash the toilet bowl 11, both of the open/close valves 4J and 4R are closed. Namely, if being explained by FIG. 100, the piston 46 is moved to one side in the axial direction, in other words, the direction of an arrow Y1, by act force of the spring 52. Then, the piston 46 is attached to a seat face 41*x* of the valve housing 41, and an outer periphery of the piston 46 closes the water-in port 42. Accordingly, the communication between the water-in port 42 and the water-out port 43 is closed, and water is not supplied to the bowl portion 11 of the western-style toilet body 1.

The following explanation is about the case that the toilet bowl 11 is washed by the normal mode. In this case, in accordance with the operation of the toilet washing switch 96 of the user, the motor control signal S10 is inputted by the controller 9 to the motor driving circuit 71*c* to drive the electric motor 71 of the driving device 7, and the rotation axis 83 is rotatingly driven. Due to this, a cam surface of the first cam 85 pushes the shaft 47 of the rim open/close valve 4R downward to open the rim open/close valve 4R, and "rim water supply" is carried out. If being explained by FIG. 100, the spring 52 is elastically contracted, and the piston 46 is moved to the other direction of the axial direction, namely, toward the direction of an arrow Y2. Accordingly, the piston 46 is detached from the seat face 41*x* of the valve housing 41 to open the communication between the water-in port 42 and the water-out port 43. When the rim open/close valve 4R is opened like this, water is supplied to the rim channel 12 by way of the rim conduit 19, and an inner wall surface of the bowl portion 10 of the toilet bowl 11 is washed.

In accordance with the driving of the cam device 8, the cam surface of the first cam 85 doesn't come to push the shaft 47 of the rim open/close valve 4R downward, and the rim open/close valve 4R is closed. After that, the cam surface of the second cam 86 pushes the shaft 47 of the jet open/close valve 4J downward to open the jet open/close valve 4J, and "jet water supply" is carried out. When the jet open/close valve 4J is opened like this, water is supplied to the jet nozzle 15 by way of the jet conduit 18, and a siphon effect is forcibly generated in the trap portion 14.

Next, in accordance with the driving of the cam device 8, the cam surface of the second cam 86 doesn't come to push the shaft 47 of the jet open/close valve 4J downward, and the jet open/close valve 4J is closed. After that, the cam surface of the first cam 85 again pushes the shaft 47 of the rim open/close valve 4R downward to open the rim open/close valve 4R, and "rim water supply" is carried out. Due to this, water is supplied to the rim channel 12 by way of the rim conduit 19 to seal the bowl portion 10 of the toilet bowl 11 with water.

As shown in FIG. 99, when the electric motor 71 of the driving device 7 is not operated by power failure or breakdown of the electric motor 71 and the like, the user operates the manual handle 75 which is exposed from the cover 32. Namely, when the user fluctuates the manual handle 75 manually, the rotation axis 83 of the cam device 8 is rotated manually, and the first cam 85 and the second cam 86 are rotated. Due to this, in the same manner as that of the case in which the electric motor 71 is driven, the rim open/close valve 4R is opened to carryout "rim water supply", and water is supplied to the rim channel 12 by way of the rim conduit 19, and an inner wall surface of the bowl portion 10 of the toilet bowl 11 is washed. Furthermore, in accordance with a manual operation, the cam surface of the second cam 86 pushes the shaft 47 of the jet open/close valve 4J downward to open the jet open/close valve 4J, and "jet water supply" is carried out. Then, water is supplied to the jet nozzle 15 by way of the jet conduit 18 to generate a siphon effect in the trap portion 14 forcibly. Next, the rim open/close valve 4R is again opened to carry out "rim water supply", and the bowl portion 10 of the toilet bowl 11 can be sealed with water.

Since the manual handle 75 is mounted in such a manner that the manual handle 75 is exposed from the cover 32 like this, although it is not in case of emergency, there is the possibility that the user who is not accustomed to a tankless western-style flush toilet mistakenly operates the manual handle 75 for emergency after he relieves oneself. In this respect, in the tankless western-style flush toilet according to the embodiment 1, even if the user is not accustomed to such a tankless western-style flush toilet and he doesn't notice the existence of the toilet washing switch 95, when the user operates the manual handle 77 lightly, the handle sensor 77 detects that the user touches the manual handle 77 lightly. Due to this, the controller 9 drives the electric motor 71 by way of the motor driving circuit 71*c* to fluctuate the manual handle 75, and the washing of the toilet bowl 11 of the western-style toilet body 1 is carried out. Furthermore, the controller 9 operates the electronic noise generation device 72 by way of the electronic noise generation circuit 72*c* to generate an intermittent electronic noise.

In other words, as shown in FIG. 101, the controller 9 inputs the motor control signal S1 to the motor driving circuit 71*c* to drive the electric motor 71, and the rotation axis 83 is rotatingly driven. Besides, the controller 9 inputs the intermittent noise generation signal S20 to the electronic noise generation circuit 72*c* to operate the electronic noise generation device 71, and an intermittent electronic noise is generated. Namely, when the user touches the manual handle 75 lightly with his finger, an operation of the cam device 8 is assisted by the electric motor 71, and at the same time, an intermittent electronic noise is generated.

As a result, in the same manner as the above, the first cam 85 pushes the shaft 47 of the rim open/close valve 4R downward to open the rim open/close valve 4R, and "rim water supply" is carried out. Next, the cam surface of the first cam 85 doesn't come to push the shaft 47 of the rim open/close valve 4R downward, and the rim open/close valve 4R is closed. After that, the cam surface of the second cam 86 pushes the shaft 47 of the jet open/close valve 4J downward to open the jet open/close valve 4J, and the above-mentioned "jet water supply" is carried out. Next, the cam surface of the second cam 86 doesn't come to push the shaft 47 of the jet open/close valve 4J downward, and the jet open/close valve 4J is closed. After that, the cam surface of the first cam 85 again pushes the shaft 47 of the rim open/close valve 4R downward to open the rim open/close valve 4R, and "rim water supply" is carried out.

Figure 102:
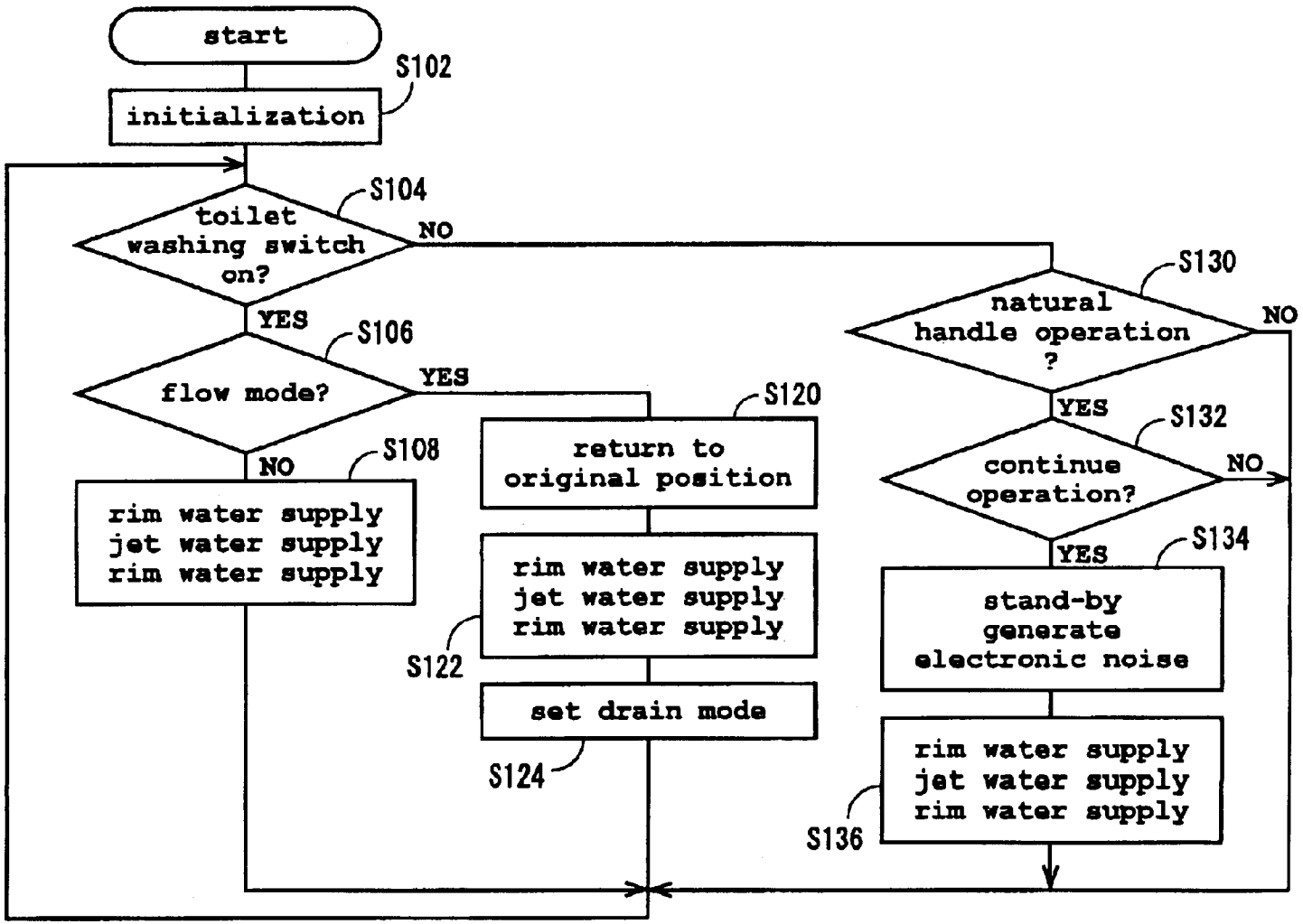
FIG. 102 is a flow chart which is carried out by a CPU of a controller according to an embodiment 1 in the tenth invention.

At this time, the CPU which is contained in the controller 9 executes a control flow chart which is shown in FIG. 102. Namely, at the step S102, an initialization is carried out. At the step S104, the judgment is made whether or not an ON operation of the toilet washing switch 96 is carried out. If the user carries out an ON operation of the toilet washing switch 96, he has an intention of washing the toilet bowl 11 of the western-style toilet body 1 by the normal washing mode. Next, at the step S106, the judgment is made whether or not the rotation axis 83 of the cam device 8 is at an original position, namely, whether or not a drain mode is set. If the drain mode is not set, the control flow chart proceeds to the step S108, and the electric motor 71 is driven to rotate the rotation axis 83 of the cam device 8, the first cam 85 and the second cam 86. Accordingly, as aforementioned, water supply is carried out in the order of "rim water supply"→"jet water supply"→"rim water supply", and the bowl portion 10 of the toilet bowl 11 of the western-style toilet body 1 is washed. After that, the control flow chart returns to the step S104.

The drain mode is applied to the case that the freezing of water is prevented during the cold season. So, in the drain mode, by opening the open/close valves 4R and 4J slightly on condition that the stop cock 102 is closed, water which may be remained in the open/close valves 4R and 4J and the like is discharged. It is possible to adopt a flow mode, in which a small amount of water per unit time continuously flows into the western-style toilet body 1 by always opening the open/close valves 4R and 4J slightly, as a drain mode.

As the result of the judgment at the step S106, if the drain mode is set, the control flow chart proceeds from the step S106 to the step S120, and the electric motor 71 is driven slightly to return the rotation axis 83 to its original position. At this time, a return amount is stored in the memory 93. After that, at the step S122, the electric motor 71 is further driven to rotate the rotation axis 83, the first cam 85 and the second cam 86. Accordingly, in the same manner as a fore mentioned, water supply is carried out in the order of "rim water supply"→"jet water supply"→"rim water supply", and the toilet bowl 11 of the western-style toilet body 1 is washed. After that, the control flow chart proceeds to the step S124, and the electric motor 71 is rotated backward in the stored return amount. Then, the mode is returned to the drain mode to open the open/close valves 4R and 4J slightly, and the control flow chart returns to the step S104.

As the result of the judgment at the step S104, if the toilet washing switch 96 is OFF, it is not requested that the toilet bowl 11 of the western-style toilet body 1 is washed by the normal washing mode. So, the control flow chart proceeds from the step S104 to the step S130, and the judgment is made whether or not a touch operation of the manual handle 75 is carried out by the user. This judgment is carried out based on a touch signal from the handle sensor 77 of the manual handle 75. When the touch operation of the manual handle 75 is not carried out by the user, the control flow chart returns from the step S130 to the step S104.

When the touch operation of the manual handle 75 is carried out by the user, the control flow chart proceeds to the step S132, and the judgment is made whether or not the touch operation of the manual handle 75 is continued for the predetermined time ΔT1 since the time at the step S130 (for example, in the range of from 0.02 to 1 second). The operation of the manual handle 75 is continued, the judgment accuracy that the user actually carries out the touch operation of the manual handle 75 is improved. So, the step S132 is functioned as a confirmation means for confirming whether or not the touch operation of the manual handle 75 is existed. Accordingly, if the touch operation of the manual handle 75 by the user is continued, the control flow chart proceeds to the step S134. Then, an electronic noise is generated, and at the same time, the predetermined time ΔT2 is acquired for stand-by. After that, the control flow chart proceeds to the step S136, and the electric motor 71 is driven to rotate the first cam 85 and the second cam 86. Due to this, in the same manner as afore mentioned, water supply is carried out in the order of "rim water supply"→"jet water supply"→"rim water supply", and the bowl portion 10 of the toilet bowl 11 of the western-style toilet body 1 is washed.

Thus, in this tankless western-style flush toilet, the manual handle 75 is assisted to be fluctuated, and the washing of the western-style toilet body 1 is carried out. Therefore, in the tankless western-style flush toilet, the user who is not accustomed to a tankless western-style flush toilet can wash the western-style toilet body 1 with an excellent operability. Furthermore, by the generation of the electric noise, it is known that the manual handle 75 is assisted. So, the user doesn't try to rotate the manual handle 75 unnecessarily, and it is possible to prevent malfunction or breakdown.

Embodiment 2

Figure 103:
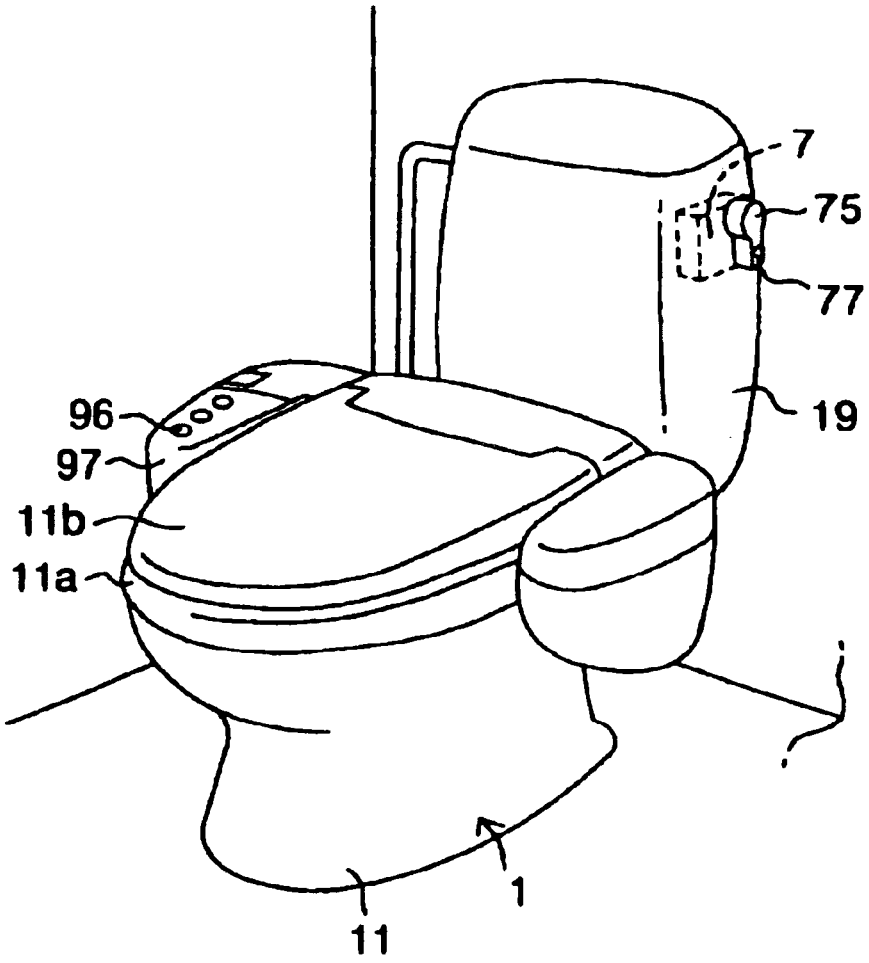
FIG. 103 is a perspective view of a western-style flush toilet which has a toilet washing tank according to an embodiment 2 in the tenth invention.

FIG. 103 shows the embodiment 2. The embodiment 2 is a tank-type flush toilet having a toilet washing tank. The portions which exhibit the common function as that of the embodiment 1 are labeled as the common symbols.

A western-style toilet body 1 includes a toilet bowl 11 having a bowl portion 10, a toilet seat 11*a* and a toilet lid 11*c* which are supported at an upper portion of the toilet bowl 11 in such a manner that they can be fluctuated and a toilet washing tank 19 which is mounted at a rear portion of the toilet bowl 11. In the toilet washing tank 19, a valve mechanism for supplying water which is stored in the toilet washing tank 19 to the western-style toilet body 1 at the time of opening the valve is equipped.

At the side surface of the toilet washing tank 19, a manual handle 75 which is mechanically connected to the valve mechanism of the toilet washing tank 19 is mounted in such a manner that the manual handle 75 can be fluctuated. When the manual handle 75 is fluctuated, the valve mechanism of the toilet washing tank 19 is opened, and water which is stored in the toilet washing tank 19 is supplied to the bowl portion 10 of the western-style toilet body 1.

To the manual handle 75, a driving device 7 by which the manual handle 75 is fluctuated is connected. The driving device 7 is held at the toilet washing tank 19, and it is constituted by an electric motor and a reduction gear for reducing the rotation speed of the electric motor.

On the manual handle 75, a handle sensor 77 as a detection means for detecting whether or not the user touches the manual handle 75 is mounted. A controller for controlling the electric motor of the driving device 7 is contained in a control panel 97 having a toilet washing switch 96.

Also in the embodiment 2, when the user touches the manual handle 75 lightly, the handle sensor 77 detects such a condition. Then, the controller drives the electric motor of the driving device 7, and at the same time, an intermittent electronic noise is generated. Accordingly, the manual handle 75 is automatically fluctuated in the direction for opening the valve, and the washing of the bowl portion 10 of the toilet bowl 11 of the western-style toilet body 1 is carried out.

Therefore, in the tank-type western-style flush toilet of the embodiment 2, it is possible to obtain an advantage that the fluctuation operation of the manual handle 75 is assisted by the electric motor to be simplified. So, not only a serious patient or an old man whose physical strength is considerably weak but also an ordinary person obtains a good operability. Furthermore, by the generation of the intermittent electric noise, the user knows that the manual handle 75 is assisted to be fluctuated by the electric motor. So, the user doesn't try to rotate the manual handle 75 unnecessarily, and it is possible to prevent malfunction or breakdown.

Eleventh Invention

An embodiment which embodies the eleventh invention is explained hereinafter in conjunction with drawings 104 to 108.

Figure 104:
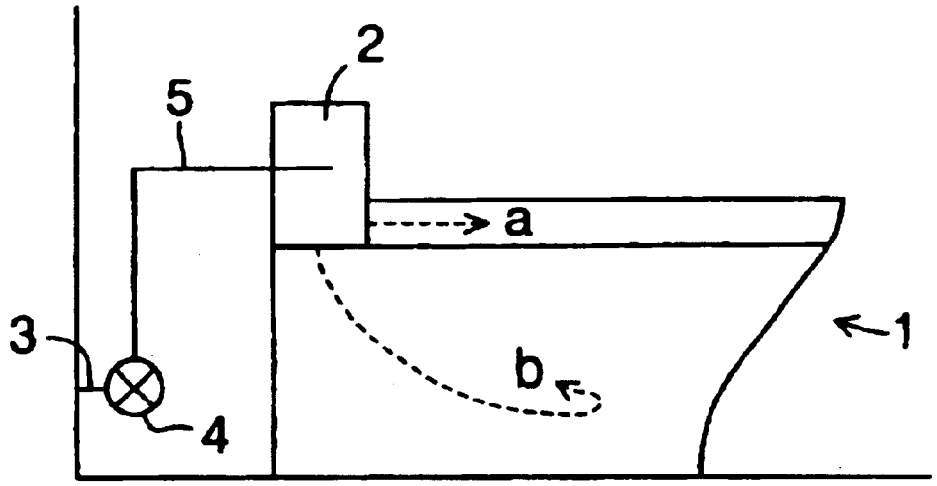
FIG. 104 is a typical view of a tankless western-style flush toilet according to an embodiment in the eleventh invention.

FIG. 104 is a typical view of a tankless western-style flush toilet according to the embodiment. The tankless western-style flush toilet includes a western-style toilet body 1, a toilet washing device 2, a heating toilet seat which is not shown in the drawing and a toilet lid which is not shown in the drawing.

Figure 105:
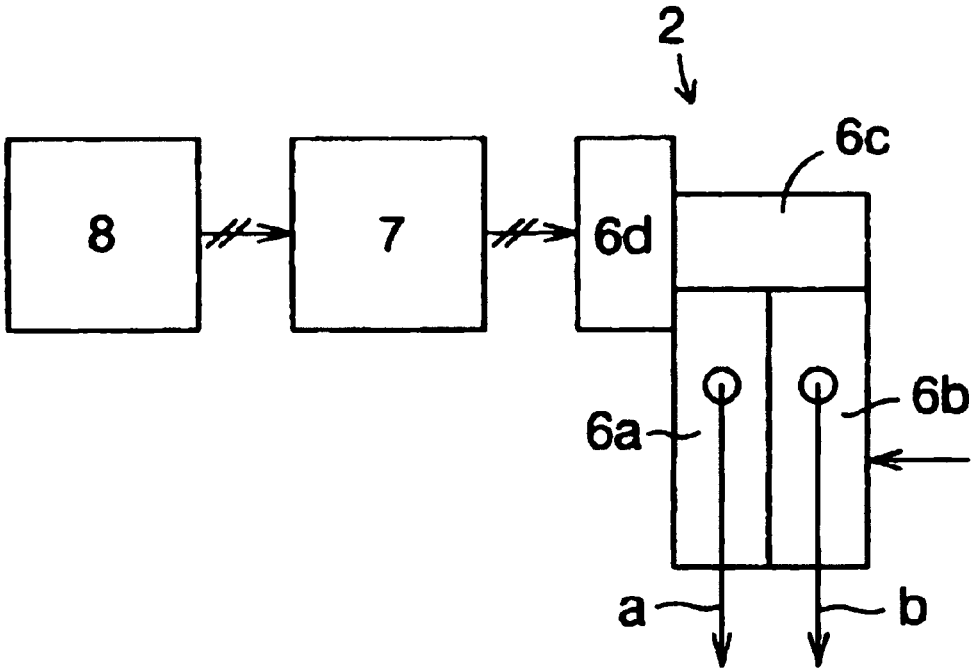
FIG. 105 is a typical view of a toilet washing device and the like according to a tankless western-style flush toilet of an embodiment in the eleventh invention.

The toilet washing device 2 is directly connected to a city water service pipe 3 by means of a flexible hose 5 via a stop cock 4. As shown in FIG. 105, in the inside of the toilet washing device 2, a rim open/close valve 6*a* and a jet open/close valve 6*b* are equipped. A cam device 6*c* is mounted upward from the rim open/close valve 6*a* and the jet open/close valve 6*b*, and an electric motor 6*d* is mounted at the side of the cam device 6*c*. The cam device 6*c* is driven by the electric motor 6*d*, and the rim open/close valve 6*a* and the jet open/close valve 6*b* are opened and closed by driving the cam device 6*c*.

The electric motor 6*d* is electrically connected to a controller 7, and the controller 7 can be operated by a remote control 8.

Figure 106:
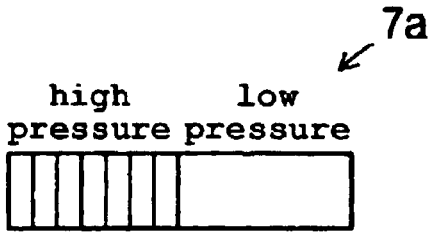
FIG. 106 is an appearance view of a changing switch according to a tankless western-style flush toilet of an embodiment in the eleventh invention.

On the controller 7, a sliding type changing switch 7*a* as a switching means which is shown in FIG. 106 is mounted, and the changing switch 7*a* can be selected for high pressure or low pressure.

Figure 107:
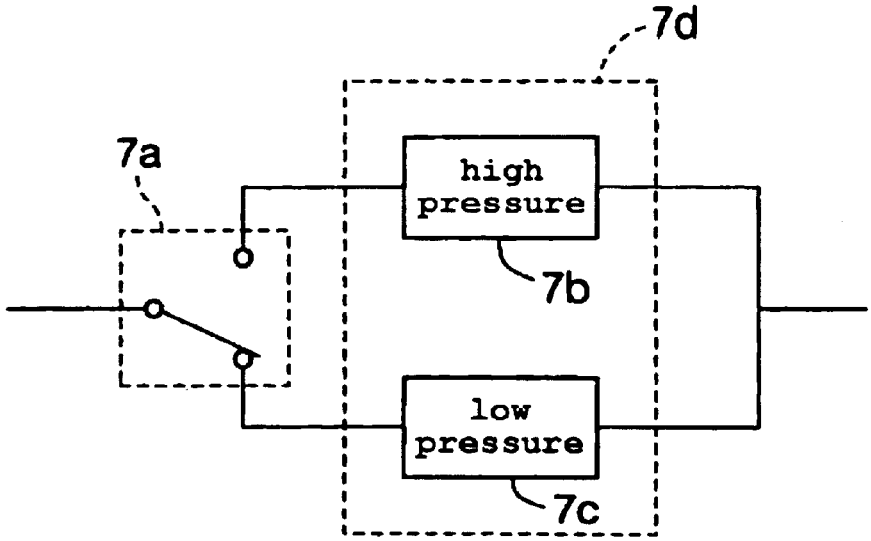
FIG. 107 is a typical view of a water control system according to a tankless western-style flush toilet of an embodiment in the eleventh invention.

Furthermore, as shown in FIG. 107, in the controller 7, a control portion 7*d* is mounted. The control portion 7*d* comprises a high pressure circuit 7*b* which shortens the releasing time of the rim open/close valve 6*a* and the jet open/close valve 6*b* for high pressure, and a low pressure circuit 7*c* which prolongs the releasing time of the rim open/close valve 6*a* and the jet open/close valve 6*b* for low pressure. To the control portion 7*d*, the changing switch 7*a* is connected.

In the tankless western-style flush toilet which is constituted as above, when it is mounted, as shown in FIGS. 106 and 107, by switching the changing switch 7*a* in accordance with the pressure of city water in the city water service pipe 3, which is performed by an installation person, the releasing time of the rim open/close valve 6*a* and the jet open/close valve 6*b* is selected.

Figure 108:
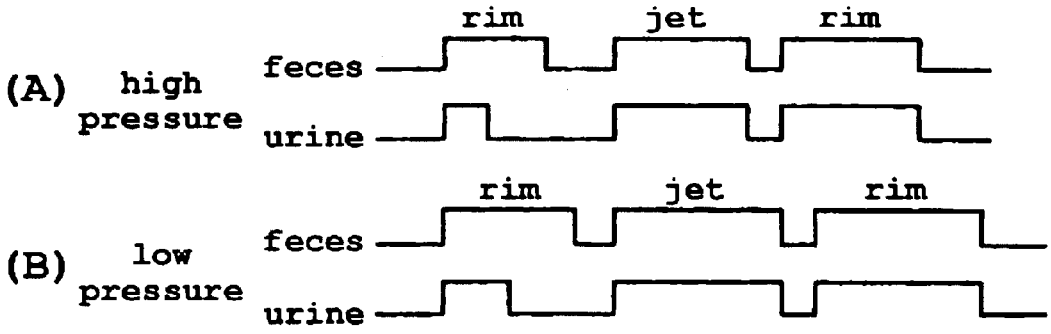
FIG. 108 is a water time chart according to a tankless western-style flush toilet of an embodiment in the eleventh invention.

In other words, when the pressure of city water in the city water service pipe 3 is high pressure, the installation person switches the changing switch 7*a* to the one for high pressure. Due to this, when the user operates a washing switch for either feces or urine by the remote control 8, the releasing time of the rim open/close valve 6*a* and the jet open/close valve 6*b* is set to be the one which is shown in FIG. 108(A).

In this condition, first, water a is spouted to a rim channel of the western-style toilet body 1 by releasing the rim open/close valve 6*a* to flow filth which is adhered to a bowl portion of the western-style toilet body 1. After that, water b is spouted to a trap of the western-style toilet body 1 by releasing the jet open/close valve 6*b* to generate a siphon effect forcibly, and the filth is discharged. Then, water a is spouted to the rim channel of the western-style toilet body 1 by releasing the rim open/close valve 6*a* again to seal the trap of the western-style toilet body 1 with water.

At this time, when the washing switch for feces is operated, the first releasing time of the rim open/close valve 6*a* is long. On the contrary, when the washing switch for urine is operated, the first releasing time of the rim open/close valve 6*a* is short. In this respect, the first releasing time of the rim open/close valve 6*a* is different between the case of feces or the case of urine, and there is no difference in the releasing time of the jet open/close valve 6*b* and the second releasing time of the rim open/close valve 6*a*. Especially, in spite of the difference between the case of feces and the case of urine, the releasing time of the jet open/close valve 6*b* is equal.

Furthermore, when the pressure of city water in the city water service pipe 3 is low pressure, the installation person switches the changing switch 7*a* to the one for low pressure. Due to this, when the user operates a washing switch for either feces or urine by the remote control 8, the releasing time of the rim open/close valve 6*a* and the jet open/close valve 6*b* is set to be the one which is shown in FIG. 108(B).

At this time, the first releasing time of the rim open/close valve 6*a*, the releasing time of the jet open/close valve 6*b* and the second releasing time of the rim open/close valve 6*a* become longer as compared with each releasing time for high pressure. In the same manner as that of the high pressure, the first releasing time of the rim open/close valve 6*a* is different between the case of feces or the case of urine, and there is no difference in the releasing time of the jet open/close valve 6*b* and the second releasing time of the rim open/close valve 6*a*. Especially, in spite of the difference between the case of feces and the case of urine, the releasing time of the jet open/close valve 6*b* is equal.

Accordingly, in this tankless western-style flush toilet, the rim open/close valve 6*a* and the jet open/close valve 6*b* is released at an appropriate releasing time which is in accordance with the pressure of the city water in the city water service pipe 3. Namely, even when the pressure of the city water is low and the water is spouted not powerfully, it is possible to perfectly discharge filth that is remained in the trap of the western-style toilet body 1 by prolonging the releasing time of the rim open/close valve 6*a* and the jet open/close valve 6*b*. Due to this, there is no cause of an unpleasant smell and the like, and the western-style toilet body 1 becomes sanitary.

On the other hand, when the pressure of the city water is spouted powerfully, by shortening the releasing time of the rim open/close valve 6*a* and the jet open/close valve 6*b*, water is not consumed in an amount greater than needed.

Moreover, in this tankless western-style flush toilet, in spite of the difference between the case of feces and the case of urine, the releasing time of the jet open/close valve 6*b* is set to be equal. In both of the case of feces and the case of urine, the same volume is already ensured together with filth in the trap, so almost the same level of the siphon effect is generated by the same water supply amount. Due to this, the filth can be discharged even if the releasing time of the jet open/close valve 6*b* is set to be equal like this. As a result, it is possible to surely prevent both of the unsanitary condition and waste consumption of water. Besides, it is possible that the constitution of the control portion 7*d* becomes simple, and accordingly, the reduction of the cost can be achieved.

Therefore, in the tankless western-style flush toilet of this embodiment, it is possible to prevent both of the unsanitary condition and waste consumption of water surely.

Twelfth Invention

An embodiment which embodies the twelfth invention is explained hereinafter in conjunction with drawings 109 to 113.

Figure 109:
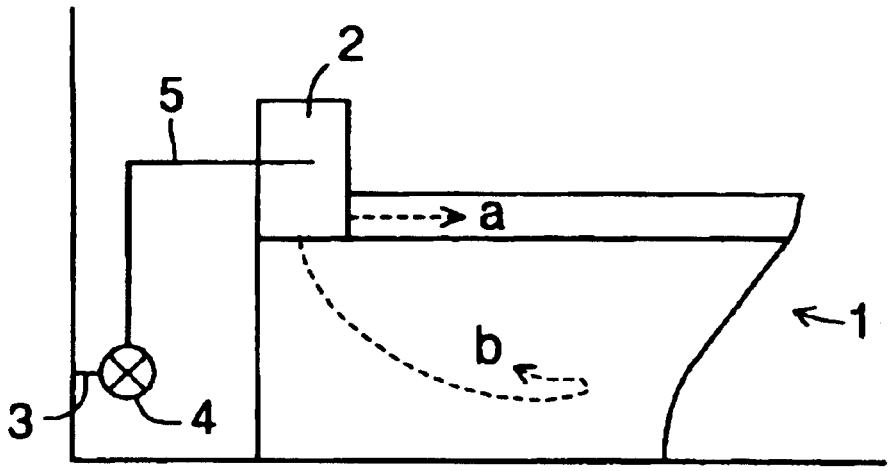
FIG. 109 is a typical view of a tankless western-style flush toilet according to an embodiment in the twelfth invention.

FIG. 109 is a typical view of a tankless western-style flush toilet according to the embodiment. The tankless western-style flush toilet has no toilet washing tank, and it includes a western-style toilet body 1, a toilet washing device 2, a heating toilet seat which is not shown in the drawing and a toilet lid which is not shown in the drawing.

The western-style toilet body 1 is made of porcelain. The toilet washing device 2 is directly connected to a city water service pipe 3 by a flexible hose 5 via a stop cock 4, and it is possible to wash the western-style toilet body 1 by spouting water a and water b.

Figure 110:
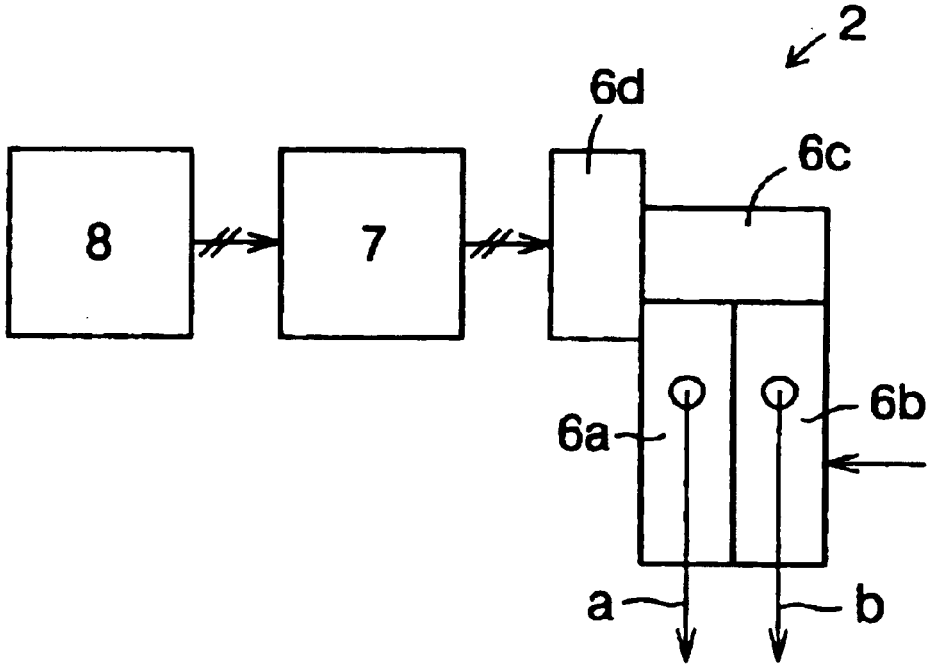
FIG. 110 is a typical view of a toilet washing device and the like according to a tankless western-style flush toilet of an embodiment in the twelfth invention.

As shown in FIG. 110, in the inside of the toilet washing device 2, a rim open/close valve 6*a* and a jet open/close valve 6*b* are equipped. A cam device 6*c* is mounted upward from the rim open/close valve 6*a* and the jet open/close valve 6*b*, and a stepping motor 6*d* is mounted at the side of the cam device 6*c*. The cam device 6*c* is driven by the stepping motor 6*d*, and the rim open/close valve 6*a* and the jet open/close valve 6*b* are opened and closed by driving the cam device 6*c*.

Figure 111:
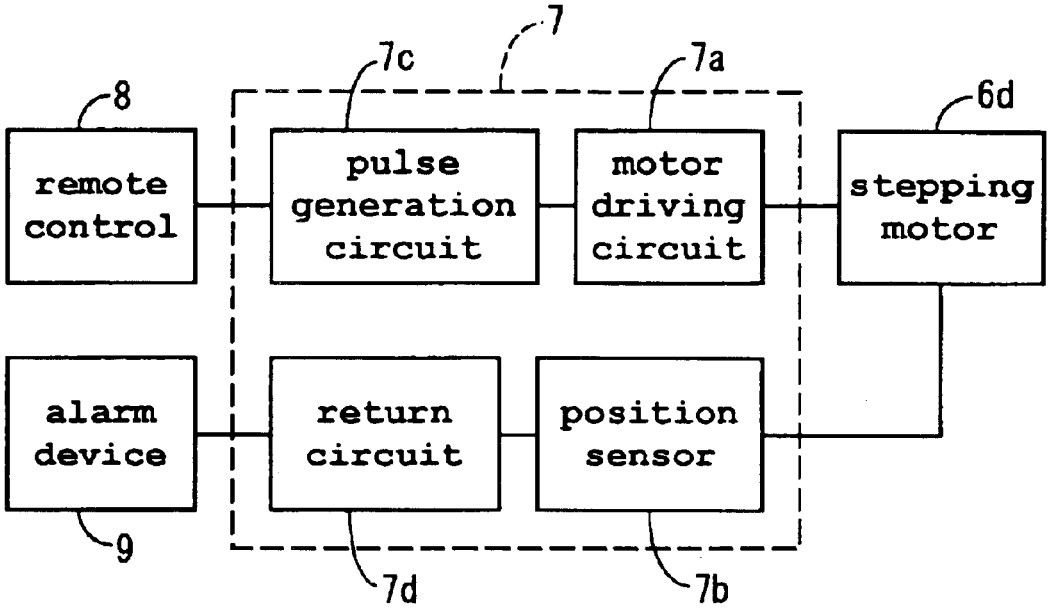
FIG. 111 is a block constitutional view of a controller and the like according to a tankless western-style flush toilet of an embodiment in the twelfth invention.

The stepping motor 6*d* is electrically connected to a controller 7, and the controller 7 can be operated by a remote control 8. As shown in FIG. 111, the controller 7 has a motor driving circuit 7*a* and a position sensor 7*b* which are connected to the stepping motor 6*d*, a pulse generation circuit 7*c* which is connected to the motor driving circuit 7*a* and which generates a pulse signal and a return circuit 7*d* by which the abnormal condition of the rim open/close valve 6*a* and the jet open/close valve 6b is returned to the normal condition. Here, the position sensor 7*b* detects the open or closed condition of the rim open/close valve 6*a* and the jet open/close valve 6*b* based on the pulse signal which is transmitted to the stepping motor 6*d*. The return circuit 7*d* is connected to an alarm device 9 as a notice means which is mounted in the tankless western-style flush toilet.

Figure 112:
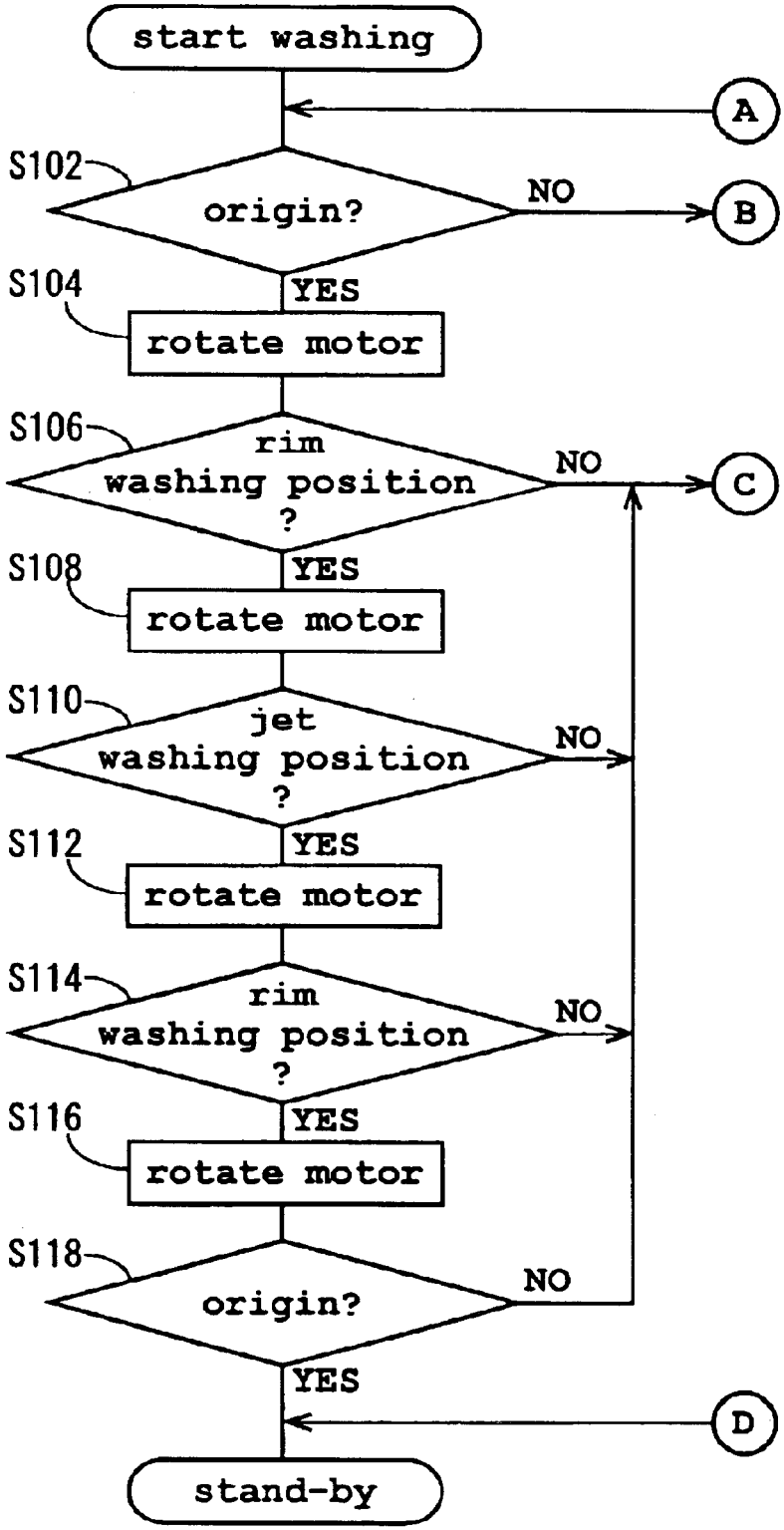
FIG. 112 is a flow chart for the normal washing treatment which is carried out by a controller according to a tankless western-style flush toilet of an embodiment in the twelfth invention.
Figure 113:
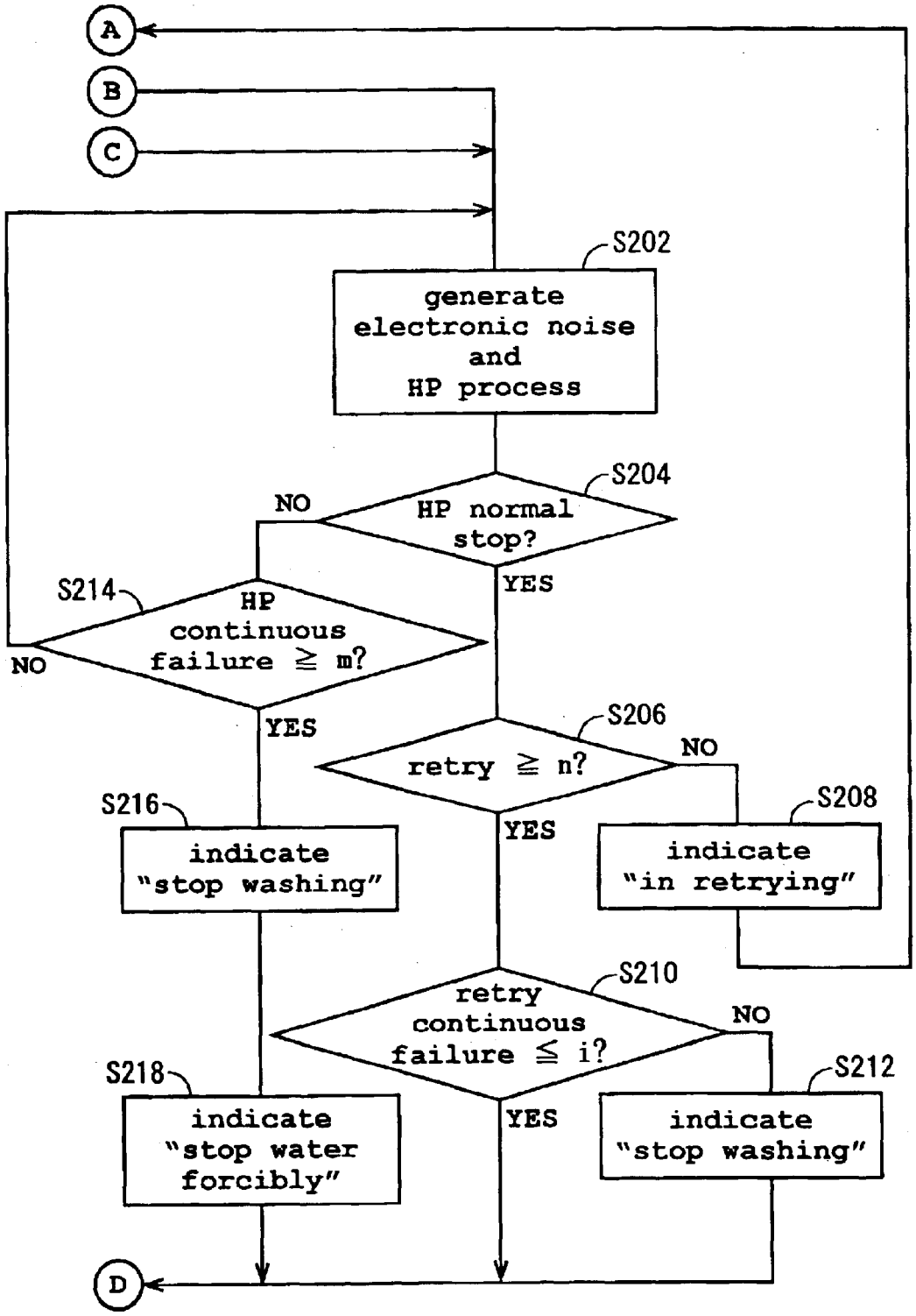
FIG. 113 is a flow chart for an abnormal treatment which is carried out by a controller according to a tankless western-style flush toilet of an embodiment in the twelfth invention.

In the tankless western-style flush toilet which is constituted as above, the controller 7 carries out a washing treatment in accordance with a flow chart shown in FIGS. 112 and 113 by the return circuit 7*d* and a memory means which is not shown in the drawing.

When the user pushes a washing start button of the remote control 8, first, a normal washing treatment is carried out in accordance with the flow chart which is shown in FIG. 112. Namely, at the step S102, the judgment is made whether or not both of the rim open/close valve 6*a* and the jet open/close valve 6b are in the closed condition. At this time, under the necessity of determining the standard of the frequency of pulse which is transmitted to the stepping motor 6*d*, when both of the rim open/close valve 6*a* and the jet open/close valve 6*b* are in the closed condition, this is determined as "the origin".

When the judgment of the step S102 is "the origin", the flow chart proceeds to the step S104. Due to this, the stepping motor 6*d* is rotated in the predetermined angle to be stopped, and the rim open/close valve 6*a* is released. Accordingly, water a is spouted for the predetermined time, and filth is collected in a trap.

Next, the flow chart proceeds to the step S106, and the judgment is made whether or not the rim open/close valve 6*a* is in the open condition, and whether or not the jet open/close valve 6*b* is in the closed condition. Here, when the judgment is YES, the flow chart proceeds to the step S108. Due to this, the stepping motor 6*d* is rotated in the predetermined angle to be stopped, and the rim open/close valve 6*a* is closed, and at the same time, the jet open/close valve 6*b* is released. Accordingly, water a is stopped, and water b is spouted for the predetermined time to generate a siphon effect forcibly, and the filth is discharged.

Then, the flow chart proceeds to the step S110, and the judgment is made whether or not the rim open/close valve 6*a* is in the closed condition, and whether or not the jet open/close valve 6*b* is in the open condition. Here, when the judgment is YES, the flow chart proceeds to the step S112. Due to this, the stepping motor 6*d* is rotated in the predetermined angle to be stopped, and the jet open/close valve 6*b* is closed, and at the same time, the rim open/close valve 6*a* is released. Accordingly, water b is stopped, and water a is spouted for the predetermined time to carry out a water sealing treatment in the trap.

Next, the flow chart proceeds to the step S114, and the judgment is made whether or not the rim open/close valve 6*a* is in the open condition, and whether or not the jet open/close valve 6*b* is in the closed condition. Here, when the judgment is YES, the flow chart proceeds to the step S116. Due to this, the stepping motor 6*d* is rotated in the predetermined angle to be stopped, and the flow chart proceeds to the step S118. Accordingly, the judgment is made whether or not both of the rim open/close valve 6*a* and the jet open/close valve 6*b* are in the closed condition. Here, when the judgment is YES, the condition becomes stand-by to finish the washing treatment.

On the other hand, when the judgment is NO at the steps S102, S106, S110, S114 and S118, this means the abnormal condition, and an abnormal treatment is carried out in accordance with a flow chart which is shown in FIG. 113.

Namely, first, at the step S202, an electronic noise for notifying the abnormal condition is generated by an alarm device 9, and at the same time, a return treatment to "the origin" is carried out. After that, the flow chart proceeds to the step S204, and the judgment is made whether or not the return to "the origin" is normally carried out. Here, when the judgment is YES, the flow chart proceeds to the step S206, and the judgment is made how many times retry is repeated. When the frequency of the retry is less than n times, the judgment is NO. Then, at the step S208, the alarm device 9 indicates that the retry is going on. After that, the flow chart returns to the step S102 which is shown in FIG. 112, and a normal washing treatment is carried out. The return circuit 7*d* and the steps S202, S204, S206 and S208 in the memory means are the return means.

On the other hand, at the step S206, if it is judged that the frequency of the retry is not less than n times, the judgment is YES, and the flow chart proceeds to the step S210. Due to this, it is possible to prevent the retry from being repeated endlessly, and to prevent waste consumption of energy.

Then, at the step S210, the judgment is made how many times the frequency of the retry, which is judged to be not less than n times, is. When this frequency is not more than i times, the judgment is YES, and the condition becomes stand-by. Furthermore, when the frequency of the retry, which is judged to be not less than n times, is more than i times, the judgment is NO. Then, the flow chart proceeds to the step S212, and the alarm device 9 indicates the indication of "stop washing", and after that, the condition becomes stand-by. Accordingly, it is possible to inform the user that the tankless western-style flush toilet is out of order.

Besides, at the step S204, when it is judged that the return to "the origin" is not normally carried out, the judgment is NO, and the flow chart proceeds to the step S214. Here, the frequency that the return to "the origin" is not normally carried out is compared. When the frequency is less than m times, the judgment is NO, and the flow chart returns to the step S202. Furthermore, when the frequency is more than m times, the judgment is YES. Then, the flow chart proceeds to the step S216, and the alarm device 9 indicates the indication of "stop washing". After that, the flow chart proceeds to the step S218, and the alarm device 9 indicates the indication of "stop water forcibly", and then, the condition becomes stand-by. Accordingly, it is possible to prevent the return treatment to "the origin" from being repeated endlessly, and to prevent waste consumption of energy.

As above-mentioned, in the tankless western-style flush toilet of this embodiment, even if the rim open/close valve 6*a* or jet open/close valve 6*b* becomes the abnormal condition, such a condition is detected by the position sensor 7*b*, and the rim open/close valve 6*a* and the jet open/close valve 6*b* are automatically returned to the closed condition by the return circuit 7*d* and the like.

Therefore, in this tankless western-style flush toilet, water supply is automatically stopped, and waste consumption of water is not occurred.

In addition, in the return circuit 7*d* and the like, water sealing treatment in the western-style toilet body 1 is carried out. So, even if the rim open/close valve 6*a* or the jet open/close valve 6*b* becomes the abnormal condition, it is possible to prevent a nasty smell from going up through a drain pipe.

Moreover, the return circuit 7*d* and the like make the rim open/close valve 6*a* or the jet open/close valve 6*b* in the closed condition after carrying out the normal washing treatment of the western-style toilet body 1. So, even if the rim open/close valve 6*a* or the jet open/close valve 6*b* is in the abnormal condition, the normal washing treatment of the western-style toilet body 1 is carried out at least one time, and the washing of the western-style toilet body 1 is surely carried out. Accordingly, filth is not remained, and the generation of an unpleasant smell is prevented, and the tankless western-style flush toilet becomes sanitary.

Furthermore, in case of exceeding a constant frequency of retry, the return circuit 7*d* and the like make the rim open/close valve 6*a* or the jet open/close valve 6*b* to be stopped in the closed condition. So, the retry is not repeated endlessly, and finally, water is not left to flow. Accordingly, waste consumption of energy is prevented, and waste consumption of water is also prevented.

Thirteenth Invention

An embodiment which embodies the thirteenth invention is explained hereinafter in conjunction with drawings 114 to 121.

Figure 114:
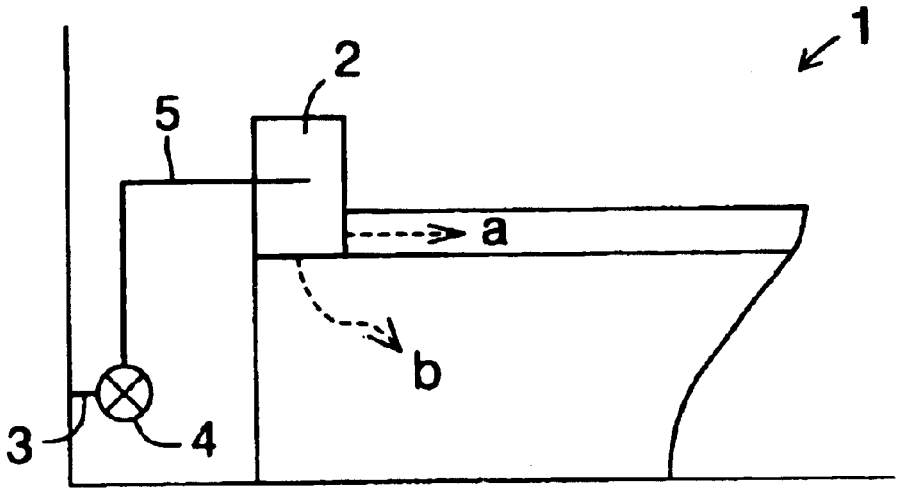
FIG. 114 is a typical view of a tankless western-style flush toilet according to an embodiment in the thirteenth invention.

A tankless western-style flush toilet according to this embodiment, as shown in FIG. 114, has no toilet washing tank, and the tankless western-style flush toilet includes a western-style toilet body 1 made of porcelain, a toilet washing device 2, a heating toilet seat which is not shown in the drawing and a toilet lid which is not shown in the drawing.

The toilet washing device 2 is directly connected to a city water service pipe 3 by means of a flexible hose 5 via a stop cock 4, and it is possible to wash the western-style toilet body 1 by spouting water a and water b.

Figure 115:
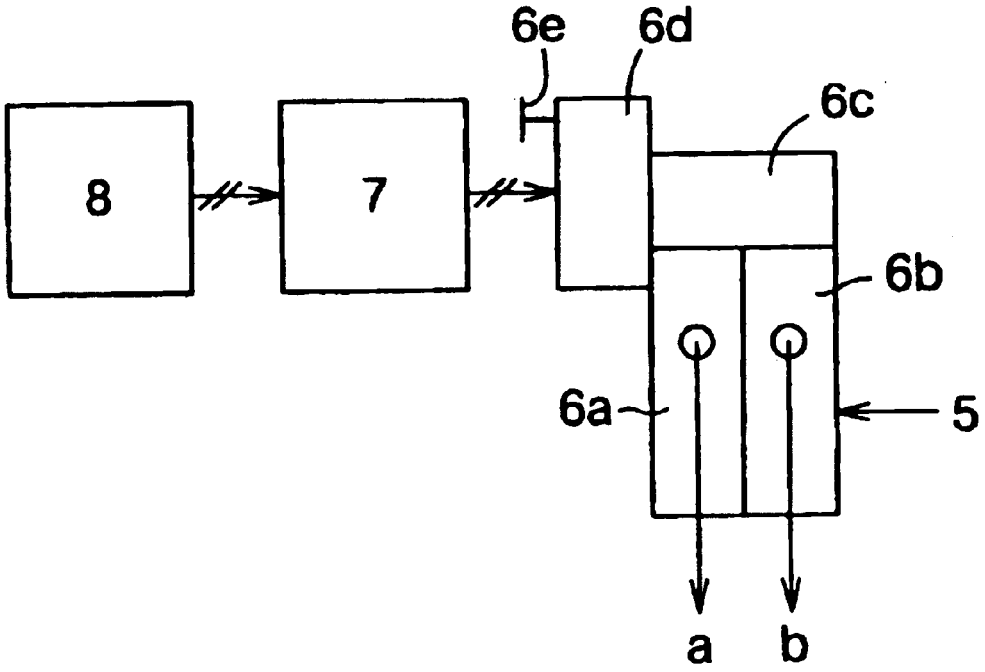
FIG. 115 is a typical view of a toilet washing device and the like according to a tankless western-style flush toilet of an embodiment in the thirteenth invention.

As shown in FIG. 115, in the inside of the toilet washing device 2, a rim open/close valve 6*a* and a jet open/close valve 6*b* are equipped. A cam device 6*c* is mounted upward from the rim open/close valve 6*a* and the jet open/close valve 6*b*, and a stepping motor 6*d* as an electric driving means is mounted at the side of the cam device 6*c*. The cam device 6*c* is driven by the stepping motor 6*d*, and the rim open/close valve 6*a* and the jet open/close valve 6*b* are opened and closed by driving the cam device 6*c*. Furthermore, a manual handle 6*e* is attached to the side of the stepping motor 6*d*, and the manual handle 6*e* can release the rim open/close valve 6*a* and the jet open/close valve 6*b* manually.

Figure 116:
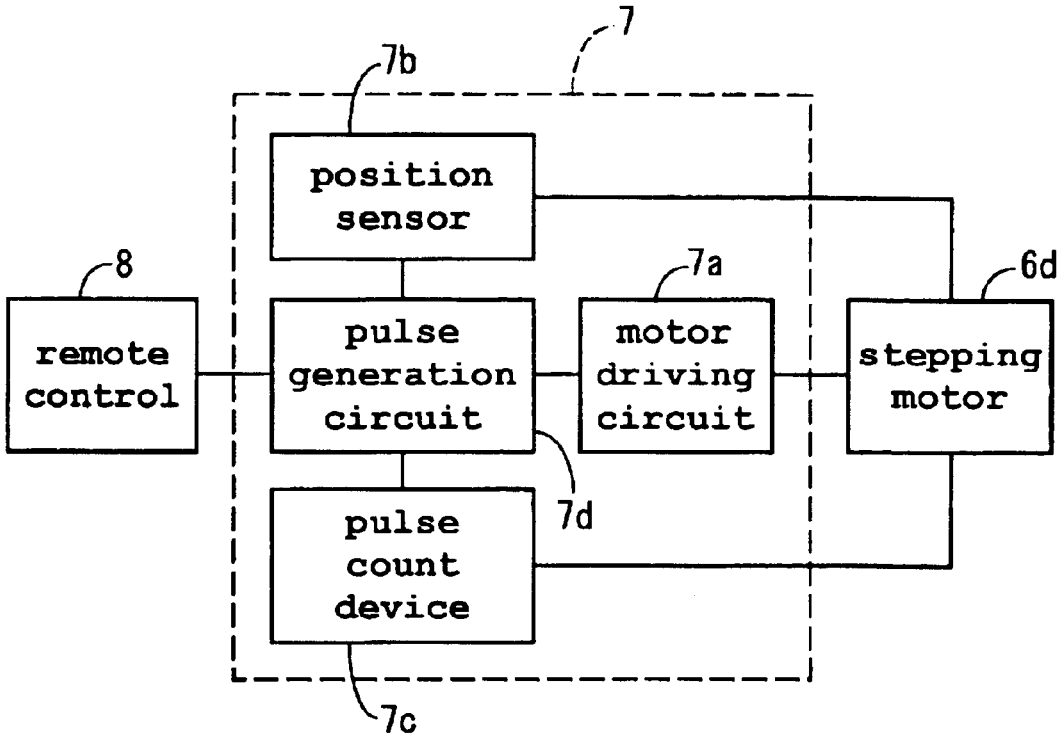
FIG. 116 is a block constitutional view of a controller and the like according to a tankless western-style flush toilet of an embodiment in the thirteenth invention.

The stepping motor 6*d* is electrically connected to a controller 7, and the controller 7 can be operated by a remote control 8. As shown in FIG. 116, the controller 7 has a motor driving circuit 7*a* which is connected to the stepping motor 6*d*, a position sensor 7*b* which detects a rotation angle of the stepping motor 6*d* optically to generate a L signal and a H signal, a pulse count device 7*c* as a count means for counting a pulse number of the stepping motor 6*d* and a pulse generation circuit 7*d* which is connected to the motor driving circuit 7*a*, the position sensor 7*b* and the pulse count device 7*c* to generate a pulse signal. The position sensor 7*b* and the pulse count device 7*c* are detection means for detecting the condition of the rim open/close valve 6*a* and the jet open/close valve 6*b*. Besides, the pulse generation circuit 7*d*, a memory device which is not shown in the drawing and a CPU are control means.

As shown in FIGS. 117(B) to 120(B), the rim open/close valve 6*a* has a valve housing 61 and a valve mechanism 62 which is mounted in the valve housing 61.

At the valve housing 61, a water-in port 61*a* which is connected to the flexible hose 5 to take water in, and a water-out port 61*b* which is connected to a rim channel not shown in the drawing of the western-style toilet body 1 to spout water out are formed. Furthermore, in the inside of the valve housing 61, a piston room 61*c* which is communicated with the water-in port 61*a* and the water-out port 61*b* is formed.

The valve mechanism 62 is constituted by a piston 62*a* which is slidably mounted in the piston room 61*c* and which closes the communication between the water-in port 61*a* and the water-out port 61*b* by being attached at one end side, a shaft 62*b* which is coaxially fixed to one end side of the piston 62*a* and which is protruded from the valve housing 61 and a spring 62*c* which is mounted between a lower end of the piston 62*a* and the valve housing 61 to push the piston 62*a* to one end side.

An inner construction of the jet open/close valve 6*b* is the same as that of the rim open/close valve 6*a*. The cam device 6*c* has a rim cam 63 and a jet cam 64, and the rim cam 63 and the jet cam 64 are coaxially fixed to a rotation axis 65. A top end of the shaft 62*b* of the rim open/close valve 6*a* is brought into contact with the rim cam 63 of the cam device 6*c*, and a top end of the shaft 62*b* of the jet open/close valve 6*b* is brought into contact with the jet cam 64. One end of the rotation axis 65 of the cam device 6*c* is connected to the stepping motor 6*d* which is shown in FIGS. 115 and 116 by way of a reduction gear, and the other end of the rotation axis 65 is connected to the manual handle 6*e* as shown in FIGS. 117(A) to 120(A).

Figure 117:
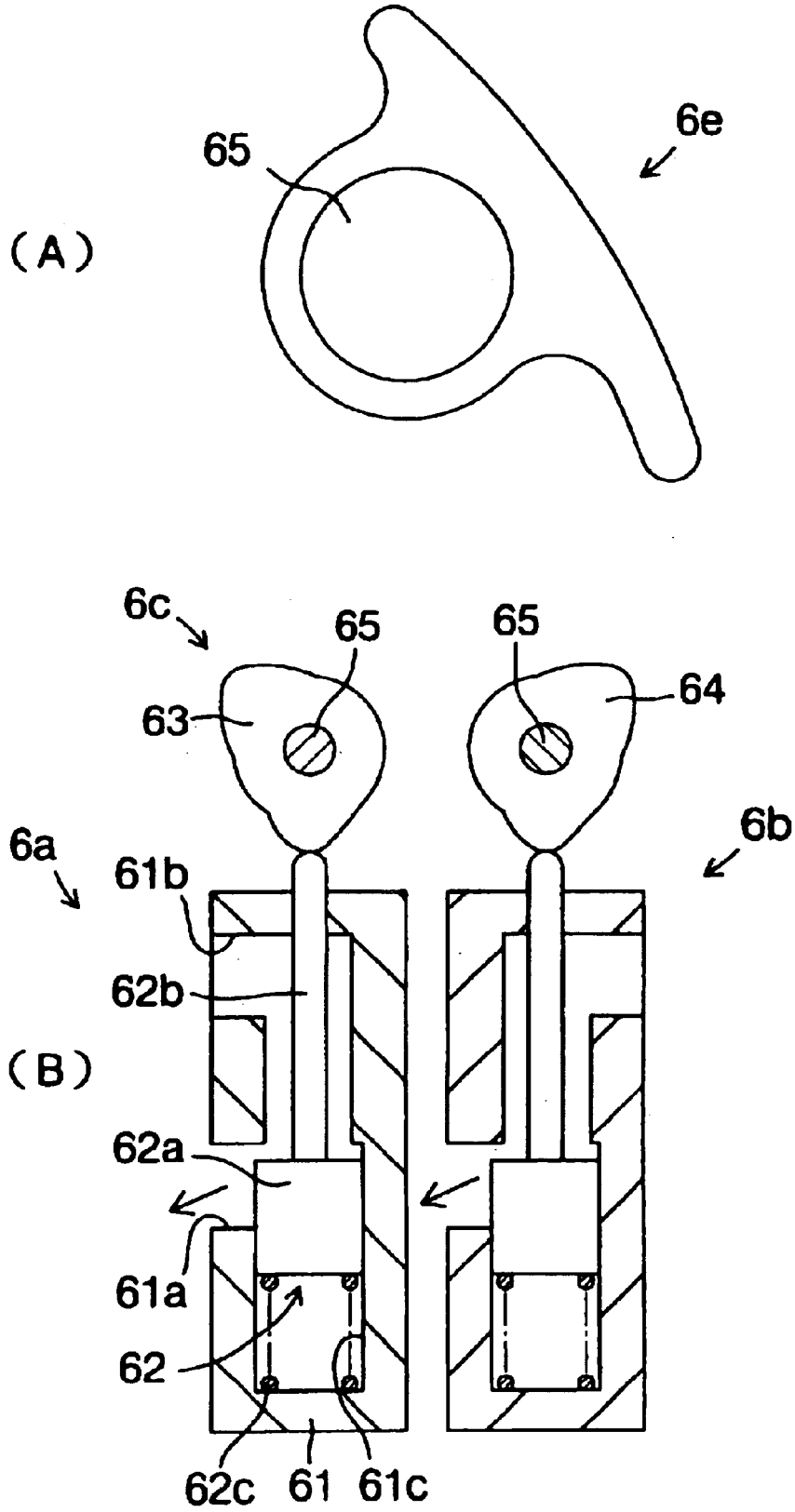
FIG. 117(A) is a side view of a manual handle when it is at "the position where water is drained away" according to a tankless western-style flush toilet of an embodiment in the thirteenth invention.
FIG. 117(B) is a cross-sectional view of a rim open/close valve and the jet open/close valve and the like according to a tankless western-style flush toilet of an embodiment in the thirteenth invention.

The rim open/close valve 6*a* and the jet open/close valve 6*b* like these are operated as follows. Namely, at "drain position" which is shown in FIG. 117, the manual handle 6*e* is in the condition of FIG. 117(A). Furthermore, as shown in FIG. 117(B), the rim open/close valve 6*a* and the jet open/close valve 6*b* are in the semi-opened condition, so water can be drained away by closing a stop cock which is in the ground and which is not shown in the drawing.

Figure 118:
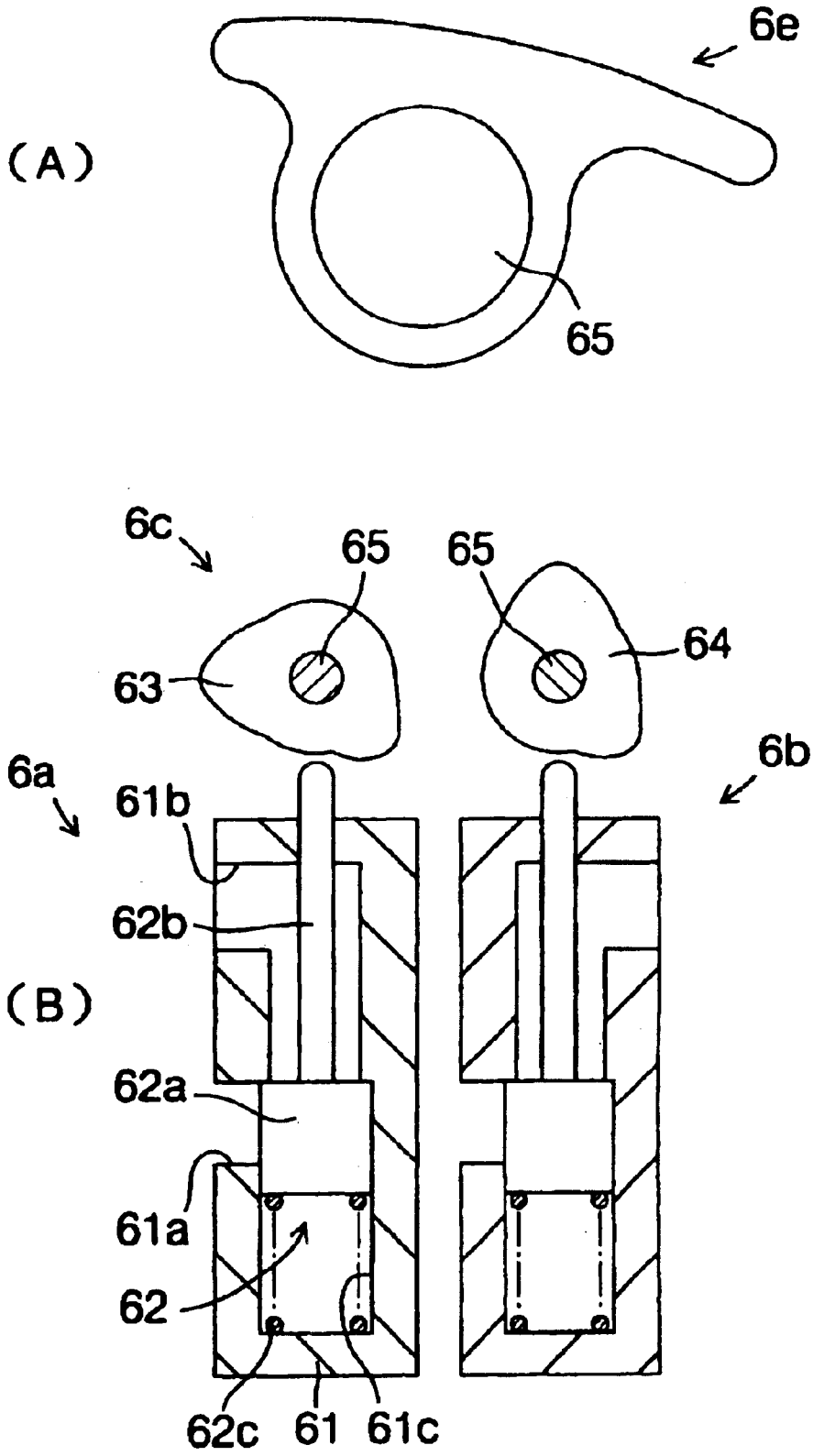
FIG. 118(A) is a side view of a manual handle when it is at "the origin" according to a tankless western-style flush toilet of an embodiment in the thirteenth invention.
FIG. 118(B) is a cross-sectional view of a rim open/close valve and the jet open/close valve and the like according to a tankless western-style flush toilet of an embodiment in the thirteenth invention.

At "original position" which is shown in FIG. 118, the manual handle 6*e* is in the condition of FIG. 118(A). Furthermore, as shown in FIG. 118(B), the rim open/close valve 6*a* and the jet open/close valve 6*b* are in the closed condition, so water a and water b are not spouted out.

Figure 119:
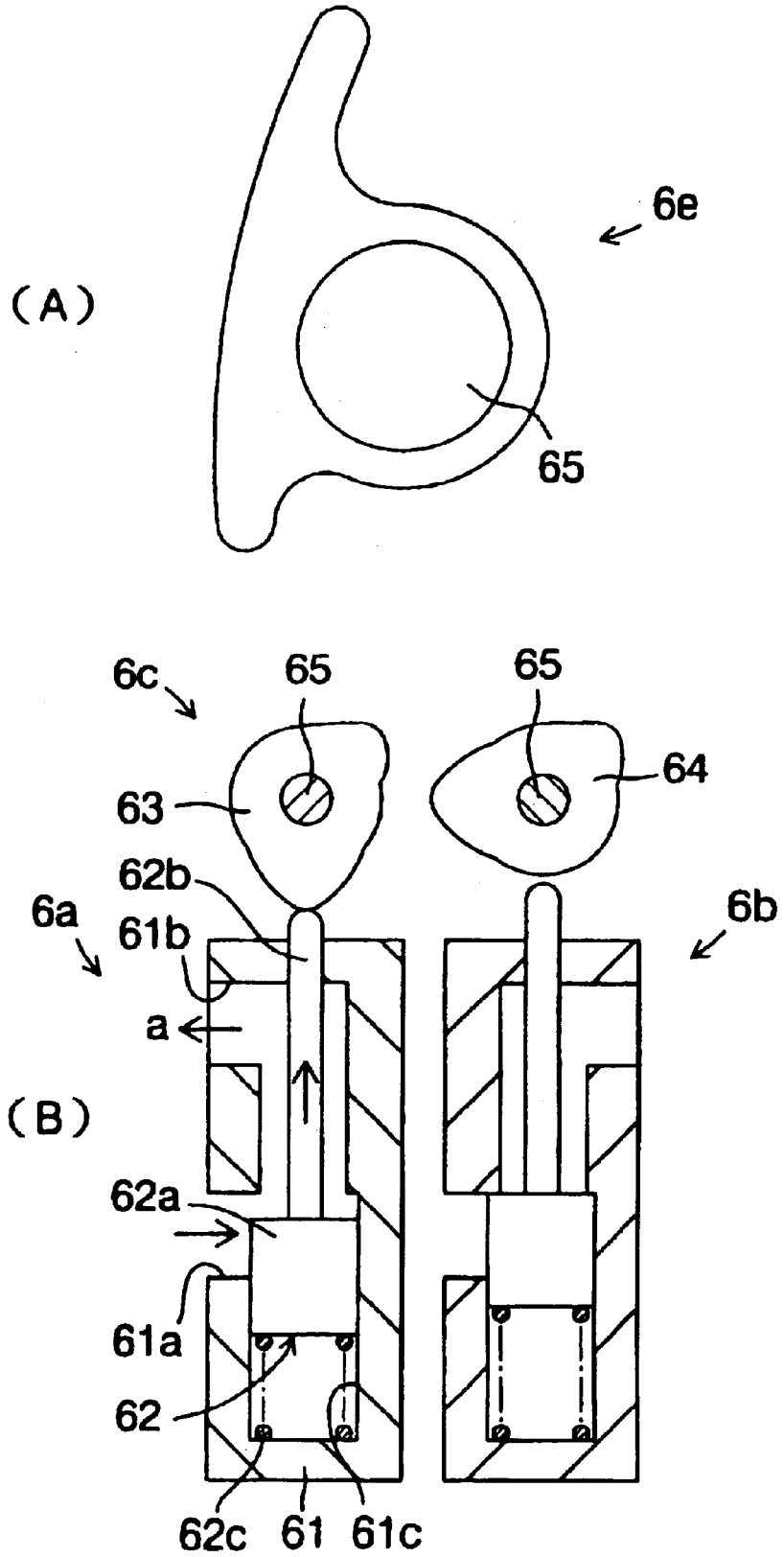
FIG. 119(A) is a side view of a manual handle when it is at "a rim washing position" according to a tankless western-style flush toilet of an embodiment in the thirteenth invention.
FIG. 119(B) is a cross-sectional view of a rim open/close valve and the jet open/close valve and the like according to a tankless western-style flush toilet of an embodiment in the thirteenth invention.

In addition, at "rim washing position" which is shown in FIG. 119, the manual handle 6*e* is in the condition of FIG. 119(A). Furthermore, as shown in FIG. 119(B), the rim open/close valve 6*a* is in the open condition, and water a is spouted out. On the contrary, the jet open/close valve 6*b* is in the closed condition, and water b is not spouted out.

Figure 120:
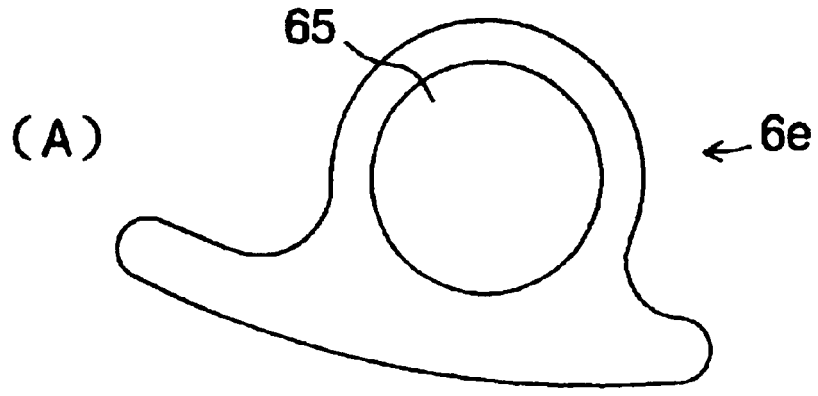
Figure 120:
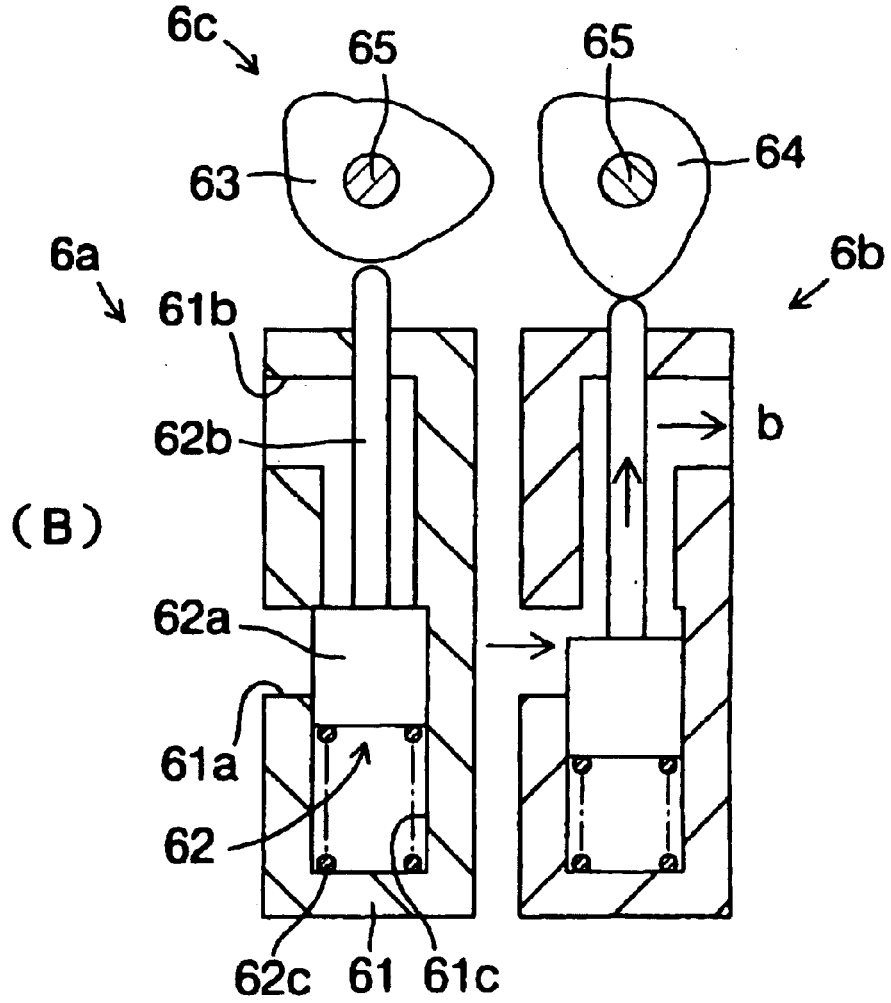

Besides, at "jet washing position" which is shown in FIG. 120, the manual handle 6*e* is in the condition of FIG. 120(A). Furthermore, as shown in FIG. 120(B), the rim open/close valve 6*a* is in the closed condition, and water a is not spouted out. On the contrary, the jet open/close valve 6*b* is in the open condition, and water b is spouted out.

In the tankless western-style flush toilet which is constituted as above, when the user makes a washing switch of the remote control 8 which is shown in FIG. 115 be in ON condition, the rim open/close valve 6*a* and the jet open/close valve 6*b* are controlled by the controller 7 in accordance with the following modes.

Figure 121:
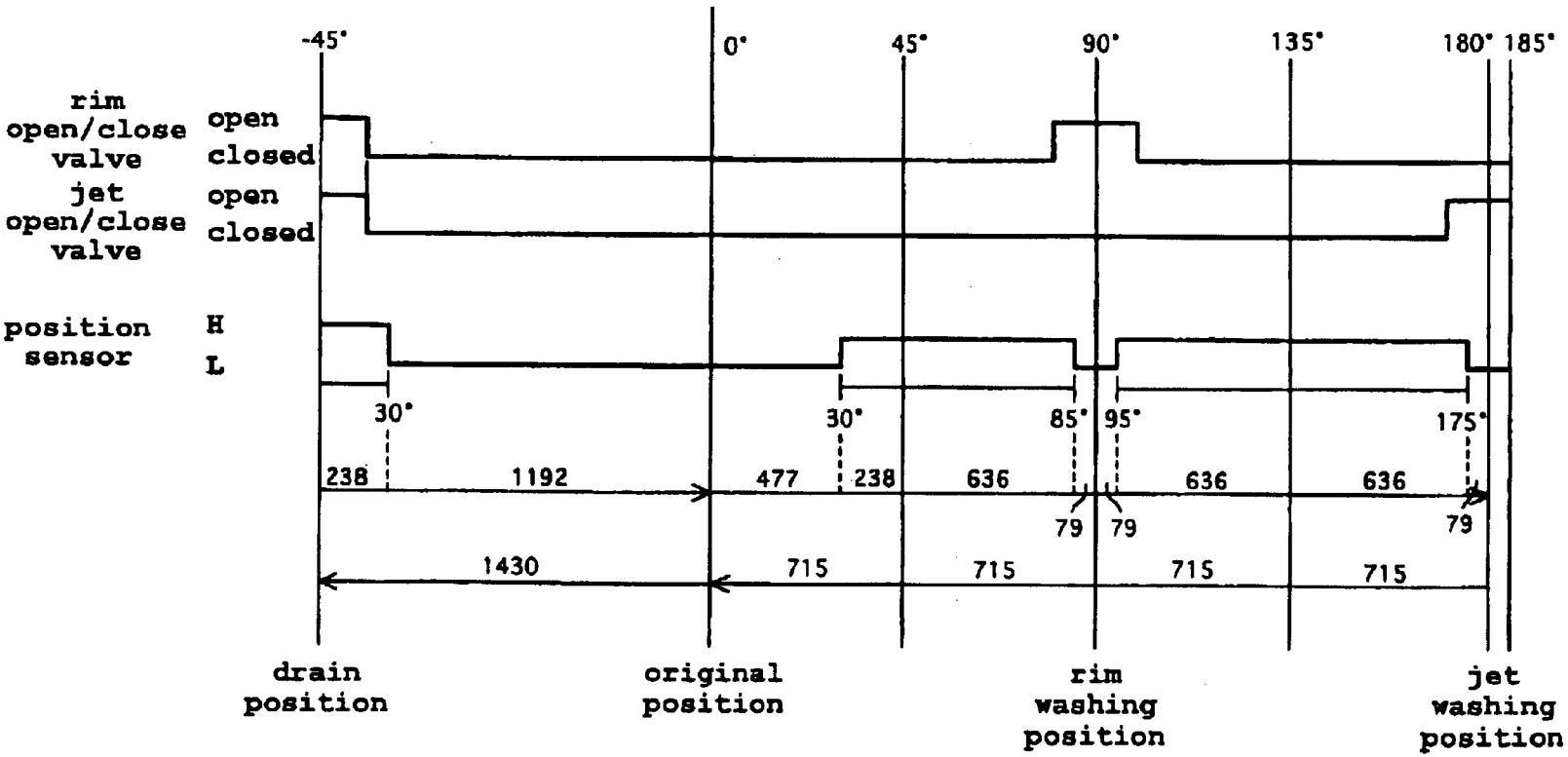

When the initial condition is "original position" which is shown in FIG. 118, if the user makes the washing switch of the remote control 8 be in ON condition, as shown in FIG. 121, the stepping motor 6*d* begins to make a normal rotation, and the pulse count device 7*c* counts the pulse number of the stepping motor 6*d*. If the signal of the position sensor 7*b* is changed from a L signal to a H signal just when the pulse count device 7*c* counts 477 pulses, it is confirmed that the initial condition is "original position".

Then, the rim open/close valve 6*a* is released to be "rim washing position" which is shown in FIG. 119, and the signal of the position sensor 7*b* is changed from H signal to L signal just when the pulse count device 7*c* further counts 874 pulses, and after that, such a condition is maintained for a while. Furthermore, the signal of the position sensor 7*b* is changed from a L signal to a H signal just when the pulse count device 7*c* further counts 158 pulses, and after that, the rim open/close valve 6*a* is closed to finish "rim washing position".

After that, the stepping motor 6*d* further makes a normal rotation, and the jet open/close valve 6*b* is released to be "jet washing position" which is shown in FIG. 120. The signal of the position sensor 7*b* is changed from H signal to L signal just when the pulse count device 7*c* further counts 1272 pulses, and after that, the stepping motor 6*d* makes a reverse rotation before it reaches to around 185 degrees, and then, such a condition is maintained for a while. Furthermore, the signal of the position sensor 7*b* is changed from L signal to H signal just when the pulse count device 7*c* counts —79 pulses, and after that, the jet open/close valve 6*b* is closed to finish "jet washing position".

Moreover, the stepping motor 6*d* continues to make a reverse rotation, and the rim open/close valve 6*a* is released to be "rim washing position" which is shown in FIG. 119 again. The signal of the position sensor 7*b* is changed from H signal to L signal just when the pulse count device 7*c* further counts —1272 pulses, and after that, such a condition is maintained for a while. Furthermore, the signal of the position sensor 7*b* is changed from L signal to H signal just when the pulse count device 7*c* further counts —158 pulses, and after that, the rim open/close valve 6*a* is closed to finish "rim washing position". Accordingly, water sealing treatment of a trap is carried out.

Finally, the stepping motor 6*d* continues to make a reverse rotation, and the signal of the position sensor 7*b* is changed from H signal to L signal just when the pulse count device 7*c* further counts —874 pulses. Then, just when the pulse count device 7*c* further counts —477 pulses, the rim open/close valve 6*a* and the jet open/close valve 6*b* are at "original position" to be stopped. Accordingly, a washing process is finished.

Thus, in this tankless western-style flush toilet, the stepping motor 6*d* electrically drives the rim open/close valve 6*a* and the jet open/close valve 6*b*. During this, the position sensor 7*b* and the pulse count device 7*c* detect the condition of the rim open/close valve 6*a* and the jet open/close valve 6*b*, and the pulse generation circuit 7*d* and the like control the stepping motor 6*d* in the desired mode.

Besides, in this tankless western-style flush toilet, the rim open/close valve 6*a* and the jet open/close valve 6*b* are released in the semi-opened condition by operating the manual handle 6*e* manually. There is an assumption that, as shown in FIG. 117, in order to prevent the freezing during the winter season, the control person operates the manual handle 6*e* to make the rim open/close valve 6*a* and the jet open/close valve 6*b* be in the semi-opened condition, and at the same time, to make the stop cock be in the closed condition, and that the user makes the washing switch be in ON condition by opening the stop cock. In this case, the stepping motor 6*d* also begins to make a normal rotation as shown in FIG. 121, and the pulse count device 7*c* counts the pulse number of the stepping motor 6*d*. Then, the signal of the position sensor 7*b* is changed from H signal to L signal just when the pulse count device 7*c* counts 238 pulses, and the signal of the position sensor 7*b* is not changed from L signal to H signal just when the pulse count device 7*c* counts 477 pulses. Due to this, it is confirmed that the initial condition is "drain position".

Hereafter, the mode is changed in the order of "rim washing position", "jet washing position" and "rim washing position", and finally "original position" as above-described. After that, the stepping motor 6*d* continues to make a reverse rotation, and the signal of the position sensor 7*b* is changed from L signal to H signal just when the pulse count device 7*c* further counts —1192 pulses. The rim open/close valve 6*a* and the jet open/close valve 6*b* are in the semi-opened condition to beat "drain position", and they are stopped. Accordingly, a washing process is finished.

Thus, the pulse generation circuit 7*d* and the like return the rim open/close valve 61 and the jet open/close valve 6*b* to the initial condition even after the rim open/close valve 6*a* and the jet open/close valve 6*b* carry out the mode in the initial condition in which they are released by the manual handle 6*e*. Due to this, only if the stop cock is closed after the user uses the tankless western-style flush toilet, water which is reserved in the rim open/close valve 6*a* and the jet open/close valve 6*b* are discharged to the western-style toilet body 1, namely, draining is maintained. So, it is possible to exhibit the effect of the prevention of the freezing of the rim open/close valve 6*a* and the jet open/close valve 6*b*.

Therefore, in the tankless western-style flush toilet according to this embodiment, it is possible to achieve both of the control person's intention and the user's use.

The above-mentioned embodiments are only for illustrative purpose, and the first to thirteenth inventions can be carried out in modes including various modifications within a range without departing from the gist of the inventions.

Industrial Applicability

Accordingly, the open/close valve of the first invention contributes the stabilization of the operation responsibility. The toilet washing water supply device of the second invention contributes the stabilization of the operation of the valve mechanism, and at the same time, it is possible to prevent the freezing of water during the cold season and the like, and the toilet washing water supply device is relatively low cost. In the tankless western-style flush toilet of the third invention, it is possible to suppress a mounting space of the toilet washing device. In the water supply method to the western-style toilet body of the fourth invention, it is possible to prevent the freezing of water at an upstream side of the western-style toilet body. In the flow passage switching device of the fifth invention, it is possible to control the opening and closing of the open/close valve automatically without increasing the cost. The tankless western-style flush toilet of the sixth invention can attempt to reduce the number of components, and it has an advantage in respect of the reduction of the cost. In the open/close valve of the seventh invention, water is able to flow in a small flow amount or a large flow amount, and dead water is not generated. The open/close valve of the eighth invention has an advantage in the reduction of an arrangement space of pipes and the security of an appearance. The open/close valve for a flush toilet of the ninth invention is not damaged by the freezing of water after draining water away, and it can be used immediately at the next time, so there doesn't arise a disadvantage in the preferable use at the next time. In the western-style flush toilet of the tenth invention, it is possible to wash the western-style toilet body with excellent operability by the user who is not accustomed to this western-style flush toilet. In the tankless western-style flush toilet of the eleventh invention, it is possible to surely prevent both of the unsanitary condition and waste consumption of water. In the flush toilet of the twelfth invention, supplying water is automatically stopped, and water is not consumed wastefully. In the flush toilet of the thirteenth invention, it is possible to achieve both of the control person's intention and the user's use during the winter season.

What is claimed is:

1. A tankless western-style flush toilet having a western-style toilet body and a toilet washing device configured to wash said western-style toilet body with water, the toilet washing device comprising an open/close valve configured to be directly connected to a city water service pipe to supply water from outside and configured to spout water by being opened and closed electrically, wherein said toilet washing device comprises a control portion configured to ensure at least two periods of releasing times of said open/close valve, and means for switching said control portion in accordance with a pressure of city water in said city water service pipe.

* * * * *